US005610598A

United States Patent [19]

Buchwitz et al.

[11] Patent Number: 5,610,598

[45] Date of Patent: Mar. 11, 1997

[54] MISSILE TELEMETRY DATA INTERFACE CIRCUIT

[75] Inventors: Guy R. Buchwitz, Oxnard; Andrew H. Snelgrove; Paul H. Sailer, both of Ventura, all of Calif.

[73] Assignee: The United States of America as represented by the Secretary of the Navy, Washington, D.C.

[21] Appl. No.: 619,289

[22] Filed: Mar. 18, 1996

[51] Int. Cl.[6] ..... G08C 19/16

[52] U.S. Cl. ..... 340/870.07; 340/870.19; 340/870.13

[58] Field of Search ..... 340/870.01, 870.07, 340/870.13, 870.19; 375/25, 35

[56] References Cited

U.S. PATENT DOCUMENTS

| | | | |
|---|---|---|---|
| H1,288 | 2/1994 | Lusk | 340/870.07 |
| 3,887,873 | 6/1975 | Duncan | 340/870.13 |
| 4,040,059 | 8/1977 | Simons | 340/870.07 |
| 5,016,005 | 5/1991 | Shaw | 340/870.19 |
| 5,227,783 | 7/1991 | Shaw | 340/870.19 |

*Primary Examiner*—Jeffery Hofsass
*Assistant Examiner*—Albert K. Wong
*Attorney, Agent, or Firm*—David S. Kalmbaugh; Melvin J. Sliwka

[57] ABSTRACT

An interface circuit for receiving an analog PAM telemetry data stream from a missile's telemetry unit. The PAM data stream comprises a waveform divided into 64 channels and includes a sync signal. The PAM data stream is supplied to a filter which removes from the PAM data stream subcarrier channel oscillator frequencies. The filtered data stream is next supplied to an analog-to-digital converter which converts each sample of the data stream to an equivalent twelve bit PAM data word which is supplied to a slave microprocessor. The slave microprocessor processes each of the sixty four PAM channels by utilizing a 25.6 kHz PAM clock signal generated by a PAM signal processing circuit. The slave microprocessor first checks for the sync signal. When the sync signal is decoded, the slave microprocessor sends a message to a master microprocessor via a dual port RAM indicating that the sync signal was located. The master microprocessor will respond with an acknowledgement message to the slave microprocessor. The slave microprocessor processes each channel of the PAM data stream in accordance with a predetermined algorithm which scales the PAM data providing a ten bit digital equivalent word for each channel of PAM data. The ten bit digital words for each of the sixty four channels of a frame of PAM data and a channel identification for each channel are output to a missile subsystem test set via three eight bit latches.

20 Claims, 22 Drawing Sheets

MISSILE TELEMETRY DATA INTERFACE CIRCUIT

BACKGROUND OF THE INVENTION

1. Field of the Invention

This present invention relates generally to digital computer controlled data processing apparatus. In particular, the present invention relates to a digital interface circuit which receives telemetry data from a missile's telemetry unit, processes the telemetry data and provides the processed data to a Missile Subsystem Test Set for evaluation.

2. Description of the Prior Art

There is currently a missile subsystem test set being utilized to test certain missiles, such as HARPOON and SLAM, prior to the missiles being approved for deployment with the United States Navy. Pulse amplitude modulated (PAM) telemetry data is supplied from the missile's telemetry unit to PAM PDM Synchronizer which processes the PAM telemetry data converting the PAM telemetry data from an analog format to a digital data format which is compatible with the missile subsystem test set.

The PAM PDM Synchronizer is no longer manufactured by its designer, Monitor Systems Company. In addition, the PAM PDM Synchronizer does not process pulse code modulated (PCM) telemetry data from a missile's telemetry unit.

Accordingly, there is a need to provide a state of the art microprocessor controlled missile telemetry data interface circuit which can receive PAM telemetry data from a missile's telemetry unit and then process PAM telemetry data so that the processed data is in a digital format which is compatible with the missile subsystem test set.

SUMMARY OF THE INVENTION

The present invention comprises an interface circuit which receives a PAM telemetry data stream from a missile's telemetry unit in an analog format. The PAM telemetry data stream comprises a waveform divided into 64 channels. Channels 1 through 59 of the data stream represent analog data signals from the missile's telemetry unit, while channels 60 through 64 are the sync signal which is used to locate the start of a frame of PAM data. The PAM telemetry data stream is first supplied to an analog multiplexer which has its input receiving the PAM telemetry data stream enabled by a master microprocessor allowing the analog multiplexer to pass the PAM telemetry data therethrough.

The PAM telemetry data stream is then supplied to a 6 pole low pass bessel filter which is utilized to remove from the PAM data stream subcarrier channel oscillator frequencies which are 144 kHz and 160 kHz. The filtered analog PAM data stream is next supplied to an analog-to-digital converter which converts each sample of the filtered analog PAM data stream to an equivalent twelve bit PAM data word which is supplied to a slave microprocessor. The slave microprocessor processes each of the sixty four PAM channels by utilizing a 25.6 kHz PAM clock signal which is a clock signal generated by a PAM signal processing circuit and which is a clock signal synchronized to each of the sixty four PAM channels.

The slave microprocessor first checks for the PAM sync signal. When the PAM sync signal is decoded by the slave microprocessor, the slave microprocessor sends a message to the master microprocessor via a dual port RAM indicating that a PAM sync signal was decoded. The master microprocessor will respond with an acknowledgement message "PAM mode" to the slave microprocessor which indicates to the slave microprocessor that it is to begin processing PAM data.

The slave microprocessor processes the digital equivalent of the PAM data stream in accordance with a predetermined algorithm which scales the PAM data providing a ten bit digital equivalent word for each channel of PAM data. The ten bit digital words for each of the sixty four channels of a frame of PAM data are output to a missile subsystem test set via a pair of eight bit latches. The channel identification for each of the sixty four channels of the frame is also output from the slave microprocessor to the missile subsystem test set via a third eight bit latch.

DETAILED DESCRIPTION OF THE PREFERRED EMBODIMENT

Figure 1A:
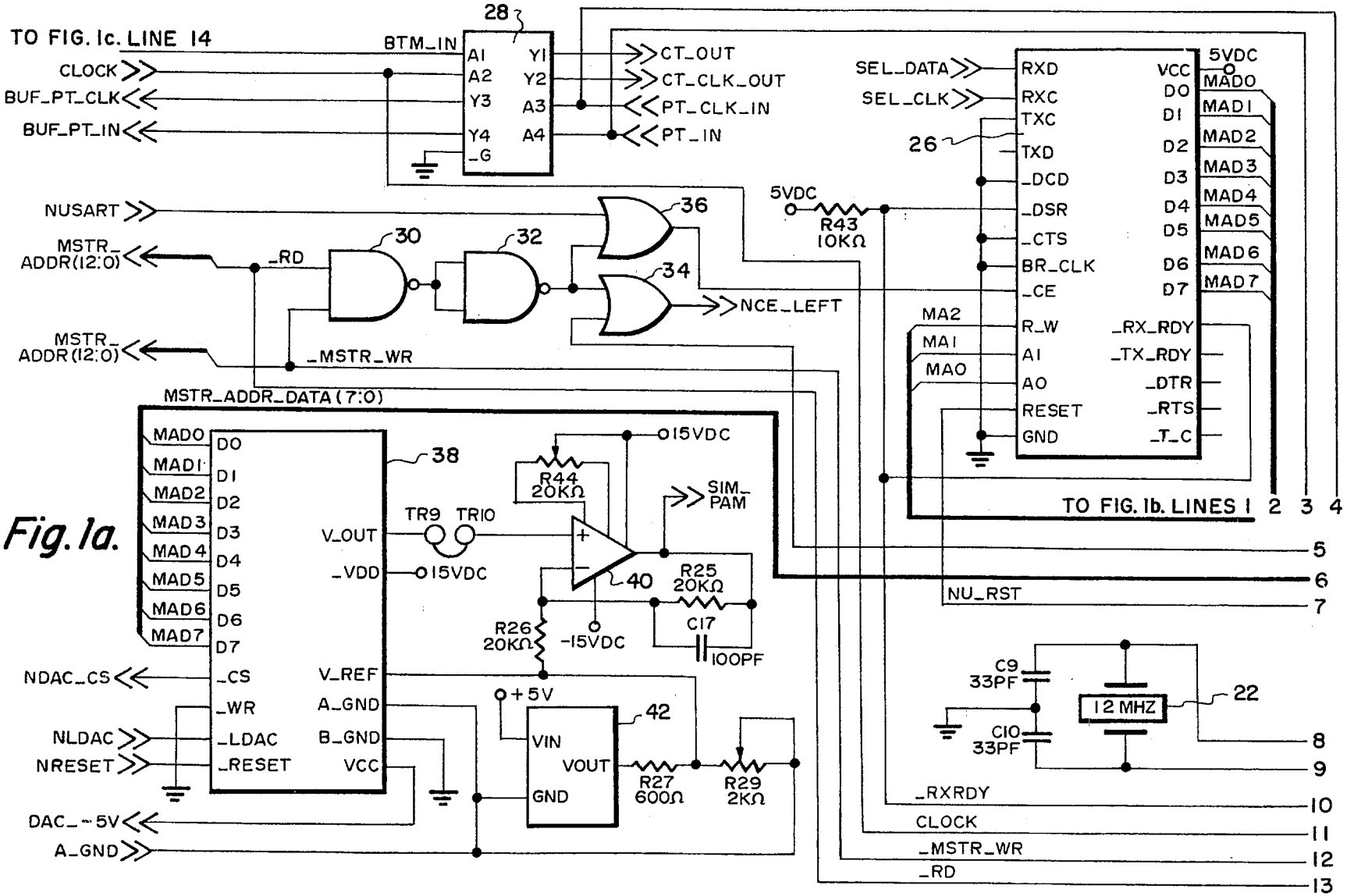
FIGS. 1*a*, 1*b* and 1*c* illustrate the master microprocessor of the present invention and its associated logic circuitry.

The preferred embodiment of the present invention will now be discussed in conjunction with all of the figures of the drawings, wherein like parts are designated by like reference numerals, insofar as it is possible and practical to do so.

OPERATION OF THE COMPUTER SOFTWARE FOR SLAVE MICROPROCESSOR 70

Referring to FIGS. 1*a*, 1*b*, 3*a*, 3*b*, 5*a*, 5*b* and 13 and the computer program listing of Appendix A, slave microprocessor 70 utilizes the computer software program of Appendix A which comprises the modules set forth in the table below:

TABLE I

| | | |
|---|---|---|
| c_int11.c | ipcomms2.c | pcm_mod3.c |
| comp.c | lachtest.c | ramtest.c |
| dprantst.c | lookups.asm | regtest.c |
| gen_pcm | mail.c | send_pcm.c |
| getpcm.c | newmtim.c | simpam.c |
| globals.h | newmtim.h | sndnontm.c |
| gnuusart.c | pcf.c | st3.c |
| gs2.c | pcm.h | to2.c |
| hex2bcd.c | pcm_lkup.asm | |

Module newmtim.h of the computer software of Appendix A is a header file which defines certain constants in the computer program of Appendix A in terms of a hexadecimal number which causes the program's compiler to substitute the hexadecimal number for the constant. For example, when the program detects the statement "SETUP_TIMER1" the program's compiler will substitute the hexadecimal number 200 for the statement. The hexadecimal numbers of the module newmtim.h define the assembly language utilized by slave microprocessor 70.

The computer program for slave microprocessor 70 is stored in four erasable programmable read only memories 72, 74, 76 and 78. The erasable programmable read only memories 72, 74, 76 and 78 are enabled by a logic zero chip signal supplied to the _CS inputs of memories 72, 74, 76 and 78. This logic zero chip select signal is provided by microprocessor 70 utilizing the strobe signal and the read/write signal from microprocessor 70. The strobe signal and the inverted read/write signal from microprocessor 70 are supplied to OR gate 110 which, in turn, supplies the chip select signal to the four erasable programmable read only memories 72, 74, 76 and 78.

The newmtim.h module of the computer software of Appendix A defines the operation codes which are utilized by the master microprocessor 20 to request that the slave microprocessor 70 perform operations defined by the constant (lines 68–88 of the newmtim.h module). The constant "SEARCH_FOR_PAM_SYNC" will result in the program's compiler substituting the hexadecimal number 40 for the constant. Slave microprocessor 70 in response to the hexadecimal number 40 will look for a sync signal in a pulse amplitude modulated data stream which is being received by microprocessor 70.

The newmtim.h module also includes the operation codes which are utilized by the slave microprocessor 70 to request that the master microprocessor 20 perform operations defined by the constant (lines 90–99 of the newmtim.h module).

The globals.h module is a header file which is included in each module of Table I. This module includes every global variable required by each module during its execution.

The pcm.h module is a header file which includes the definitions required by slave microprocessor 70 to allow slave microprocessor 70 to perform any pulse code modulation operation.

The newmtim.c module is the main program utilized by the slave microprocessor 70 to process pulse amplitude modulated data and pulse code modulated data received by microprocessor 70. The newmtim.c module also includes the operation codes supplied by microprocessor 20 to microprocessor 70. At lines 5–94 of the newmtim.c module pointers are declared. The pointers first initialized are for universal synchronous asynchronous receiver transmitter 140. For example, at line 6 of the newmtim.c module the pointer "*gnu_usart_rcvr_xmit_ptr" is declared. This pointer holds the address of an unsigned integer. The contents of this address are initialized with a defined constant of "GNU_USART_RCVR_XMIT_ADD" which is at line 25 of the newmtim.h module and has a hexadecimal value of 800E00.

It should be noted that universal synchronous asynchronous receiver transmitter 140 along with a differential line driver 144 function as an RS-422 interface receiving selected PCM data words of an incoming PCM data stream in a parallel format from microprocessor 70 and then transmitting these selected PCM data words in a differential serial RS-422 format to an RS-422 interface of an external computer (not illustrated) for processing. Universal synchronous asynchronous receiver transmitter 140 also provides at its _TX_RDY output a _TXRDY signal to microprocessor 70 which indicates that its transmit buffer is empty. The transmit clock signal, which is a 38.4 kHz signal, is provided by a clock signal generator 142 to the TXC input of universal synchronous asynchronous receiver transmitter 140.

At lines 19–24 of the newmtim.c module the variables for serial port 1 (FSX1, DX1, CLKX1, FSR1, DR1 and CLKR1 inputs/outputs) of microprocessor 70. The pointers which are declared refer to registers within microprocessor 70 which control the operation of serial port 1 of microprocessor 70. The timer 0 (TCLK0 input/output) and timer 1 (TCLK0 input/output) pointers for microprocessor 70 are declared at lines 28–33 of the newmtim.c module.

The analog to digital pointers for analog-to-digital converter 88 are declared at lines 36–37 of the newmtim.c module. The variable "*adc_status_control_ptr" comprises the address of a control register within analog to digital converter 88 which defines the operating characteristics or manner of operation for converter 88. The variable "*adc_fifo_data_out_ptr" comprises the address of a separate register within analog to digital converter 88 which has the output digital data from converter 88 latched therein. To retrieve output digital data from converter 88 the variable "*adc_fifo_data_out_ptr" is utilized.

Analog-to-digital converter 88 has a plurality of address and control inputs which receive logic signals from microprocessor 70 to control the operation of analog-to-digital converter 88. The ADD0 address input of converter 88 is an address input which determines whether a word placed on the output data bus of converter 88 is a data word from the FIFO RAM within converter 88 or the contents of the status/control register of converter 88. A logic low accesses the data word from location zero of the FIFO, while a logic one selects the contents of the status/control register of converter 88. The _CS input of converter 88 is a chip select input which is active low and is used to select converter 88. The _DMWR (data memory write) input is an active low input which is used in conjunction with _CS input low and ADDO input high to write data to the status/control register of converter 88. The _DMRD (data memory read) input is an active low input used in conjunction with _CS input low to enable three state output buffers within converter 88. The _CONVST input is a logic input wherein a low to high transition at this input places a track/hold mode of operation into its hold mode and starts a conversion. The _CONVST input of converter 88 is synchronous with the CLKIN input of converter 88. The _RESET input of converter 88 is an active low reset signal to converter 88. The CLKIN input of analog-to-digital converter 88 is the clock input for converter 88 and is used as the clock source for the A/D conversion. Analog-to-digital converter 88 also has a _BUSY output which goes low when converter 88 receives a not CONVST pulse and remains low until the track/hold has gone into its hold mode. In addition, analog-to-digital converter 88 has a _ALFL output which indicates at the logic zero state that the word count (i.e., number of conversion results) in the FIFO memory has reached the programmed word count in the status control register. The _ALFL output is updated at the end of each conversion. The _ALFL output is reset to a logic one when a word is read from the FIFO memory.

The interprocessor communications pointers are declared at lines 40–43 of the newmtim.c module. For example, at line 40 the variable "*t_mess_opcode_ptr" is the variable which comprises the address of the message operation code transmitted to master microprocessor 20 by slave microprocessor 70.

At lines 12–16 of the newmtim.c module the MTIM I/O pointers are declared. At line 12 the variable "*mtim_chan_out_ptr" is declared which indicates to microprocessor 70 that it is to perform the operation of writing data to an eight bit latch 148. Microprocessor provides a thirteen bit address at its XA0–XA12 outputs and a master strobe signal at its _MSTRB output. Bits SA8–SA12 of the thirteen bit address signal are supplied to a three line to eight line decoder 92 which decodes these signals. When the signals occurring at the A and G1 inputs of decoder 92 are high and the signals occurring at B, C and G2 inputs of decoder 92 are low, decoder 92 provides at its _Y1 output a logic zero chip enable signal which enables latch 148. Microprocessor 70 then writes an eight bit data word into latch 148.

In a like manner, the variable "*mtim_data_out_ptr" indicates to microprocessor 70 that it is to perform the operation of writing data to eight bit latches 146 and 152. The variable "*input_port_ptr" indicates to microprocessor 70 that it is to provide an enable signal via the _Y4 output of decoder 92 and a read signal via inverter 98 and OR gate 100 to tri-state octal buffers 158 and 160 allowing buffers 158 and 160 to read the data at their A1–A8 inputs to the XD0–XD15 inputs/outputs of microprocessor 70. This data is provided by a PCM pushwheel switch 202 and an MTIM pushwheel switch 204 on front panel 200 The variable "*mtim_led_out_ptr" is a pointer assigned to latches 150 and 156, while the variable "*pcm_led_out_ptr" is a pointer assigned to latches 154.

When the logic zero _MD_CE signal occurring at the _Y0 output of three line to eight line decoder 92 is low an enable signal is supplied to latch 146. When the logic zero _PL_CE signal occurring at the _Y3 output of three line to eight line decoder 92 is low an enable signal is supplied to latch 154. When the logic zero _ML_CE signal occurring at the _Y3 output of three line to eight line decoder 92 is low an enable signal is supplied to latches 150 and 156. When the logic zero _WS_CE signal occurring at the _Y5 output of three line to eight line decoder 92 is low an enable signal is supplied to tri-state octal buffers 158 and 160.

The read/write signal and the clock signal for each latch 146, 148, 150, 152, 154 and 156 are also provided by microprocessor 70, with the read/write signal occurring at the output of OR gate 100 and the clock signal occurring at the output of OR gate 102. For example, when latch 146 is enabled and the _MRD line is high data is written into an latch 146 by a negative going pulse supplied to the CLK input of latch 146. It should be noted that each latch 146, 148, 150, 152, 154 and 156 has a read back mode of operation which allows data in the latch to be read back by setting the _MRD line to the logic zero state.

Referring to FIGS. 3*a*, 3*b*, 4 and 6*b*, microprocessor 70 provides at its XF1 output a watch dog interrupt signal which is supplied to the NSLV_WDI of interface circuit 120. Interface circuit 120, in turn, provides an edge signal which is supplied to a watch dog timer 176. Watch dog timer 176 will, in turn, provide a system reset signal (RESET_IN) whenever it does not receive an edge signal from interface circuit 120 within a predetermined time period of about 1.6 seconds.

Referring to FIGS. 1*a*, 1*b*, 3*a*, 3*b*, 5*a*, 5*b* and 13 and the computer program listing of Appendix A at line 50 of the newmtim.c module the variable type is "Mtim_data" and the name of the variable is "mtim_data_output". The program's compiler sets aside ten bits of memory for data, one bit is set aside for sync status, one bit is set aside for analog to digital converter 88, one bit is set aside "mclk" and one bit is set aside for "track_hold" (lines 189–193 of the newmtim.h module). This is the data output from microprocessor 70 to eight bit latches 146 and 152. Whenever the pointer "*mtim_data_out_ptr" at line 13 of the newmtim.c file is declared in the computer software of Appendix A microprocessor 70 will output data bits MD0–MD9 and bits SYNCST, ADC_DR and MCLK to a connector MJ5, and the bit "TRACK_HOLD" to an analog track-hold circuit 162.

Referring to FIGS. 3*a*, 3*b*, 4 and 6*b*, a flag "watch_dog_timer_reset" (line 94 of the newmtim.c module) is used to determine the state of the signal occurring at the XF1 output of microprocessor 70. At lines 296–303 of the newmtim.c module the watch dog timer function is set forth. Whenever microprocessor 70 loops through the main program (the newmtim.c module), microprocessor 70 will output a signal to clear timer 176 which is supplied to interface circuit 120. Depending upon whether a falling edge or a rising edge signal was previously provided to timer 176 by interface circuit 120, the edge signal currently being supplied to timer 176 will always be the opposite of the edge signal previously provided to timer 176.

Referring to Appendix B and FIGS. 1*a*, 1*b*, 2, 3*a* and 3*b* Appendix B sets forth the communications protocol between master microprocessor 20 and slave microprocessor 70 via a dual port RAM 60. The messages sent between microprocessor 20 and microprocessor 70 consist of two bytes of information, the first byte being the data byte and the second byte being the opcode byte. The opcode indicates the function which either master microprocessor 20 or slave microprocessor 70 is to perform, while the data byte provides additional requirements for the particular function being performed by either microprocessor 20 or microprocessor 70. For example, the opcode 40h is from microprocessor 20 to microprocessor 70 commanding microprocessor 70 to search for a PAM (pulse amplitude modulated) sync signal and return an opcode 41h if the PAM sync signal is found. Microprocessor 70 then returns the opcode 41h when microprocessor 70 detects the sync signal. Each opcode 40h and 41h has a data byte of 00h.

When master microprocessor 20 sends the opcode 02h to slave microprocessor 70, microprocessor 20 commands microprocessor 70 to send non-telemetry function status to microprocessor 20. The data byte accompanying opcode 02h is 00h. Microprocessor 70 will respond with an opcode 03h and a data byte consisting of eight bits (MSB=b7,b6,b5,b4, b3,b2,b1,b0=LSB) with bits b0, b1, b2, b3, b4 and b5 indicating non-telemetry function status. For example, when bit b4 is a one the 320 kHz test clock frequency is within 0.1% of its value. When bit b4 is a zero the 320 kHz test clock frequency is outside of its tolerance. When b5 is a one the 25.6 kHz PAM clock frequency is within 0.1% of its value. When bit b5 is a zero the PAM clock frequency is outside of its tolerance. When the data bits b0–b5 are zeros the particular device being tested is not operating within the parameters of the device.

Referring again to FIGS. 1*a*, 1*b*, 2, 3*a*, 3*b*, 4 and 6*b* and the computer program listing of Appendix A, the watch_dog_timer_reset variable is initialized to a one. The first time through the system loop of the main program the watch_dog_timer_reset variable is set to zero. Microprocessor 70 then sends a falling edge signal via its port XF1 interface circuit 120 which then clears timer 176 (lines 296–299 of the newmtim.c module). The next time through the system loop of the main program the watch_dog_timer_reset variable is set to one. Microprocessor 70 will send a rising edge signal via its port XF1 to interface circuit 120 (lines 300–303 of the newmtim.c module).

At line 291 of the newmtim.c module the switch mode of the main program is entered. At the end of the main program an r_message_flag is examined. If this flag is set then master microprocessor 20 has communicated with slave microprocessor 70. When slave microprocessor 70 is interrupted an interrupt service routine identified as ipcomms2.c is entered. The interrupt service routine sets a flag which is the r_message_flag and retrieves the opcode and the data byte of the message supplied by master microprocessor 20 to slave microprocessor 70 via dual port RAM 60.

When the r_message_flag is set the main program calls the mail.c module. When, however, the r_message_flag is not set the main program continues to loop. The mail.c module examines the opcode byte relating to the function to be performed by slave microprocessor 70. For example, if the master microprocessor 20 commands the slave microprocessor to process a DISPLAY TEST which is opcode 60h, the program jump to line 220 of the mail.c module executing the code at lines 220–225 of the mail.c module. At line 222 the mode variable is set equal to "DISPLAY TEST". The program of Appendix A returns to the main program (newmtim.c module) at line 293. The program then executes the code beginning at line 293 (case DISPLAY_TEST) and continuing through line 323.

Referring to FIGS. 3*a*, 3*b*, 5*a*, 5*b* and 13, during the display test microprocessor 70 energizes the light emitting diodes 206 and 208 on the front panel 200 of the present invention for about three seconds. The light emitting diodes 206 and 208 on the front panel 200 are energized by microprocessor 70 which provides logic zero signals through latch 154 to the PCM light emitting diodes 206 and latches 150 and 156 to the MTIM light emitting diodes 208. Microprocessor 70 next reads the settings, which is a binary number, from a PCM pushwheel switch 202 and an MTIM pushwheel switch 204 on front panel 200 and then energizes light emitting diodes 206 and 208 to display the settings from pushwheel switches 206 and 208. Microprocessor 70 utilizes a flag "all_leds_are_on" to keep track of when light emitting diodes 206 and 208 are energized and when light emitting diodes 206 and 208 are displaying the settings from pushwheel switches 206 and 208. When light emitting diodes 206 and 208 are energized timer 1 of microprocessor 70 is polled for a time period of about one half second and then microprocessor 70 resets timer 176. This sequence is repeated to prevent watch dog timer 176 from generating a reset signal. After about three seconds the main program begins to cycle through a loop. Since the flag "all_leds_are_on" is set microprocessor 70 utilizes two lines of code (lines 321 and 322 of newmtim.c module) to read the settings of from pushwheel switches 206 and 208 and then display these settings on light emitting diodes 206 and 208. When the master microprocessor 20 sends the opcode 0x61 to slave microprocessor 70, the main.c module sets the mode=PAUSE (line 230 of mail.c) which causes no matches to any of the cases (set forth at lines 291–564 of newmtim.c module) within the switch statement of the main program. The main program (newmtim.c module) then resets the watch dog timer 176 and checks the r_message_flag until a new message is received from master microprocessor 20. The mail.c module turns off the PCM light emitting diodes 206 (line 227 of the mail.c module) and the MTIM light emitting diodes 208 (line 228 of the mail.c module) and resets the flag "all_leds_are_on" at line 233 of the mail.c module.

Referring to FIGS. 1*a*, 1*b*, 3*a*, 3*b*, 4 and 8, whenever master microprocessor 20 supplies to slave microprocessor 70 an opcode 11h and a data byte 00h; an opcode 13h and a data byte 00h or an opcode 15h and a data byte 00h a DAC_ADC_TEST is implemented which checks the operation of a digital-to-analog, analog-to-digital loop in the circuit elements of the present invention. Master microprocessor 20 supplies to the D0–D7 inputs of an digital-to-analog converter 38 an eight bit data word which digital-to-analog converter 38 then converts the eight bit data word to a first analog signal which has a voltage range of between 0 volts and 1.5 volts. A clock signal generator 132 provides at its CLK output a 256 kHz clock signal which is supplied to the 256 KHZ input of an interface circuit 120. Interface circuit 120 then divides the signal by a factor of ten resulting in a 25.6 kHz clock signal at the NLDAC output of interface circuit 120. This 25.6 kHz signal provided by interface circuit 120 is next supplied to the _LDCA input of digital-to-analog converter 38 which then converts the digital words to its equivalent analog signal at a frequency of 25.6 kHz. A logic zero chip select signal (NDAC_AC) is also supplied to the _CS input of digital-to-analog converter 38 by interface circuit 120 enabling digital-to-analog converter 38.

This first analog signal is supplied to an operational amplifier 40 which provides at its output a second analog signal having a voltage range of ±1.5 volts. The second analog signal from amplifier 40 is supplied through an analog multiplexer 174 to a 6 pole low pass bessel filter 121. Bessel filter 121 has a center frequency $f_c$=38 kHz and an attenuation of −40 dB at 140 kHz. This filter 121 is utilized to remove from the PAM data signal subcarrier channel oscillator frequencies which are 144 kHz and 160 kHz.

The filtered analog PAM signal is next supplied to an analog-to-digital converter 88 which converts the filtered analog signal to an equivalent twelve bit digital word. This twelve bit digital word is supplied to the XD0–XD15 inputs/outputs of microprocessor 70 for processing by microprocessor 70. Microprocessor 70 also provides a pulse signal (_CONVST) at its XF0 output which is supplied to the CONVST input of analog to digital converter 88 initiating a data conversion by analog to digital converter 88. Analog-to-digital converter 88 receives an 8 MHz clock signal from Flip-Flop 96 which divides a 16 MHz from the H1 output of microprocessor 70 by two.

The voltages selected for testing are about −1.45 VDC (11h), 0.00 VDC(13h) and 1.45 VDC(15h). After comparing the twelve bit digital word supplied to its XD0–XD15 inputs to a predetermined value, microprocessor 70 supplies to microprocessor 20 a status message which indicates whether the analog voltage signal provided to converter 88 is within one percent of the expected voltage.

Referring now to FIGS. 1*a*, 1*b*, 3*a*, 3*b*, 4, 5*a*, 5*b* and 13, the master microprocessor 20 first sends the message "search for PAM sync" (opcode 40h, data byte 00h). Upon detecting the PAM sync signal, slave microprocessor 70 sends a message to the master microprocessor "PAM sync detected" (opcode 40h, data byte 00h). The master microprocessor 20 then sends a message to slave microprocessor 70 having an opcode of 42h and a data byte of 00h. Microprocessor 20 is sending a command to microprocessor 70 to enter a PAM mode of operation. Microprocessor 70 then calls the mail.c module of the software of Appendix A. The case PAM_MODE at lines 128–154 of mail.c turns off the PCM light emitting diodes 206 and the MTIM light emitting diodes 208 as well as the frame sync light 222 on front panel 200.

In the case PAM_MODE the processing function is performed by three interrupt service routines: c_int03 (EN_PAM_CLK) within the module st3.c; cint09 (en_tint_0) within the module t02.c and c_int01 (EN_ALFL) within the module gs2.c. The mail.c module enables these interrupts at lines 139 and 140 of mail.c. Since the mode is set equal to PAM a switch is executed to the main program, case PAM beginning at line 460 of the newmtim.c module and continuing through line 496 of the newmtim.c module.

In case PAM of the main program microprocessor 70 performs a debounce function which allows the MTIM pushwheel switch 204 on front panel 200 to settle out. The MTIM pushwheel switch 204 on front panel 200 is used to set a binary value into microprocessor 70 which is representative of a particular PAM channel of data to be displayed by the MTIM light emitting diodes 208. The debounce function in case PAM is performed as follows: Each time the main program passes through case PAM, microprocessor 70 reads MTIM pushwheel switch 204 on front panel 200 and then compares the binary value read with the binary value from the from the previous pass through case PAM (lines 460–496 of the newmtim.c module). When the values the mtim_debounce_count is incremented, otherwise it is set to zero (lines 462–467 of the newmtim.c module). The mtim_debounce_count is incremented until a count of 10,000 is reached allowing a sufficient time period for MTIM pushwheel switch 204 on front panel 200 to settle out into a stable state.

At lines 469–485 of the newmtim.c module, the current binary value from MTIM pushwheel switch 204 is checked to determine whether the number entered into switch 204 is outside the range of channels for PAM data. If MTIM pushwheel switch 204 reads zero or above hexadecimal 64 or if the least significant digit is hexadecimal A through hexadecimal F and the bogus_mtim_pushwheel_flag is not set, then a DATA_SELECTION_ERROR message (hexadecimal 71) is sent to master microprocessor 20 by slave microprocessor 70 and the bogus_mtim_pushwheel_flag is set. This bogus_mtim_pushwheel_flag prevents microprocessor 70 from again sending this message to microprocessor 20. When pushwheel switch 204 is set within the range of allowable channels in PAM mode and the bogus_mtim_pushwheel_flag is still set, a new DATA_SELECTION_ERROR message (hexadecimal 71) is sent to master microprocessor 70 by slave microprocessor 20 indicating pushwheel switch 204 is now within the allowable range of sixty four PAM channels. The bogus_mtim_pushwheel_flag is next reset.

Master microprocessor 20 will display an error message on a dot matrix alpha numeric display 210 of front panel 200 indicating that MTIM pushwheel switch 204 is not set at a value which is within the range of allowable channels in PAM mode.

The PAM mode also indicates to master microprocessor 20 that slave microprocessor 70 is locked to the PAM sync signal. When a sent_lost_sync_flag is set and the PAM sync signal has been found, the PAM_SYNC_DETECTED message (hexadecimal 41) is sent by microprocessor 70 to microprocessor 20. If the PAM sync signal is lost by microprocessor 70 and the sent_lost_sync_flag is low, the PAM_SYNC_LOST message (hexadecimal 43) is sent to master microprocessor 20 by slave microprocessor 70. The sent_lost_sync_flag is set until sync is regained.

At this time it should be noted that the PAM data signal comprises an analog waveform received from a missile telemetry unit which is divided into 64 channels. Channels 1 through 59 represent data signals sent from the missile's telemetry unit while channels 60 through 64 comprises the sync signal used to identify the start of a frame of PAM data. The PAM analog signal is a three volt signal peak to peak which ranges from −1.5 VDC to +1.5 VDC. In addition, the PAM data signal is modulated by one of two subcarrier channel oscillator frequencies which are 144 kHz and 160 kHz.

Figure 14A:
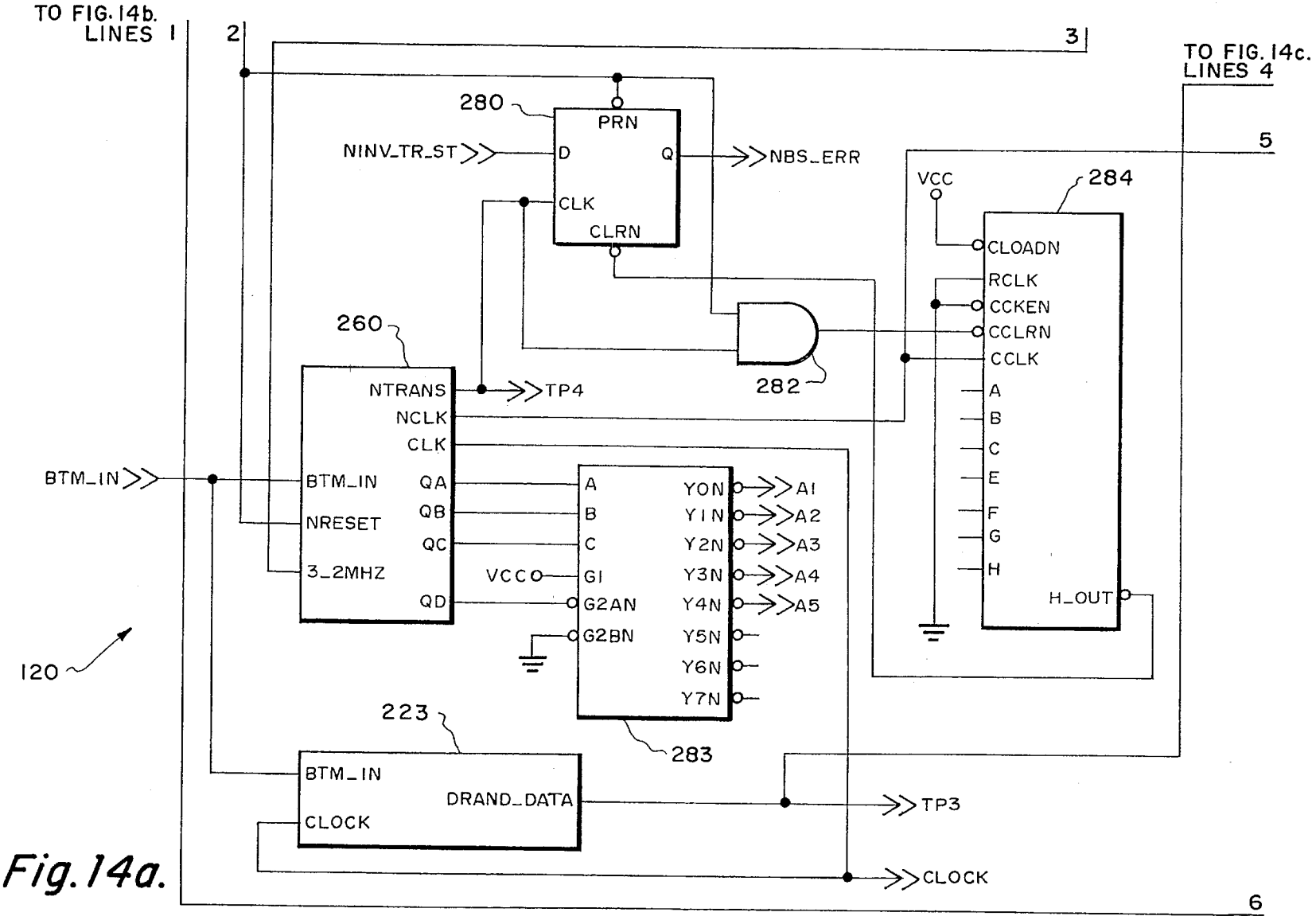
FIGS. 14*a*, 14*b*, 14*c*, 14*d*, 14*e*, 14*f*, 14*g*, 14*h*, 14*i* and 14*j* are a detailed logic diagram of the interface circuit of FIG. 4
Figure 14B:
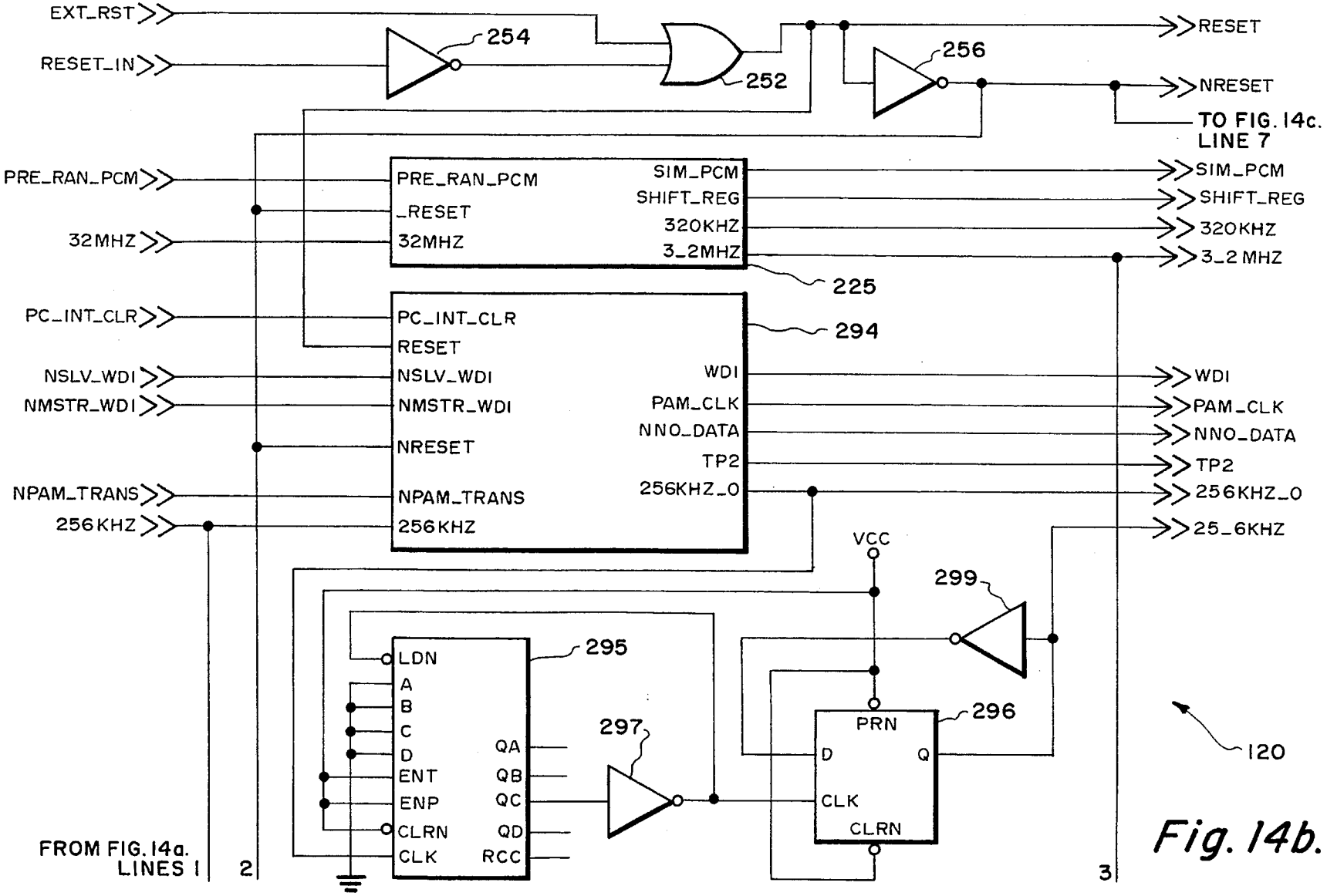
Figure 14C:
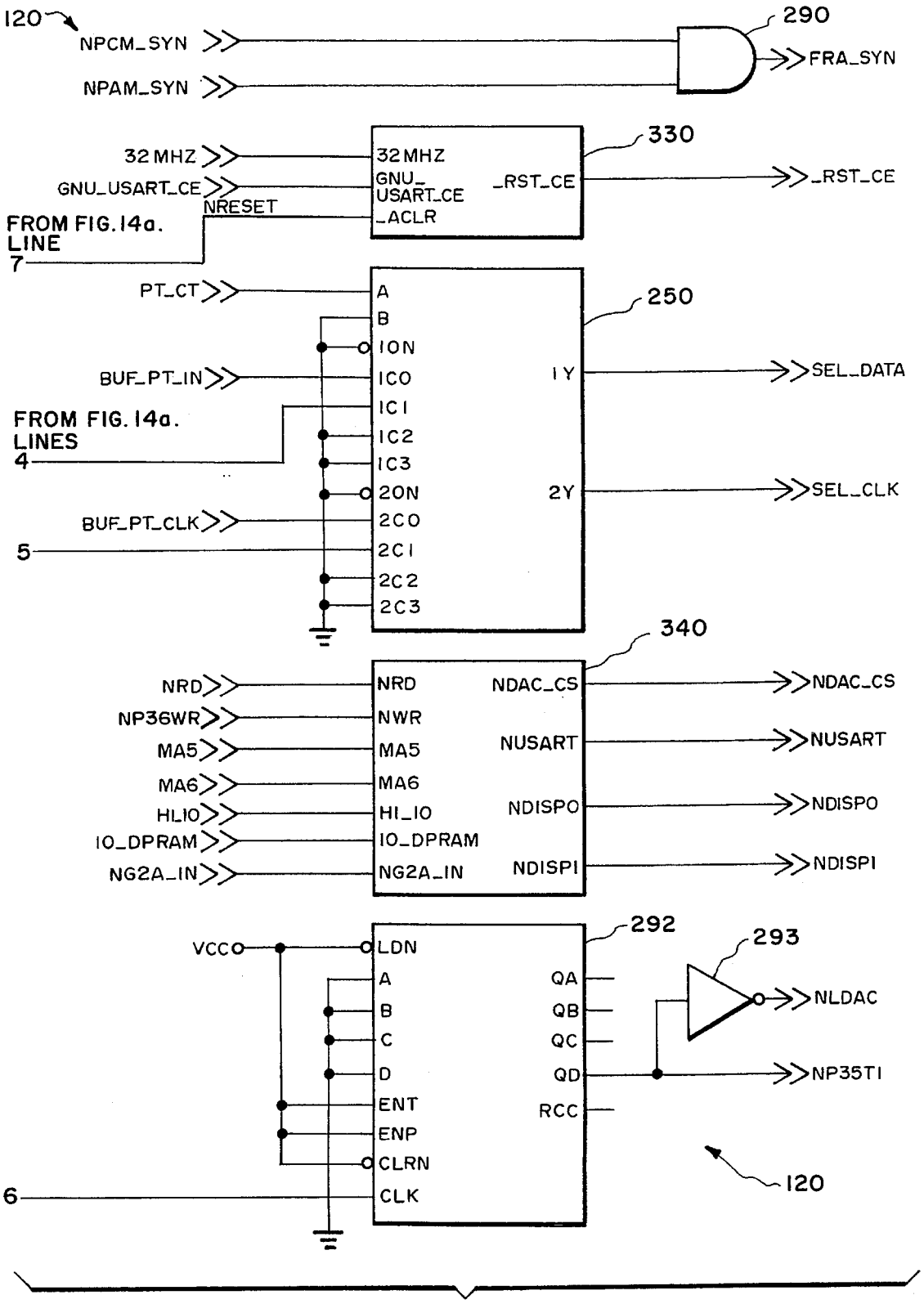

The interrupts c_int03 in module st3.c, c_int09 in t02.c and c_int01 in module gs2.c operate in a round-robin manner in the order set forth to implement all of the PAM data processing. Microprocessor 70 processes each of the sixty four PAM channels by utilizing the PAM clock which is a clock signal derived from the PAM data signal and which is a clock signal synchronized to each of the sixty four PAM channels. A logic zero interrupt is provided by interface circuit 120 to the _INT2 input of microprocessor 70 indicating the presence of a PAM channel to be processed by microprocessor 70. This interrupt results in a jump to the stc.3 module of the computer program of Appendix A. In the st3.c module a logic one signal is generated by microprocessor 70 which is supplied via its DR0 output to the PC_INT input of interface circuit 120. This logic one sets a Flip-Flop 318 (FIG. 14*g*) to the logic one state within interface circuit 120 allowing the PAM clock signal which is derived from the next channel to be processed by processor 70 to clock the Flip-Flop 318 to generate another interrupt. The Flip-Flop 318 within interface circuit 120 is set with bit 6 of the FSR/DR/CLKR port 0 control register within microprocessor 70.

A timer 0 within microprocessor 70 is initiated to provide a delay of about 12.5 us. which equates to a count of 100 (lines 31–33 of st3.c). A check is made to see if oper_cal is set and whenever oper_cal is set then mtim_data_output-.data is equal to mtim_1015_or_8 (line 36 of stc.3 module). This is a calibration function which results in an output at latches 146 and 152 of the binary equivalent of 1015, 8 or 512. The binary equivalent of 1015 represents 100% calibration, 8 represents 0% calibration and 512 represents a calibration error. Oper_cal is set only when master microprocessor 20 supplies to slave microprocessor 70 an opcode 21h (calibrate PAM) and a data byte which has bit b0 set to a one or a zero. When bit b0 of the data byte is set to one then slave microprocessor 70 is to output 0% (MTIM DATA=8)for all non-sync data. When bit b0 of the data byte is set to zero then slave microprocessor 70 is to output 100% (MTIM DATA=1015) for all non-sync data.

If the PAM sync signal has been decoded by microprocessor 70, then the PAM data is scaled in accordance with the following expression:

$$\text{Scaled value} = \left(\frac{R_{0\%} - R_{CH}}{R_{0\%} - R_{100\%}}\right) \times 1007 + 8 \quad (1)$$

where $R_{0\%}$ is a voltage reading representing an ADC (analog to digital conversion) input voltage for channel 60 of the sync signal, $R_{CH}$ is the PAM data sample voltage reading for the channel of telemetry data being processed by slave microprocessor 70 and $R_{100\%}$ is a voltage reading representing an ADC input voltage for channels 61, 62 and 63 of the sync signal. $R_{0\%}$ is about +1.5 volts and $R_{100\%}$ is about −1.5 volts. This expression provides a range of 8 to 1015 for 0% to 100% of full scale. If the scaled value of the expression (1) is more than 1023 it is set equal to 1023. If the scaled value is less than zero, that is the scaled value is negative, it is set equal to zero.

When slave microprocessor 70 is in a calibration mode the simulated scaled PAM data is stored in an array (pam_test_array) within microprocessor 70 for later comparison with a fixed set of values stored within microprocessor 70. When the oper_cal line to master microprocessor 20 is low and the hund_zero line to master microprocessor 20 is high, slave microprocessor 70 will output the binary equivalent of 1015 to latches 146 and 152 indicating that the simulated PAM data compared favorably with the fixed set of values stored within microprocessor 70. In a like manner, when the oper_cal line to master microprocessor 20 is low and the hund_zero line to master microprocessor 20 is low, slave microprocessor 70 will output the binary equivalent of 8 to latches 146 and 152 indicating that the simulated PAM data compared favorably with the fixed set of values stored within microprocessor 70. When microprocessor 70 outputs the binary equivalent of 512 the simulated PAM data did not compare with the fixed set of values stored within microprocessor 70.

If oper_cal (operate mode) is high and sync is established then the PAM data is scaled in accordance with expression one and then written to eight bit latches 146 and 152. The identification of the channel is written to latch 148 and the syncst bit (SYNCST), which is to be written to latch 152, is now at the logic one state indicating sync has been established. If sync is not established then logic zeros are written to latches 146 and 152, that is MD0–MD9 are zeros and SYNCST is also zero. When the channel identification matches the ID set by MTIM pushwheel switch 204 on front panel 200, microprocessor 70 latches the MTIM data in latches 150 and 156 which then provide the MTIM data to MTIM light emitting diodes 208 on front panel 200 indicating the binary value of the MTIM data for the selected channel.

The stc.3 module increments and reinitializes chan_id which is a channel counter (lines 85–88 of the st3.c module).

The timer 0 within microprocessor 70 initiates the interrupt cint09 in the t02.c module. When timer 0 times, that is reaches a count of 100, the interrupt cint09 is generated and microprocessor 70 executes the code within the t02.c module of the software of Appendix A. When the channel identification from MTIM pushwheel switch 204 matches the channel of PAM data being processed by microprocessor 70, microprocessor 70 asserts a track/hold signal which is written to latch 152 and appears at the 6Q output of latch 152. This track/hold signal which is now a logic one is supplied to an analog track/hold amplifier 162 which also receives the analog PAM data signal from bessel filter 121. Circuit 162, in turn, tracks the analog PAM data signal and then holds the PAM data sample when the track/hold signal is asserted low allowing the PAM data sample for the selected PAM channel to be accessible through a connector 213 on front panel 200. At line 20 of the t02.c module microprocessor 70 sets its XF0 output to a logic zero state generating a logic zero CONVST signal which is supplied to the _CONVST input of analog to digital converter 88. This CONVST signal initiates an analog-to-digital conversion of the incoming analog PAM data. The ADC_DR signal from latch 152 is also set low. When this signal is low external devices do not read the MTIM data output from latches 146 and 152 via the MTIM DATA (12:0) bus to connector MJ5.

Analog-to-digital converter 88 provides at its _ALFL output a logic zero interrupt pulse which is supplied to the _INT0 input of slave microprocessor 70. This pulse indicates that an analog to digital conversion of analog PAM data is complete and that an equivalent digital data byte (bits SD0–SD11) is ready to be supplied to the XD0–XD11 data inputs of microprocessor 70 for processing by microprocessor 70. This interrupt causes a jump to the gs2.c module of Appendix A.

This gs2.c module is used to locate the PAM sync signal. At lines 12–13 the TRACK_HOLD signal from the 6Q output of latch 152 is driven to a logic zero and ADC_DR signal is set high. It should be noted that a rising edge of the ADC_DR signal indicates to the missile subsystem test set (MSTS) that it is to accept MTIM data output via the MTIM_DATA (12:0) bus from latches 146 and 152.

During the gs2.c module microprocessor 70 retrieves samples of digital data from analog-to-digital converter 88 and then uses two state machines operating in parallel to detect the PAM sync signal. The first state machine is used to locate the 0%, 100%, 100%, 100%, 50% PAM sync sequence that marks the end of a frame of PAM data, that is the first state machine locates channels 60–64 of a frame of PAM data. The second state machine tracks the spacing between frame sync patterns to ensure that the frame sync patterns are the correct distance apart before sync is actually established. Two frame sync patterns must be detected by microprocessor 70 at the correct spacing before microprocessor 70 is synchronized to the incoming PAM data stream. Each time this interrupt service routine is executed, it makes one pass through the code (gs2.c module) changing the states of both machines as required.

The first state machine which looks for the sync pattern has seven states including a state "NOT_SEARCHING" during which the state machine is disabled. The state "NOT_SEARCHING" does not match any of the "case:" instances of the switch (sync_state) statement. During the state "IDLE:" microprocessor 70 is waiting for first zero percent value of the PAM sync pattern. When the first PAM sample is greater than or equal to the zero percent threshold voltage the first state machine proceeds to state "FIRST_ZERO_PERCENT:" during which the first state machine waits for the first hundred percent voltage value of the PAM sync signal. The first state machine will remain in this state for repeated zero percent voltage values or return to state "IDLE".

When the first hundred percent voltage value of the PAM sync signal is located by microprocessor 70, the first state machine proceeds to state "SECOND_*HUNDRED*_PERCENT:" during which the state machine waits for the second hundred percent voltage value of the PAM sync signal, otherwise the first state machine returns to state "IDLE". When the second hundred percent voltage value of the PAM sync signal is located by microprocessor 70, the first state machine proceeds to state "THIRD_HUNDRED_PERCENT:" during which the state machine waits for the third hundred percent voltage value of the PAM sync signal, otherwise the first state machine returns to state "IDLE". When the third hundred percent voltage value of the PAM sync signal is located by microprocessor 70, the first state machine calculates the fifty percent value of the PAM sync signal, checks tolerance and proceeds to state "FIFTY_PERCENT:" during which the state machine returns state "IDLE".

The second state machine of the gs2.c module checks the spacing between sync patterns has four states. Until the first PAM sync pattern is detected the second state machine remains in a state identified as "LOST_SYNC". When the first PAM sync pattern is located, that is the fifty percent value has been detected in channel sixty four by state machine one, the channel identification counter is set to sixty four. When the channel identification is sixty four, the voltage level in channel sixty four is fifty percent and the second state machine is in state "LOST_SYNC" then the second state machine proceeds to a state identified as "FIRST_SYNC" indicating that a PAM sync pattern has been detected In state "FIRST_SYNC:" microprocessor 70 is waiting for second sync pattern. When a second PAM sync pattern is detected by the first state machine sixty four channels after the first PAM sync pattern was located by the first state machine, the second state machine proceeds to a state "IN_SYNC:" indicating that two sync patterns have been located which are the correct distance apart. The second state machine also has a state identified as "LOST_FIRST:" which the second state machine proceeds to when it missed one PAM sync pattern. Thus, the second machine determines when microprocessor 70 is synchronized to the incoming PAM data stream.

During the gs2.c module frame sync light 222 on front panel 200 is energized when microprocessor 70 when bit 6 of the fsr/dr/clkr port 1 control register of microprocessor 70 is pulled low.

The gs2.c module also resets the getting_test_adc_sample which is required for the analog-to-digital, digital-to-analog test in the calibration mode.

At this time it should be noted that a zero percent voltage value in the PAM waveform is approximately +1.5 VDC, a one hundred percent voltage value is approximately −1.5 VDC and a fifty percent voltage value in the PAM waveform is approximately 0 VDC.

Referring now to FIGS. 3*a*, 3*b*, 5*b* and 13 the newmtim.c module the case "PCM:" (line 498 of the newmtim.c module) includes a switch debouncing routine which monitors PCM pushwheel switch 202 and an MTIM pushwheel switch 204 on front panel 200. When monitoring PCM pushwheel switch 202, the pcm_debounce_count reaches 100 before it is zeroed. DATA_SELECTION_ERROR messages are not utilized when processing a PCM data stream since all switch settings for PCM pushwheel switch 202 are valid for the PCM mode. Since the pushwheel inputs from PCM pushwheel switch 202 are supplied to microprocessor 70 by latch 160 in the byte of the reading of the switch settings, the reading is masked off with hexadecimal FFFF00FF and then shifted right by eight bits. The hexadecimal value of the switch setting is then converted to its decimal equivalent.

The MTIM output pushwheel settings from MTIM pushwheel switch 204 in PCM mode in the same manner the settings are monitored in PAM mode. The valid range of settings for MTIM pushwheel switch 204 in PCM mode is from hexadecimal 00 to hexadecimal 7F. When the settings on MTIM pushwheel switch 204 in PCM mode are greater than hexadecimal 7F and the bogus_mtim_pushwheel_flag is not set, then a DATA_SELECTION_ERROR message (hexadecimal 71) is sent to master microprocessor 20 by slave microprocessor 70 and the bogus_mtim_pushwheel_flag is set.

Referring to FIGS. 1*a*, 1*b*, 2, 3*a* and 3*b*, 5*a* and 13, microprocessor 20 receives a PCM (pulse code modulated) data stream via universal synchronous asynchronous receiver transmitter (USART) 26 from an external device such as a telemetry unit. USART 26 detects a sync pattern and then interrupts microprocessor 20 which then retrieves each word of PCM data from each frame of the PCM data stream. Dual Port RAM 60 has two banks (bank 0 and bank 1) for storing data therein and then having data read therefrom. Each bank in dual port RAM 60 is adapted for storing one frame of PCM data. This, in turn, requires that master microprocessor 20 first store one frame of PCM data in the bank 0 of dual port RAM 60 and then send a command to slave microprocessor 70 to retrieve the frame of PCM data stored in the bank 0 of dual port RAM 60. This command is PCM mode (opcode 50h, data byte 00h) which indicates to microprocessor 70 that PCM data is stored in bank 0 of dual port RAM 60 and is awaiting processing by slave microprocessor 70.

To generate an interrupt to the master microprocessor 20, the slave microprocessor 70 supplies the address 3FEh to the A0–A9 inputs (right side inputs) of dual port RAM 60. This, in turn requires that the A0 input of dual port RAM 60 be at the logic zero state and that the A1–A9 inputs of dual port RAM 60 be at the logic one state. To generate an interrupt to the slave microprocessor 70, the master microprocessor 20 supplies the address 3FFh to A0L–A9L inputs (left side inputs) of dual port RAM 60. This requires that the A0L–A9L of dual port RAM 60 be at the logic one state.

While microprocessor 70 is retrieving the PCM data stored in the bank 0 of dual port RAM 60, microprocessor 20 is storing another frame of PCM data in the bank 1 of dual port RAM 60. As storage of each subsequent frame of data into one of the two banks of PCM data in dual port RAM 60 is completed, master microprocessor 20 sends a message to slave microprocessor 70 to begin processing the recently filled bank by alternately sending the following two commands: (1) Process DPRAM Bank 1 (opcode 52h and data byte 00h) or (2) Process DPRAM Bank 0 (opcode 51h and data byte 00h).

The getpcm.c module is used by microprocessor 70 to retrieve data from bank 0 or bank 1 of dual port RAM 60 depending upon the message received from microprocessor 20. If the message is opcode 50h or opcode 51h microprocessor 70 is commanded to read the PCM data from bank 0 (lines 18–19 of the getpcm.c module) otherwise microprocessor 70 reads the PCM data from bank 1. Microprocessor 70 will then read 100 words of PCM data from either bank 1 or bank 2 of dual port RAM 60. The PCM data words in two's complement form are stored in a one hundred word/slot array (identified as pcm_wd[ ]) within RAM in microprocessor 70.

Each word of PCM data has thirty two bits or four eight bit bytes. The upper three bytes of each word are set to zero and bit eight of the lower byte is examined to determine its state. If this bit is a logic zero each bit of the upper three bytes is cleared to zero. If this bit is a logic one each bit of the upper three bytes are set to a logic one. Thus, each PCM data byte read from the dual port RAM 60 is converted to 32-bit 2's compliment form. The pushwheel setting 202 is compared with the channel identification for sending input PCM data via latch 154 to the PCM light emitting diodes 206.

The module lookups.asm includes a lookup table (set forth as _scale_2_table at lines 6–19 of the module lookups.asm) which identifies each word of PCM data that is to be processed in accordance with the function identified as scale 2. The pcm_mod3.c module includes a counter identified as pcm_loop_counter that counts the number of PCM words processed in accordance with the function scale 2.

Microprocessor 70 utilizes a one hundred twenty eight slot internal array (identified as PCM[ ]) to store each channel of PCM data processed in accordance with the function scale 2. The function scale 2 is expressed as follows:

$$\text{scale } 2 = \left( \frac{2'sC\ PCM\ WD + 128}{255} \right) * 1007 + 8 \quad (2)$$

where the symbol "*" indicates multiply.

Microprocessor 70 retrieves a pair of hexadecimal numbers from the lookup table which identify the location of the word in the one hundred slot array in microprocessor 70 and the location for storing the data in the one hundred twenty eight slot array in microprocessor 70. For example, for the numbers 16h, 0Fh, microprocessor 70 will read the PCM word stored in slot 15 (0F hexadecimal) of the 100 slot array in microprocessor 70, process the word in accordance with the function scale 2 and store the result in slot 16h of the 128 slot array in microprocessor 70.

Figure 6A:
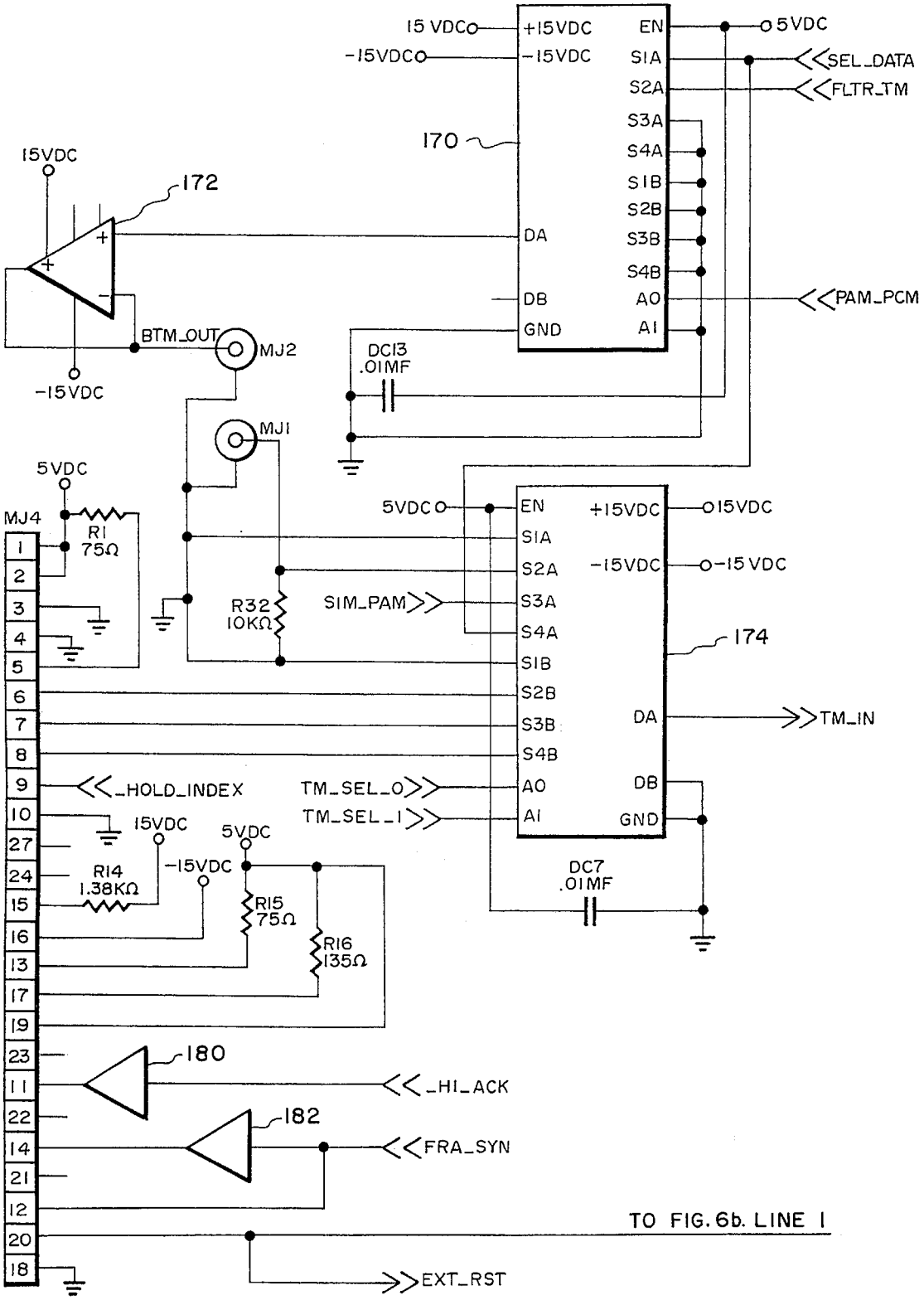
FIGS. 6*a* and 6*b* illustrate analog input circuitry used in the present invention.
Figure 6B:
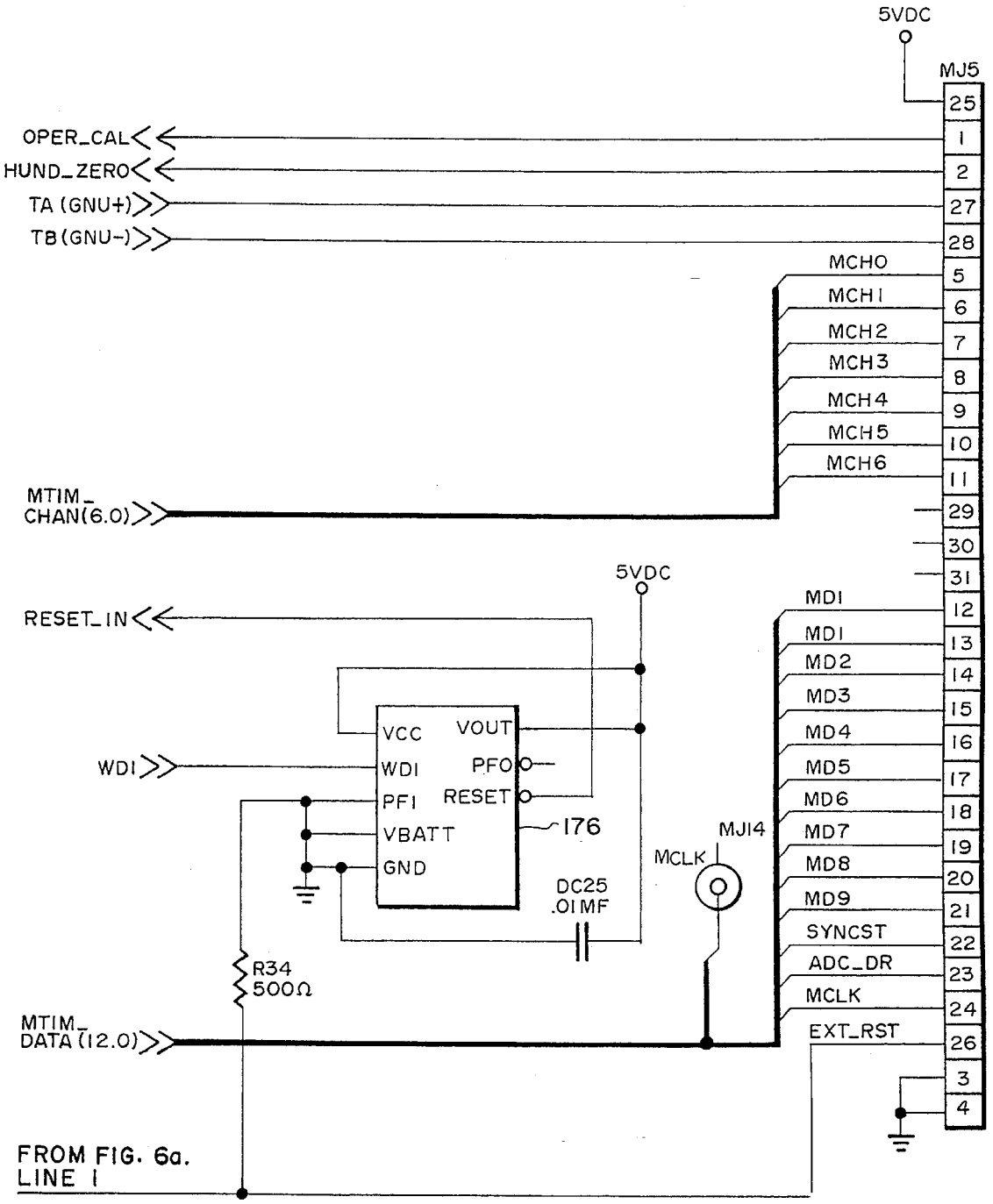
Figure 8:
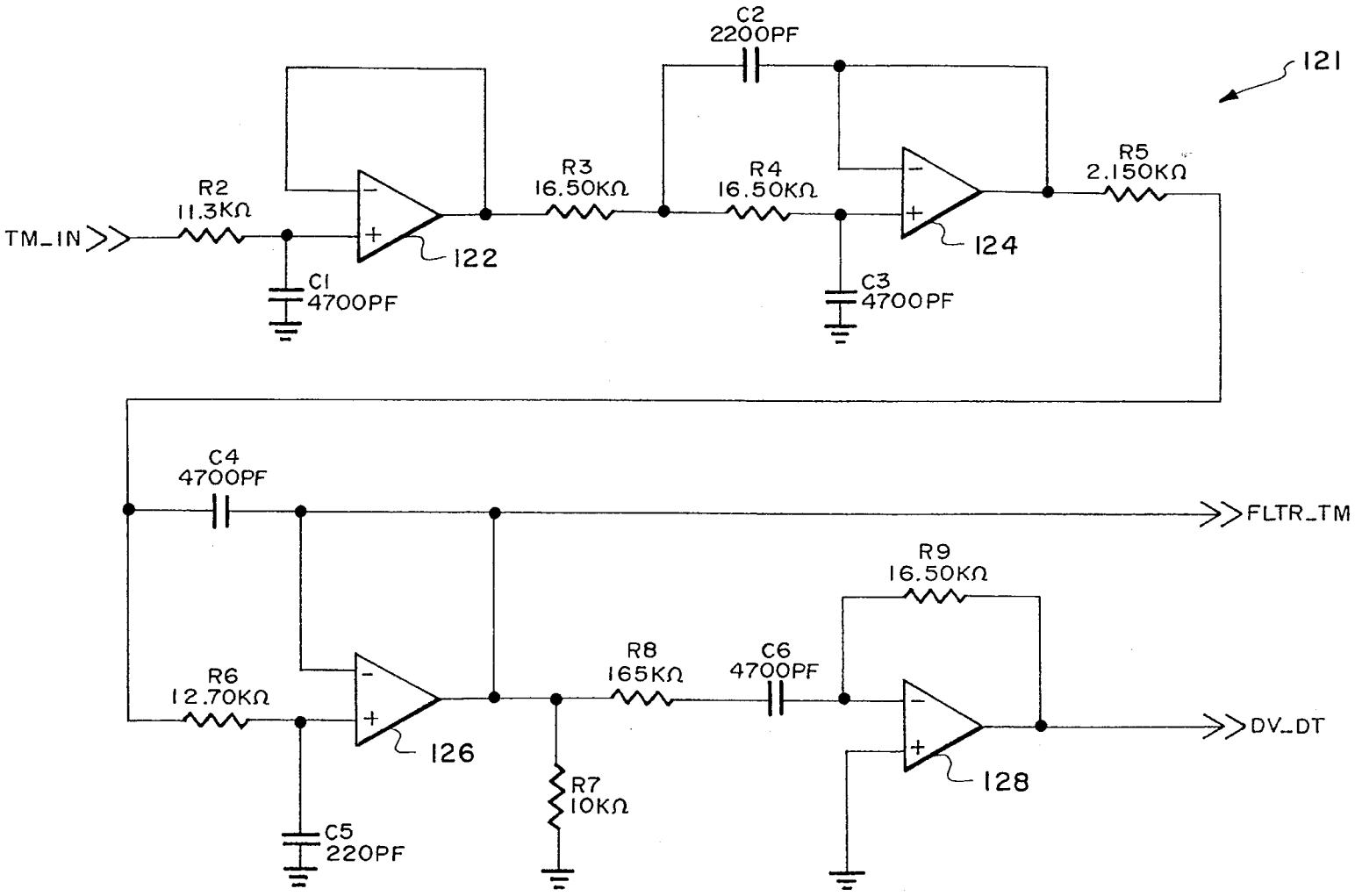
FIG. 8 illustrates the 6 pole low pass bessel filter used in the present invention.

The scaled PCM data is output from microprocessor 70 via latches 146 and 152 through bus MTIM_DATA(12:0) to connector MJ5, while the channel identification is output from microprocessor 70 via latch 148 through bus MTIM_CHAN(6:0) to connector MJ5 (FIG. 6*b*). Connector MJ5 is connected to the missile subsystem test set. The bit ADC_DR from latch 152 when at the logic one state indicates to the missile subsystem test set that the scaled PCM data from microprocessor 70 is valid.

At this time it should be noted that Appendix G sets forth the manner by which each of the 100 channels of PCM data is to be processed by microprocessor 70. For example, as shown in Appendix B each of the PCM words in channels 20 through 40 of the 100 channel PCM data stream will be processed in accordance with the function scale 2 and then stored in the 128 channel array as set forth in Appendix G.

OPERATION OF THE COMPUTER SOFTWARE FOR MASTER MICROPROCESSOR 70

Referring to FIGS. 1*a*, 1*b*, 2, 3*a*, 3*b* and 13 and the software of Appendix C, (which is the source code listing for microprocessor 20 and is identified as MTIMASTER.ASM) at lines 13–146 symbolic references are assigned to constants. For example, at line 13 DSP_SW_VER_ADDRESS EQU 70h allows the assembler to replace the symbol "DSP_SW_VER_ADDRESS" with 70h. At line 120–146 symbolic references are assigned to bits of the ports P1, P2 and P3 of microprocessor 30. Port P0 of microprocessor 20 is being used as a general purpose data and address bus. For example, the line of code HUND_zero refers to the bit occurring at the P10 input of master microprocessor 20. Further, the line of code HI_IO refers to the bit occurring at the P17 output of master microprocessor 20.

At lines 151–166 of MTIMASTER.ASM interrupt vectors are established. A logic one RESET signal occurring at RST input of microprocessor 20 initializes microprocessor 20. An active low interrupt signal (_RXRDY) from USART 26 to the P32 input of microprocessor 20 will result in a jump to address 0003h. There are interrupt vectors for TIMER0 and TIMER1 which are internal timers of microprocessor 20. There is an interrupt _SLAV_MASTER_INT from dual port RAM 60.

Beginning at line 169 microprocessor 20 is initialized. The input/output ports P0, P1 and P2 of microprocessor 20 are set to a known state. A flag MBANK_STAT is set to a logic one. The signal MBANK is a control signal provided to dual port RAM 60 which allows master microprocessor 20 to access BANK 0 and BANK 1 of dual port RAM 60. BANK 1 is accessed when the signal MBANK is set, BANK 0 is accessed when the signal MBANK is cleared. Internal registers are set to trigger the USART 26 and dual port RAM 60 interrupts when a falling edge occurs. The USART 26 and dual port RAM 60 interrupts are then cleared. TIMER0 and TIMER1 of microprocessor 20 are cleared.

Interrupts which are active during the power up sequence microprocessor 20 are initialized beginning at line 189 of MTIMASTER.ASM. Interrupt priorities are set beginning of line 198 of MTIMASTER.ASM with the highest priority being assigned to USART 26. At line 207 the TIMER1 interrupt service routine is told not to execute its routine. The USART 26 is next initialized to accept PCM telemetry data allowing USART 26 to search for the PCM frame sync signal. At lines 212–216 of MTIMASTER.ASM, register bank 3 of microprocessor 20, which is utilized to process PCM data, is initialized.

At line 218 of MTIMASTER.ASM, the main program for microprocessor 20 is entered. At line 219 of MTIMASTER.ASM, a flag is cleared indicating that calibration test performed by microprocessors 20 and 70 have not passed. At line 220 of MTIMASTER.ASM the USART interrupt service routine is notified that the first frame of PCM data has not been acquired. At lines 221, 222 and 223 of MTIMASTER.ASM respectively the flags PCM_FRAME_ERROR, NO_PCM and CALIBRATING are cleared.

At line 224 of MTIMASTER.ASM the flag, which indicates that a "data select error", opcode error 71h was previously supplied to microprocessor 20 by microprocessor 70, is cleared. At line 225 of MTIMASTER.ASM the variable which receives the opcode for messages supplied by microprocessor 70 to microprocessor 20 is cleared. At line 226 of MTIMASTER.ASM the USART interrupt service routine is notified that the HUND_ZERO signal occurring at the P10 input of microprocessor 20 has not changed state during calibration. Microprocessor 20 is initialized to a PAM mode of operation at line 228 of MTIMASTER.ASM. A jump to the calibrate mode occurs at line 229 of MTIMASTER.ASM if the missile subsystem test set sends a logic zero to microprocessor 20 via its P27 input. A routine SELF_TEST is called at line 230 of MTIMASTER.ASM which is a display test for checking the PCM pushwheel switch 202 and an MTIM pushwheel switch 204 on front panel 200. The SELF_TEST routine test all front panel display elements on front panel 200 and allows an operator to access PAM and PCM data simulated by the present invention via connector 211 on front panel 200.

It should be noted that front panel 200 has a connector 215 which is used to access PAM and PCM frame sync and an MTIM data and clock output connector 217.

At line 231 a routine CALIBRATE is called which test, for example, the internal RAM and registers of microprocessor 20 and the ability of microprocessor 20 to access to dual port RAM 60. When the OPER_CAL line is high (operate mode), a display test is executed. When OPER_CAL line is low (calibrate mode), a display test is not executed.

After the self test of the missile telemetry data interface circuit are complete, the MAIN_PROCESSING is entered at line 233 of MTIMASTER.ASM. The USART 26 interrupt is disabled at line 234 of MTIMASTER.ASM.

Figure 1B:
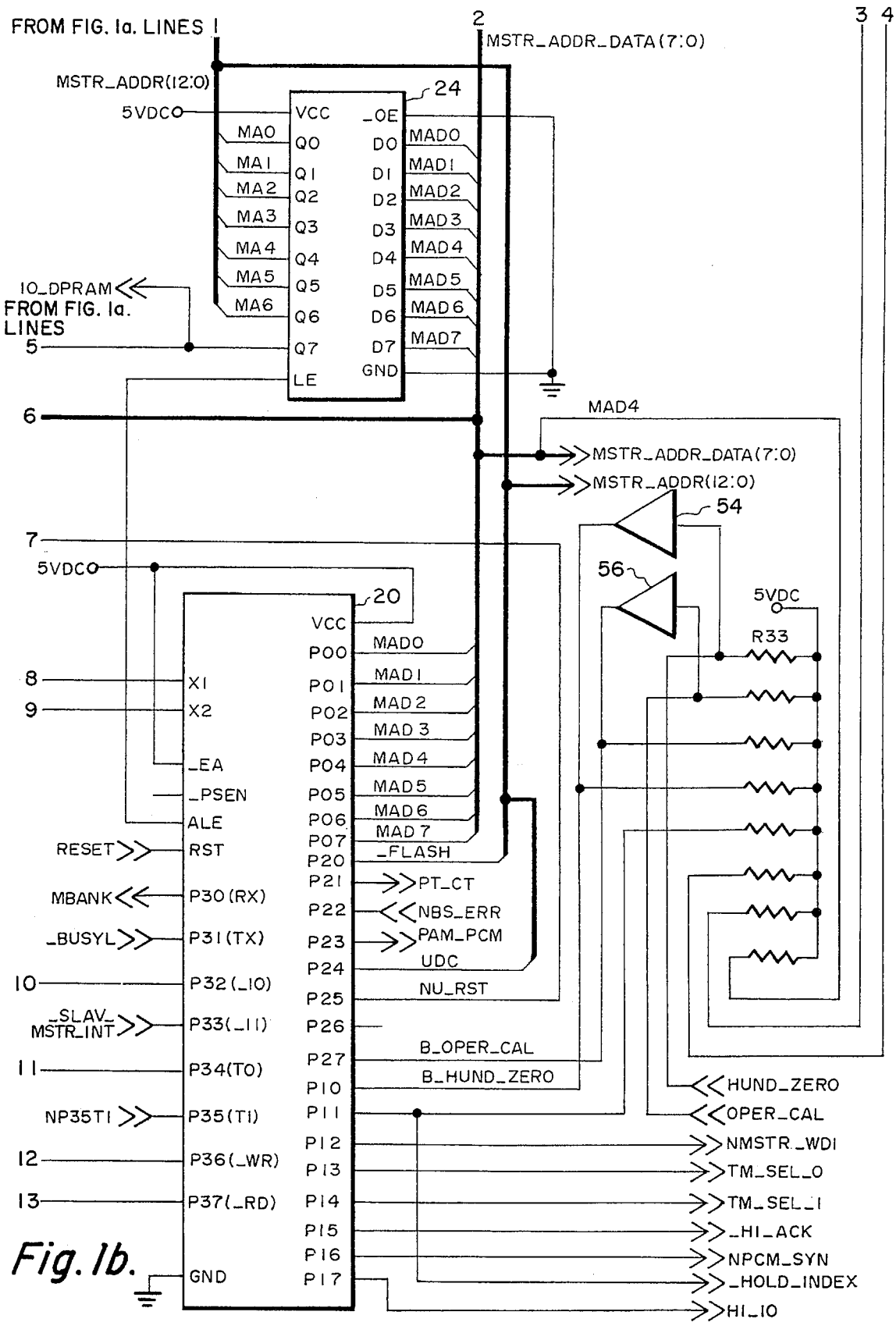

Referring to FIGS. 1*a*, 1*b*, and 6*a* microprocessor 20 supplies a pair of signals TM_SEL_0 and TM_SEL_1 to an analog multiplexer 174 which allows multiplexer 174 to pass through a ground, external generated PCM or PAM data, simulated PCM data or simulated PAM data. At lines 123–127 of MTIMASTER.ASM the logic states for allowing analog telemetry data to pass through multiplexer 174 are defined. For example, when the TM_SEL_1 signal is zero and the TM_SEL_0 signal is one external PAM or PCM data from a missile's telemetry unit passes through multiplexer 174 via its S2A input. At lines 235 and 236 of MTIMASTER.ASM the TM_SEL_0 and TM_SEL_1 signals are initialized so that external PCM or PAM telemetry data passes through multiplexer 174. At line 237 of MTIMASTER.ASM the PAM_PCM signal is cleared to a logic zero state. This signal is supplied to the A0 input of an analog multiplexer 170 which allows PAM or PCM telemetry data to pass through multiplexer 170 to an output buffer 172. When the S2A input of multiplexer 170 is selected filtered PAM data from 6 pole low pass bessel filter 121 passes through multiplexer 170 to output buffer 172. When missile telemetry data interface circuit is in the PCM mode, PCM data (SEL_DATA) supplied to the RXD input of USART 26 is also provided to the S1A input of multiplexer 170 passing through multiplexer 170 to output buffer 172.

At this time it should be noted that the mode of processing telemetry data which is either PAM mode or PCM mode is determined by the detection of the sync signal by microprocessor 70 or USART 26. When microprocessor 70 first detects a PAM sync signal the mode of processing telemetry data is changed to PAM mode. When, however, USART 26 first detects a PCM sync signal, the mode of processing telemetry data is changed to PCM mode.

Figure 1C:
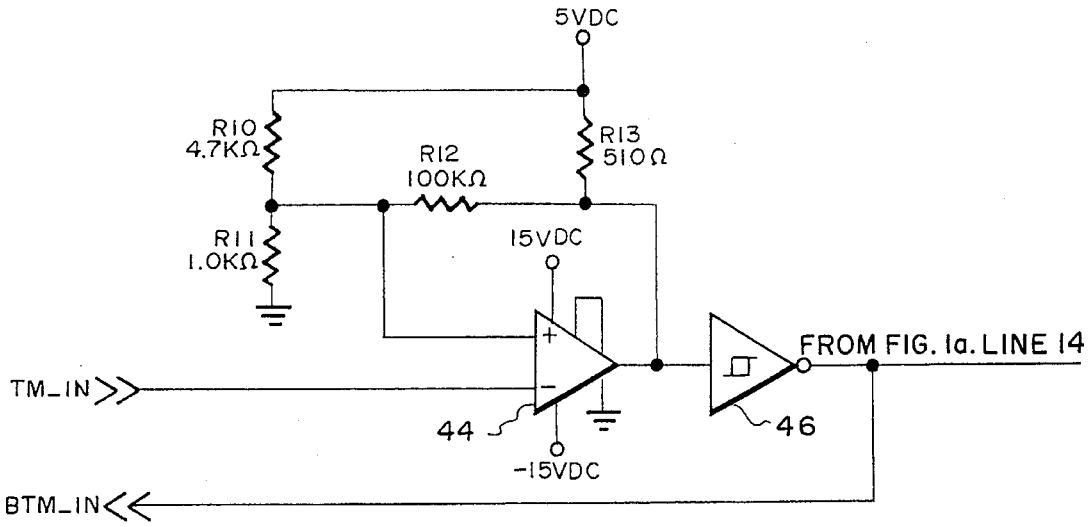

Referring to FIGS. 1*c*, and 6*a* telemetry data which passes through analog multiplexer 174 is supplied to a comparator 44 which converts the input +15 V to −15 V input signal to a TTL compatible 0 V to +5 V signal. The 0–5 V TTL compatible signal is next supplied to an inverter 46 which inverts the signal and eliminates noise from the signal.

Referring now to FIG. 1*c*, 4, and 14*a*, 14*b*, and 14*c*, when interface circuit 120 receives unencrypted PCM data directly from a missile telemetry unit there is a requirement that the data be decoded or derandomized for processing by missile telemetry data interface circuit. Interface circuit 120 includes a de-randomizer circuit 223 which receives randomized unencrypted PCM data directly from the telemetry unit via its BTM_IN input.

Figure 14D:
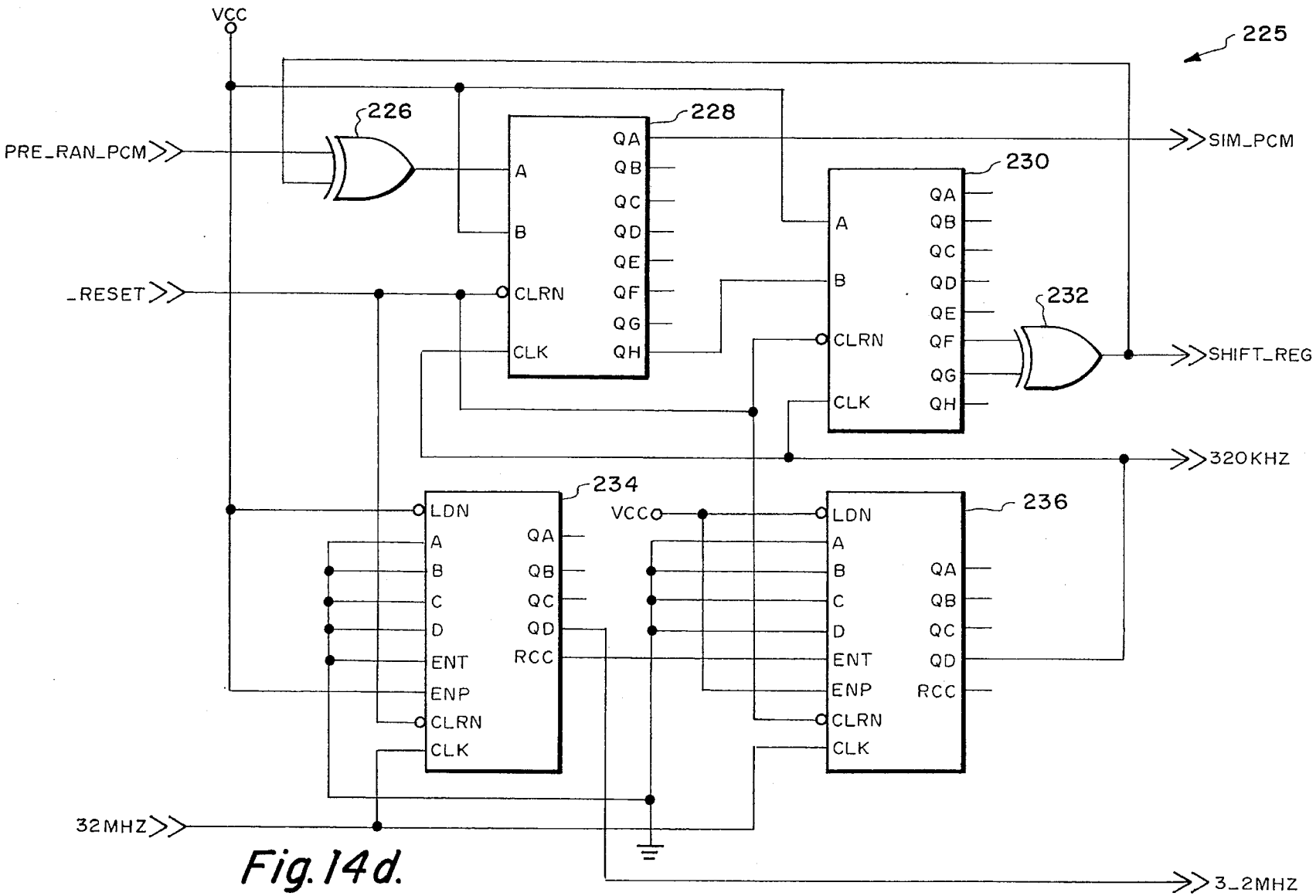

Referring to FIG. 14*d*, the randomized PCM data is provided by an externally located randomizer circuit which is identical to the randomizer circuit 225 illustrated in FIG. 14*d*. Randomizer circuit 225 includes a pair of EXCLUSIVE-OR gates 228 and 232 and a pair of 8-Bit Parallel-Out Serial Shift registers 228 and 230 which comprise the data randomizer within randomizer circuit 225. Shift registers 228 and 230 are configured to form a 15 bit shift register with the fourteenth and fifteenth bit of the shift register being connected to the inputs of EXCLUSIVE-OR gate 232. The data randomizer within randomizer circuit 225 encodes PCM telemetry data in accordance with the following Boolean expression:

$$D=A\oplus B\oplus C \tag{3}$$

where A is the PCM data input to EXCLUSIVE-OR gate 226 via the PRE_RAN_PCM input of circuit 225, B is the data bit which is output from the QF output of shift register 230 to the first input of EXCLUSIVE-OR gate 232, C is the data bit which is output from the QG output of shift register 230 to the second input of EXCLUSIVE-OR gate 232 and D is the output of EXCLUSIVE-OR gate 226. The randomized PCM data from EXCLUSIVE-OR gate 226 is supplied to shift register 228 and than clocked through shift register 228 by a 320 kHz clock signal to eliminate glitches which may occur at the output of EXCLUSIVE-OR gate 226.

Figure 3A:
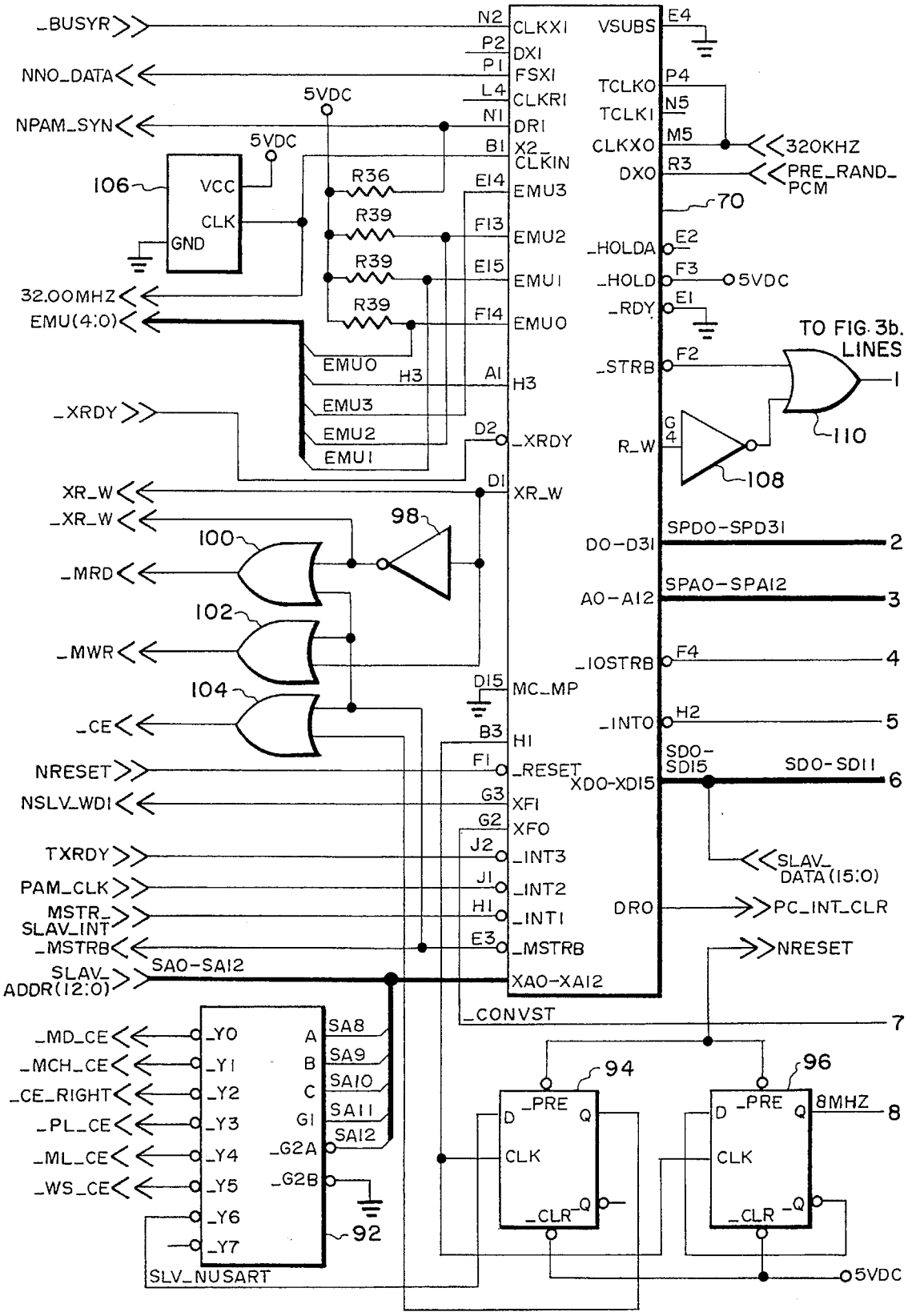
FIGS. 3*a* and 3*b* illustrate the slave microprocessor of the present invention and its associated logic circuitry.
Figure 3B:
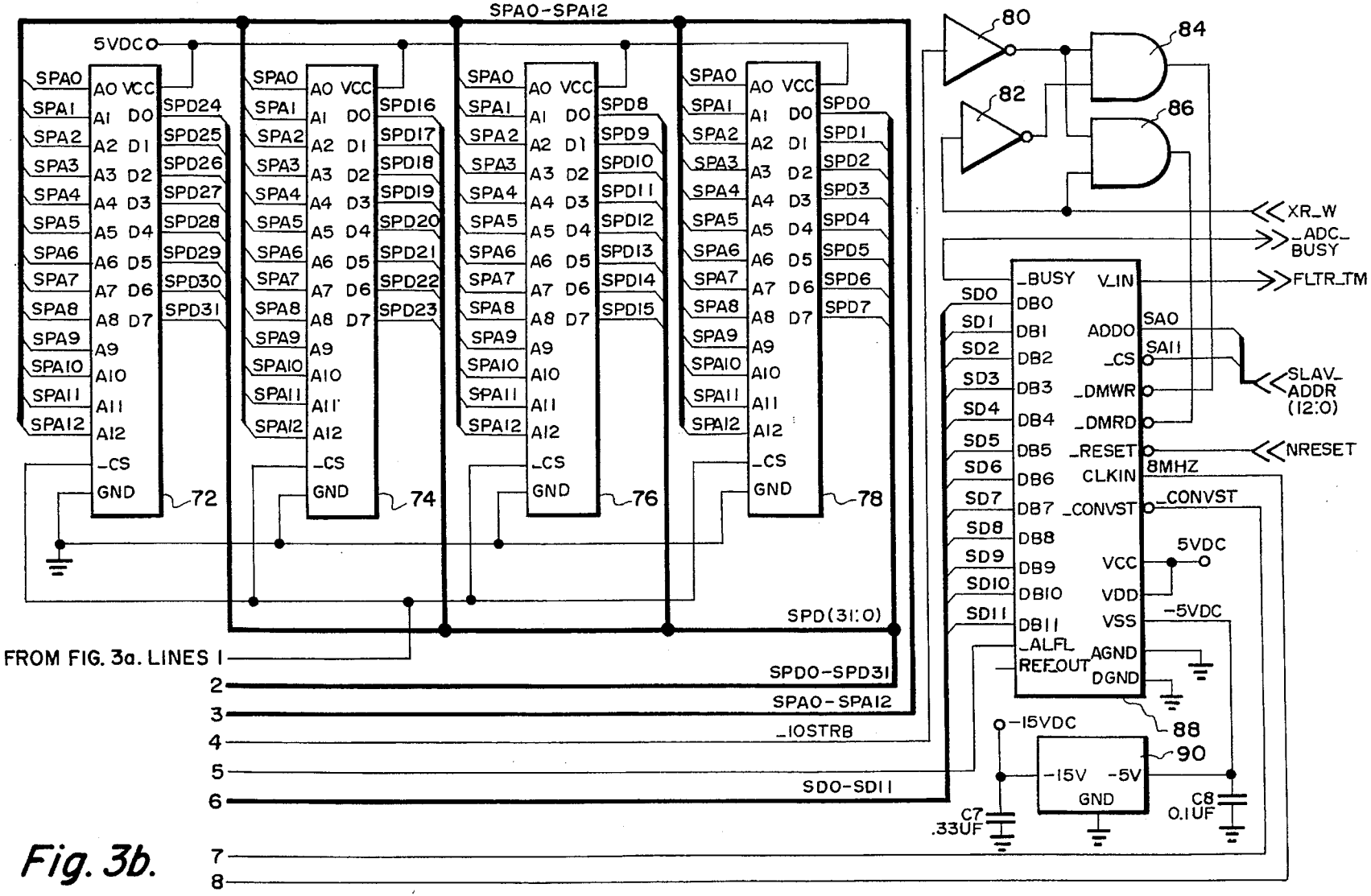

Randomizer circuit 225 also includes a pair of Synchronous 4-Bit Decade counters 234 and 236 which receive an external 32 MHz clock signal generated by a clock signal generator 106 (FIG. 3*a*). Counter 234 divides the 32 MHz clock signal by ten resulting in a 3.2 MHz clock signal at the 3_2 output of randomizer circuit 225. Counter 236 divides the 3.2 MHz clock signal by ten resulting in the 320 kHz signal which to the clock inputs of shift registers 228 and 230.

Figure 14E:
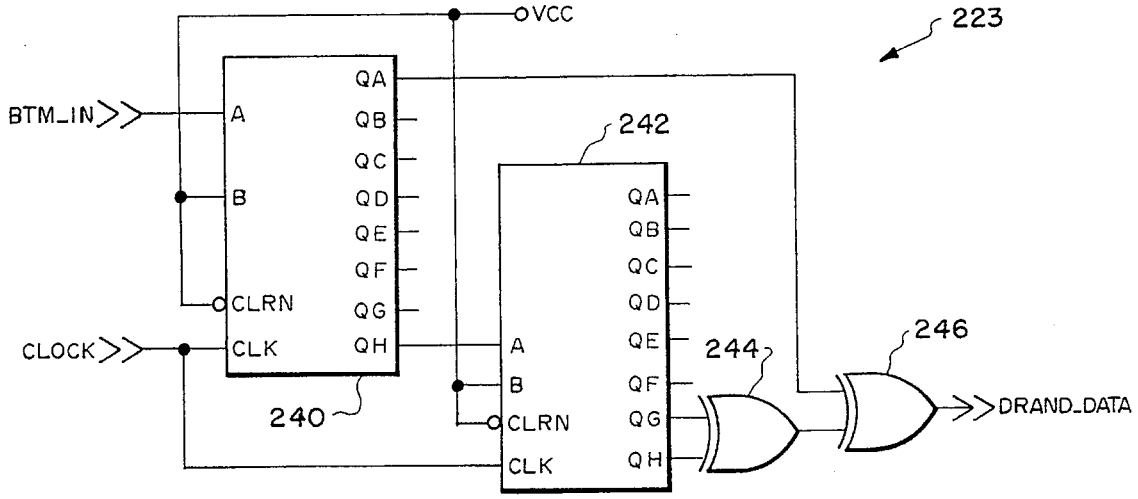
Figure 14H:
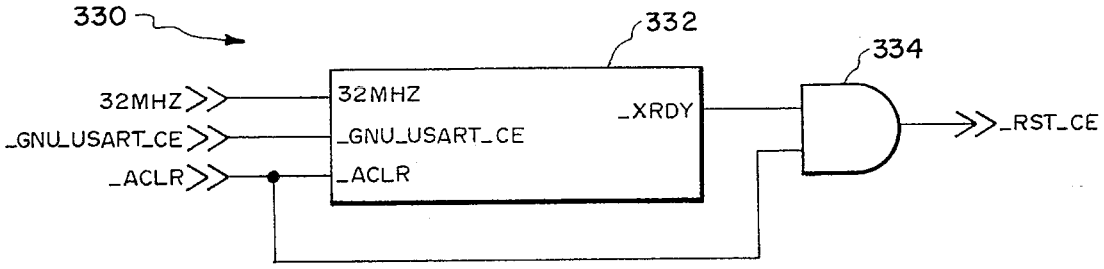
Figure 14I:
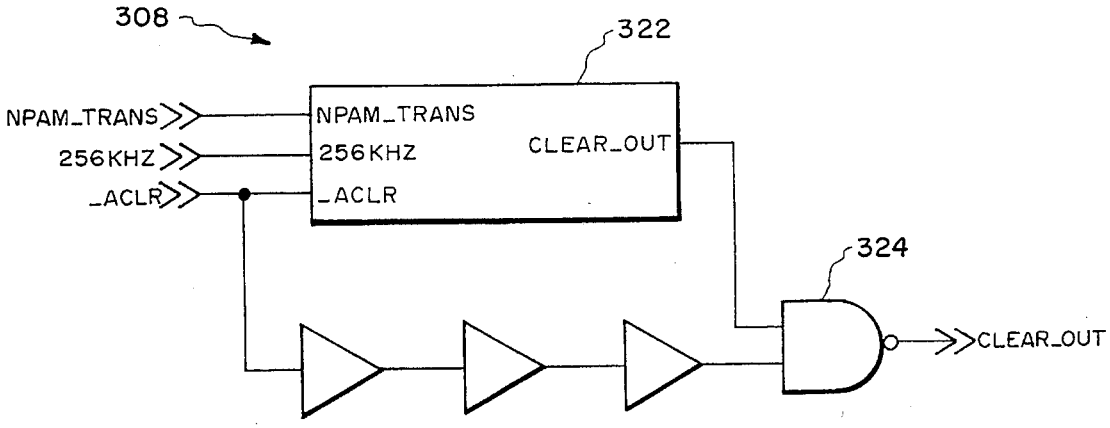

Referring to FIG. 14*e*, de-randomizer circuit 223 includes a pair of 8-Bit Parallel-Out Serial Shift registers 240 and 242 and a pair of EXCLUSIVE-OR gates 244 and 246. The de-randomizer circuit 223 de-randomizes PCM randomized telemetry data in accordance with the following Boolean expression:

$$A'=D\oplus B\oplus C \tag{4}$$

where D is the randomized PCM telemetry data output from the QA output of shift register 240 to the first input of EXCLUSIVE-OR gate 246, B is the data bit which is output from the QG output of shift register 242 to the first input of EXCLUSIVE-OR gate 244, C is the data bit which is output from the QH output of shift register 242 to the second input of EXCLUSIVE-OR gate 244 and A' is the de-randomized PCM telemetry data supplied from the output of EXCLUSIVE-OR gate 246.

At this time it should be noted that randomized PCM telemetry data generated by randomizer circuit 225 is utilized to test missile telemetry data interface circuit in the PCM mode of operation.

Referring to FIGS. 1*b*, 14*a*, 14*c* and 14*e*, interface circuit 120 includes a 4-line to 1-line multiplexer 250. Multiplexer 250 receives at its A input a PT_CT signal which is supplied to its A input by microprocessor 20. Multiplexer 250 also receives at its 1C1 input the de-randomized PCM telemetry data supplied from the output of EXCLUSIVE-OR gate 246. When the PT_CT signal is a one the PCM data provided to the 1C1 input of multiplexer 250 passes through multiplexer 250 to the SEL_DATA output of interface circuit 120. The clock signal, which has a frequency of 320 kHz, for the de-randomized PCM telemetry data is supplied by a bit sync circuit 260 to the 2C1 input of multiplexer 250. When the PT_CT signal is a one this 320 kHz clock signal passes through multiplexer 250 to the SEL_CLK output of interface circuit 120. The SEL_DATA output of interface circuit 120 is connected to the RXD input of universal synchronous asynchronous receiver transmitter 26, while the SEL_CLK output of interface circuit 120 is connected to the RXC input of universal synchronous asynchronous receiver transmitter 26. The universal synchronous asynchronous receiver transmitter 26 then converts the de-randomized PCM telemetry data from a serial format to a parallel format for transmission to microprocessor 20.

The interface circuit 120 also is adapted to receive PCM data and a clock signal from an encryption unit which may be a KGR-68 decryption unit. This data which is de-randomized PCM telemetry data is supplied to the 1C0 input of multiplexer 250, while the 320 kHz clock signal is supplied to the 2C0 input of multiplexer 250. When the PT_CT signal is low the PCM telemetry data and the clock signal from the encryption unit pass through multiplexer 250 to its 1Y and 2Y outputs. It should be noted that the PT_CT signal is a signal which is toggled by microprocessor 20.

Figure 4:
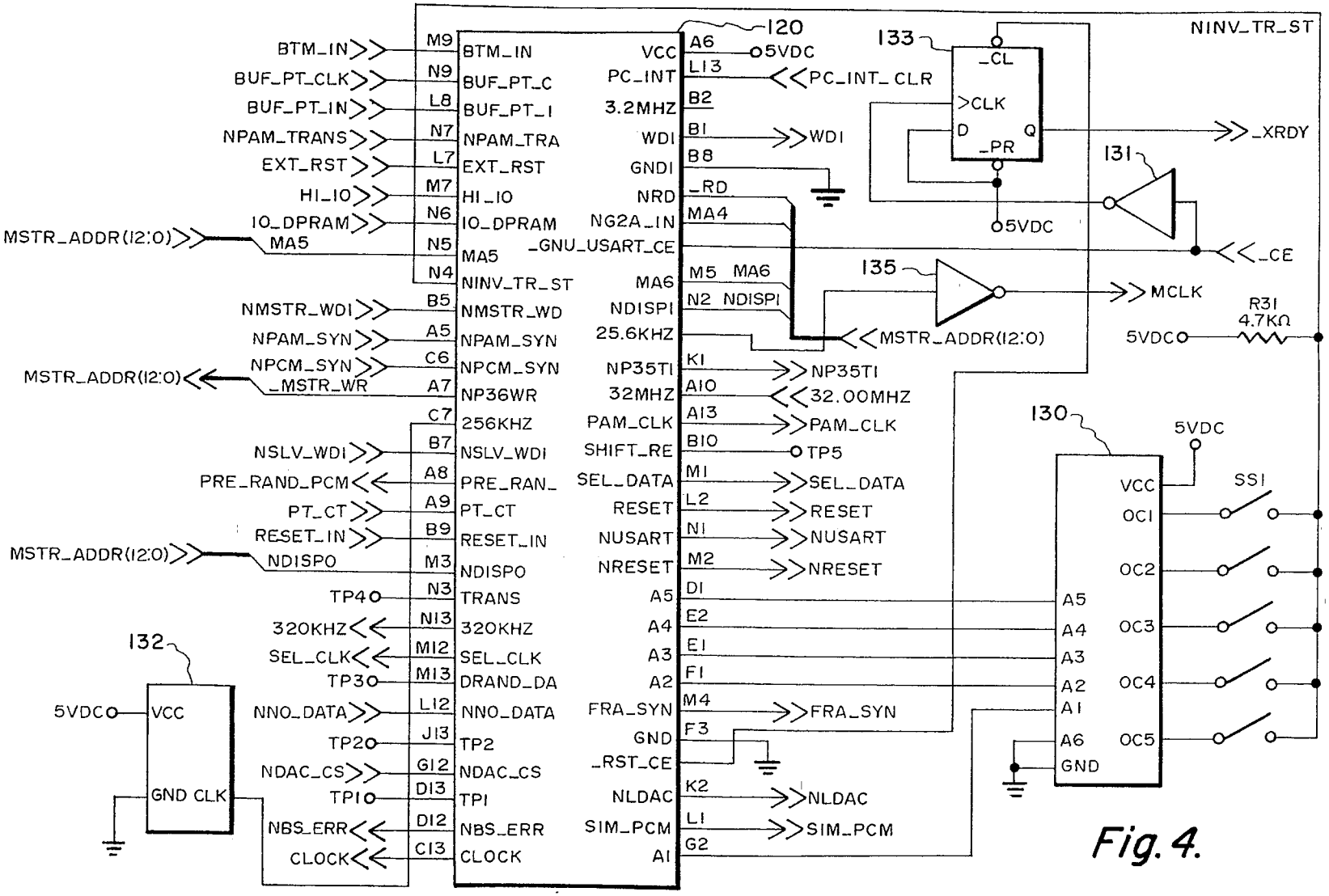
FIG. 4 illustrates an interface circuit and its associated logic circuitry used in the present invention.
Figure 5A:
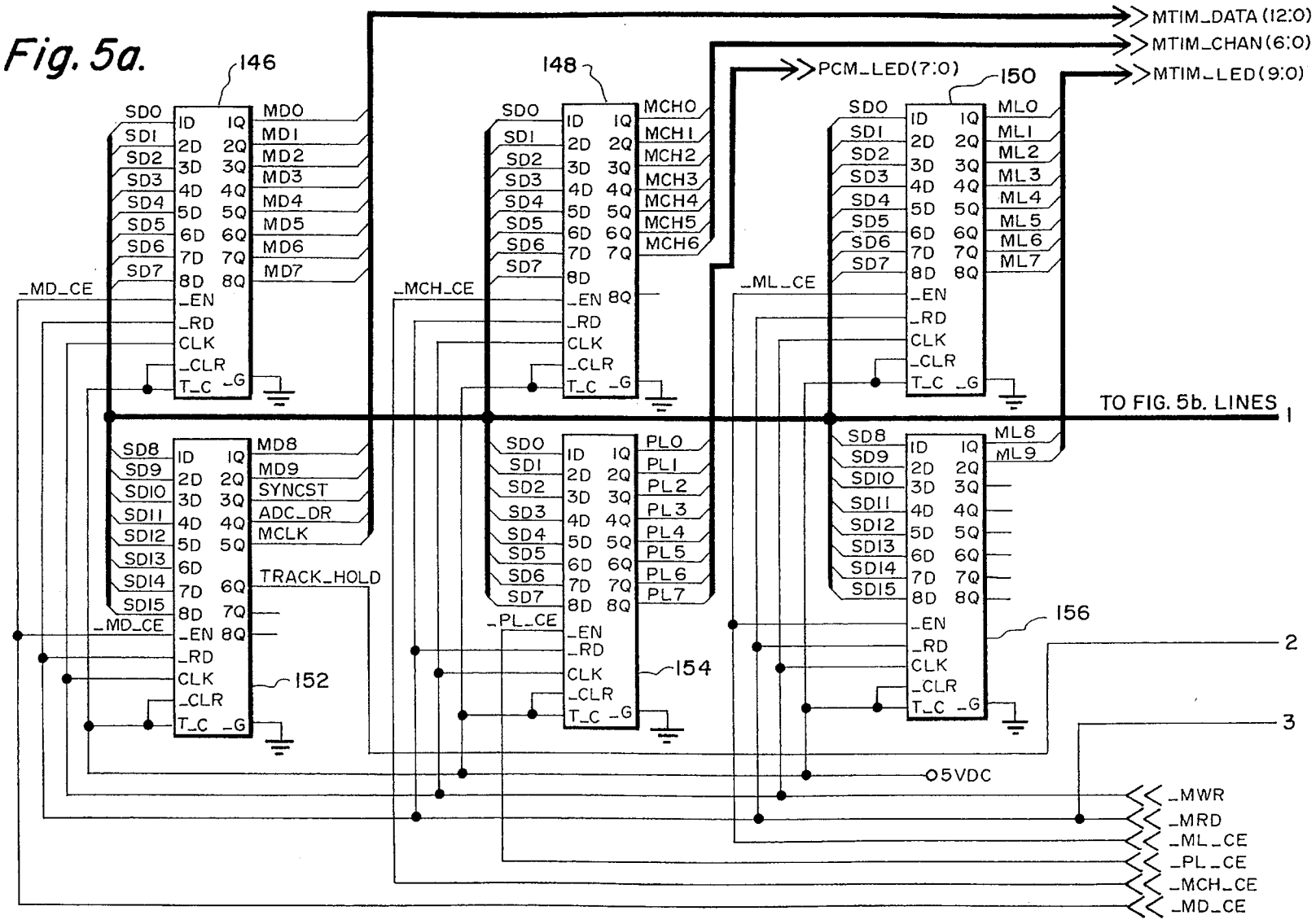
FIGS. 5*a* and 5*b* illustrate latching circuitry which is coupled to the slave microprocessor of FIG. 3*a* for receiving and latching therein telemetry data processed by the slave microprocessor of FIG. 3*a;*
Figure 5B:
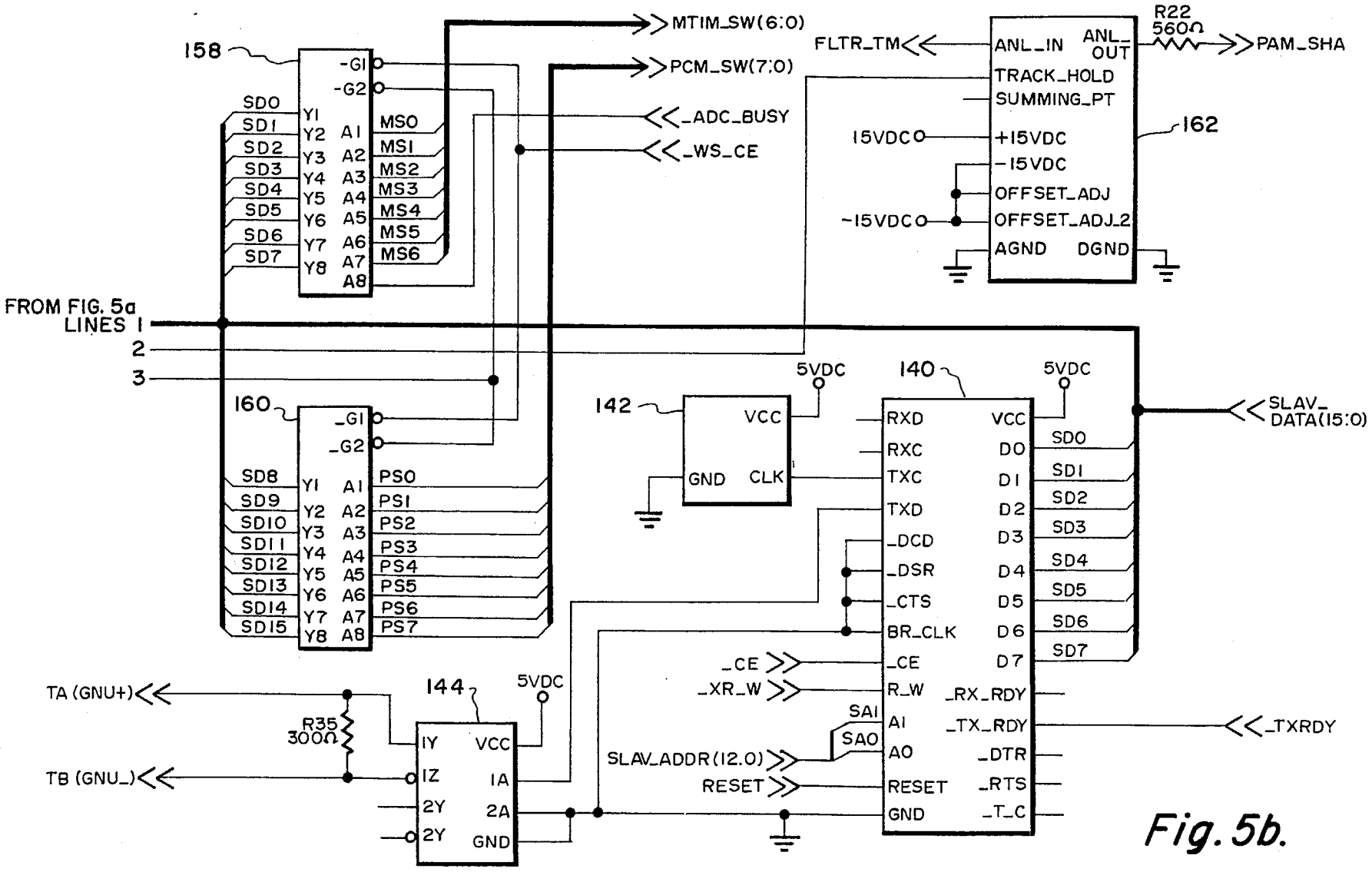
Figure 14F:
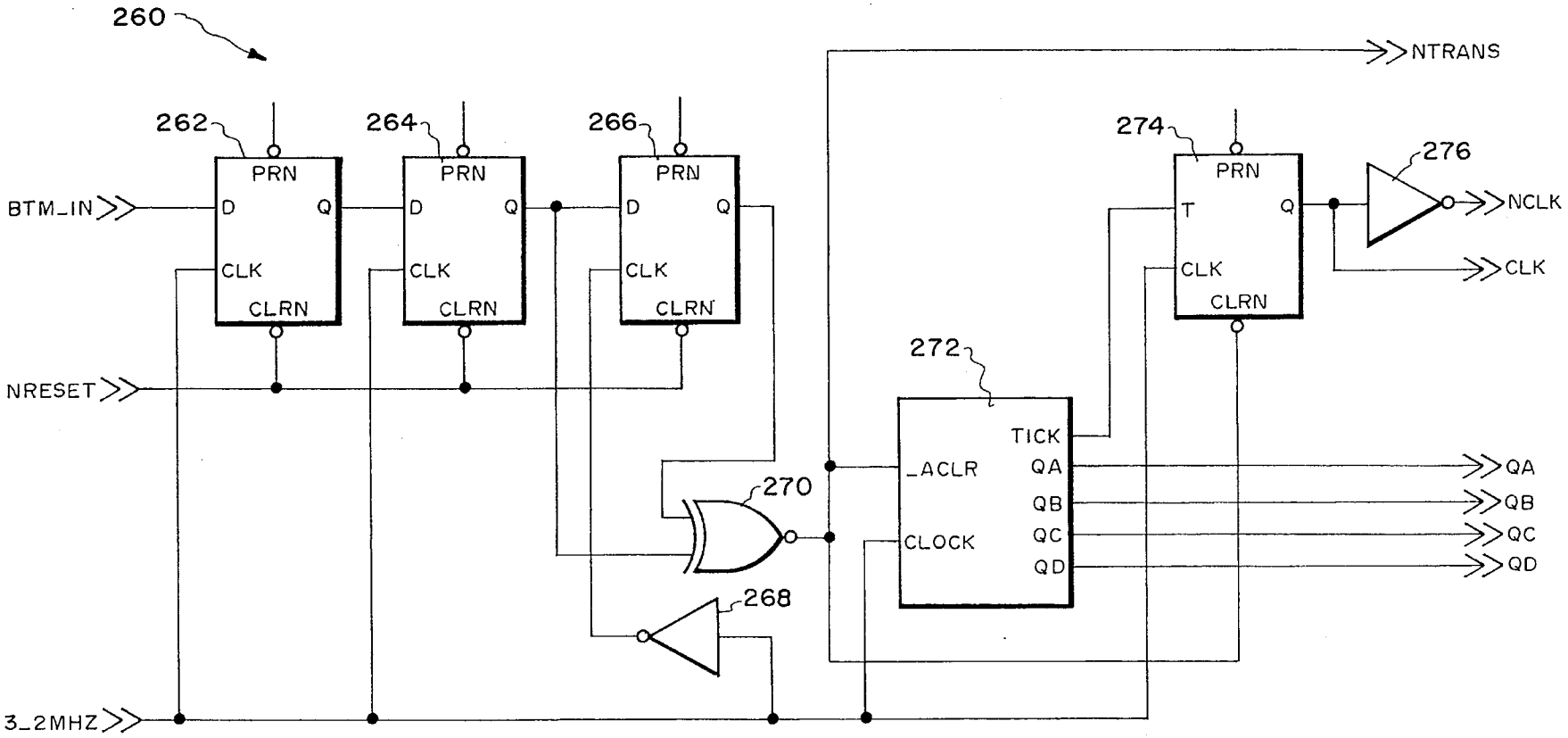
Figure 14G:
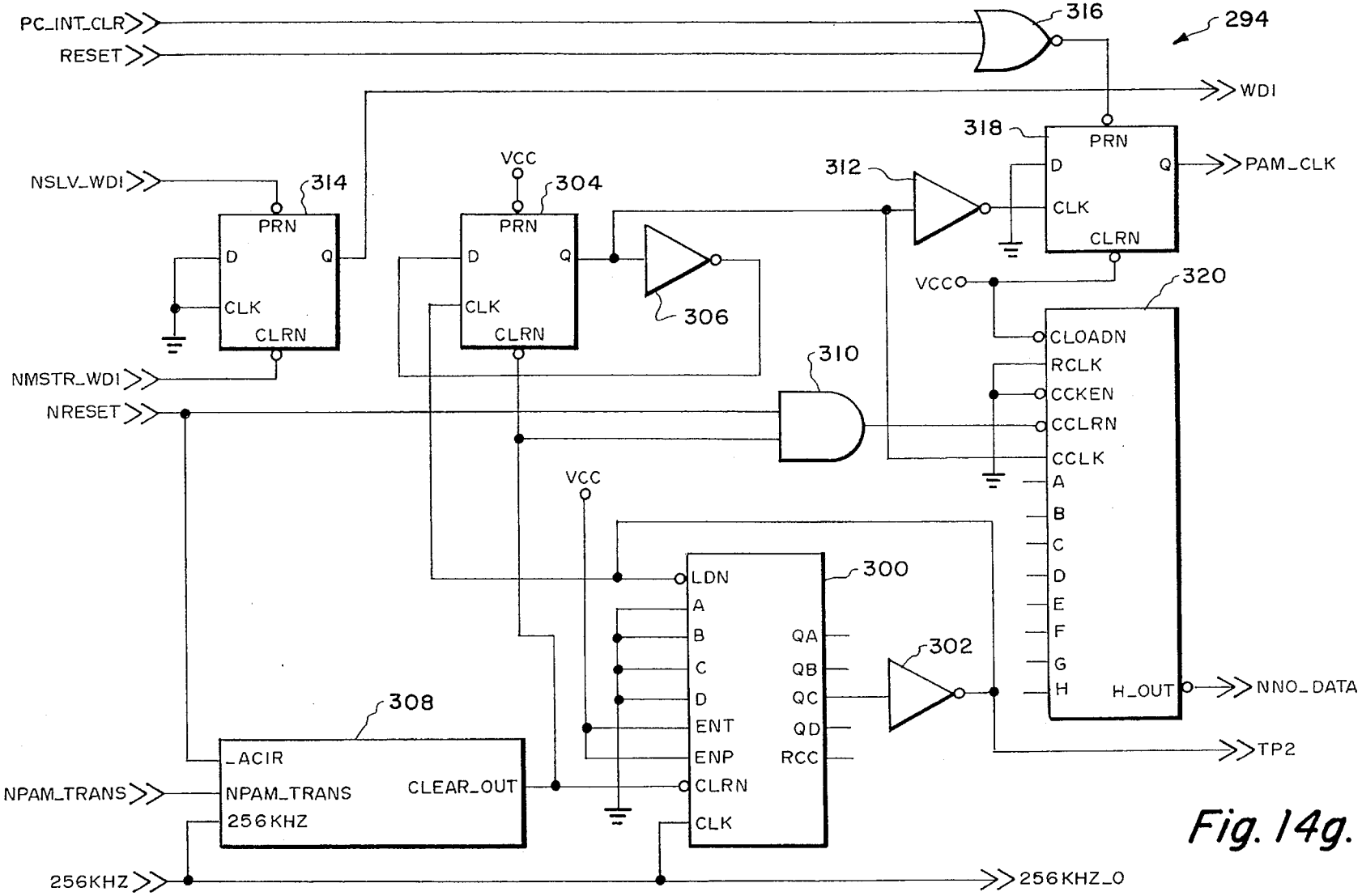
Figure 14J:
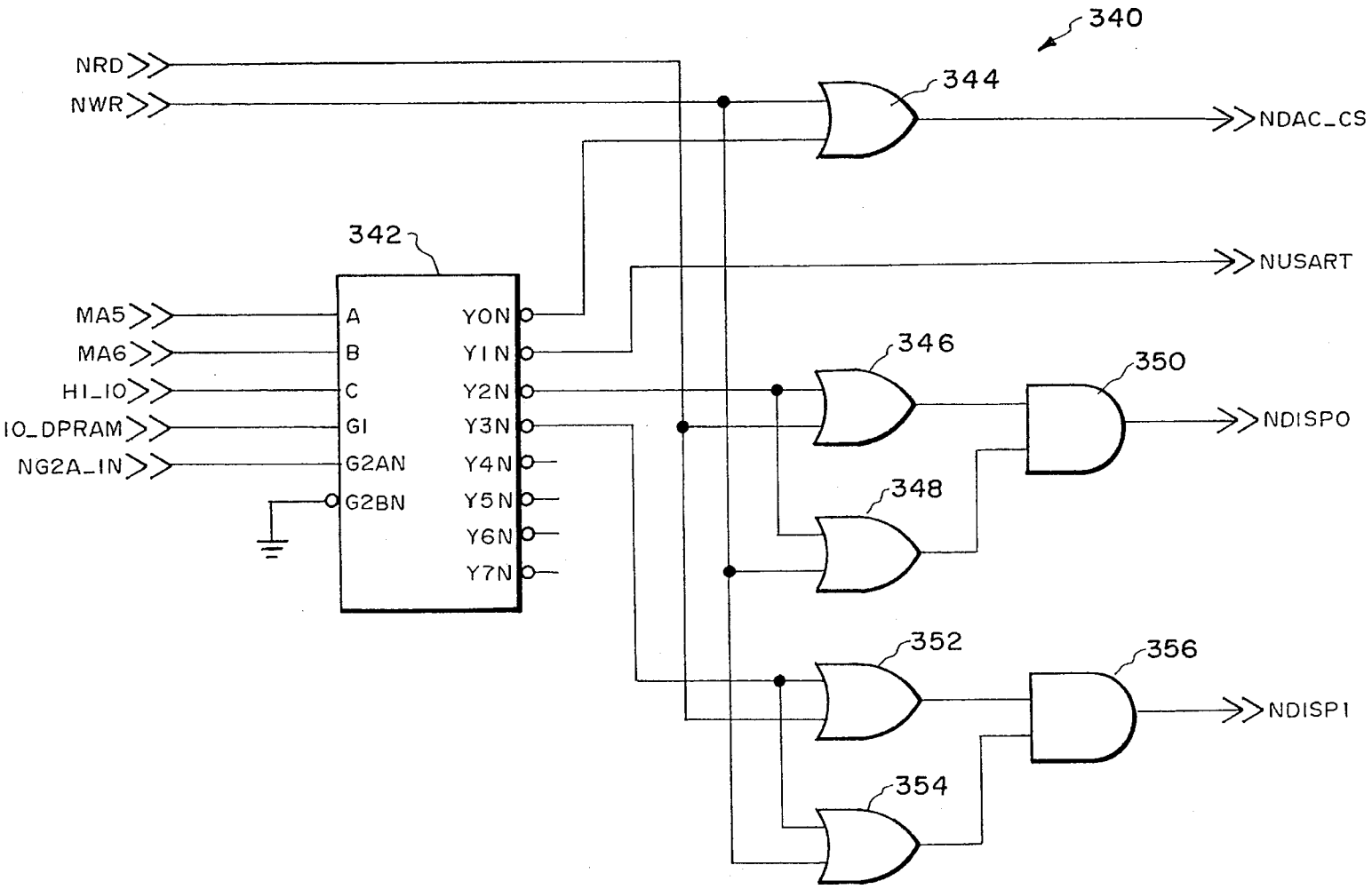

Referring to FIGS. 4, 14*a* and 14*f*, the interface circuit 120 includes a bit sync circuit 260 which receives the randomized PCM telemetry data via its BTM_IN input. Bit sync circuit 260 also receives the 3.2 MHz clock signal from randomizer circuit 225 and a negative reset (NREST) from inverter 256. Bit sync circuit 260 includes a pair of D type Flip-Flops 262 and 264 which synchronize an incoming serial PCM data stream to the 3.2 MHz clock signal. The combination of a third D Flip-Flop 266 and an EXCLUSIVE-NOR gate 270 generates a clear pulse whenever a change of state occurs within the synchronized serial PCM data stream. This clear pulse is supplied to the _aclr input of a ten state state machine 272 resetting the state machine 272 to a state s0. This clear pulse is also supplied to the NTRANS output of bit sync circuit 260.

When the state machine 272 transition to a state s4 the state machine generates a logic one enable signal at its tick output which is supplied to the T input if a toggle Flip-Flop 274 enabling toggle Flip-Flop 274. Enabling toggle Flip-Flop 274 allows Flip-Flop 274 to change state. The 3.2 MHz clock signal then clocks toggle Flip-Flop 274 causing the Q output of Flip-Flop 274 to change state. At its state s9 state machine 274 again provides a logic one enable signal to the T input of toggle Flip-Flop 274 enabling toggle Flip-Flop 274 which allows the 3.2 MHz clock signal to clock Flip-Flop 274 causing another change of state at the Q output of toggle Flip-Flop 274. This results in a 320 kHz clock signal at the output of the toggle Flip-Flop which is synchronized to the incoming PCM serial data stream, that is the 320 kHz signal transitions at approximately at the center of the bit period of a data bit of the PCM data stream. This 320 kHz clock signal is then provided to the CLOCK output of interface circuit 120. There is also an inverted 320 kHz signal provided by bit sync circuit 260 at its NCLK output. This inverted 320 kHz signal is also supplied to the 2C1 input of multiplexer 250.

Appendix E is a program listing for the state machine 272. At states S4 and S9 a logic one is provided at the TICK output of state machine 272 which when supplied to the T input of Flip-Flop 274 allows the 3.2 megahertz clock signal to toggle (change the state of) the Q output of Flip-Flop 24. As is best illustrated by Appendix E state machine 272 branches from state s9 to state s5 unless state machine 272 is reset to state s0 by an asynchronous clear pulse supplied by EXCLUSIVE-NOR gate 270 to the _ACLR input of state machine 272. Only during a logic zero to one transition of the incoming PCM data stream or a logic one to zero transition of the incoming PCM data stream is an asynchronous clear pulse supplied by EXCLUSIVE-NOR gate 270 to the _ACLR input of state machine 272.

The QA, QB and QC outputs of bit sync circuit 260 are respectively connected to the A, B and C inputs of a three line to eight line decoder 283, while the QD output of bit sync circuit 260 is connected to the G2AN input of three line to eight line decoder 283. Decoder 283 decodes the binary output counts 0 through 4 from bit sync circuit 260 will provide logic zeros at its Y1, Y2, Y3, Y4 or Y5 outputs which depend upon the states of the input signals supplied to A, B and C inputs of three line to eight line decoder 283.

The switches of switch block SS1 may be either closed or opened to select the desired counts within the bit period of a data bit of the PCM data stream at which a logic zero will be provided to the NINV_TR_ST input of interface circuit 120. When a logic zero is supplied through the NINV_TR_ST input of interface circuit 120 to the D input of Flip-Flop 280 a clear pulse occurring at the NTRAN output of the bit sync circuit 260 will clock the logic zero to the Q output of Flip-Flop 280. This logic zero (NBS_ERR) is supplied to the P22 input of microprocessor 20. In normal operation the switches of switch block SS1 will be configured to generate this NBS_ERR signal only when a transition of the 320 kHz signal provided by bit sync circuit 260 occurs at point other than approximately the center of the bit period of a data bit of the PCM data stream.

The digital logic illustrated in FIG. 14*f* was implemented using an Erasable Programmable Logic Device manufactured by the ALTERA Corporation of San Jose, Calif. Any of the 5000 series Erasable Programmable Logic Devices, such as the EPM5128 or the EPM5130 manufactured by the ALTERA Corporation may be used to implement the digital logic of FIG. 14*f*. The ALTERA Corporation MAX+PLUS AHDL software implements the logic elements of FIG. 14*f* as well as the state machine functions of Appendix E.

Referring to FIGS. 4, 14*a*, 14*b* and 14*c*, interface circuit 120 also includes an eight bit binary counter 284 which provides a negative going pulse whenever the counter 284 reaches the hex word FF. Eight bit binary counter 284 is reset to a count of zero whenever a logic zero is supplied to its /CCLRN input from AND gate 282. AND gate 282, in turn, transitions to the logic zero state whenever a negative reset signal (NRESET) from inverter 256 is supplied to the first input of AND gate 282 or the clear signal from bit sync circuit 260 is supplied to the second input of AND gate 282. Bit sync circuit 260 supplies the inverted 320 kHz clock signal to counter 284 clocking circuit 284 until an overflow error occurs. When 256 consecutive clock pulses are provided to counter 284 without counter 284 being reset, counter 284 will clear D-type Flip-Flop 280 resulting in the Q output of Flip-Flop 280 transitioning to the logic zero state. This logic zero is supplied via the NBS_ERR output of interface circuit 120 to the P22 input of microprocessor 20 indicating to microprocessor 20 that the missile telemetry data interface circuit is not receiving PCM telemetry data.

Interface circuit 120 also includes an AND gate 290 which receives at its first input an NPAM_SYN signal from microprocessor 70 and at its second input an NPCM_SYN signal from microprocessor 20. When either the NPAM_SYN signal or the NPCM_SYN signal is active, that is at the logic zero state, the output of AND gate 290 will transition to the logic zero state indicating the presence of a sync signal. This signal is supplied through the FRA_SYN output of interface circuit to the missile subsystem test set.

Referring to FIGS. 3*a*, 4, 14*a*, 14*b*, 14*c* and 14*g* interface circuit 120 receives a 256 kHz clock signal from a clock signal generator 132. This 256 kHz clock signal is supplied through the 256 KHZ input of a PAM signal processing circuit 294 to the 256 KHZ_O output of circuit 294 and then to a divide-by-ten circuit. The divide-by-ten circuit which comprises a decade counter 295, a Flip-Flop 296 and a pair of inverters 297 and 299 divides the 256 kHz clock signal by a factor of ten. This results in a 25.6 kHz signal at the 25_6 KHZ output of interface circuit 120. The 25.6 kHz is inverted by an inverter 135 and is then output from missile telemetry data interface circuit via connector MJ5, Pin 24.

The 256 kHz clock signal from clock signal generator 132 is also supplied to the CLK input of Synchronous 4-Bit Decade counter 292 which divides the signal by ten resulting in a 25.6 kHz clock signal. This signal is inverted by inverter 293 and then supplied through the NLDAC output of interface circuit 120 to the _LDAC (load digital-to-analog converter) input of digital-to-analog converter 38. This 25.6 kHz clock signal provided by interface circuit 120 is next supplied to the _LOAD input of digital-to-analog converter 38 which then converts the digital words to its equivalent analog signal at a frequency of 25.6 kHz.

The 256 kHz clock signal is supplied to the clock input of a Synchronous 4-Bit Decade counter 300 which divides the signal by five resulting in a 51.2 kHz signal at the QC output of counter 300. This 51.2 kHz signal is inverted by an inverter 302 and then supplied to the CLK input of a D-type Flip-Flop 304. The Q output of Flip-Flop 304 is connected to the input of inverter 306 which has its output connected to the D input of Flip-Flop 304 so that Flip-Flop 304 functions as a toggle Flip-Flop. Flip-Flop 304 divides the 51.2 kHz signal resulting in a 25.6 kHz signal at the Q output of Flip-Flop 304. This 25.6 kHz signal occurring at the Q output of Flip-Flop 304 has a fifty percent duty cycle.

The 25.6 kHz signal at the Q output of Flip-Flop 304 is supplied to the input of an inverter 312 which inverts the signal and provides the inverted 25.6 kHz signal to the clock input of a Flip-Flop 318. The 25.6 kHz signal clocks the logic zero at the D input of Flip-Flop 318 to its Q output. The logic zero signal (PAM_CLK) is supplied by interface circuit 318 to the _INT2 input of microprocessor 70 indicating the presence of a PAM channel to be processed by microprocessor 70. It should be noted that this logic zero PAM_CLK signal occurs immediately following beginning the beginning of a PAM channel.

Microprocessor 70 responds with a signal PC_INT_CLR (pam clock interrupt clear) which is supplied to the PC_INT of interface circuit 120. This PC_INT_CLR signal which is a logic one is supplied to the first input of a NOR gate 316 resulting in a logic zero at the output of NOR gate 316. The logic zero occurring at the output of NOR gate 316 is supplied to the preset input of Flip-Flop 318 presetting the Q output of Flip-Flop 318 to the logic one state allowing Flip-Flop 318 to again interrupt microprocessor 70.

The PAM signal processing circuit 294 also includes a an eight bit binary counter 320 which provides a negative going pulse whenever the counter 320 reaches the hex word FF (decimal count 256). Whenever the NRESET signal from inverter 256 transitions to the logic zero state the output of AND gate 310 will transition to the logic zero state. Eight bit binary counter 320 is then reset to a count of zero whenever this logic zero is supplied to its /CCLRN input from AND gate 310. Eight bit binary counter 320 is also reset by a negative going clear pulse generated by a negative edge detect circuit 308 which is supplied to AND gate 310. The negative going pulse (NNO_DATA) generated by counter 320 occurs whenever counter 320 reaches a count of 256 is supplied to the FSX1 input of microprocessor 70 indicating to microprocessor 70 that a PAM data stream is not being received by missile telemetry data interface circuit. When the clear_out output of negative edge detect circuit 308 remains at the logic one state counter 320 will reach a count of FF (hexadecimal) resulting in the overflow condition which generates the NNO_DATA negative going pulse. It should be noted that this condition will not occur when a sixty four channel PAM frame of PAM data since the window comparator circuit of FIG. 7 will provide at least one negative going NPAM_TRANS pulse every frame of PAM data.

Figure 7:
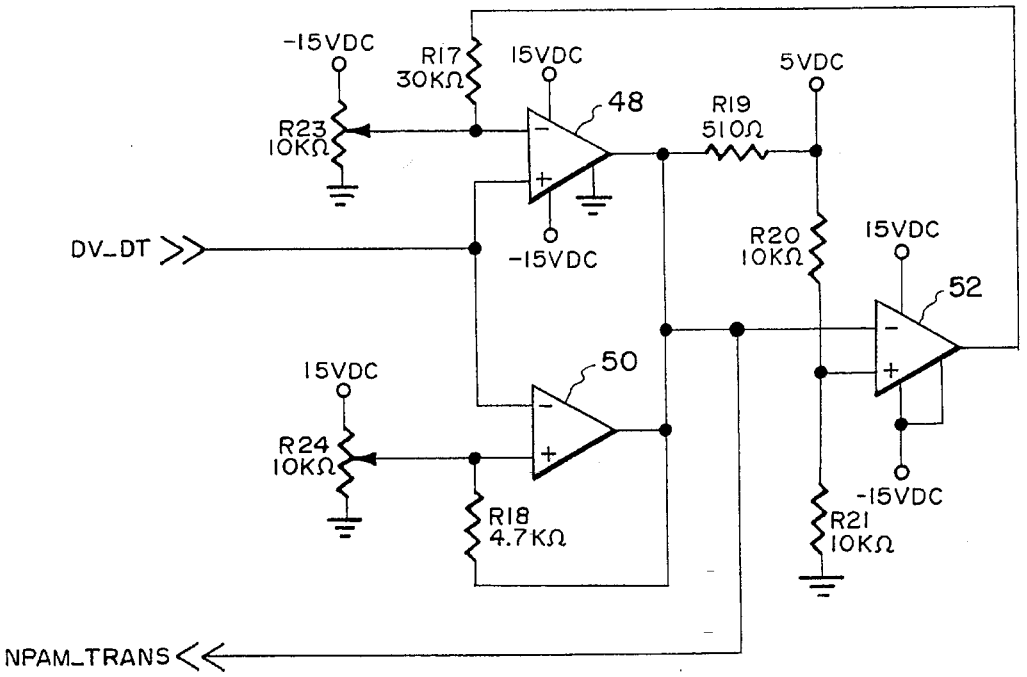
FIG. 7 illustrates a window comparator circuit used in the present invention.
Figure 2:
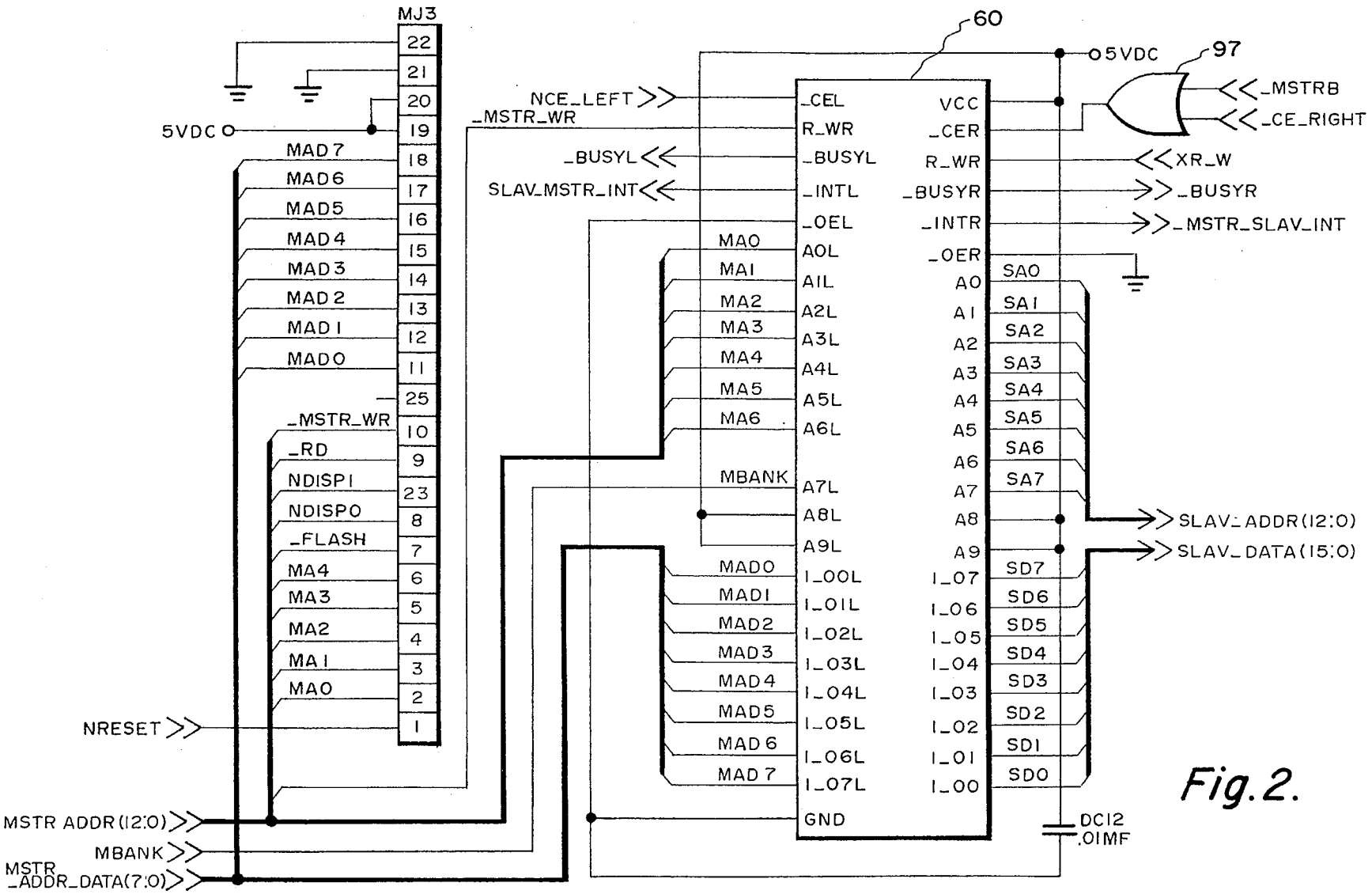
FIG. 2 illustrates the dual port RAM used in the present invention.

Referring to FIGS. 1*b*, 3*a*, 7, 8, 13, 14*g* and 14*i*, the circuit illustrated in FIG. 7 is used to identify channel edges in the incoming PAM telemetry data stream. Low pass bessel filter 121 includes an operational amplifier 128 which functions as a differentiating circuit providing a derivative with respect to time of the input signal. Operational amplifier 128 provides at the DV_DT output of filter 121 an analog output voltage signal which is proportional to the rate of change of the input voltage which is the filtered analog PAM data signal provided by filter 121. The analog output voltage signal (DV_DT) from operational amplifier 126 is supplied to the window comparator circuit of FIG. 7. The window comparator circuit of FIG. 7, in turn, comprises operational amplifiers 48, 50 and 52.

When a voltage spike of the analog output voltage signal (DV_DT) exceeds +2 VDC or −2 VDC the window comparator circuit of FIG. 7 will provide a negative going pulse at its NPAM_TRANS output. This negative going pulse, which is a TTL compatible signal, is then supplied through the NPAM_TRANS input of PAM signal processing circuit 294 to the npam_trans input of negative edge detect circuit 308. It should be noted that the negative going pulse provided by the window comparator circuit of FIG. 7 is greater than one clock cycle wide of the 256 kHz clock signal. It should also be noted that this negative going pulse is used to define boundaries of channels of the incoming PAN telemetry data stream.

Counter 300 and Flip-Flop 318 are cleared by the negative going clear pulse signal provided to counter 300 and Flip-Flop 318 by negative edge detect circuit 308. As shown in FIG. 14*i* negative edge detect circuit 308 includes a state machine 322 and a two input NAND gate 324. The ALTERA Corporation MAX+PLUS AHDL software is used to implement the state machine functions of state machine 322 as set forth in Appendix D.

State machine 322 is a three state state machine having states s0, s1 and s2. State machine 322 is clocked by the 256 kHz clock signal which is supplied to the 256 kHz input of state machine 322 and is cleared by the negative reset signal (NRESET) from inverter 256. When state machine 322 is in state s0, clear_out is zero. When state machine 322 is in state s1 clear_out is at a logic one state. When state machine 322 is in state s2, clear_out is again zero. State machine is clocked by the 256 kHz clock signal supplied to its 256 kHz input. When state machine 322 is in state s0, a logic one at the npam_trans input of state machine 322 will result in state machine remaining in state s0. When, however, the npam_trans input of state machine 322 transitions to the logic zero state, the 256 kHz clock signal will clock state machine 322 to state s1. If the npam_trans input of state machine 322 remains at zero than the 256 kHz clock signal will clock state machine 322 to state s2. The state machine 322 will remain in state s2 until the npam_trans input of state machine 322 again transitions to the logic one state. The 256 kHz clock signal will then clock state machine 322 to its initial state which is state s0. The transition of state machine from state s0 through state s1 to state s2 results in the generation of a positive going pulse signal at the clear_out output of state machine 322.

This positive going pulse signal from the clear_out output is next supplied to NAND gate 324 which gates the positive going pulse signal with the 256 kHz clock signal to provide the negative going clear pulse which is supplied to AND gate 282. This negative going pulse signal has a pulse width of about one half the clock cycle of the clock signal of the 256 kHz. Thus, the negative going pulse occurring at the clear_out output of negative edge detect circuit 308 is now less than one clock pulse cycle wide of the 256 kHz clock signal.

It should be noted that state machine 322 will return to state s0 from state sl if the npam_trans input of state machine 322 is at the logic one state. It should also be noted that the signal appearing at the npam_trans input of state machine 322 indicates the occurrence of a transition in the PAM data stream.

Slave microprocessor 70 generates a negative going pulse signal (NSLV_WDI) at its XF1 output which is supplied to the PRN input of a D-type Flip-Flop 314. In a like manner, master microprocessor 20 generates a negative going pulse at its P12 output which is supplied to the CLRN input of a D-type Flip-Flop 314. A logic zero occurring at the PRN input of D-type Flip-Flop 314 will cause the Q output of Flip-Flop 314 to transition from the logic zero state to the logic one state, while a logic zero occurring at CLRN input of D-type Flip-Flop 314 will cause the Q output of Flip-Flop 314 to transition from the logic one state to the logic zero state. These logic state transitions or edges are supplied to WDI input of timer 176 so that timer signal 176 will not generate the RESET_IN signal. Whenever timer 176 generates a RESET_IN signal, this signal is supplied to the RESET_IN input of interface circuit 120. The RESET_IN signal is inverted by inverter 254 to a logic one state passing through OR gate 252 to the RESET output of interface circuit 120. The logic signal passing through OR gate 252 is also supplied to the input of inverter 256 which inverts the signal to a logic zero NRESET signal. The logic zero NRESET signal is supplied to the NRESET input of PAM signal processing circuit 294, the NRESET input of bit sync circuit 260, the PRN input of D-type Flip-Flop 280 resulting in the Q output of Flip-Flop 280 being preset to a logic one state and the first input of AND gate 282. The NRESET signal from interface circuit 120 is supplied to microprocessor 70 resetting microprocessor 70, while the RESET signal from interface circuit 120 is supplied to microprocessor 20 resetting microprocessor 20.

Front panel 200 has a reset push button 214 which supplies a logic zero EXT_RST signal through the EXT_RST input of interface circuit 120 to OR gate 252 allowing an operator to reset missile telemetry data interface circuit.

Referring to FIGS. 4 and 14*h*, interface circuit 120 includes a USART wait circuit 330 which comprises a USART wait state machine 332 and an AND gate 334. The ALTERA Corporation MAX+PLUS AHDL software is used to implement the state machine functions of state machine 332 as set forth in Appendix F.

Referring to FIGS. 3*a*, 4, 5*b* and 14*h*, three line to eight line decoder 92 will provide at its _Y6 output a logic zero (SLV_NUSART) when its G1, B and C inputs are high and its _G2A, _G2B and A inputs are low. This logic zero is supplied to the D input of Flip-Flop 94 and then clocked through Flip-Flop 94 by the sixteen megahertz clock signal occurring at the H1 output of microprocessor 70. This logic zero will next pass through OR gate 104 when the master strobe signal occurring at the _MSTRB output of microprocessor 104 is at the logic zero state resulting in a logic zero chip enable (_CE) at the output of OR gate 104.

The logic zero chip enable occurring at the output of OR gate 104 is provided to an inverter 131 which inverts the signal. The inverted chip enable signal is supplied to the clock input of Flip-Flop 133 clocking the logic one at the D input of Flip-Flop 133 to its Q output. This logic one signal (_XRDY) is supplied to the _XRDY input of microprocessor 70 resulting in microprocessor 70 suspending the transmission of data (SD)-SD15) via the SLAV_DATA(15:0) bus to the D0–D7 inputs of universal synchronous asynchronous receiver 140.

The logic zero chip enable occurring at the output of OR gate 92 is provided to the _gnu_usart_ce input of state machine 332. State machine 332 is clocked by the 32 MHz clock signal. When the signal occurring at the _gnu_usart_ce input of state machine 332 is one then state machine remains at state s0. When the signal occurring at the _gnu_usart_ce input of state machine 332 transitions to zero than the 32 MHz clock signal will clock state machine 332 from state s0 through states s1, s2, s3, s4, s5, s6, s7, s8, s9 and s10 to state s11. At state s11 the _xrdy output of output will transition to a logic zero which is then supplied through AND gate 334 to the clear input of Flip-Flop 133 clearing the Q output of Flip-Flop 133 to the logic zero state. This logic zero is supplied to the _XRDY input of microprocessor 70 indicating to microprocessor 70 that microprocessor 70 may transmit data to universal synchronous asynchronous receiver 140.

Referring to FIGS. 1*a*, 1*b*, 2, 3*a*, 3*b*, 14*a*, 14*b*, 14*c* and 14*j*, interface circuit 120 includes a decoder circuit 340. Decoder circuit 340 has a three line to eight line decoder 342 which receives the signal HI_IO, address signals MA4, MA5 and MA6 from microprocessor 20 as well as IO_DPRAM from microprocessor 20 via latch 24. In addition, decoder circuit 340 receives a write signal at its NWR input and a read signal at its NRD input. It should be noted that the NP36WR of interface circuit 120 receives the write signal which is identified as _MSTR_WR in FIG. 4. Microprocessor 20 provides the write signal and the read signal each of which are logic zero signals.

When, for example, microprocessor 20 provides the write signal to the first input of an OR gate 344 and the Y0N output of three line to eight line decoder 342 is at the logic zero state the output of OR gate 344 will transition to the logic zero state. This logic zero is supplied to the _CS (chip select) input of digital-to-analog converter 38 enabling digital-to-analog converter 38.

When either the read signal or the write signal from microprocessor 20 is at the logic zero state, a logic one is provided at the output of NAND gate 30 which results in a logic zero at the output of NAND gate 32. This logic zero is supplied to OR gates 34 and 36 enabling OR gates 34 and 36. When OR gate 36 is enabled and the Y1N output of three line to eight line decoder 342 is at the logic zero state this logic zero will pass through OR gate 36 to the _CE input of universal synchronous asynchronous receiver transmitter 26 enabling transmitter 26. When OR gate 34 is enabled and the IO_DPRAM signal from latch 24 is at the logic zero state a logic zero NCE_LEFT signal is provided at the output of OR gate 34. This logic zero is supplied to the _CEL input of dual port RAM 60 enabling the left side data and address inputs and outputs which allows microprocessor 20 to communicate with the left side of dual port RAM 60.

In a similar manner, microprocessor 70 uses three line to eight line decoder 92 to provides an enable signal (_CE_RIGHT) to enable the right side of dual port RAM 60. Three line to eight line decoder 92 provides at its _Y2 output a logic zero which passes through an OR gate 97 to the _CER input of dual port RAM whenever the master strobe signal from microprocessor 70 is at the logic zero state.

Figure 13:
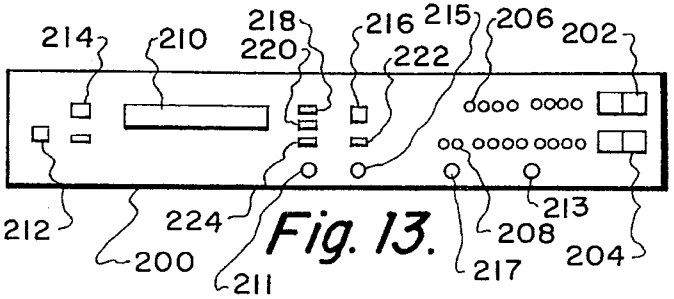
FIG. 13 illustrates the front panel of the present invention.
Figure 10:
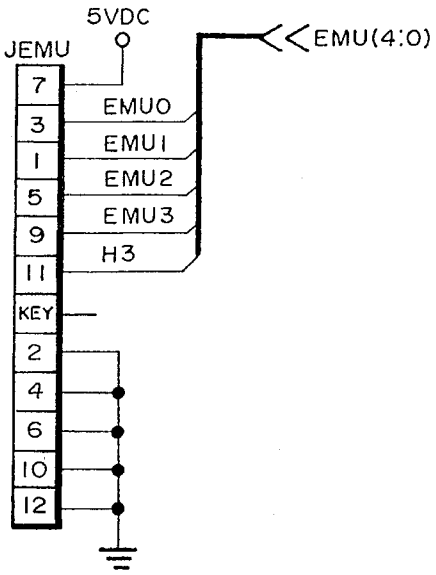
FIG. 10 illustrates a second signal connector used in the present invention.
Figure 9:
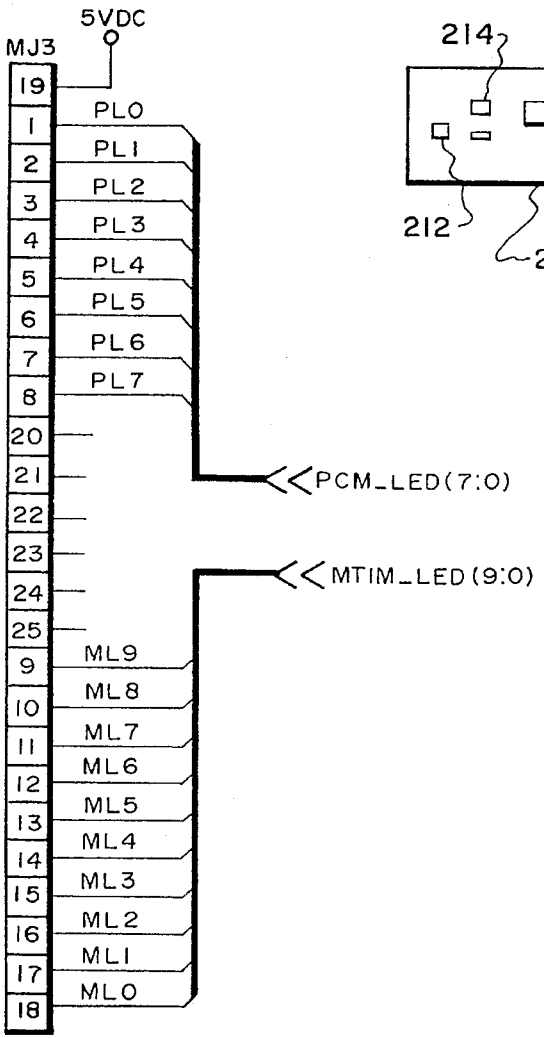
FIG. 9 illustrates a first signal connector used in the present invention.
Figure 12:
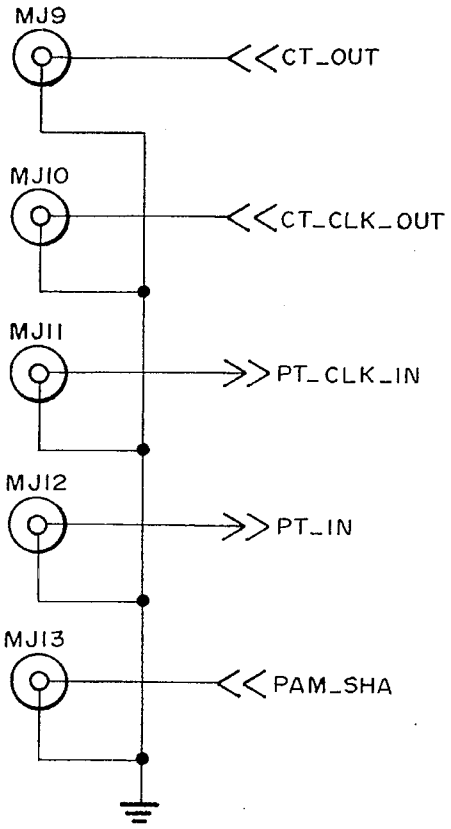
FIG. 12 illustrates a fourth signal connector used in the present invention.
Figure 11:
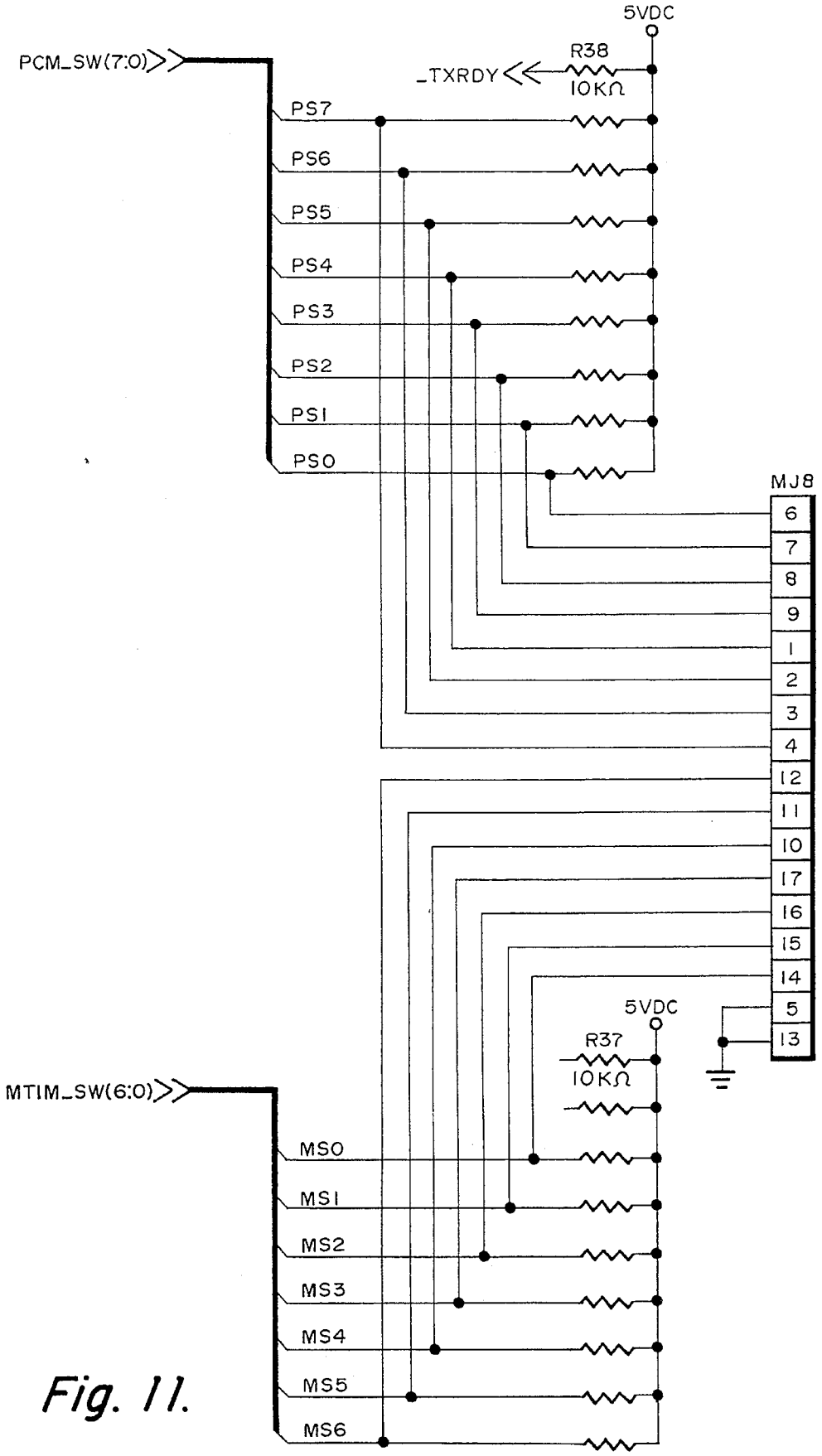
FIG. 11 illustrates a third signal connector used in the present invention.

Decoder circuit 340 also provides a pair of logic zero signals NDISP0 and NDISP1 which are enable signals for the alpha numeric display 210 of front panel 200 (FIG. 13).

Referring to FIGS. 1*a*, 1*b*, 2, 3*a*, 3*b*, 4, 6*a* and 13 and the software of Appendix C, microprocessor 20 enters its main program at line 233 (MAIN PROCESSING). At lines 265–269, microprocessor 20 is checking for plain text PCM telemetry data, that is PCM telemetry data which is not provided by an encryption unit. The PT_CT output of microprocessor 20 is first set to the logic one state followed by a 10 millisecond delay. Microprocessor 20 than waits from an interrupt from USART 26.

When the USART 26 recognizes a frame synchronization pattern of the incoming PCM data stream, the USART 26 asserts an interrupt via its _RX_RDY output to the P32 input of microprocessor 20. At line 269 of the software of Appendix C, microprocessor 20 test the interrupt from USART 26. If the interrupt is not set a jump occurs to line 308. The PT_CT line (P21 output of microprocessor 20) is set to a logic zero. Setting the PT_CT line to a logic zero gates the PCM telemetry data stream and the clock signal from the encryption unit, i.e. a KGR-68 encryption unit to USART 26.

Microprocessor 20 also will respond to a message from the slave microprocessor 70 indicating that microprocessor 70 has detected a PAM synchronization signal.

When microprocessor 20 detects an interrupt from USART 26, microprocessor 20 sets a variable MASTER_MODE (line 271 of Appendix C). Microprocessor 20 next sets its P23 output to a logic zero resulting in a logic zero being supplied to the A0 input of analog multiplexer 170 which allows PCM telemetry data to pass through multiplexer 170 to output buffer 172.

At line 273 a subroutine ACQUIRE_PCM_BANK0 is called. During this subroutine, the one hundred eight bit words of PCM data from a frame of the PCM data stream are placed in Bank 0 of dual port RAM 60. It should be noted that USART 26 converts each eight bit word of the PCM data stream from a serial format to a parallel format generating an interrupt for each eight bit word of the PCM data stream. Microprocessor 20 then reads the data from USART 26.

Microprocessor 20 first polls or monitors the _RX_RDY line for an interrupt from USART 26 until word 93 is reached. When word 93 is reached, microprocessor 20 responds to the interrupt from USART 26 exiting the interrupt mode and entering a polling mode.

When USART 26 first detects the frame sync of the PCM data stream, microprocessor 20 will re-initialize USART 26 allowing USART 26 to again look for the synchronization pattern of the PCM data stream which occurs once for each frame of PCM data. During the 10 millisecond delay four frame of PCM data may be supplied to USART 26.

It should be noted that USART 26 recognizes the first and second eight bit words of the three word synchronization pattern of the PCM data stream. The third eight bit word of the three word synchronization pattern is supplied to microprocessor 20 which then checks the third word for a match of the bit pattern for the third word. The PCM data from the first frame is now stored in bank 0 of dual port RAM 60.

At line 873 MBANK is cleared, while MBANK_STAT is cleared at line 874 of the ACQUIRE_PCM_BANK0 subroutine. The signal MBANK is the control signal provided to the A7L input of dual port RAM 60 which allows master microprocessor 20 to access BANK 0 and BANK 1 of dual port RAM 60. BANK 0 of dual port RAM 60 is accessed when the signal MBANK is cleared.

Register one of microprocessor 20, which is a pointer to the first address within dual pointer, is initialized to zero at line 877. The ACQUIRE_PCM_BANK0 subroutine then enters a loop writing the 100 words of the first frame of PCM data into bank 0 of dual port RAM 60. At line 880 of the ACQUIRE_PCM_BANK0 subroutine a 30 microsecond timeout is initialized. If microprocessor 20 does not receive an interrupt from USART 26 within 30 microseconds, microprocessor 20 returns to the main program unless the mode of operation is the calibrate mode which results in an error message being displayed on dot matrix alpha numeric display 210 of front panel 200.

When microprocessor 20 is in an interrupt mode of operation, microprocessor 20 responds to an a logic interrupt from the _RX_RDY output of USART 26. Microprocessor 20 transitions to the interrupt after PCM word 93. At line 893 of the Appendix C, microprocessor 20 moves to USART_ISR.

At line 275 of MAIN_PCM_LOOP the watch dog timer 176 is reset when PCM data is written alternatively into bank 0 and then bank 1 of dual port RAM 60. At line 277 a check is made to determine if slave microprocessor 70 supplied a message to master microprocessor 20. If the message is not "Display Data Select Error" then a jump occurs to line 285 (CHECK_PCM_USART_ISR_FLAGS). If PCM synchronization is not confirmed then a jump occurs at line 286. It should be noted that PCM words 98, 99 and 100 comprise the PCM frame sync words.

When PCM synchronization is confirmed, then a flag PCM_VERIFIED is cleared. At line 290, the message "PROCESSING PCM" is pointed to for display on the alpha numeric display 210 of front panel 200, while at line 293 the message "PROCESSING STM" is pointed to for display on the alpha numeric display 210 of front panel 200. STM data is secured telemetry data. At line 295, a routine "DISPLAY_PCM_OR_STM" for displaying the selected message is called.

At line 296, microprocessor 20 checks for a PCM frame error, that is a flag indicating a frame error has been set. If the flag has been set a jump to "MAIN_PROCESSING" occurs at line 299 re-initializing the search for telemetry data. The frame error occurs, for example, when word 99 of the PCM telemetry data stream does not match the PCM word microprocessor 20 expects to receive, that is there is an error in the frame sync.

At lines 303–304, a check is made to determine if there is a loss of PCM data. A logic zero is supplied via the NBS_ERR output of interface circuit 120 to the P22 input of microprocessor 20 indicating to microprocessor 20 that the missile telemetry data interface circuit is not receiving PCM telemetry data which, in turn, sets a flag NO_PCM data. The NO_PCM flag is cleared at line 305 of Appendix C.

Microprocessor 20 first checks for a PCM data frame sync and then checks for a message from microprocessor 70 indicating that microprocessor 70 has detected a PAM synchronization signal beginning at line 315. At line 347 the main program checks the hold/index push button 216 on front panel 200 to determine whether the operator has activated the push button 216. If the push button 216 has been activated and any errors occurred during calibration, then the appropriate error messages are displayed via dot matrix alpha numeric display 210 of front panel 200. If an error did not occur the message "PASSED SELF TEST" is displayed via dot matrix alpha numeric display 210 of front panel 200. When error occurs during calibration, the software of Appendix C jumps to line 359 LIST_SELF_TEST_ERRORS. From line 360 to line 434 of Appendix C, the self test errors are displayed on dot matrix alpha numeric display 210 of front panel 200. These error messages include MASTER_RAM_ERROR, MASTER_DPRAM_ERROR, MASTER_PAM_CLK_ERROR (25.6 kHz clock signal), MASTER_PCM_CLK_ERROR (320 kHz clock signal) and the remaining error messages set forth at lines 360–434 of Appendix C.

When slave microprocessor 70 detects the PAM synchronization signal, then master microprocessor 20 displays the message "PROCESSING PAM" via dot matrix alpha numeric display 210 of front panel 200 (line 317 of Appendix C). Microprocessor 20 also sends an acknowledgement message "PAM mode" to microprocessor 70 which indicates to microprocessor 70 that microprocessor 70 is to begin processing PAM data. Microprocessor 20 also sets its P23 output high (PAM_PCM line) which allows PAM data from filter 121 to pass through multiplexer 170 to output buffer 172.

At line 325 microprocessor enter the main program loop for processing PAM data. At line 326 the HOUSEKEEPING subroutine is called which is used to reset the watch dog timer 176. At line 327 messages from microprocessor 70 are read by microprocessor 20. Microprocessor 20 first checks to see if the message is a "PAM sync lost" message which is a message slave microprocessor 70 sends to master microprocessor 20 indicating that PAM frame sync has been lost by microprocessor 70 (see Appendix B). Microprocessor 20 then checks for "data select error" message from microprocessor 70 which results when the operator selects a number outside of the PAM data channel range of from 1 to 64 while in the PAM mode of operation. If neither of these messages are supplied to microprocessor 20 to microprocessor 70 then a loop occurs to line 325 "MAIN_PAM_LOOP".

When a PAM sync lost message is received by master microprocessor 20 (line 328), the OPCODE for the message is cleared and the program of Appendix C returns to MAIN_PROCESSING (line 233).

When the data byte of the "Display data select error" from microprocessor 70 is a one then slave microprocessor 70 is indicating to microprocessor 20 that an error has been detected by microprocessor 70. When the data byte of the "Display data select error" from microprocessor 70 is a zero then slave microprocessor 70 is indicating to microprocessor 20 that the error has been corrected.

At line 1224 of Appendix C, the software enters a SEND_MESSAGE routine. Microprocessor 20 first checks the variable MASTER_MODE to see if the interface circuit is operating in PCM mode. If microprocessor 20 is not in PCM mode then a jump occurs to SEND_MSG at line 1236 of Appendix C. For master microprocessor 20 to send a message to microprocessor 70 output P30 of microprocessor 20 must be at the logic one state. Dual port RAM 60 requires a logic one at its A7L input to enable the communications interrupt from microprocessor 20 to microprocessor 70. When the master microprocessor 20 writes the data byte to the 3FC Dual Port RAM address and the opcode to the 3FF Dual Port RAM address, the _INTR output of dual port RAM 60 is asserted low indicating to slave microprocessor 70 that a message will be sent from master microprocessor 20 to slave microprocessor 70. It should be noted that the opcode 3FF generates the interrupt to the slave microprocessor 70. In a like manner, the slave microprocessor 70 writes the data byte to the 3FD Dual Port RAM address and the opcode to the 3FE Dual Port RAM address, dual port RAM 60 generates a logic zero interrupt at its _INTL output which is supplied to the P33 input of microprocessor 20. The toggling function which is used to write PCM data into bank 0 and bank 1 of dual port RAM 60 is controlled during the interrupt service routine for USART 26.

Beginning at line 1251 of Appendix C, there is a routine SIMULATE_PAM which generates simulated PAM data which is used to test analog to digital converter 88 and all PAM data processing functions. Beginning at line 1379 of Appendix C, there is routine INIT_USART which initializes USART 26. At line 1424 of Appendix C, the software enters the USART 26 interrupt service routine (USART_ISR) during which microprocessor 20 monitors the _RX_RDY line from USART 26 for interrupts. During this routine the master microprocessor 20 is processing the one hundred words of a frame of PCM data.

Microprocessor 20 is a Model 8751H 8-Bit Microcomputer commercially available from Intel Corporation of Santa Clara, Calif. Microprocessor 70 is a Model TMS320C30 Microcontroller commercially available from Texas Instruments of Dallas, Tex. Dual Port RAM 60 is a Model IDT130SA35P Dual Port RAM commercially available from Integrated Device Technology Incorporated of Santa Clara, Calif. Universal synchronous asynchronous receiver transmitters 26 and 140 are each Model SCN2651 USARTS commercially available from Signetics Company of Sunnyvale, Calif. Digital-to-analog converter 38 is a Model PM-7224 eight bit D/A converter commercially available from Analog Devices PMI Division of Norwood, Mass. Analog to digital converter 88 is a Model AD7878 12 bit A/D converter commercially available from Analog Devices PMI Division of Norwood, Mass. Analog track-hold circuit 162 is a Model AD389 Track-and-Hold Amplifier commercially available from Analog Devices PMI Division of Norwood, Mass.

From the foregoing, it may readily be seen that the present invention comprises a new, unique and exceedingly useful missile telemetry data interface circuit which constitutes a considerable improvement over the known prior art. Obviously, many modifications and variations of the present invention are possible in light of the above teachings. It is therefore to be understood that within the scope of the appended claims the invention may be practiced otherwise than as specifically described.

Navy Case No. 77,062

Appendix A

```
/* newmtim.h */

#ifndef _NEWMTIM
#define _NEWMTIM

#include "pcm.h"
/*#include "globals.h"  *** placed later in file ***/

/* misc. stuff */
#define OR ||        /* LOGICAL 'or' !!!!!!! */
#define or ||
#define AND && /* LOGICAL 'and' !!!!!!!! */
#define and &&
#define NUMBER_OF_PAM_CHANNELS 64

/* sampling stuff */
/*#define ZERO_PERCENT_THRESHOLD      0x00000333 /* >=  1.2 volts */
/*#define HUNDRED_PERCENT_THRESHOLD   0xFFFFFCCD /* <= -1.2 volts */
/*#define FIFTY_PERCENT_TOLERANCE     0x000000CD /* 0.3 volt (either side of 0v) */
#define ZERO_PERCENT_THRESHOLD      0x00000377 /* >=  1.3 volts */
#define HUNDRED_PERCENT_THRESHOLD   0xFFFFFC89 /* <= -1.3 volts */
#define FIFTY_PERCENT_TOLERANCE     0x000000CD /* 0.3 volt (either side of 0v)*/

/* GNU USART */
#define GNU_USART_RCVE_XMIT_ADD   0x800E00
#define GNU_USART_STATUS_SYN_ADD  0x800E01
#define GNU_USART_MODE_REGS_ADD   0x800E02
#define GNU_USART_COMMAND_REG_ADD 0x800E03

/* I/O stuff */
#define INPUT_PORT_ADD    0x800D00  /* "800DXXh" on schematic. */
#define MTIM_LED_OUT_ADD  0x800C00 /* "800CXXh" on schematic */
#define PCM_LED_OUT_ADD   0x800B00  /* "800BXXh" on schematic */
#define MTIM_CHAN_OUT_ADD 0x800900 /* "8009XXh" on schematic */
#define MTIM_DATA_OUT_ADD 0x800800 /* "8008XXh" on schematic */

/* timer0 stuff */
#define TIMER0_GLOBAL_CTRL_REG 0x808020
#define TIMER0_COUNT_REG       0x808024
#define TIMER0_PERIOD_REG      0x808028
#define START_TIMER0           0x2C0
#define STOP_TIMER0            0x200
#define SETUP_TIMER0           0x200

/* timer1 stuff */
#define TIMER1_GLOBAL_CTRL_REG 0x808030
#define TIMER1_COUNT_REG       0x808034
#define TIMER1_PERIOD_REG      0x808038
#define START_TIMER1           0x2C0
#define STOP_TIMER1            0x200
#define SETUP_TIMER1           0x200

/* ADC stuff */
#define ADC_STAT_CNTRL_ADD  0x804001
#define ADC_FIFO_OUT_ADD    0x804000
#define ADC_BUSY            0x00000080
```

Navy Case No. 77,062

```
57    #define WAIT_BEFORE_SAMPLE  100 /* Delay to allow PAM signal to settle out in
58                                     channel period. 12.5 microseconds
59                                     (100 = 12.5uS / 125nS)  */
60    #define RESET_ADC   0x040
61
62    /* Interprocessor comm.s stuff */
63    #define T_MESS_OPCODE_ADD   0x800AFE
64    #define T_MESS_DATA_ADD     0x800AFD
65    #define R_MESS_OPCODE_ADD   0x800AFF
66    #define R_MESS_DATA_ADD     0x800AFC
67
68    /* opcodes: Master-to-Slave */
69    #define TEST_NON_TM_FUNCTIONS          0x01
70    #define SEND_NON_TM_FUNCTION_STATUS    0x02
71    #define DAC_ADC_TEST_1                 0x11
72    #define DAC_ADC_TEST_2                 0x13
73    #define DAC_ADC_TEST_3                 0x15
74    #define CALIBRATE_PAM                  0x21
75    #define SEND_PAM_CALIBRATION_STATUS    0x22
76    #define CALIBRATE_PCM                  0x24
77    #define SEND_PCM_CALIBRATION_STATUS    0x25
78    #define OUTPUT_50_PERCENT              0x30
79    #define SEARCH_FOR_PAM_SYNC            0x40
80    #define PAM_MODE                       0x42
81    #define PCM_MODE                       0x50
82    #define PROCESS_DPRAM_BANK_0           0x51
83    #define PROCESS_DPRAM_BANK_1           0x52
84    #define BEGIN_DISPLAY_TEST             0x60
85    #define STOP_DISPLAY_TEST              0x61
86    #define SWITCH_CALIBRATE_OUTPUT        0x80
87    #define PREPARE_TO_CALIBRATE           0x90
88    #define TEST_GNU_USART                 0x100
89
90    /* opcodes: Slave-to-Master */
91    #define NON_TM_FUNCTION_STATUS         0x03
92    #define DAC_ADC_TEST_1_STATUS          0x12
93    #define DAC_ADC_TEST_2_STATUS          0x14
94    #define DAC_ADC_TEST_3_STATUS          0x16
95    #define CALIBRATE_PAM_TEST_STATUS      0x23
96    #define CALIBRATE_PCM_TEST_STATUS      0x26
97    #define PAM_SYNC_DETECTED              0x41
98    #define PAM_SYNC_LOST                  0x43
99    #define DATA_SELECTION_ERROR           0x71
100
101   /* internal RAM */
102   #define RAM0_START  0x809800
103   #define RAM0_END    0x809BFF
104   #define RAM1_START  0x809C00
105   #define RAM1_END    0x809FFF
106
107   /* DPRAM */
108   #define DPRAM_BANK0_START   0x800A00
109   #define DPRAM_BANK0_END     0x800A7F
110   #define DPRAM_BANK1_START   0x800A80
111   #define DPRAM_BANK1_END     0x800AFB /* -AFE and -AFF are for opcodes and cause
112                                           interrupts*/
113
```

Navy Case No. 77,062

```
114     /* serial port 0 */
115     #define SER0_Glob_Ctrl_Reg     0x808040 /* Serial Port 0 Global Ctrl Reg*/
116     #define SER0_XFDC_Ctrl_Reg     0x808042 /* FSX/DX/CLKX Port Ctrl Reg    */
117     #define SER0_RFDC_Ctrl_Reg     0x808043 /* FSR/DR/CLKR Port Ctrl Reg    */
118     #define SER0_RX_Tim_Ctrl_Reg   0x808044 /* R/X Timer Control Register   */
119     #define SER0_RX_Tim_Ctr_Reg    0x808045 /* R/X Timer Counter Register   */
120     #define SER0_RX_Tim_Per_Reg    0x808046 /* R/X Timer Period Register    */
121     #define SER0_X_Reg             0x808048 /* Data Transmit Register       */
122     #define SER0_R_Reg             0x80804C /* Data Receive Register        */
123
124     /* serial port 1 */
125     #define FSX_DX_CLKX_PORT_1_CNTRL_ADD 0x808052
126     #define FSR_DR_CLKR_PORT_1_CNTRL_ADD 0x808053
127     #define SER_PORT_1_GLOB_CNTRL_ADD    0x808050
128     #define RX_TIMER_CNTRL_PTR_ADD       0x808054
129     #define RX_TIMER_COUNTER_PTR_ADD     0x808055
130     #define RX_TIMER_PERIOD_PTR_ADD      0x808056
131
132     /* DMA processor */
133     #define DMA_Glob_Ctrl_Reg  0x808000 /* DMA Global Control Register  */
134     #define DMA_Src_Addr_Reg   0x808004 /* DMA Source Address Register  */
135     #define DMA_Dst_Addr_Reg   0x808006 /* DMA Destination Address Reg  */
136     #define DMA_Tran_Ctr_Reg   0x808008 /* DMA Transfer Counter Register*/
137
138     /* bus configuration */
139     #define Exp_Bus_Ctrl_Reg   0x808060 /* Expansion Bus Control Reg    */
140     #define Pri_Bus_Ctrl_Reg   0x808064 /* Primary Bus Control Reg      */
141
142     /* interrupt control */
143     #define DIS_CPU_INTS       0xFFFFF800
144     #define EN_IP_COMMS        0x00000002
145     #define DIS_IP_COMMS       0xFFFFFFFD
146     #define EN_ALFL            0x00000001
147     #define DIS_ALFL           0xFFFFFFFE
148     #define EN_PAM_CLK         0x00000004
149     #define DIS_PAM_CLK        0xFFFFFFFB
150     #define EN_TINT_0          0x00000100
151     #define DIS_TINT_0         0xFFFFFEFF
152     #define EN_TINT_1          0x00000200
153     #define DIS_TINT_1         0xFFFFFDFF
154     #define EN_GNU_USART       0x00000008
155     #define DIS_GNU_USART      0xFFFFFFF7
156
157     /* type definitions */
158     typedef enum {PAUSE,
159                 DISPLAY_TEST,
160                 CALIBRATE,
161                 PAM,
162                 PCM,
163                    TEST_GNU_COMMS} Modes;
164
165     typedef enum {WAIT,
166                 PAM_CLOCK_TEST,
167                 TEST_CLOCK_TEST,
168                 DPRAM_TEST,
169                 INTERNAL_RAM_TEST,
170                 R_AR_TEST,
```

Navy Case No. 77,062

```
171                 READBACK_LATCH_TEST,
172                 CAL_PAM,
173                 CAL_PCM,
174                 DAC_ADC_TEST,
175                 FIND_PAM_SYNC} Calibrate_states;
176
177     typedef enum {LOST_SYNC,
178                 FIRST_SYNC,
179                 IN_SYNC,
180                 LOST_FIRST} Synchronization_states;
181
182     typedef enum {NOT_SEARCHING,
183                 IDLE,
184                 FIRST_ZERO_PERCENT,
185                 FIRST_HUNDRED_PERCENT,
186                 SECOND_HUNDRED_PERCENT,
187                 THIRD_HUNDRED_PERCENT,
188                 FIFTY_PERCENT} Pam_sync_states;
189
190     typedef struct {    unsigned int data : 10;
191                 unsigned int syncst : 1;
192                 unsigned int adc_dr : 1;
193                 unsigned int mclk : 1;
194                 unsigned int track_hold : 1;} Mtim_data;
195
196     /* function declarations */
197     void c_int01(void); /* gs2.c */
198     void c_int02(void); /* interprocessor comm.s */
199     void c_int03(void); /* st3.c */
200     void c_int04(void); /* see file t02.c */
201     void c_int05(void); /* see file t02.c */
202     void c_int06(void); /* see file t02.c */
203     void c_int07(void); /* see file t02.c */
204     void c_int08(void); /* see file t02.c */
205     void c_int09(void); /* t02.c */
206     void c_int10(void); /* see file t02.c */
207     void dpramtst(void);
208     void lachtest(void);
209     void mail(void);
210     void ram_test(void);
211     void reg_test(void);
212     void send_message(unsigned int, unsigned int);
213     void send_non_tm_cal_readings(void);
214     void send_pcm(unsigned int, unsigned int);
215
216     #include "globals.h"
217
218     #endif
```

Navy Case No. 77,062

```
1    /* globals.h */
2
3    #ifndef _GLOBALS
4    #define _GLOBALS
5
6    /* GNU USART */
7    extern unsigned int *gnu_usart_rcve_xmit_ptr;
8    extern unsigned int *gnu_usart_status_syn_ptr;
9    extern unsigned int *gnu_usart_mode_regs_ptr;
10   extern unsigned int *gnu_usart_command_reg_ptr;
11   extern int gnu_usart_test_count;
12
13   /* misc. stuff */
14   extern unsigned int calibrating_pam;
15   extern unsigned int calibrating_pcm;
16   extern unsigned int *regptr;
17   extern unsigned int simpam[];
18   extern unsigned int hex2bcd[];
19   extern unsigned int oper_cal;
20   extern unsigned int watch_dog_timer_reset;
21
22   /* push wheels stuff */
23   extern unsigned int *input_port_ptr;
24   extern int bogus_mtim_pushwheels_flag;
25   extern unsigned int pcm_pushwheels;
26   extern unsigned int pcm_pushwheels_old;
27   extern unsigned int pcm_pushwheels_temp;
28   extern unsigned int mtim_pushwheels;
29   extern unsigned int mtim_pushwheels_old;
30   extern unsigned int mtim_pushwheels_temp;
31   extern unsigned int mtim_debounce_count;
32   extern unsigned int pcm_debounce_count;
33
34   /* LED stuff */
35   extern unsigned int *mtim_led_out_ptr;
36   extern unsigned int *pcm_led_out_ptr;
37   extern unsigned int all_leds_are_on;
38
39   /* I/O stuff */
40   extern Mtim_data *mtim_data_out_ptr;
41   extern Mtim_data mtim_data_output;
42   extern unsigned int mtim_1015_or_8;
43   extern unsigned int *fsx_dx_clkx_port_1_ptr, *fsr_dr_clkr_port_1_ptr;
44   extern unsigned int *mtim_chan_out_ptr;
45
46   /* timer0 stuff */
47   extern unsigned int *timer0_period_ptr;
48   extern unsigned int *timer0_global_cntrl_ptr;
49
50   /* timer1 stuff */
51   extern unsigned int *timer1_count_ptr;
52   extern unsigned int *timer1_global_cntrl_ptr;
53   extern unsigned int *timer1_period_ptr;
54
55   /* sampling stuff */
56
57   /* ADC stuff */
```

Navy Case No. 77,062

```
extern unsigned int *adc_status_control_ptr, getting_test_adc_sample;
extern unsigned int *adc_fifo_data_out_ptr;
extern signed int pam_sample;
extern int expected_adc_out;
extern signed int zero_percent;
extern signed int hundred_percent;
extern signed int trial_zero_percent;
extern signed int trial_hundred_percent;

/* States */
extern Calibrate_states cal_state;
extern Modes mode;
extern Synchronization_states sync;
extern Pam_sync_states sync_state;

/* Self Test */
extern unsigned int pam_test_array[];
extern double test_clock_freq;
extern unsigned int test_stat;
extern unsigned int latchtest_stat;
extern unsigned int pcm_test_stat;
extern unsigned int bank_count;
extern int dac_adc_stat;
extern unsigned int pam_period_count;

/* Sync */
extern unsigned int chan_id;
extern signed int fifty_percent;

/* Interprocessor comm.s stuff */
extern unsigned int *r_mess_data_ptr, *r_mess_opcode_ptr;
extern unsigned int *t_mess_data_ptr, *t_mess_opcode_ptr;
extern unsigned int r_message_flag, r_message_opcode, r_message_data;

/* internal RAM */

/* DPRAM */

/* serial port 0 */

/* serial port 1 */

/* interrupt control */
extern unsigned int interrupt_en_cntrl;

/* PCM stuff */
extern unsigned int pcm_word[],sim_pcm[],pcm_wd[];
extern unsigned int inword, outword, gie_ctrl;
extern unsigned int scale_2_index[], scale_1_index[];
extern unsigned int pcf_1_index[];
extern unsigned int pcm_50_mask[], pcm_51_mask[];
extern unsigned int comp_index[];
extern unsigned int pass_thru_index[];
extern unsigned int index1,index2,index3;
extern unsigned int pcm_loop_counter;
extern unsigned int sent_pcm_status;
extern int comp[];
```

Navy Case No. 77,062

```
extern int paul; /* new 7/8/95 */
#endif
```

Navy Case No. 77,062

```
/* ************************************************************/
/*  pcm.h     v1.00                                          */
/*                                                           */
/*  Definitions for MTIMS Slave Command System               */
/*  Paul H. Sailer      April 17, 1995                       */
/*                                                           */
/*  ************************************************************/

#ifndef _PCM
#define _PCM

/* ************************************************************     */
/*              Define Constants                                    */
/* ************************************************************     */
#define PCM_SIZE                0x80
#define CHAN_SIZE               0x80
#define MEAN_SIZE               0x2
#define NUMER_SIZE              0xA
#define DENOM_SIZE              0xA
#define COMP_SIZE               0x20
#define DUMMY_VALUE_1           0x55
#define DUMMY_VALUE_2           0xAA

/* DUAL PORT RAM BEGINNING AND ENDING ADDRESSES (BANK 0/1)
#define BANK0_BEGIN             0x800A00
#define BANK0_END               0x800A7F
#define BANK1_BEGIN             0x800A80
#define BANK1_END               0x800AFF                */

/* 0%, 50%, and 100% thresh-hold values              */
#define ZERO_PERCENT            0x8             /* 8  decimal */
#define ONE_HUNDRED_PERCENT     0x3F7            /* 1015 decimal */
#define FTY_PERCENT      0x200          /* 512 decimal */

/* DEFINE PCF_1 & PCF_2 COUNT VALUES */
#define PCF_1_COUNT_1   0x50    /* 80 decimal */
#define PCF_1_COUNT_2   0x140   /* 320 decimal */
#define PCF_1_COUNT_3   0x240   /* 576 decimal */
#define PCF_1_COUNT_4   0x330   /* 816 decimal */
#define PCF_2_COUNT_1   0x8     /* 8 decimal */
#define PCF_2_COUNT_2   0xC0    /* 192 decimal*/
#define PCF_2_COUNT_3   0x140   /* 320 decimal */
#define PCF_2_COUNT_4   0x1E0   /* 480 decimal */

#define DMA_SER0_INT 0x00100402 /* DMA to CPU and SER0 to DMA inter */
#define GIE_BIT 0x2000        /* enable Global Interrupt Enable bit */

/* ************************************************************     */
/*  Define Functions                                                */
/* ************************************************************ */
void generate_pcm(void);
void pcm_mode(void);
void c_int11(void);
void get_pcm_words(void);
int hi_lo_out(int pcm_word,int mean);
int pcf_1(int cttb_1,int cttb_2);
int pcf_2(int cttb_1,int cttb_2);
```

Navy Case No. 77,062

```
int scale(int pcm_word,int numer,int denom);
int check_sign(int digitized_analog);
int un_2_comp(int digitized_analog, int sign);
int send_out(int result,int chan,int comp,int bit_value);
#endif
```

Navy Case No. 77,062

```
/* newmtim.c */

#include "newmtim.h"

/* GNU USART */
unsigned int *gnu_usart_rcve_xmit_ptr = (unsigned int*)GNU_USART_RCVE_XMIT_ADD;
unsigned int *gnu_usart_status_syn_ptr = (unsigned int*)GNU_USART_STATUS_SYN_ADD;
unsigned int *gnu_usart_mode_regs_ptr = (unsigned int*)GNU_USART_MODE_REGS_ADD;
unsigned int *gnu_usart_command_reg_ptr = (unsigned int*)GNU_USART_COMMAND_REG_ADD;

/*  MTIM I/O pointer declarations */
unsigned int *mtim_chan_out_ptr = (unsigned int *)MTIM_CHAN_OUT_ADD;
Mtim_data *mtim_data_out_ptr = (Mtim_data *)MTIM_DATA_OUT_ADD;
unsigned int *input_port_ptr = (unsigned int *)INPUT_PORT_ADD;
unsigned int *mtim_led_out_ptr = (unsigned int *)MTIM_LED_OUT_ADD;
unsigned int *pcm_led_out_ptr = (unsigned int *)PCM_LED_OUT_ADD;

/* serial port 1 */
unsigned int *fsx_dx_clkx_port_1_ptr = (unsigned int*)FSX_DX_CLKX_PORT_1_CNTRL_ADD;
unsigned int *fsr_dr_clkr_port_1_ptr = (unsigned int*)FSR_DR_CLKR_PORT_1_CNTRL_ADD;
unsigned int *ser_port_1_glob_cntrl_ptr = (unsigned int*)SER_PORT_1_GLOB_CNTRL_ADD;
unsigned int *rx_timer_cntrl_ptr = (unsigned int *)RX_TIMER_CNTRL_PTR_ADD;
unsigned int *rx_timer_counter_ptr = (unsigned int *)RX_TIMER_COUNTER_PTR_ADD;
unsigned int *rx_timer_period_ptr = (unsigned int *)RX_TIMER_PERIOD_PTR_ADD;


/* timer pointer declarations */
unsigned int *timer0_global_cntrl_ptr = (unsigned int*)TIMER0_GLOBAL_CTRL_REG;
unsigned int *timer0_count_ptr = (unsigned int *)TIMER0_COUNT_REG;
unsigned int *timer0_period_ptr = (unsigned int *)TIMER0_PERIOD_REG;
unsigned int *timer1_global_cntrl_ptr = (unsigned int*)TIMER1_GLOBAL_CTRL_REG;
unsigned int *timer1_count_ptr = (unsigned int *)TIMER1_COUNT_REG;
unsigned int *timer1_period_ptr = (unsigned int *)TIMER1_PERIOD_REG;

/* ADC pointer declarations */
unsigned int *adc_status_control_ptr = (unsigned int *)ADC_STAT_CNTRL_ADD;
unsigned int *adc_fifo_data_out_ptr = (unsigned int *)ADC_FIFO_OUT_ADD;

/* interprocessor comm.s pointer declarations */
unsigned int *t_mess_opcode_ptr = (unsigned int *)T_MESS_OPCODE_ADD;
unsigned int *t_mess_data_ptr = (unsigned int *)T_MESS_DATA_ADD;
unsigned int *r_mess_opcode_ptr = (unsigned int *)R_MESS_OPCODE_ADD;
unsigned int *r_mess_data_ptr = (unsigned int *)R_MESS_DATA_ADD;

/* declarations with typedefs */
Modes mode = PAUSE;
Synchronization_states sync = LOST_SYNC;
Calibrate_states cal_state = WAIT;
Pam_sync_states sync_state = NOT_SEARCHING;
Mtim_data mtim_data_output;

unsigned int chan_id = 0;
unsigned int test_stat;
unsigned int pam_period_count = 100; /* count periods in PAM clock test;4ms-worth of
                                        PAM ticks */

double test_clock_freq;
```

Navy Case No. 77,062

```
58    unsigned int r_message_opcode, r_message_data, r_message_flag;
59    int dac_adc_stat, expected_adc_out;
60
61    unsigned int pcm_word[PCM_SIZE]; /* array of scaled pcm words */
62    unsigned int pcm_wd[PCM_SIZE]; /* array of unscaled/raw pcm words */
63    unsigned int sim_pcm[PCM_SIZE]; /* array of simulated pcm words */
64    signed int pam_sample = 0;
65
66    signed int zero_percent = ZERO_PERCENT_THRESHOLD;
67    unsigned int inword,outword;
68    signed int fifty_percent = 0;
69
70    int bogus_mtim_pushwheels_flag = 0;
71    unsigned int pcm_pushwheels = 0;
72    unsigned int pcm_pushwheels_old = 0;
73    unsigned int pcm_pushwheels_temp = 0;
74    unsigned int mtim_pushwheels = 0;
75    unsigned int mtim_pushwheels_old = 0;
76    unsigned int mtim_pushwheels_temp = 0;
77    unsigned int pcm_debounce_count = 0;
78    unsigned int mtim_debounce_count = 0;
79
80    /* for DMA and serial port 0 set-up; see Paul for questions...  */
81    unsigned int *regptr;
82    unsigned int interrupt_en_cntrl = DIS_CPU_INTS;
83    unsigned int interrupt_enab_ctrl = DMA_SERO_INT;
84    unsigned int gie_ctrl = GIE_BIT;
85    unsigned int *serial_port_0_tx_ptr;
86
87    unsigned int mtim_1015_or_8, all_leds_are_on = 0;
88    unsigned int getting_test_adc_sample = 0;
89    double clock_difference;
90
91    unsigned int oper_cal = 0;
92    unsigned int calibrating_pam = 0;
93    unsigned int calibrating_pcm = 0;
94    unsigned int watch_dog_timer_reset = 0;
95
96    void main(void)
97    {
98    int temp, i, sent_lost_sync_flag = 0;
99
100   asm(" LDI 00h,ST          ; globally disable all interrupts. ");
101   asm(" LDI 00000000h,IF    ; clear all interrupt flags. ");
102   asm(" LDI @_interrupt_en_cntrl,IE   ; disable CPU interrupts individually. ");
103   asm(" LDI 02000h,ST       ; globally enable all interrupts. ");
104
105   /* send "1 0 0" to master to signify DSP ver. 1.00 */
106   regptr = (unsigned int *)0x800A70;
107   *regptr = 0x31;
108   regptr = (unsigned int *)0x800A71;
109   *regptr = 0x30;
110   regptr = (unsigned int *)0x800A72;
111   *regptr = 0x30;
112
```

Navy Case No. 77,062

```
/*********************************start  Paul's stuff*************************/
/* ################### DIRECT MEMORY ACCESS ######################### */
     regptr = (unsigned int *) DMA_Glob_Ctrl_Reg;
     *regptr = 0x00000E10;
                /* START=00 - Reset DMA to begin new cycle on start */
                 /*        - NOTE: Must be set to 11 to begin Trans*/
                 /* STAT=00 - Read Only */

                /* INCSRC=1 - incr source address */
                /* DECSRC=0 - do not decr source address */
                /* INCDST=0 - do not incr dest address */
                /* DECDST=0 - do not decr dest addrss */

                 /* SYNC=10 - write on enable from XINT0 */
                    /* TC=1 - stop when transfer cntr = 0 */
                 /* TCINT=1 - set DMA int TC=0 */

          regptr = (unsigned int *) DMA_Src_Addr_Reg;
          *regptr = (unsigned int) &sim_pcm[0];       /* DMA Source Address = */
                          /*   */

          regptr = (unsigned int *) DMA_Dst_Addr_Reg;
          *regptr = SER0_X_Reg;       /* DMA Destination Address = */
                          /* Serial port 0 Transmit */

          regptr = (unsigned int *) DMA_Tran_Ctr_Reg;
          *regptr = 0x19;             /* DMA Transfer Counter = 19 */


/* ################### BUS CONTROL ################################ */
          regptr = (unsigned int *) Exp_Bus_Ctrl_Reg;
          *regptr = 0x00/*0x08*/; /* WTCNT=00, SWW=00, *RDTint=*RDYwtcnt */
                    /* ADC/DAC accesses get 2 wait states */
          regptr = (unsigned int *) Pri_Bus_Ctrl_Reg;
          *regptr = 0x08;                /* WTCNT=00, SWW=01, *RDYint=*RDY,     */
                                              /* no bank switch, no internal hold  */

/* ################### SERIAL PORTS ################################ */
           regptr = (unsigned int *) SER0_Glob_Ctrl_Reg;
           *regptr = 0x00C1204/*0x00C1200*/;
                    /* RRDY=0 - Read Only */
                    /* XRDY=0 - Read Only */
                  /* FSXOUT=1 - output, FSX0 */
               /* XSREMPTY=0 - Read Only */

                 /* RSRFULL=0 - Read Only */
                      /* HS=0 - Disable Handshaking */
                /* XCLKSRCE=0 - CLKX0 Inputs 320KHz clk */
                /* RCLKSRCE=0 - n/a, CLKR0 */

                  /* XVAREN=0 - n/a, FSX0 */
                  /* RVAREN=1 - FSR0 variable data rate signaling */
                    /* XFSM=0 - n/a, FSX0 */
                    /* RFSM=0 - FSR0 Frame sync mode, "Standard Mode" */

                   /* CLKXP=1 - Clock DX0 out on falling edge of CLKX0 */
                   /* CLXPR=0 - n/a, FSX0 */
```

Navy Case No. 77,062

```
170                 /* DXP=0 - DX0 polarity is active high **7/18/95** */
171                 /* DRP=0 - n/a */
172
173                /* FSXP=0 - active high */
174                /* FSRP=0 - active high */
175               /* XLEN=11 - XMIT 32-bits of PCM Data */
176
177               /* RLEN=00 - n/a */
178               /* XTINT=0 - disable XMTR timer interrupt */
179                /* XINT=0 - enable XMTR intrerrupt */
180                 /*          Note: Must be set to 1 to enable PCM */
181
182               /* RTINT=0 - disable RCVR timer interrupt */
183                /* RINT=0 - disable RCVR interrupt */
184              /* XRESET=0 - Put XMTR in reset mode */
185              /* RRESET=0 - n/a */
186
187          regptr = (unsigned int *) SER0_XFDC_Ctrl_Reg;
188          *regptr = 0x0231/*0x0031*/;
189               /* CLKXFUNC=1 - CLKX0 used in "Serial Port" mode */
190                 /* CLKXiO=0 - CLKX0 is input pin */
191            /* CLKXDATAOUT=0 - Initially CLKX0 outputs 0 */
192              /* CLKXDATIN=0 - Read only */
193
194                 /* DXFUNC=1 - DX0 used in "Serial Port" mode */
195                   /* DXiO=1 - DX0 is output pin for PCM data */
196               /* DXDATOUT=0 - Initially DX0 outputs 0 */
197                /* DXDATIN=0 - Read Only */
198
199                /* FSXFUNC=0 - n/u, FSX0 is general purpose I/O pin */
200                  /* FSXiO=1 - n/u, FSX0 is output pin */
201              /* FSXDATOUT=0 - n/u, data out */
202               /* FSXDATIN=0 - data in  */
203
204          regptr = (unsigned int *) SER0_RFDC_Ctrl_Reg;
205          *regptr = 0x020;
206               /* CLKRFUNC=0 - n/u, CLKR0 digital I/O port */
207                 /* CLKRiO=0 - n/u, CLKR0 is input pin */
208            /* CLKRDATAOUT=0 - n/u, CLKR0 outputs 0 */
209              /* CLKRDATIN=0 - Read only */
210
211                 /* DRFUNC=0 - n/u, DR0 digital I/O port */
212                   /* DRiO=1 - n/u, DR0 is output pin*/
213               /* DRDATOUT=0 - n/u. DR0 outputs 0 */
214                /* DRDATIN=0 - Read Only */
215
216                /* FSRFUNC=0 - FSR0 digital I/O port */
217                  /* FSRiO=0 - FSR0 is input pin */
218              /* FSRDATOUT=0 - FSR0 output 0 */
219               /* FSRDATIN=0 - Read Only */
220
221          regptr = (unsigned int *) SER0_RX_Tim_Ctrl_Reg;
222          *regptr = 0x0;            /* NOTE: Neither the receiver nor      */
223                                          /* transmitter timers are used        */
224          regptr = (unsigned int *) SER0_RX_Tim_Ctr_Reg;
225          *regptr = 0;                  /* NOTE: The SER0 timers are not used */
226          regptr = (unsigned int *) SER0_RX_Tim_Per_Reg;
```

Navy Case No. 77,062

```
227             *regptr = 0;                /* NOTE: The SER0 timers are not used */
228             regptr = (unsigned int *) SER0_X_Reg;
229             *regptr = 0;                /* Set Data Transmit Register */
230                             /* equal to first pcm word value */
231             regptr = (unsigned int *) SER0_R_Reg;
232             *regptr = 0;                /* Clear Data Receive Register */
233
234     /********************************** end Paul's stuff *************************/
235     test_stat = 0;
236
237     /* set up serial port 1 */
238        *fsx_dx_clkx_port_1_ptr = 0x020; /* set up FSX1, CLKX1, DX1  */
239        *fsr_dr_clkr_port_1_ptr = 0x262;   /* set up FSR1, CLKR1, DR1 */
240        *ser_port_1_glob_cntrl_ptr = 0x0411000;
241        *rx_timer_cntrl_ptr = 0x003;
242        *rx_timer_period_ptr = 0x01; /* interrupt after one edge of _BUSYR(see schem.) */
243
244     /* Set up XF1 and XF0 as general purpose outputs, initialized HIGH.*/
245        asm(" LDI  66h,IOF   ; XF1 is _SLAV_WDI, XF0 is _CONVST");
246
247     /* Reset analog-to-digital converter:
248        -- _ALFL asserted (low) after one word written to FIFO
249        -- ADC data bus inactive while _BUSY is low */
250        *adc_status_control_ptr = RESET_ADC;
251
252     /* internal clock source = 8 Mhz (half H1), timers are held, pulse mode */
253        *timer1_global_cntrl_ptr = SETUP_TIMER1;
254        *timer1_period_ptr = 8000;
255        *timer0_global_cntrl_ptr = SETUP_TIMER0;
256
257     *mtim_led_out_ptr = 0x3FF; /* turn LEDs off */
258     *pcm_led_out_ptr = 0xFF;
259     mtim_data_output.data = 0x000;
260     mtim_data_output.syncst = 0;
261     mtim_data_output.adc_dr = 0;
262     mtim_data_output.track_hold = 1; /* 'track' mode */
263
264     *mtim_chan_out_ptr = 0x00;
265
266     sync_state = IDLE;
267
268     regptr = (unsigned int *)SER0_RFDC_Ctrl_Reg;/* reset pam clock int flop */
269     *regptr = 0x060;
270     asm(" NOP; ");
271     asm(" NOP; ");
272     *regptr = 0x020;
273     asm(" LDI 00h,IF ; "); /* clear pending interrupts */
274     interrupt_en_cntrl = interrupt_en_cntrl | EN_IP_COMMS;
275     asm(" LDI @_interrupt_en_cntrl,IE ;");
276
277
278
279     while(1){  /* system loop */
280
281     if (watch_dog_timer_reset){
282      watch_dog_timer_reset = 0;
283      asm(" AND 0BFh,IOF ; clear watchdog timer (falling edge, port XF1, bit 6)");
```

Navy Case No. 77,062

```
284     }
285     else{
286      asm(" OR 040h,IOF ; clear watchdog timer (rising edge, port XF1, bit 6) ");
287      watch_dog_timer_reset = 1;
288     }
289
290
291     switch(mode){
292
293     case DISPLAY_TEST:
294
295        if (!all_leds_are_on){
296          all_leds_are_on = 1;
297          *timer1_global_cntrl_ptr = STOP_TIMER1;
298          *timer1_period_ptr = 0xFFFFFFFF;
299          *mtim_led_out_ptr = 0x000;
300          *pcm_led_out_ptr = 0x00;
301          *timer1_global_cntrl_ptr = START_TIMER1;
302          while(*timer1_count_ptr < 8e6);
303          asm(" OR 040h,IOF    ; clear watchdog timer (rising edge, port XF1, bit 6) ");
304          *timer1_global_cntrl_ptr = START_TIMER1;
305          while(*timer1_count_ptr < 4e6);
306          asm(" AND 0BFh,IOF ; clear watchdog timer (falling edge, port XF1, bit 6)");
307          *timer1_global_cntrl_ptr = START_TIMER1;
308          while(*timer1_count_ptr < 4e6);
309          asm(" OR 040h,IOF    ; clear watchdog timer (rising edge, port XF1, bit 6) ");
310          *timer1_global_cntrl_ptr = START_TIMER1;
311          while(*timer1_count_ptr < 4e6);
312          asm(" AND 0BFh,IOF ; clear watchdog timer (falling edge, port XF1, bit 6)");
313          *timer1_global_cntrl_ptr = START_TIMER1;
314          while(*timer1_count_ptr < 4e6);
315          asm(" OR 040h,IOF    ; clear watchdog timer (rising edge, port XF1, bit 6) ");
316          *timer1_global_cntrl_ptr = START_TIMER1;
317          while(*timer1_count_ptr < 4e6);
318          asm(" AND 0BFh,IOF ; clear watchdog timer (falling edge, port XF1, bit 6)");
319          *timer1_global_cntrl_ptr = STOP_TIMER1;
320        }/* end if (!all_leds_are_on) */
321        *mtim_led_out_ptr = *input_port_ptr | 0xFFFFFF00;
322        *pcm_led_out_ptr = (*input_port_ptr & 0x0000FF00) >> 8;
323        break; /* end case DISPLAY_TEST:  */
324
325     case CALIBRATE:
326
327        switch(cal_state){
328           case R_AR_TEST:
329                send_non_tm_cal_readings();
330                reg_test();
331                cal_state = INTERNAL_RAM_TEST;
332                /* break;  */
333           case INTERNAL_RAM_TEST:
334                send_non_tm_cal_readings();
335                ram_test();
336                cal_state = DPRAM_TEST;
337                /* break;  */
338           case DPRAM_TEST:
339                send_non_tm_cal_readings();
340                dpramtst();
```

Navy Case No. 77,062

```
341                 cal_state = /*READBACK_LATCH_TEST*/ TEST_CLOCK_TEST;
342                 /* break;  */
343     /*    case READBACK_LATCH_TEST:  this is now done at the top of mail.c
344                 send_non_tm_cal_readings();
345                 lachtest();
346                 cal_state = TEST_CLOCK_TEST;
347                 /* break; */
348           case TEST_CLOCK_TEST:
349                 send_non_tm_cal_readings();
350                 *timer0_global_cntrl_ptr = 0x101; /* stop counter 0 */
351                 *timer0_period_ptr = 0xFFFFFFFF;
352                 *timer0_count_ptr = 0x0000;
353                 *timer1_global_cntrl_ptr = STOP_TIMER1;
354                 *timer1_count_ptr = 0x0000;
355                 *timer1_period_ptr = 0xFFFFFFFF;
356                 *timer0_global_cntrl_ptr = 0x1C1; /* start counter 0 */
357                 while(*timer0_count_ptr == 0);
358                 *timer1_global_cntrl_ptr = START_TIMER1;
359                 while(*timer0_count_ptr < 1000);
360                *timer1_global_cntrl_ptr = STOP_TIMER1;
361                *timer0_global_cntrl_ptr = 0x101; /* stop counter 0 */
362                test_clock_freq = 100/(*timer1_count_ptr * 125e-9);
363                clock_difference = test_clock_freq - 3.2e5;
364                if (clock_difference < 0)
365                 clock_difference = -clock_difference;
366                if (clock_difference <= 3200.0)
367                 test_stat = test_stat | 0x00000010; /* set b4 */
368                else
369                 test_stat = test_stat & 0xFFFFFFEF; /* clear b4 */
370                cal_state = PAM_CLOCK_TEST;
371               /* break; */
372           case PAM_CLOCK_TEST:
373                send_non_tm_cal_readings();
374                *timer1_global_cntrl_ptr = STOP_TIMER1;
375                *timer1_count_ptr = 0x0000;
376                *timer1_period_ptr = 0xFFFFFFFF;
377                /* set flop for pam clock interrupt */
378                regptr = (unsigned int *)SER0_RFDC_Ctrl_Reg;
379                *regptr = 0x060;
380                asm(" NOP   ;");
381                asm(" NOP   ;");
382                *regptr = 0x020;
383                asm(" AND 07FBh,IF ;");/* clear pam clock int flag */
384                interrupt_en_cntrl = (interrupt_en_cntrl /*& DIS_IP_COMMS*/) |EN_PAM_CLK;
385                asm(" LDI @_interrupt_en_cntrl,IE  ;");
386                while(pam_period_count == 101);
387               *timer1_global_cntrl_ptr = START_TIMER1;
388               while(pam_period_count > 0);
389               *timer1_global_cntrl_ptr = STOP_TIMER1;
390               test_clock_freq = 100/(*timer1_count_ptr * 125e-9);
391               clock_difference = test_clock_freq - 2.56e4;
392               if (clock_difference < 0)
393                clock_difference = -clock_difference;
394               if (clock_difference <= 256.0)
395                test_stat = test_stat | 0x00000020; /* set b5 */
396               else
397                test_stat = test_stat & 0xFFFFFFDF; /* clear b5 */
```

Navy Case No. 77,062

```
398            cal_state = WAIT;
399            regptr = (unsigned int *) SERO_XFDC_Ctrl_Reg; /* testing; PAM flag */
400            *regptr = *regptr & 0xBFF; /* testing; PAM flag falling edge */
401               interrupt_en_cntrl = (interrupt_en_cntrl & DIS_PAM_CLK)
402               /*|EN_IP_COMMS*/;
403               asm(" LDI @_interrupt_en_cntrl,IE  ;");
404               break;
405         case DAC_ADC_TEST:
406             send_non_tm_cal_readings();
407             getting_test_adc_sample = 1;
408             interrupt_en_cntrl = interrupt_en_cntrl & DIS_CPU_INTS;
409             asm(" LDI @_interrupt_en_cntrl,IE  ;");
410             /* assert _CONVST to start A to D conversion */
411             asm(" AND 0FBh,IOF; XF0 bit 2");
412             asm(" NOP;");
413             asm(" NOP;");
414             asm(" NOP;");
415             asm(" NOP;");
416             asm(" OR 04h,IOF;");
417             interrupt_en_cntrl = interrupt_en_cntrl | EN_ALFL;
418             asm(" LDI @_interrupt_en_cntrl,IE  ;");
419             while(getting_test_adc_sample); /* wait for getsample INT0 assertion */
420             /* the getsample ISR just cleared getting_test_adc_sample */
421             temp = pam_sample - expected_adc_out;
422             if (temp > -35 AND temp < 35)
423              test_stat = 1;
424             else
425              test_stat = 0;
426             send_message(dac_adc_stat,test_stat);
427             interrupt_en_cntrl = (interrupt_en_cntrl & DIS_CPU_INTS) | EN_IP_COMMS;
428             asm(" LDI @_interrupt_en_cntrl,IE  ;");
429             cal_state = WAIT;
430             break;
431         case CAL_PCM:
432             generate_pcm();
433             cal_state = WAIT;
434             break;
435         case CAL_PAM:
436             *timer1_global_cntrl_ptr = STOP_TIMER1;
437             *timer1_period_ptr = 0xFFFFFFFF;
438             while(sync != IN_SYNC);
439             *timer1_global_cntrl_ptr = START_TIMER1;
440             while(*timer1_count_ptr < 22400); /* 2.8 ms delay */
441             interrupt_en_cntrl = (interrupt_en_cntrl & DIS_CPU_INTS) | EN_IP_COMMS;
442             asm(" LDI @_interrupt_en_cntrl,IE ;");
443             test_stat = 1;
444             for (i = 1; i < 65; i++){
445              temp = pam_test_array[i] - simpam[i];
446              if (temp > 25 OR temp < -25)/* was 20;too small; occasional failures*/
447               test_stat = 0;
448             }
449             interrupt_en_cntrl = interrupt_en_cntrl | EN_TINT_0 | EN_PAM_CLK |EN_ALFL\
450                                                     | EN_IP_COMMS;
451             asm(" LDI @_interrupt_en_cntrl,IE ;");
452             cal_state = WAIT;
453             break; /* end case CAL_PAM: */
454         default:
```

Navy Case No. 77,062

```
455             break;
456          }/* end switch(cal_state) */
457
458     break;/* end case CALIBRATE */
459
460     case PAM:
461
462        mtim_pushwheels_old = mtim_pushwheels_temp;
463        mtim_pushwheels_temp = ~(*input_port_ptr | 0xFFFFFF00);
464        if (mtim_pushwheels_old == mtim_pushwheels_temp)
465          mtim_debounce_count++;
466        else
467          mtim_debounce_count = 0;
468
469        if (mtim_debounce_count > 10000){
470          mtim_debounce_count = 0;
471          mtim_pushwheels = ~(*input_port_ptr | 0xFFFFFF00);
472          if ((mtim_pushwheels < 1 OR mtim_pushwheels > 0x64 \
473             OR ((mtim_pushwheels & 0x0000000F) > 9))\
474             AND !bogus_mtim_pushwheels_flag) {
475            *mtim_led_out_ptr = 0x3FF; /*turn off MTIM LEDs for bogus pushwheel values*/
476            send_message(DATA_SELECTION_ERROR, 0x01);
477            bogus_mtim_pushwheels_flag = 1;
478          }/* end if ((mtim_pushwheels...) */
479          else if ( ! (mtim_pushwheels < 1 OR mtim_pushwheels > 0x64 \
480             OR ((mtim_pushwheels & 0x0000000F) > 9))\
481             AND bogus_mtim_pushwheels_flag) {
482            send_message(DATA_SELECTION_ERROR, 0x00);
483            bogus_mtim_pushwheels_flag = 0;
484          }/* end else if (!(mtim_pushwheels...) */
485        }/* end if(mtim_debounce_count > 10000) */
486
487        if (/*cal_state*/sent_lost_sync_flag/* == FIND_PAM_SYNC*/ AND sync == IN_SYNC){
488          send_message(PAM_SYNC_DETECTED,0x00);
489          cal_state = WAIT;
490          sent_lost_sync_flag = 0;
491        }
492        if (sync == LOST_SYNC AND !sent_lost_sync_flag){
493          send_message(PAM_SYNC_LOST,0x00);
494          sent_lost_sync_flag = 1;
495        }
496        break; /* end case PAM: */
497
498     case PCM:
499
500        pcm_pushwheels_old = pcm_pushwheels_temp;
501        pcm_pushwheels_temp = ~(*input_port_ptr | 0xFFFF00FF) >> 8;
502        if (pcm_pushwheels_temp == pcm_pushwheels_old)
503          pcm_debounce_count++;  /* INITIALIZE IN MAIL.C!!!! */
504        else
505          pcm_debounce_count = 0;
506
507        if (pcm_debounce_count > 100){
508          pcm_pushwheels = -(*input_port_ptr | 0xFFFF00FF) >> 8;
509          pcm_pushwheels = (pcm_pushwheels & 0x0000000F) + ((pcm_pushwheels & 0x000000F0)
510                           >> 4)* 10;
511          pcm_debounce_count = 0;
```

Navy Case No. 77,062

```
512        }
513
514
515        mtim_pushwheels_old = mtim_pushwheels_temp;
516        mtim_pushwheels_temp = ~(*input_port_ptr | 0xFFFFFF00);
517        if (mtim_pushwheels_old == mtim_pushwheels_temp)
518          mtim_debounce_count++;
519        else
520          mtim_debounce_count = 0;
521
522        if (mtim_debounce_count > 100){
523          mtim_debounce_count = 0;
524          mtim_pushwheels = ~(*input_port_ptr | 0xFFFFFF00);
525          if ((mtim_pushwheels > 0x7F) AND !bogus_mtim_pushwheels_flag) {
526            *mtim_led_out_ptr = 0x3FF;/* turn off MTIM LEDs for bogus pushwheel values */
527            send_message(DATA_SELECTION_ERROR, 0x01);
528            bogus_mtim_pushwheels_flag = 1;
529          }/* end if((mtim_pushwheels > ...) */
530          else if ( (! (mtim_pushwheels > 0x7F)) AND bogus_mtim_pushwheels_flag) {
531              send_message(DATA_SELECTION_ERROR, 0x00);
532              bogus_mtim_pushwheels_flag = 0;
533          }/* end else if ((!(mtim_pushwheels > ...) */
534
535         } /* end if(mtim_debounce_count > 100) */
536
537
538     regptr = (unsigned int *) SER0_XFDC_Ctrl_Reg; /* testing; PAM flag */
539     *regptr = *regptr | 0x400; /* testing; PAM flag rising edge */
540         pcm_mode();
541     *regptr = *regptr & 0xBFF; /* testing; PAM flag falling edge */
542
543         mode = PAUSE; /* wait for master to tell me to process next DPRAM bank */
544         break; /* end case PCM: */
545
546     case TEST_GNU_COMMS:
547         /* enable GNU USART ISR here */
548         interrupt_en_cntrl = (interrupt_en_cntrl & DIS_CPU_INTS) | EN_GNU_USART;
549         asm(" LDI @_interrupt_en_cntrl,IE ;");
550         while(1){
551           if (watch_dog_timer_reset){
552               watch_dog_timer_reset = 0;
553               asm(" AND 0BFh,IOF ; clear watchdog timer (falling edge, port XF1,bit 6)");
554               }
555           else{
556               asm(" OR 040h,IOF ; clear watchdog timer (rising edge, port XF1, bit 6) ");
557               watch_dog_timer_reset = 1;
558               }
559          }/* end while(1) */
560         break;
561
562     default:
563         break;
564     }/* end switch(mode) */
565
566     if (r_message_flag)
567       mail();
568
```

Navy Case No. 77,062

```
}/* end while(1) (system loop)*/

}/* end main() */
```

Navy Case No. 77,062

```
1     /*  mail.c */
2
3     #include "newmtim.h"
4
5     void mail(void)
6     {
7
8     interrupt_en_cntrl = ((interrupt_en_cntrl & DIS_CPU_INTS) | DMA_SERO_INT);
9     asm(" LDI @_interrupt_en_cntrl,IE ;update IE register");
10
11    switch(r_message_opcode){
12       case PREPARE_TO_CALIBRATE:
13         lachtest();
14          if (r_message_data)
15         mtim_1015_or_8 = 1015;
16          else
17         mtim_1015_or_8 = 8;
18        test_stat = 1;
19        pcm_test_stat = 1;
20    /*  regptr = (unsigned int *) SERO_RFDC_Ctrl_Reg;/* testing; PCM flag, *
21        *regptr = *regptr | 0x040;                    /* testing; rising edge */
22          send_non_tm_cal_readings();
23          oper_cal = 1;
24          chan_id = 64; /* for initial readings going out back of box */
25          bank_count = 0;
26          cal_state = WAIT;
27          mode = PAUSE;
28          sync = LOST_SYNC;
29          sync_state = NOT_SEARCHING;
30          break;
31       case TEST_NON_TM_FUNCTIONS:
32          /*  check b0 for outputting 0% or 100% initially */
33        regptr = (unsigned int *) SERO_XFDC_Ctrl_Reg; /* testing; PAM flag */
34        *regptr = *regptr | 0x400; /* testing; PAM flag rising edge */
35          if (r_message_data)
36                mtim_1015_or_8 = 1015;
37          else
38                mtim_1015_or_8 = 8;
39          chan_id = 64; /* for initial readings going out back of box */
40          pam_period_count = 101;
41          cal_state = R_AR_TEST;
42          mode = CALIBRATE;
43          sync = LOST_SYNC;
44          sync_state = NOT_SEARCHING;
45          break;
46       case SEND_NON_TM_FUNCTION_STATUS:
47          test_stat = test_stat | latchtest_stat;
48          send_message(NON_TM_FUNCTION_STATUS,test_stat);
49          test_stat = 0;
50          break;
51       case DAC_ADC_TEST_1:
52          expected_adc_out = 0xFFFFFC00;/* -1.50 volts */
53          dac_adc_stat = DAC_ADC_TEST_1_STATUS;
54          cal_state = DAC_ADC_TEST;
55          mode = CALIBRATE;
56          sync = LOST_SYNC;
57          sync_state = NOT_SEARCHING;
```

Navy Case No. 77,062

```
58          break;
59       case DAC_ADC_TEST_2:
60          expected_adc_out = 0x00000000;
61          dac_adc_stat = DAC_ADC_TEST_2_STATUS;
62          cal_state = DAC_ADC_TEST;
63          mode = CALIBRATE;
64          sync = LOST_SYNC;
65          sync_state = NOT_SEARCHING;
66          break;
67       case DAC_ADC_TEST_3:
68          expected_adc_out = 0x00000400;/* +1.5 volts */
69          dac_adc_stat = DAC_ADC_TEST_3_STATUS;
70          cal_state = DAC_ADC_TEST;
71          mode = CALIBRATE;
72          sync = LOST_SYNC;
73          sync_state = NOT_SEARCHING;
74          break;
75       case CALIBRATE_PAM:
76          calibrating_pam = 1;
77        regptr = (unsigned int *) SER0_XFDC_Ctrl_Reg; /* testing; PAM flag */
78        *regptr = *regptr | 0x400; /* testing; PAM flag rising edge */
79    /*  regptr = (unsigned int *) SER0_RFDC_Ctrl_Reg;/* testing; PCM flag, *
80        *regptr = *regptr & 0xFBF;                    /* testing; falling edge */
81          mtim_pushwheels_temp = ~(*input_port_ptr | 0xFFFFFF00);
82          mtim_debounce_count = 0;
83          pcm_debounce_count = 0;
84          bogus_mtim_pushwheels_flag = 0;
85          if (r_message_data)
86                mtim_1015_or_8 = 1015;
87          else
88                mtim_1015_or_8 = 8;
89          *fsr_dr_clkr_port_1_ptr = 0x040 | *fsr_dr_clkr_port_1_ptr;/* shut off frame
90                                                                      sync lamp */
91          *mtim_led_out_ptr = 0x3FF; /* shut off LEDs */
92          *mtim_led_out_ptr = 0x4000; /* PAM flag for testing purposes */
93          *pcm_led_out_ptr = 0xFF; /* shut off PCM input LEDs */
94          mtim_data_output.syncst = 1; /* assert sync status line */
95          cal_state = CAL_PAM;
96          mode = CALIBRATE;
97          sync = LOST_SYNC;
98          sync_state = IDLE;
99          interrupt_en_cntrl = interrupt_en_cntrl|EN_PAM_CLK|EN_ALFL|EN_TINT_0;
100         asm(" LDI @_interrupt_en_cntrl,IE ;update IE register");
101   /*    asm(" LDI 00h,IF;"); /* clear pending ints */
102         break;
103      case SEND_PAM_CALIBRATION_STATUS:
104         send_message(CALIBRATE_PAM_TEST_STATUS,test_stat);
105         test_stat = 0;
106       regptr = (unsigned int *) SER0_XFDC_Ctrl_Reg; /* testing; PAM flag */
107       *regptr = *regptr & 0xBFF; /* testing; PAM flag falling edge */
108         break;
109      case SEARCH_FOR_PAM_SYNC:
110         calibrating_pcm = 0;
111         oper_cal = 0;
112         mtim_pushwheels_temp = ~(*input_port_ptr | 0xFFFFFF00);
113         mtim_debounce_count = 0;
114         pcm_debounce_count = 0;
```

Navy Case No. 77,062

```
115          bogus_mtim_pushwheels_flag = 0;
116          *fsr_dr_clkr_port_1_ptr = 0x040 | *fsr_dr_clkr_port_1_ptr;/* shut off frame
117                                                                      sync lamp */
118          *mtim_led_out_ptr = 0x3FF; /* shut off LEDs */
119          *pcm_led_out_ptr = 0xFF; /* shut off PCM input LEDs */
120          mtim_data_output.syncst = 0; /* deassert sync status line */
121          cal_state = FIND_PAM_SYNC;
122          mode = PAM;
123          sync = LOST_SYNC;
124          sync_state = IDLE;
125          interrupt_en_cntrl = interrupt_en_cntrl|EN_PAM_CLK|EN_ALFL|EN_TINT_0;
126          asm(" LDI @_interrupt_en_cntrl,IE ;update IE register");
127          break;
128       case PAM_MODE:
129          mtim_pushwheels_temp = ~(*input_port_ptr | 0xFFFFFF00);
130          mtim_debounce_count = 0;
131          pcm_debounce_count = 0;
132          *fsr_dr_clkr_port_1_ptr = 0x040 | *fsr_dr_clkr_port_1_ptr;/* shut off frame
133                                                                      sync lamp */
134          *mtim_led_out_ptr = 0x3FF; /* shut off LEDs */
135          *pcm_led_out_ptr = 0xFF; /* shut off PCM input LEDs */
136          mtim_data_output.syncst = 0; /* deassert sync status line */
137          cal_state = WAIT;
138          mode = PAM;
139          interrupt_en_cntrl = interrupt_en_cntrl|EN_PAM_CLK|EN_ALFL|EN_TINT_0;
140          asm(" LDI @_interrupt_en_cntrl,IE ;update IE register");
141          if ((mtim_pushwheels < 1 OR mtim_pushwheels > 0x64 \
142                          OR ((mtim_pushwheels & 0x0000000F) > 9))\
143                          AND !bogus_mtim_pushwheels_flag) {
144         *mtim_led_out_ptr = 0x3FF;  /* turn off MTIM LEDs for bogus pushwheel values */
145         send_message(DATA_SELECTION_ERROR, 0x01);
146         bogus_mtim_pushwheels_flag = 1;
147          }
148          else if ( ! (mtim_pushwheels < 1 OR mtim_pushwheels > 0x64 \
149                              OR ((mtim_pushwheels & 0x0000000F) > 9))\
150                              AND bogus_mtim_pushwheels_flag) {
151         send_message(DATA_SELECTION_ERROR, 0x00);
152         bogus_mtim_pushwheels_flag = 0;
153          }
154          break;
155       case CALIBRATE_PCM:
156          /*  check b0 for outputting 0% or 100% initially (50% if error) */
157        test_stat = 1;
158        pcm_test_stat = 1;
159        bank_count = 0;
160          calibrating_pcm = 1;
161          calibrating_pam = 0;
162        regptr = (unsigned int *) SER0_RFDC_Ctrl_Reg;/* testing; PCM flag, */
163        *regptr = *regptr | 0x040;                    /* testing; rising edge */
164          pcm_pushwheels_temp = ~(*input_port_ptr | 0xFFFF00FF) >> 8;
165          mtim_pushwheels_temp = ~(*input_port_ptr | 0xFFFFFF00);
166          mtim_debounce_count = 0;
167          pcm_debounce_count = 0;
168          bogus_mtim_pushwheels_flag = 0;
169          *fsr_dr_clkr_port_1_ptr = 0x040 | *fsr_dr_clkr_port_1_ptr;/* shut off frame
170                                                                      sync lamp */
171          *mtim_led_out_ptr = 0x3FF; /* shut off LEDs */
```

Navy Case No. 77,062

```
172          *pcm_led_out_ptr = 0xFF; /* shut off PCM input LEDs */
173          mtim_data_output.syncst = 1; /* assert sync status line */
174          if (r_message_data)
175         mtim_1015_or_8 = 1015;
176          else
177         mtim_1015_or_8 = 8;
178          cal_state = CAL_PCM;
179          mode = CALIBRATE;
180          sync = LOST_SYNC;
181          sync_state = NOT_SEARCHING;
182          break;
183     /* case SEND_PCM_CALIBRATION_STATUS:
184          send_message(CALIBRATE_PCM_TEST_STATUS,pcm_test_stat);
185          test_stat = 0;
186        regptr = (unsigned int *) SER0_RFDC_Ctrl_Reg;/* testing; PCM flag, *
187        *regptr = *regptr & 0xFBF;                   /* testing; falling edge *
188         break;*/
189       case PROCESS_DPRAM_BANK_1:
190       case PROCESS_DPRAM_BANK_0:
191          cal_state = CAL_PCM /*WAIT*/;
192          mode = PCM;
193          sync = LOST_SYNC;
194          sync_state = NOT_SEARCHING;
195          break;
196       case PCM_MODE:
197          mtim_debounce_count = 0;
198          pcm_debounce_count = 0;
199          *fsr_dr_clkr_port_1_ptr = 0x040 | *fsr_dr_clkr_port_1_ptr;/* shut off frame
200                                                                      sync lamp */
201          *mtim_led_out_ptr = 0x3FF; /* shut off LEDs */
202          *pcm_led_out_ptr = 0xFF; /* shut off PCM input LEDs */
203          mtim_data_output.syncst = 1; /* assert sync status line */
204          cal_state = WAIT;
205          mode = PCM;
206          sync = LOST_SYNC;
207          sync_state = NOT_SEARCHING;
208          pcm_pushwheels_temp = ~(*input_port_ptr | 0xFFFF00FF) >> 8;
209          mtim_pushwheels_temp = ~(*input_port_ptr | 0xFFFFFF00);
210          if ((mtim_pushwheels > 0x7F) AND !bogus_mtim_pushwheels_flag) {
211           *mtim_led_out_ptr = 0x3FF;/* turn off MTIM LEDs for bogus pushwheel values */
212           send_message(DATA_SELECTION_ERROR, 0x01);
213           bogus_mtim_pushwheels_flag = 1;
214          }
215          else if ( (! (mtim_pushwheels > 0x7F)) AND bogus_mtim_pushwheels_flag) {
216           send_message(DATA_SELECTION_ERROR, 0x00);
217           bogus_mtim_pushwheels_flag = 0;
218          }
219          break;
220       case BEGIN_DISPLAY_TEST:
221          cal_state = WAIT;
222          mode = DISPLAY_TEST;
223          sync = LOST_SYNC;
224          sync_state = NOT_SEARCHING;
225          break;
226       case STOP_DISPLAY_TEST:
227          *pcm_led_out_ptr = 0xFF; /* turn off the 8 PCM LEDs */
228          *mtim_led_out_ptr = 0x3FF; /* turn off the 10 MTIM LEDs */
```

Navy Case No. 77,062

```
229          cal_state = WAIT;
230          mode = PAUSE ;
231          sync = LOST_SYNC;
232          sync_state = NOT_SEARCHING;
233          all_leds_are_on = 0;
234          break;
235       case OUTPUT_50_PERCENT:
236          mtim_1015_or_8 = 512;
237          cal_state = WAIT;
238          mode = CALIBRATE;
239          sync = LOST_SYNC;
240          sync_state = IDLE;
241          /* if (calibrating_pam){  */
242              interrupt_en_cntrl = interrupt_en_cntrl|EN_PAM_CLK|EN_ALFL|EN_TINT_0;
243              asm(" LDI @_interrupt_en_cntrl,IE ;update IE register");
244           /*    } */
245          break;
246       case TEST_GNU_USART:
247    /*    regptr = (unsigned int *) Exp_Bus_Ctrl_Reg;
248          *regptr = 0xA8;/* WTCNT=5, SWW=01, *RDTint=*RDYwtcnt */
249    /* change the exp bus back to 0 wait states when not writing to GNU USART!! */
250          *gnu_usart_mode_regs_ptr = 0x5D;  /* load mode reg #1 */
251                                            /* 1 stop bit,
252                                               odd parity,
253                                               parity control enabled,
254                                               8-bit characters,
255                                               asynch. 1X */
256          *gnu_usart_mode_regs_ptr = 0x00;  /* load mode reg #2, external clocks */
257    /*    *gnu_usart_status_syn_ptr = 0xAA; /* load syn1 reg */
258    /*    *gnu_usart_status_syn_ptr = 0x55; /* load syn2 reg */
259    /*    *gnu_usart_status_syn_ptr = 0x...;/* load DLE reg -- not needed for "normal"
260                                               transparency control */
261          *gnu_usart_command_reg_ptr = 0x11;
262          *gnu_usart_rcve_xmit_ptr = 0x00;  /* clear xmit holding reg */
263          mode = TEST_GNU_COMMS;
264          break;
265       default:
266          break;
267    }/* end switch(r_message_opcode) */
268
269    r_message_flag = 0;
270    interrupt_en_cntrl = interrupt_en_cntrl | EN_IP_COMMS;
271    asm(" LDI @_interrupt_en_cntrl,IE ;update IE register");
272    /*   asm(" LDI 00h,IF;"); /* clear pending ints */
273
274    /*asm(" OR 040h,IOF    ; clear watchdog timer (rising edge, port XF1, bit 6)");*/
275
276    return;
277    }
```

Navy Case No. 77,062

```
1     /* st3.c */
2
3     #include "newmtim.h"
4
5     unsigned int pam_test_array[65];
6     unsigned int previous_chan_id = 0;
7
8     void c_int03(void)   /* _INT2; PAM clock input */
9     {
10    int temp;
11    double inter_calc;
12
13    /* "DR DATAOUT", bit 6 of FSR/DR/CLKR port 0 control register, is used to
14       SET the pam clock input flop in the Altera 5130GC. It is spaghetti-wired
15       to pin L13 of the 5130GC.
16
17       This DSP pin is also used for testing purposes to mark (high) the
18       beginning and ending of the "calibrate PCM" portion of CALIBRATE mode.
19     */
20     regptr = (unsigned int *)SER0_RFDC_Ctrl_Reg;
21                          *regptr = 0x060; /* DR DATAOUT, bit 6 of FSR/DR/CLKR port 0
22                                              cntrl reg */
23                          asm(" NOP   ;");
24                          asm(" NOP   ;");
25                          *regptr = 0x020;
26
27    asm(" AND 07FBh,IF ;");  /* clear INT2 bit in IF register */
28
29
30    *timer0_global_cntrl_ptr = STOP_TIMER0;
31    *timer0_period_ptr = WAIT_BEFORE_SAMPLE; /* = 100 counts ( 12.5us / 125ns per
32                                                 count)*/
33    *timer0_global_cntrl_ptr = START_TIMER0;
34
35    if (oper_cal/*mode == CALIBRATE*/){
36      mtim_data_output.data = mtim_1015_or_8;
37      mtim_data_output.syncst = 1;
38      *mtim_data_out_ptr = mtim_data_output;
39      *mtim_chan_out_ptr = hex2bcd[chan_id];
40
41      if (sync == IN_SYNC){
42        inter_calc = ((double)(zero_percent - pam_sample) / (zero_percent - \
43                                    hundred_percent))*1007;
44        temp = inter_calc + 8;
45        if (temp > 1023)
46          temp = 1023;
47        else if (temp < 0)
48          temp = 0;
49
50        pam_test_array[chan_id] = temp;
51        } /* end if (sync == IN_SYNC) */
52
53    } /* end if (oper_cal) */
54    else{ /* if (oper_cal) */
55
56      if (sync == IN_SYNC){
57        mtim_data_output.syncst = 1;
```

Navy Case No. 77,062

```
58          inter_calc = ((double)(zero_percent - pam_sample) / (zero_percent - \
59                                hundred_percent))*1007;
60          temp = inter_calc + 8;
61          if (temp > 1023)
62            temp = 1023;
63          else if (temp < 0)
64            temp = 0;
65
66          mtim_data_output.data = temp;
67
68          if (hex2bcd[chan_id] == mtim_pushwheels)
69             *mtim_led_out_ptr = ~mtim_data_output.data;
70
71          } /* end if (sync == IN_SYNC) */
72
73        else { /* if (sync == IN_SYNC) */
74
75          mtim_data_output.syncst = 0;
76          mtim_data_output.data = 0;
77        } /* end else if (sync == IN_SYNC) */
78
79        *mtim_data_out_ptr = mtim_data_output;
80        *mtim_chan_out_ptr = hex2bcd[chan_id];
81
82      } /* end else if (oper_cal) */
83
84
85      if (chan_id == NUMBER_OF_PAM_CHANNELS)
86        chan_id = 1;
87      else
88        chan_id++;
89
90      if (watch_dog_timer_reset){
91       watch_dog_timer_reset = 0;
92       asm(" AND 0BFh,IOF ; clear watchdog timer (falling edge, port XF1, bit 6)");
93      }
94      else{
95       asm(" OR 040h,IOF ; clear watchdog timer (rising edge, port XF1, bit 6) ");
96       watch_dog_timer_reset = 1;
97      }
98
99      pam_period_count--;
100
101     /* end st3.c */
102     }
```

Navy Case No. 77,062

```
1     /* t02.c */
2
3     #include "newmtim.h"
4
5     void c_int09(void)
6     {
7
8     *timer0_global_cntrl_ptr = STOP_TIMER0;
9
10
11          if (hex2bcd[chan_id] == mtim_pushwheels){
12                mtim_data_output.track_hold = 1;  /* 'track' mode of s&h amp */
13                /*send_mtim_data_out(mtim_data_output.data, chan_id);*/
14                 *mtim_data_out_ptr = mtim_data_output;
15
16    }
17
18
19    /* keep _CONVST low for 320ns (+-). Keep low at least 250ns */
20              asm(" AND 0FBh,IOF ; assert _CONVST (low, XF0, bit 2)");
21              asm(" NOP  ; keep _CONVST low ");
22              asm(" NOP  ; keep _CONVST low ");
23              asm(" NOP  ; keep _CONVST low ");
24              asm(" NOP  ; keep _CONVST low ");
25              asm(" OR 04h,IOF ; deassert _CONVST (high, XF0, bit 2)");
26
27    /* mtim_data_output.track_hold = 0; /* 'track' mode */
28    mtim_data_output.adc_dr = 0;  /* low to indicate converted data not ready */
29    /* send_mtim_data_out(mtim_data_output.data, chan_id); */
30        *mtim_data_out_ptr = mtim_data_output;
31
32    }
33
34    /* void c_int04(void){} */
35    void c_int05(void){}
36    void c_int06(void){}
37    void c_int07(void){}
38    void c_int08(void){}
39    void c_int10(void){}
```

Navy Case No. 77,062

```
/* gs2.c */

#include "newmtim.h"

signed int hundred_percent, hosed_adc;
signed int trial_hundred_percent, trial_zero_percent;

void c_int01(void) /* _INT0; _ALFL input from ADC */
{
signed int temp1, temp2;

mtim_data_output.track_hold = 0;
mtim_data_output.adc_dr = 1;  /* rising edge for MSTS to accept MTIM output data */
*mtim_data_out_ptr = mtim_data_output;

temp1 = *adc_fifo_data_out_ptr;
if (0x00000800 & temp1)
  pam_sample = 0xFFFFF000 | temp1;
else
  pam_sample = 0x00000FFF & temp1;

/* pamsync(); */

*mtim_chan_out_ptr = *mtim_chan_out_ptr | 0x80;/* pamsync marker for scope
                                                  display */

switch (sync_state) {
    case IDLE:
        if (pam_sample >= (signed int)ZERO_PERCENT_THRESHOLD){
            trial_zero_percent = pam_sample;
            sync_state = FIRST_ZERO_PERCENT;
            }
        break;

    case FIRST_ZERO_PERCENT:
        if (pam_sample <= (signed int)HUNDRED_PERCENT_THRESHOLD){
           sync_state = FIRST_HUNDRED_PERCENT;
           }
        else if (pam_sample >= (signed int)ZERO_PERCENT_THRESHOLD){
            trial_zero_percent = pam_sample;
            /* don't change sync_state */
            }
        else
            sync_state = IDLE;
        break;

    case FIRST_HUNDRED_PERCENT:
        if (pam_sample <= (signed int)HUNDRED_PERCENT_THRESHOLD){
          sync_state = SECOND_HUNDRED_PERCENT;
          }
        else
            sync_state = IDLE;
        break;

    case SECOND_HUNDRED_PERCENT:
        if (pam_sample <= (signed int)HUNDREL_PERCENT_THRESHOLD){
            trial_hundred_percent = pam_sample;
```

Navy Case No. 77,062

```
58                  sync_state = THIRD_HUNDRED_PERCENT;
59                  }
60              else
61                  sync_state = IDLE;
62              break;
63
64          case THIRD_HUNDRED_PERCENT:
65              fifty_percent = (trial_zero_percent + trial_hundred_percent) >> 1;
66              temp2 = pam_sample - fifty_percent;
67              if (temp2 < 0)
68                temp2 = -temp2;
69             if (temp2 <= (signed int)FIFTY_PERCENT_TOLERANCE){
70                  sync_state = FIFTY_PERCENT;
71                  hundred_percent = trial_hundred_percent;
72                  zero_percent = trial_zero_percent;
73                  }
74              else
75                  sync_state = IDLE;
76              break;
77
78          case FIFTY_PERCENT:
79              sync_state = IDLE;
80              break;
81
82          default:
83              break;
84
85        } /* end switch(sync_state) */
86
87
88      if (sync_state == FIFTY_PERCENT AND sync == LOST_SYNC){
89         chan_id = NUMBER_OF_PAM_CHANNELS;
90         }
91
92      if (chan_id == NUMBER_OF_PAM_CHANNELS){
93          if (sync_state == FIFTY_PERCENT){
94                  switch(sync){
95                      case LOST_SYNC:
96                            sync = FIRST_SYNC;
97                            break;
98                      case FIRST_SYNC:
99                         /* Assert discrete _PAM_SYNC (port DR1) */
100                          sync = IN_SYNC;
101                          *fsr_dr_clkr_port_1_ptr = 0x040 | *fsr_dr_clkr_port_1_ptr;
102                          asm(" NOP  ;");
103                          asm(" NOP  ;");
104                          asm(" NOP  ;");
105                          asm(" NOP  ;");
106                          asm(" NOP  ;");
107                          asm(" NOP  ;");
108                          asm(" NOP  ;");
109                          asm(" NOP  ;");
110                          asm(" NOP  ;");
111                          asm(" NOP  ;");
112                          asm(" NOP  ;");
113                          asm(" NOP  ;");
114                          *fsr_dr_clkr_port_1_ptr = 0xFBF & *fsr_dr_clkr_port_1_ptr;
```

Navy Case No. 77,062

```
115                     break;
116                case IN_SYNC:
117                     *fsr_dr_clkr_port_1_ptr = 0x040 | *fsr_dr_clkr_port_1_ptr;
118                      asm(" NOP  ;");
119                      asm(" NOP  ;");
120                      asm(" NOP  ;");
121                      asm(" NOP  ;");
122                      asm(" NOP  ;");
123                      asm(" NOP  ;");
124                      asm(" NOP  ;");
125                      asm(" NOP  ;");
126                      asm(" NOP  ;");
127                      asm(" NOP  ;");
128                      asm(" NOP  ;");
129                      asm(" NOP  ;");
130                      *fsr_dr_clkr_port_1_ptr = 0xFBF & *fsr_dr_clkr_port_1_ptr;
131                      break;
132                case LOST_FIRST:
133                     *fsr_dr_clkr_port_1_ptr = 0x040 | *fsr_dr_clkr_port_1_ptr;
134                      asm(" NOP  ;");
135                      asm(" NOP  ;");
136                      asm(" NOP  ;");
137                      asm(" NOP  ;");
138                      asm(" NOP  ;");
139                      asm(" NOP  ;");
140                      asm(" NOP  ;");
141                      asm(" NOP  ;");
142                      asm(" NOP  ;");
143                      asm(" NOP  ;");
144                      asm(" NOP  ;");
145                      asm(" NOP  ;");
146                      *fsr_dr_clkr_port_1_ptr = 0xFBF & *fsr_dr_clkr_port_1_ptr;
147                     sync = IN_SYNC;
148                     break;
149                default:
150                     break;
151            }/* end switch(sync) */
152        }/* end if (sync_state == FIFTY_PERCENT) */
153
154    else {    /* if (sync_state == FIFTY_PERCENT) */
155
156        switch(sync){
157                case LOST_SYNC:
158                     break;
159                case FIRST_SYNC:
160                     sync = LOST_SYNC;
161                     break;
162                case IN_SYNC:
163                     *fsr_dr_clkr_port_1_ptr = 0x040 | *fsr_dr_clkr_port_1_ptr;
164                      asm(" NOP  ;");
165                      asm(" NOP  ;");
166                      asm(" NOP  ;");
167                      asm(" NOP  ;");
168                      asm(" NOP  ;");
169                      asm(" NOP  ;");
170                      asm(" NOP  ;");
171                      asm(" NOP  ;");
```

Navy Case No. 77,062

```
172                         asm(" NOP  ;");
173                         asm(" NOP  ;");
174                         asm(" NOP  ;");
175                         asm(" NOP  ;");
176                         *fsr_dr_clkr_port_1_ptr = 0xFBF & *fsr_dr_clkr_port_1_ptr;
177                         sync = LOST_FIRST;
178                         break;
179                   case LOST_FIRST:
180                         sync = LOST_SYNC;
181                         /* Deassert discrete _PAM_SYNC (port DR1) */
182                         *fsr_dr_clkr_port_1_ptr = 0x040 | *fsr_dr_clkr_port_1_ptr;
183                         *mtim_led_out_ptr = 0x3FF;
184                         break;
185                   default:
186                         break;
187                 }/* end switch(sync) */
188
189       }/* end else (sync_state == FIFTY_PERCENT) */
190
191     } /* end if (chan_id == NUMBER_OF_PAM_CHANNELS) */
192
193     *mtim_chan_out_ptr = *mtim_chan_out_ptr & 0x7F; /* pamsync marker for scope
194     display */
195
196     asm(" AND 07FEh,IF;"); /* clear INT0 bit in IF register */
197     asm(" NOP;");
198     asm(" NOP;");
199     asm(" NOP;");
200     asm(" STI IF,@_hosed_adc;");
201     if ((hosed_adc & 0x00000001) AND (pam_sample == 0xFFFFF800)){
202          *adc_status_control_ptr = 0x080; /* disable _ALFL output of ADC */
203          *adc_status_control_ptr = RESET_ADC;
204          }
205
206
207     getting_test_adc_sample = 0;
208     }
```

Navy Case No. 77,062

```
/* ipcomms2.c */

#include "newmtim.h"

unsigned int sent_pcm_status = 0;

void c_int02(void)  /* interprocessor communications ISR */
{
/*  regptr = (unsigned int *) SER0_XFDC_Ctrl_Reg;/* testing; PAM flag, */
/*  *regptr = *regptr | 0x400;                   /* testing; rising edge */

/*   asm(" LDI 02000h,ST      ; globally enable all interrupts. ");*/

switch(*r_mess_opcode_ptr & 0x000000FF){
   case SWITCH_CALIBRATE_OUTPUT:
      if (*r_mess_data_ptr & 0x000000FF)
        mtim_1015_or_8 = 1015;
      else
        mtim_1015_or_8 = 8;
      break;
   case SEND_PCM_CALIBRATION_STATUS:
      send_message(CALIBRATE_PCM_TEST_STATUS,pcm_test_stat);
    regptr = (unsigned int *) SER0_RFDC_Ctrl_Reg;/* testing; PCM flag, */
    *regptr = *regptr & 0xFBF;                   /* testing; falling edge */
      sent_pcm_status++;
      test_stat = 0x00;
      pcm_test_stat = 0x0B;
      break;
   default:
       r_message_opcode = *r_mess_opcode_ptr & 0x000000FF;
       r_message_data = *r_mess_data_ptr & 0x000000FF;
       r_message_flag = 1;
       break;
 }/* end switch(){} */

   asm(" AND 07FDh,IF;"); /* clear INT1 of IF reg */
/*  *regptr = *regptr & 0xBFF;  /* PAM flag falling edge */
}




void send_message(unsigned int code, unsigned int info)
{
  while(!(*fsx_dx_clkx_port_1_ptr & 0x00000008));/* wait for _busyr to
deassert*/
     *t_mess_data_ptr = info;
     *t_mess_opcode_ptr = code;  /* Send the opcodes last because the address which
                                    the opcodes go to cause the interrupt at the
                                    receiving end. */
  return;
}
```

Navy Case No. 77,062

```
/* sndnontm.c */

#include "newmtim.h"

/* This function is called at arbitrary points within the non-TM testing
   phase of the CALIBRATE mode to satisfy ICD requirements. Chan_id stays at
   64 (although the ICD says to cycle through channel IDs), .syncst stays at
   1, and .adc_dr is toggled. .data is the appropriate choice of 1015, 8,
   or 512.
*/

void send_non_tm_cal_readings(void)
{
   mtim_data_output.data = mtim_1015_or_8;

   mtim_data_output.syncst = 1;

   mtim_data_output.adc_dr = 0;

   *mtim_chan_out_ptr = hex2bcd[64];
   *mtim_data_out_ptr = mtim_data_output;

   *timer1_global_cntrl_ptr = START_TIMER1;
   while(*timer1_count_ptr < 20); /* setup time */

   mtim_data_output.adc_dr = 1;
   *mtim_data_out_ptr = mtim_data_output;

   *timer1_global_cntrl_ptr = START_TIMER1;
   while(*timer1_count_ptr < 20); /* hold time */

   *timer1_global_cntrl_ptr = STOP_TIMER1;

   return;
}
```

Navy Case No. 77,062

```
1     /* gen_pcm.c */
2
3     /* ************************************************************ */
4     /*      This Function will generate the simulated PCM stream     */
5     /*        for output onto the serial port.  The values have to   */
6     /*        be bit reversed for the MTIMS                          */
7     /* ************************************************************ */
8
9     #include "newmtim.h"
10
11    int paul;
12
13    void generate_pcm()
14    {
15
16    /*      extern unsigned int     r_message_opcode,
17                          inword,
18                          outword,
19                          interrupt_enab_ctrl,
20                          gie_ctrl,
21                          sim_pcm[PCM_SIZE];
22    */
23         int                     x,y;                /* Local variables */
24
25         unsigned int            *register_ptr;
26
27         interrupt_en_cntrl = DMA_SERO_INT;
28
29         if (r_message_opcode == 0x24)
30         {
31              for (x=0; x<=24; x++)
32              {
33                   sim_pcm[x] = 0xAA55AA55;
34              }
35              sim_pcm[24] = 0x04CF5F55;
36    /*        sim_pcm[24] = 0xAA04CF5F;*/
37
38              for (x=0; x<=24; x++)
39              {
40                   inword = sim_pcm[x];  /* inword is a global variable */
41                   asm(" LDI @_inword,R5; Load R5 with inword");
42                   for (y = 1; y<= 32; y++)
43                   {
44                        asm(" RORC R5; Rotate right through carry");
45                        asm(" ROLC R4; Rotate left through carry");
46                   }
47                   asm(" STI R4,@_outword; Load outword with R4");
48                   sim_pcm[x] = outword; /* outword is a global variable */
49              }
50
51              register_ptr = (unsigned int *) DMA_Glob_Ctrl_Reg;
52              *register_ptr = 0x00000E10;
53
54              register_ptr = (unsigned int *) DMA_Src_Addr_Reg;
55              *register_ptr = (unsigned int) &sim_pcm[0];
56
57              register_ptr = (unsigned int *) DMA_Dst_Addr_Reg;
```

Navy Case No. 77,062

```
58              *register_ptr = SER0_X_Reg;
59
60              register_ptr = (unsigned int *) DMA_Tran_Ctr_Reg;
61              *register_ptr = 0x19;
62
63              register_ptr = (unsigned int *) SER0_Glob_Ctrl_Reg;
64              *register_ptr = 0xC1204/*0xC1200*/;
65
66              register_ptr = (unsigned int *) SER0_XFDC_Ctrl_Reg;
67              *register_ptr = 0x231/*0x31*/;
68
69              register_ptr = (unsigned int *) SER0_RFDC_Ctrl_Reg;
70         /*  *register_ptr = 0x20; */
71              *register_ptr = *register_ptr | 0x020;/* to preserve the state
72                                 of PCM flag, bit 6, for testing */
73
74              register_ptr = (unsigned int *) SER0_RX_Tim_Ctrl_Reg;
75              *register_ptr = 0x0;
76
77              register_ptr = (unsigned int *) SER0_RX_Tim_Ctr_Reg;
78              *register_ptr = 0x0;
79
80              register_ptr = (unsigned int *) SER0_RX_Tim_Per_Reg;
81              *register_ptr = 0x0;
82
83              register_ptr = (unsigned int *) SER0_X_Reg;
84              *register_ptr = 0x0;
85
86              register_ptr = (unsigned int *) SER0_R_Reg;
87              *register_ptr = 0x0;
88
89              register_ptr = (unsigned int *) DMA_Glob_Ctrl_Reg;
90              *register_ptr = 0x00000E13;
91                        /* START=11 - Reset DMA to begin new cycle on start */
92                         /*         - NOTE: Must be set to 11 to begin Trans*/
93                         /* STAT=00 - Read Only */
94                        /* INCSRC=1 - incr source address */
95                        /* DECSRC=0 - do not decr source address */
96                        /* INCDST=0 - do not incr dest address */
97                        /* DECDST=0 - do not decr dest addrss */
98                         /* SYNC=10 - write on enable from XINT0 */
99                             /* TC=1 - stop when transfer cntr = 0 */
100                        /* TCINT=1 - set DMA int TC=0 */
101
102           asm (" LDI @_interrupt_en_cntrl,IE; Enable CPU/DMA and DMA SER0 XMIT Ints");
103   /*          asm (" OR @_gie_ctrl,ST; Set GLobal Interrupt Enable Bit");*/
104
105             register_ptr = (unsigned int *) SER0_Glob_Ctrl_Reg;
106             *register_ptr = 0x08C1704;
107                          /* RRDY=0 - Read Only */
108                          /* XRDY=0 - Read Only */
109                          /* FSXOUT=1 - FSX0 */
110                          /* XSREMPTY=0 - Read Only */
111
112                        /* RSRFULL=0 - Read Only */
113                             /* HS=0 - Disable Handshaking */
114                        /* XCLKSRCE=0 - CLKX0 Inputs 320KHz clk */
```

Navy Case No. 77,062

```
115                    /* RCLKSRCE=0 - n/a, CLKR0 */
116
117                      /* XVAREN=1 - FSX0 */
118                      /* RVAREN=1 - FSR0 */
119                        /* XFSM=1 - FSX0 */
120                        /* RFSM=0 - n/a, FSR0 */
121
122                       /* CLKXP=1 - Clock DX0 out on falling edge of CLKX0 */
123                       /* CLXPR=0 - n/a, FSX0 */
124                         /* DXP=0 - DX0 polarity active high **7/18/95** */
125                         /* DRP=0 - n/a */
126
127                        /* FSXP=0 - n/a */
128                        /* FSRP=0 - n/a */
129                       /* XLEN=11 - XMIT 32-bits of PCM Data */
130
131                       /* RLEN=00 - n/a */
132                       /* XTINT=0 - disable XMTR timer interrupt */
133                        /* XINT=1 - enable XMTR intrerrupt */
134                         /*          Note: Must be set to 1 to enable PCM */
135
136                       /* RTINT=0 - disable RCVR timer interrupt */
137                        /* RINT=0 - disable RCVR interrupt */
138                      /* XRESET=0 - Put XMTR in reset mode */
139                      /* RRESET=0 - n/a */
140
141          register_ptr = (unsigned int *) SER0_Glob_Ctrl_Reg;
142          *register_ptr = 0x48C1704;
143                        /* RRDY=0 - Read Only */
144                        /* XRDY=0 - Read Only */
145                     /* FSXOUT=1 - FSX0 */
146                  /* XSREMPTY=0 - Read Only */
147
148                   /* RSRFULL=0 - Read Only */
149                        /* HS=0 - Disable Handshaking */
150                  /* XCLKSRCE=0 - CLKX0 Inputs 320KHz clk */
151                  /* RCLKSRCE=0 - n/a, CLKR0 */
152
153                      /* XVAREN=1 - FSX0 */
154                      /* RVAREN=1 - FSR0 */
155                        /* XFSM=1 - FSX0 */
156                        /* RFSM=0 - n/a, FSR0 */
157
158                       /* CLKXP=1 - Clock DX0 out on falling edge of CLKX0 */
159                       /* CLXPR=0 - n/a, FSX0 */
160                         /* DXP=0 - DX0 polarity active high **7/18/95** */
161                         /* DRP=0 - n/a */
162
163                        /* FSXP=0 - n/a */
164                        /* FSRP=0 - n/a */
165                       /* XLEN=11 - XMIT 32-bits of PCM Data */
166
167                       /* RLEN=00 - n/a */
168                       /* XTINT=0 - disable XMTR timer interrupt */
169                        /* XINT=1 - enable XMTR intrerrupt */
170                         /*          Note: Must be set to 1 to enable PCM */
171
```

Navy Case No. 77,062

```
                        /* RTINT=0 - disable RCVR timer interrupt */
                         /* RINT=0 - disable RCVR interrupt */
                       /* XRESET=1 - de-reset XMTR */
                       /* RRESET=0 - n/a */

            register_ptr = (unsigned int *)SERO_X_Reg;
            *register_ptr = 0xAA55AA55;

        }

    /*asm(" OR 040h,IOF    ; clear watchdog timer (rising edge, port XF1, bit 6)"); */

        return;
    }
```

Navy Case No. 77,062

```
1     /* getpcm.c */
2
3     #include "newmtim.h"
4
5     /*********************************************************************/
6     /*     This Function will get the PCM_Words out of Dual Port RAM       */
7     /*     and put them into a matrix called pcm_words to be used later    */
8     /*********************************************************************/
9
10    unsigned int previous_word_50 = 0x148B;
11    unsigned int previous_word_51 = 0xEB74;
12
13    void get_pcm_words()
14    {
15         unsigned int    chan_count = 1,
16                   *dpram_ptr_start;
17
18         if (r_message_opcode == 0x50 || r_message_opcode == 0x51)
19              dpram_ptr_start = (unsigned int *)DPRAM_BANK0_START;
20         else
21              dpram_ptr_start = (unsigned int *)DPRAM_BANK1_START;
22
23         while (chan_count <= 100)
24         {
25             dpram_ptr_start++;
26
27    /*       if (!calibrating_pcm){  */
28             if (chan_count == 50 AND !calibrating_pcm){
29               pcm_wd[chan_count] = previous_word_50;
30               previous_word_50 = *dpram_ptr_start & 0x000000FF;
31               }
32             else if (chan_count == 51 AND !calibrating_pcm){
33               pcm_wd[chan_count] = previous_word_51;
34               previous_word_51 = *dpram_ptr_start & 0x000000FF;
35               }
36             else
37               pcm_wd[chan_count] = *dpram_ptr_start & 0x000000FF;
38    /*        }* end if (!calibrating_pcm) */
39
40             if (pcm_wd[chan_count] & 0x00000080)
41                pcm_wd[chan_count] = pcm_wd[chan_count] | 0xFFFFFF00;
42
43             if ((chan_count == pcm_pushwheels) OR (chan_count == 100 AND pcm_pushwheels
44                 == 0))
45               *pcm_led_out_ptr = ~(pcm_wd[chan_count]);
46               chan_count++;
47         } /* end while (chan_count <= 100) */
48
49    /*  asm(" OR 040h,IOF    ; clear watchdog timer (rising edge, port XF1, bit 6)
50    "); */
51
52         return;
53    }
```

Navy Case No. 77,062

```
/* pcm_mod3.c */

/* ************************************************************** */
/*      PCM Mode Function.  This function will do the main number    */
/*        crunching of the PCM data stream.                          */
/*        The data will be put out onto the MTIM data channels       */
/* ************************************************************** */

#include "newmtim.h"

unsigned int pcm_loop_counter;
unsigned int pcm_test_stat = 1;
unsigned int bank_count = 0;

extern void scale_2_lookup(unsigned int);
extern void scale_1_lookup(unsigned int);
extern void pcf_1_lookup(unsigned int);
extern void pcm_50_lookup(unsigned int);
extern void pcm_51_lookup(unsigned int);
extern void pass_thru_lookup(unsigned int);
extern void comp_index_lookup(unsigned int);

unsigned int index1,index2,index3;

void pcm_mode()
{
     int     x,y,          /* Basic variables */
          value,
          mean_1,mean_2,       /* Mean comparison values for CTBB */
          op_code,
          pass_thru = 0x50;    /* variable allow both sync patterns to */
                               /*  pass thru processing and be */
                               /*  output directly, PCM & PAM sync */
     unsigned int *register_ptr;
        unsigned int test_stat_temp;
        unsigned int i; /* local counter in "for()" loops */

/* ********************************************************** */
/*             Start of PCM_MODE Function          */
/* ********************************************************** */

op_code = r_message_opcode;
interrupt_en_cntrl = DMA_SERO_INT;
asm(" LDI @_interrupt_en_cntrl,IE; Enable CPU/DMA and DMA SERO XMIT Ints");

get_pcm_words(); /*  Get all PCM Words from DPRAM */

for (pcm_loop_counter = 0; pcm_loop_counter< 132; pcm_loop_counter+=2){
  scale_2_lookup(pcm_loop_counter);
  pcm_word[index1] = scale(pcm_wd[index2],128,255);
}

for ( pcm_loop_counter = 0;  pcm_loop_counter< 24;  pcm_loop_counter+=2){
  scale_1_lookup(pcm_loop_counter);
  pcm_word[index1] = scale(pcm_wd[index2],32,63);
}
```

Navy Case No. 77,062

```
58      for ( pcm_loop_counter = 0;  pcm_loop_counter < 18 ;  pcm_loop_counter+=3){
59        pcf_1_lookup(pcm_loop_counter);
60        pcm_word[index1] = pcf_1(pcm_wd[index2], pcm_wd[index3]);
61      }
62
63
64      pcm_word[0x27] = pcf_2(pcm_wd[58], pcm_wd[59]);
65
66
67      for ( pcm_loop_counter = 0;  pcm_loop_counter < 16 ;  pcm_loop_counter+=2){
68        pcm_51_lookup(pcm_loop_counter);
69            if (pcm_wd[51] & index2)
70                 pcm_word[index1] = ONE_HUNDRED_PERCENT;
71            else
72                 pcm_word[index1] = ZERO_PERCENT;
73      }
74
75
76      for ( pcm_loop_counter = 0;  pcm_loop_counter < 16 ;  pcm_loop_counter+=2){
77        pcm_50_lookup(pcm_loop_counter);
78            if (pcm_wd[50] & index2)
79                 pcm_word[index1] = ONE_HUNDRED_PERCENT;
80            else
81
82                 pcm_word[index1] = ZERO_PERCENT;
83      }
84
85
86      /* Output MTIM Channel 59 */
87
88            if (pcm_wd[5] & 0x0008)
89                 pcm_word[0x59] = ONE_HUNDRED_PERCENT;
90            else
91
92                 pcm_word[0x59] = ZERO_PERCENT;
93
94
95      for ( pcm_loop_counter=0;  pcm_loop_counter < 52;  pcm_loop_counter+=2){
96       pass_thru_lookup(pcm_loop_counter);
97        if ( pcm_loop_counter > 11 AND  pcm_loop_counter< 21){
98             switch( pcm_loop_counter){
99                 case 12:
100                     pcm_word[index1] = ZERO_PERCENT;
101                     break;
102                case 14:
103                case 16:
104                case 18:
105                     pcm_word[index1] = ONE_HUNDRED_PERCENT;
106                     break;
107                case 20:
108                     pcm_word[index1] = FTY_PERCENT;
109                     break;
110                default:
111                     break;
112            }/* end switch(i) */
113        }
114       else
```

Navy Case No. 77,062

```
115         pcm_word[index1] = pcm_wd[index2] & 0x000000FF;
116     }
117
118
119     for (pcm_loop_counter = 0;  pcm_loop_counter < 128;  pcm_loop_counter++){
120     /* send_pcm(pcm_word[pcm_loop_counter], pcm_loop_counter); */
121
122     /* mtim_data_output.syncst = 1; /* If this function is called, then the
123                                        system is in PCM sync. */
124
125     /*   mtim_data_output.adc_dr = 0; */
126
127        if (oper_cal)
128           mtim_data_output.data = mtim_1015_or_8;
129        else
130           mtim_data_output.data = /*data_word*/ pcm_word[pcm_loop_counter];
131
132        mtim_data_output.syncst = 1;
133        *mtim_data_out_ptr = mtim_data_output;
134        *mtim_chan_out_ptr = /*chan_word*/ pcm_loop_counter;
135
136          if (/*chan_word*/ pcm_loop_counter == mtim_pushwheels){
137              *mtim_led_out_ptr = ~mtim_data_output.data;
138              }
139
140        mtim_data_output.adc_dr = 1;
141        *mtim_data_out_ptr = mtim_data_output;
142
143        *timer1_global_cntrl_ptr = START_TIMER1;
144        while(*timer1_count_ptr < 7); /* setup time */
145
146     /* *timer1_global_cntrl_ptr = START_TIMER1;
147        while(*timer1_count_ptr < 7); /* hold time */
148
149        mtim_data_output.adc_dr = 0;
150        *mtim_data_out_ptr = mtim_data_output;
151
152     /* *timer1_global_cntrl_ptr = STOP_TIMER1;*/
153
154     }
155
156
157     if (calibrating_pcm OR oper_cal){
158     if (bank_count < 2){
159         test_stat = 1;
160         for (pcm_loop_counter =0; pcm_loop_counter < 128; pcm_loop_counter++){
161            comp_index_lookup(pcm_loop_counter);
162            if (/*0*/ pcm_word[pcm_loop_counter] !=  (unsigned int)comp[index1]){
163                 test_stat = 0;
164                 break;
165                 }
166         }/* end for() loop */
167     bank_count++;
168     if (!pcm_test_stat)
169       pcm_test_stat = 0;
170     else
171       pcm_test_stat = test_stat;
```

Navy Case No. 77,062

```
172     }/* end if (bank_count < 2) */
173     }/* end if (calibrating_pcm OR oper_cal) */
174
175     return;
176     }
177
178
179
180
181     /* ************************************************************ */
182     /*    This Function will output a scaled pcm_word[]             */
183     /*       depending on analog input pcm_word[]                   */
184     /* ************************************************************ */
185
186     int scale(int digitized_analog, int numer, int denom)
187     {
188          int   scaled_output;
189          float value;
190          value = digitized_analog + numer;
191          scaled_output = (value / denom * 1007) + 8;
192
193          return (scaled_output);
194     }
```

Navy Case No. 77,062

```
1     ;pcm_lkup.asm
2
3     ; This assembly function accesses the values in the pcm lookup tables
4     ; contained in the file "lookups.asm".
5
6     FP .set AR3 ; FP is AR3
7        .global _scale_2_lookup ; declare external function name
8        .global _scale_1_lookup ; declare external function name
9        .global _pcf_1_lookup ; declare external function name
10       .global _pcm_50_lookup ; declare external function name
11       .global _pcm_51_lookup ; declare external function name
12       .global _pass_thru_lookup ; declare external function name
13       .global _comp_index_lookup ; declare external function name
14       .global _pcm_loop_counter          ; counter in C for() loops
15
16       .global _index1
17       .global _index2
18       .global _index3
19
20       .global _scale_2_index
21       .global _scale_1_index
22       .global _pcf_1_index
23       .global _pcm_50_mask
24       .global _pcm_51_mask
25       .global _pass_thru_index
26       .global _comp_index
27
28    _scale_2_lookup:
29      PUSH  FP            ;save old frame pointer
30      PUSH  R0            ;save old R0
31      PUSH  R4
32      PUSH  AR4
33      LDI   SP,FP         ;make FP point to top of stack
34      LDI   *-FP(2),R0    ;load _pcm_loop_counter into R0
35      ; small memory model -- don't need to mess with DP
36      LDI  R0,AR4
37      ADDI _scale_2_index,AR4
38      LDI  *AR4,R4
39      STI  R4,@_index1
40      ADDI 1,AR4
41      LDI  *AR4,R4
42      STI  R4,@_index2
43      POP  AR4
44      POP  R4
45      POP  R0
46      POP  FP  ; restore old FP value
47      RETS
48
49
50
51    _scale_1_lookup:
52      PUSH  FP            ;save old frame pointer
53      PUSH  R0            ;save old R0
54      PUSH  R4
55      PUSH  AR4
56      LDI   SP,FP         ;make FP point to top of stack
57      LDI   *-FP(2),R0    ;load _pcm_loop_counter into R0
```

Navy Case No. 77,062

```
58      ; small memory model -- don't need to mess with DP
59      LDI  R0,AR4
60      ADDI _scale_1_index,AR4
61      LDI  *AR4,R4
62      STI  R4,@_index1
63      ADDI 1,AR4
64      LDI  *AR4,R4
65      STI  R4,@_index2
66      POP  AR4
67      POP  R4
68      POP  R0
69      POP  FP  ; restore old FP value
70      RETS
71
72
73
74    _pcf_1_lookup:
75      PUSH  FP            ;save old frame pointer
76      PUSH  R0            ;save old R0
77      PUSH  R4
78      PUSH  AR4
79      LDI   SP,FP         ;make FP point to top of stack
80      LDI   *-FP(2),R0    ;load _pcm_loop_counter into R0
81      ; small memory model -- don't need to mess with DP
82      LDI  R0,AR4
83      ADDI _pcf_1_index,AR4
84      LDI  *AR4,R4
85      STI  R4,@_index1
86      ADDI 1,AR4
87      LDI  *AR4,R4
88      STI  R4,@_index2
89      ADDI 1,AR4
90      LDI  *AR4,R4
91      STI  R4,@_index3
92      POP  AR4
93      POP  R4
94      POP  R0
95      POP  FP  ; restore old FP value
96      RETS
97
98
99    _pcm_50_lookup:
100     PUSH  FP            ;save old frame pointer
101     PUSH  R0            ;save old R0
102     PUSH  R4
103     PUSH  AR4
104     LDI   SP,FP         ;make FP point to top of stack
105     LDI   *-FP(2),R0    ;load _pcm_loop_counter into R0
106     ; small memory model -- don't need to mess with DP
107     LDI  R0,AR4
108     ADDI _pcm_50_mask,AR4
109     LDI  *AR4,R4
110     STI  R4,@_index1
111     ADDI 1,AR4
112     LDI  *AR4,R4
113     STI  R4,@_index2
114     POP  AR4
```

Navy Case No. 77,062

```
115      POP  R4
116      POP  R0
117      POP  FP   ; restore old FP value
118      RETS
119
120
121    _pcm_51_lookup:
122      PUSH  FP            ;save old frame pointer
123      PUSH  R0            ;save old R0
124      PUSH  R4
125      PUSH  AR4
126      LDI   SP,FP         ;make FP point to top of stack
127      LDI   *-FP(2),R0    ;load _pcm_loop_counter into R0
128      ; small memory model -- don't need to mess with DP
129      LDI  R0,AR4
130      ADDI _pcm_51_mask,AR4
131      LDI  *AR4,R4
132      STI  R4,@_index1
133      ADDI 1,AR4
134      LDI  *AR4,R4
135      STI  R4,@_index2
136      POP  AR4
137      POP  R4
138      POP  R0
139      POP  FP   ; restore old FP value
140      RETS
141
142
143    _pass_thru_lookup:
144      PUSH  FP            ;save old frame pointer
145      PUSH  R0            ;save old R0
146      PUSH  R4
147      PUSH  AR4
148      LDI   SP,FP         ;make FP point to top of stack
149      LDI   *-FP(2),R0    ;load _pcm_loop_counter into R0
150      ; small memory model -- don't need to mess with DP
151      LDI  R0,AR4
152      ADDI _pass_thru_index,AR4
153      LDI  *AR4,R4
154      STI  R4,@_index1
155      ADDI 1,AR4
156      LDI  *AR4,R4
157      STI  R4,@_index2
158      POP  AR4
159      POP  R4
160      POP  R0
161      POP  FP   ; restore old FP value
162      RETS
163
164
165    _comp_index_lookup:
166      PUSH  FP            ;save old frame pointer
167      PUSH  R0            ;save old R0
168      PUSH  R4
169      PUSH  AR4
170      LDI   SP,FP         ;make FP point to top of stack
171      LDI   *-FP(2),R0    ;load _pcm_loop_counter into R0
```

Navy Case No. 77,062

```
; small memory model -- don't need to mess with DP
LDI  R0,AR4
ADDI _comp_index,AR4
LDI  *AR4,R4
STI  R4,@_index1
POP  AR4
POP  R4
POP  R0
POP  FP   ; restore old FP value
RETS
```

Navy Case No. 77,062

```
;lookups.asm

 .global _scale_2_index, _scale_1_index, _pcf_1_index, _pcm_51_mask
 .global _pcm_50_mask, _pass_thru_index, _comp_index

 .sect "scale_2_table"
; MTIM channel, index
_scale_2_index:
 .word  2h, 26h
 .word  4h, 36h,  5h, 21h,  6h, 37h,  7h, 48h,  8h, 38h,  9h, 39h, 0Ah, 1Ah
 .word 0Bh, 1Bh, 0Ch, 1Ch, 0Dh, 1Fh, 0Eh, 4Ah, 0Fh, 27h, 11h, 3Ch, 12h, 14h
 .word 14h, 58h, 15h, 59h, 16h, 0Fh, 17h, 25h, 18h, 49h, 1Ah, 18h, 1Bh, 28h
 .word 1Ch, 1Dh, 1Dh, 1Eh, 1Eh, 22h, 1Fh, 23h, 20h, 30h, 21h, 47h, 22h, 35h
 .word 23h, 46h, 24h, 34h, 25h, 57h, 29h, 5Ah, 2Ah, 2Fh, 2Bh, 3Dh, 2Ch, 4Bh
 .word 2Dh, 4Ch, 2Eh, 4Dh, 2Fh, 4Eh, 31h, 3Eh, 33h, 40h, 35h, 41h, 37h, 20h
 .word 39h, 19h, 3Ah, 4Fh, 3Bh, 50h, 3Ch, 51h, 3Dh, 52h, 3Eh, 53h, 3Fh, 54h
 .word 41h, 17h, 43h, 16h, 45h, 24h, 49h, 31h, 4Ah, 55h, 4Bh, 56h, 4Ch, 5Bh
 .word 4Eh, 60h, 4Fh, 61h, 51h, 10h, 53h, 0Eh, 55h, 42h, 57h, 3Fh, 58h, 15h
 .word 7Ch, 3Ah, 7Dh, 3Bh

 .sect "scale_1_table"
; MTIM channel, index
_scale_1_index:
 .word 0h,  0Ah
 .word 4Dh, 5Fh, 74h, 0Dh, 75h, 0Ch, 76h, 9h,  77h, 2Dh, 78h, 2Eh, 79h, 0Bh
 .word 7Ah, 6h,  7Bh, 7h,  7Eh, 29h, 7Fh, 8h

 .sect "pcf_1_table"
_pcf_1_index:
;MTIM channel, index1, index2
 .word 1h, 10, 95
 .word 3h, 13, 12
 .word 10h, 9, 45
 .word 13h, 46, 11
 .word 19h, 6, 7
 .word 47h, 41, 8

 .sect "pcm_51_table"
_pcm_51_mask:
;MTIM channel, mask
 .word 26h, 80h   ;42h, 1h
 .word 28h, 40h   ;44h, 2h
 .word 30h, 20h   ;46h, 4h
 .word 32h, 10h   ;48h, 8h
 .word 34h, 08h   ;50h, 10h
 .word 36h, 04h   ;52h, 20h
 .word 38h, 02h   ;54h, 40h
 .word 40h, 01h   ;56h, 80h

 .sect "pcm_50_table"
_pcm_50_mask:
;MTIM channel, mask
 .word 42h, 80h   ;26h, 1h
 .word 44h, 40h   ;28h, 2h
 .word 46h, 20h   ;30h, 4h
 .word 48h, 10h   ;32h, 8h
 .word 50h, 08h   ;34h, 10h
```

Navy Case No. 77,062

```
58      .word 52h, 04h    ;36h, 20h
59      .word 54h, 02h    ;38h, 40h
60      .word 56h, 01h    ;40h, 80h
61
62      .sect "pass_thru_table"
63     _pass_thru_index:
64     ;MTIM channel, index
65      .word 5Ah, 32h, 5Bh, 33h, 5Ch, 1h, 5Dh, 2h, 5Eh, 4h, 5Fh, 5h
66      .word 60h, 8h    ;ZERO_PERCENT
67      .word 61h, 3F7h ;ONE_HUNDRED_PERCENT
68      .word 62h, 3F7h ;ONE_HUNDRED_PERCENT
69      .word 63h, 3F7h ;ONE_HUNDRED_PERCENT
70      .word 64h, 200h ;FTY_PERCENT
71      .word 65h, 11h, 66h, 12h, 67h, 13h, 68h, 2Ah, 69h, 2Bh, 6Ah, 2Ch
72      .word 6Bh, 43h, 6Ch, 44h, 6Dh, 45h, 6Eh, 5Ch, 6Fh, 5Dh, 70h, 5Eh
73      .word 71h, 62h, 72h, 63h, 73h, 64h
74
75      .sect "comp_index_table"
76     _comp_index:
77     ;MTIM channel is index into table, table entries are index into comp variable
78      .word 9,14,8,15,8,5,5,8,8,5,8,5,8,5,8,5    ;0x00 thru 0x0F
79      .word 6,8,8,14,8,5,5,5,5,14,8,8,5,8,8,5    ;0x10 thru 0x1F
80
81      .word 8,5,5,8,8,5,0,16,1,8,5,5,5,8,5,8     ;0x20 thru 0x2F (original)
82      ;.word 8,5,5,8,8,5,1,16,0,8,5,5,5,8,5,8    0x20 thru 0x2F (re-mapping)
83
84      .word 0,8,1,8,0,5,1,8,0,5,5,8,5,8,5,8      ;0x30 thru 0x3F (original)
85      ;.word 1,8,0,8,1,5,0,8,1,5,5,8,5,8,5,8     0x30 thru 0x3F (re-mapping)
86
87      .word 1,5,1,8,0,8,1,15,0,5,5,8,5,4,8,5     ;0x40 thru 0x4F (original)
88      ;.word 0,5,0,8,1,8,0,15,1,5,5,8,5,4,8,5    0x40 thru 0x4F (re-mapping)
89
90      .word 1,8,0,8,1,8,0,5,5,0,3,2,2,3,3,2      ;0x50 thru 0x5F (original)
91      ;.word 0,8,1,8,0,8,1,5,5,0,2,3,2,3,3,2     0x50 thru 0x5F (re-mapping)
92
93      .word 0,1,1,1,13  ;8h,3F7h,3F7h,3F7h,200h  PAM frame sync pattern
94      .word 2,3,2,3,2,3,2,3,2,3,2,3,10,11,12  ;0x65 thru 0x73
95      .word 4,9,4,4,9,4,9,4,8,5,4,9           ;0x74 thru 0x7F
```

Navy Case No. 77,062

```
/* reg_test.c */

#include "newmtim.h"

/*extern unsigned int test_stat;*/

double testf1 = 3.14159e-4, testf2 = 9.12345e14;
int testi1 = 0xAAAAAAAA, testi2 = 0x55555555, temp1, temp2;

void reg_test(void)
{
   test_stat = 1;

   /* load and read from R and AR CPU registers */

   /* test R0 */
   asm(" STI R0,@_temp1            ; save contents of R0 at temp1 address. ");


   asm(" STI R1,@_temp2            ; save contents of R1 at temp2 address. ");

   asm(" LDI 01h,R1                ; set b0 of  R1");

   asm(" LDF  @_testf1,R0     ;load register R0 with 40-bit floating point number.");
   asm(" CMPF @_testf1,R0          ; ");
   asm(" LDINE 00h,R1              ; if not, set LSB of R1. ");
   asm(" STI   R1,@_test_stat      ; store R1 into test_stat location. ");

   asm(" LDF  @_testf2,R0    ; load register R0 with 40-bit floating point number.");
   asm(" CMPF @_testf2,R0          ; ");
   asm(" LDINE 00h,R1              ; if not, set LSB of test_stat location. ");
   asm(" STI R1,@_test_stat        ; ");

   asm(" LDI  @_testi1,R0          ; load register R0 with 32-bit integer. ");
   asm(" CMPI @_testi1,R0          ; does R0 contain 0xAAAAAAAA? ");
   asm(" LDINE 00h,R1              ; if not, set LSB of test_stat location. ");
   asm(" STI R1,@_test_stat        ; ");

   asm(" LDI  @_testi2,R0          ; load register R0 with 32-bit integer. ");
   asm(" CMPI @_testi2,R0          ; does R0 contain 0x55555555? ");
   asm(" LDINE 00h,R1              ; if not, set LSB of test_stat location. ");
   asm(" STI R1,@_test_stat        ; ");


/* test R1 */

   asm(" LDI R1,R0                 ; save current test_stat value.");
   asm(" LDF  @_testf1,R1    ; load register R1 with 40-bit floating point number.");
   asm(" CMPF @_testf1,R1          ; ");
   asm(" LDINE 00h,R0              ; if not, set LSB of R1. ");
   asm(" STI   R0,@_test_stat      ; store R0 into test_stat location. ");

   asm(" LDF  @_testf2,R1          ; load register R1 with 40-bit floating
point number.
");
   asm(" CMPF @_testf2,R1          ; ");
```

Navy Case No. 77,062

```
58      asm(" LDINE 00h,R0              ; if not, set LSB of test_stat location. ");
59      asm(" STI R0,@_test_stat        ; ");
60
61      asm(" LDI  @_testi1,R1          ; load register R1 with 32-bit integer. ");
62      asm(" CMPI @_testi1,R1          ; does R1 contain 0xAAAAAAAA? ");
63      asm(" LDINE 00h,R0              ; if not, set LSB of test_stat location. ");
64      asm(" STI R0,@_test_stat        ; ");
65
66      asm(" LDI  @_testi2,R1          ; load register R1 with 32-bit integer. ");
67      asm(" CMPI @_testi2,R1          ; does R1 contain 0x55555555? ");
68      asm(" LDINE 00h,R0              ; if not, set LSB of test_stat location. ");
69      asm(" STI R0,@_test_stat        ; ");
70
71      asm(" LDI R0,R1                 ; save current test_stat value in R1. ");
72      asm(" LDI @_temp1,R0            ; restore contents of R0. ");
73
74
75
76
77
78
79    /* test R2 */
80      asm(" STI R2,@_temp1            ; save contents of R2 at temp1 address. ");
81
82
83
84      asm(" LDF  @_testf1,R2   ; load register R2 with 40-bit floating point number.");
85      asm(" CMPF @_testf1,R2          ; ");
86      asm(" LDINE 00h,R1              ; if not, set LSB of R1. ");
87      asm(" STI   R1,@_test_stat      ; store R1 into test_stat location. ");
88
89      asm(" LDF  @_testf2,R2 ; load register R2 with 40-bit floating point number.");
90      asm(" CMPF @_testf2,R2          ; ");
91      asm(" LDINE 00h,R1              ; if not, set LSB of test_stat location. ");
92      asm(" STI R1,@_test_stat        ; ");
93
94      asm(" LDI  @_testi1,R2          ; load register R2 with 32-bit integer. ");
95      asm(" CMPI @_testi1,R2          ; does R2 contain 0xAAAAAAAA? ");
96      asm(" LDINE 00h,R1              ; if not, set LSB of test_stat location. ");
97      asm(" STI R1,@_test_stat        ; ");
98
99      asm(" LDI  @_testi2,R2          ; load register R2 with 32-bit integer. ");
100     asm(" CMPI @_testi2,R2          ; does R2 contain 0x55555555? ");
101     asm(" LDINE 00h,R1              ; if not, set LSB of test_stat location. ");
102     asm(" STI R1,@_test_stat        ; ");
103
104     asm(" LDI @_temp1,R2            ; restore contents of R2. ");
105
106
107
108   /* test R3 */
109     asm(" STI R3,@_temp1            ; save contents of R3 at temp1 address. ");
110
111
112
113     asm(" LDF  @_testf1,R3   ; load register R3 with 40-bit floating point number.");
114     asm(" CMPF @_testf1,R3          ; ");
```

Navy Case No. 77,062

```
115     asm(" LDINE 00h,R1              ; if not, set LSB of R1. ");
116     asm(" STI   R1,@_test_stat      ; store R1 into test_stat location. ");
117
118     asm(" LDF  @_testf2,R3    ; load register R3 with 40-bit floating point number.");
119     asm(" CMPF @_testf2,R3          ; ");
120     asm(" LDINE 00h,R1              ; if not, set LSB of test_stat location. ");
121     asm(" STI R1,@_test_stat        ; ");
122
123     asm(" LDI  @_testi1,R3          ; load register R3 with 32-bit integer. ");
124     asm(" CMPI @_testi1,R3          ; does R3 contain 0xAAAAAAAA? ");
125     asm(" LDINE 00h,R1              ; if not, set LSB of test_stat location. ");
126     asm(" STI R1,@_test_stat        ; ");
127
128     asm(" LDI  @_testi2,R3          ; load register R3 with 32-bit integer. ");
129     asm(" CMPI @_testi2,R3          ; does R3 contain 0x55555555? ");
130     asm(" LDINE 00h,R1              ; if not, set LSB of test_stat location. ");
131     asm(" STI R1,@_test_stat        ; ");
132
133     asm(" LDI @_temp1,R3            ; restore contents of R3. ");
134
135
136
137  /* test R4 */
138     asm(" STI R4,@_temp1            ; save contents of R4 at temp1 address. ");
139
140
141
142     asm(" LDF  @_testf1,R4    ; load register R4 with 40-bit floating point number.");
143     asm(" CMPF @_testf1,R4          ; ");
144     asm(" LDINE 00h,R1              ; if not, set LSB of R1. ");
145     asm(" STI   R1,@_test_stat      ; store R1 into test_stat location. ");
146
147     asm(" LDF  @_testf2,R4    ; load register R4 with 40-bit floating point number.");
148     asm(" CMPF @_testf2,R4          ; ");
149     asm(" LDINE 00h,R1              ; if not, set LSB of test_stat location. ");
150     asm(" STI R1,@_test_stat        ; ");
151
152     asm(" LDI  @_testi1,R4          ; load register R4 with 32-bit integer. ");
153     asm(" CMPI @_testi1,R4          ; does R4 contain 0xAAAAAAAA? ");
154     asm(" LDINE 00h,R1              ; if not, set LSB of test_stat location. ");
155     asm(" STI R1,@_test_stat        ; ");
156
157     asm(" LDI  @_testi2,R4          ; load register R4 with 32-bit integer. ");
158     asm(" CMPI @_testi2,R4          ; does R4 contain 0x55555555? ");
159     asm(" LDINE 00h,R1              ; if not, set LSB of test_stat location. ");
160     asm(" STI R1,@_test_stat        ; ");
161
162     asm(" LDI @_temp1,R4            ; restore contents of R4. ");
163
164
165
166
167  /* test R5 */
168     asm(" STI R5,@_temp1            ; save contents of R5 at temp1 address. ");
169
170
171
```

Navy Case No. 77,062

```
172        asm(" LDF  @_testf1,R5   ; load register R5 with 40-bit floating point number.");
173        asm(" CMPF @_testf1,R5         ; ");
174        asm(" LDINE 00h,R1             ; if not, set LSB of R1. ");
175        asm(" STI   R1,@_test_stat     ; store R1 into test_stat location. ");
176
177        asm(" LDF  @_testf2,R5   ; load register R5 with 40-bit floating point number.");
178        asm(" CMPF @_testf2,R5         ; ");
179        asm(" LDINE 00h,R1             ; if not, set LSB of test_stat location. ");
180        asm(" STI R1,@_test_stat       ; ");
181
182        asm(" LDI  @_testi1,R5         ; load register R5 with 32-bit integer. ");
183        asm(" CMPI @_testi1,R5         ; does R5 contain 0xAAAAAAAA? ");
184        asm(" LDINE 00h,R1             ; if not, set LSB of test_stat location. ");
185        asm(" STI R1,@_test_stat       ; ");
186
187        asm(" LDI  @_testi2,R5         ; load register R5 with 32-bit integer. ");
188        asm(" CMPI @_testi2,R5         ; does R5 contain 0x55555555? ");
189        asm(" LDINE 00h,R1             ; if not, set LSB of test_stat location. ");
190        asm(" STI R1,@_test_stat       ; ");
191
192        asm(" LDI @_temp1,R5           ; restore contents of R5. ");
193
194
195
196     /* test R6 */
197        asm(" STI R6,@_temp1           ; save contents of R6 at temp1 address. ");
198
199
200
201        asm(" LDF  @_testf1,R6   ; load register R6 with 40-bit floating point number.");
202        asm(" CMPF @_testf1,R6         ; ");
203        asm(" LDINE 00h,R1             ; if not, set LSB of R1. ");
204        asm(" STI   R1,@_test_stat     ; store R1 into test_stat location. ");
205
206        asm(" LDF  @_testf2,R6   ; load register R6 with 40-bit floating point number.");
207        asm(" CMPF @_testf2,R6         ; ");
208        asm(" LDINE 00h,R1             ; if not, set LSB of test_stat location. ");
209        asm(" STI R1,@_test_stat       ; ");
210
211        asm(" LDI  @_testi1,R6         ; load register R6 with 32-bit integer. ");
212        asm(" CMPI @_testi1,R6         ; does R6 contain 0xAAAAAAAA? ");
213        asm(" LDINE 00h,R1             ; if not, set LSB of test_stat location. ");
214        asm(" STI R1,@_test_stat       ; ");
215
216        asm(" LDI  @_testi2,R6         ; load register R6 with 32-bit integer. ");
217        asm(" CMPI @_testi2,R6         ; does R6 contain 0x55555555? ");
218        asm(" LDINE 00h,R1             ; if not, set LSB of test_stat location. ");
219        asm(" STI R1,@_test_stat       ; ");
220
221        asm(" LDI @_temp1,R6           ; restore contents of R6. ");
222
223
224
225     /* test R7 */
226        asm(" STI R7,@_temp1           ; save contents of R7 at temp1 address. ");
227
228
```

Navy Case No. 77,062

```
229      asm(" LDF  @_testf1,R7   ; load register R7 with 40-bit floating point number.");
230      asm(" CMPF @_testf1,R7         ; ");
231      asm(" LDINE 00h,R1             ; if not, set LSB of R1. ");
232      asm(" STI   R1,@_test_stat     ; store R1 into test_stat location. ");
233
234      asm(" LDF  @_testf2,R7   ; load register R7 with 40-bit floating point number.");
235      asm(" CMPF @_testf2,R7         ; ");
236      asm(" LDINE 00h,R1             ; if not, set LSB of test_stat location. ");
237      asm(" STI R1,@_test_stat       ; ");
238
239      asm(" LDI  @_testi1,R7         ; load register R7 with 32-bit integer. ");
240      asm(" CMPI @_testi1,R7         ; does R7 contain 0xAAAAAAAA? ");
241      asm(" LDINE 00h,R1             ; if not, set LSB of test_stat location. ");
242      asm(" STI R1,@_test_stat       ; ");
243
244      asm(" LDI  @_testi2,R7         ; load register R7 with 32-bit integer. ");
245      asm(" CMPI @_testi2,R7         ; does R7 contain 0x55555555? ");
246      asm(" LDINE 00h,R1             ; if not, set LSB of test_stat location. ");
247      asm(" STI R1,@_test_stat       ; ");
248
249      asm(" LDI @_temp1,R7           ; restore contents of R7. ");
250      asm(" LDI @_temp2,R1           ; restore contents of R1. ");
251
252
253   /* test AR registers */
254
255   /* test AR0 */
256      asm(" STI AR0,@_temp1          ; save contents of AR0 at temp1 address. ");
257
258
259      asm(" STI AR1,@_temp2       ; place the original contents of AR1 in temp2");
260      asm(" LDI @_test_stat,AR1      ; save current test_stat in AR1. ");
261
262      asm(" LDI  @_testi1,AR0        ; load register AR0 with 32-bit integer. ");
263      asm(" CMPI @_testi1,AR0        ; does AR0 contain 0xAAAAAAAA? ");
264      asm(" LDINE 00h,AR1            ; if not, set LSB of test_stat location. ");
265      asm(" STI AR1,@_test_stat      ;");
266
267      asm(" LDI  @_testi2,AR0        ; load register AR0 with 32-bit integer. ");
268      asm(" CMPI @_testi2,AR0        ; does AR0 contain 0x55555555? ");
269      asm(" LDINE 00h,AR1            ; if not, set LSB of test_stat location. ");
270      asm(" STI AR1,@_test_stat      ;");
271
272
273
274   /* test AR1 */
275
276      asm(" LDI AR1,AR0              ; save current value of test_stat in AR0.
277   ");
278      asm(" LDI  @_testi1,AR1        ; load register AR1 with 32-bit integer. ");
279      asm(" CMPI @_testi1,AR1        ; does AR1 contain 0xAAAAAAAA? ");
280      asm(" LDINE 00h,AR0            ; if not, set LSB of test_stat location. ");
281      asm(" STI AR0,@_test_stat      ;");
282
283      asm(" LDI  @_testi2,AR1        ; load register AR1 with 32-bit integer. ");
284      asm(" CMPI @_testi2,AR1        ; does AR1 contain 0x55555555? ");
285      asm(" LDINE 00h,AR0            ; if not, set LSB of test_stat location. ");
```

Navy Case No. 77,062

```
286        asm(" STI AR0,@_test_stat        ;");
287
288        asm(" LDI AR0,AR1                ; save current value of test_stat in AR1.
289     ");
290        asm(" LDI @_temp1,AR0            ; restore contents of AR0. ");
291
292
293
294
295     /* test AR2 */
296        asm(" STI AR2,@_temp1            ; save contents of AR2 at temp1 address. ");
297
298
299        asm(" LDI  @_testi1,AR2          ; load register AR2 with 32-bit integer. ");
300        asm(" CMPI @_testi1,AR2          ; does AR2 contain 0xAAAAAAAA? ");
301        asm(" LDINE 00h,AR1              ; if not, set LSB of test_stat location. ");
302        asm(" STI AR1,@_test_stat        ;");
303
304        asm(" LDI  @_testi2,AR2          ; load register AR2 with 32-bit integer. ");
305        asm(" CMPI @_testi2,AR2          ; does AR2 contain 0x55555555? ");
306        asm(" LDINE 00h,AR1              ; if not, set LSB of test_stat location. ");
307        asm(" STI AR1,@_test_stat        ;");
308
309        asm(" LDI @_temp1,AR2            ; restore contents of AR0. ");
310
311
312
313
314     /* test AR3 */
315        asm(" STI AR3,@_temp1            ; save contents of AR3 at temp1 address. ");
316
317
318
319        asm(" LDI  @_testi1,AR3          ; load register AR3 with 32-bit integer. ");
320        asm(" CMPI @_testi1,AR3          ; does AR3 contain 0xAAAAAAAA? ");
321        asm(" LDINE 00h,AR1              ; if not, set LSB of test_stat location. ");
322        asm(" STI AR1,@_test_stat        ;");
323
324        asm(" LDI  @_testi2,AR3          ; load register AR3 with 32-bit integer. ");
325        asm(" CMPI @_testi2,AR3          ; does AR3 contain 0x55555555? ");
326        asm(" LDINE 00h,AR1              ; if not, set LSB of test_stat location. ");
327        asm(" STI AR1,@_test_stat        ;");
328
329        asm(" LDI @_temp1,AR3            ; restore contents of AR0. ");
330
331
332
333
334     /* test AR4 */
335        asm(" STI AR4,@_temp1            ; save contents of AR4 at temp1 address. ");
336
337
338
339        asm(" LDI  @_testi1,AR4          ; load register AR4 with 32-bit integer. ");
340        asm(" CMPI @_testi1,AR4          ; does AR4 contain 0xAAAAAAAA? ");
341        asm(" LDINE 00h,AR1              ; if not, set LSB of test_stat location. ");
342        asm(" STI AR1,@_test_stat        ;");
```

Navy Case No. 77,062

```
343
344        asm(" LDI  @_testi2,AR4        ; load register AR4 with 32-bit integer. ");
345        asm(" CMPI @_testi2,AR4        ; does AR4 contain 0x55555555? ");
346        asm(" LDINE 00h,AR1            ; if not, set LSB of test_stat location. ");
347        asm(" STI AR1,@_test_stat      ;");
348
349        asm(" LDI @_temp1,AR4          ; restore contents of AR4. ");
350
351
352
353
354     /* test AR5 */
355        asm(" STI AR5,@_temp1          ; save contents of AR5 at temp1 address. ");
356
357
358
359        asm(" LDI  @_testi1,AR5        ; load register AR5 with 32-bit integer. ");
360        asm(" CMPI @_testi1,AR5        ; does AR5 contain 0xAAAAAAAA? ");
361        asm(" LDINE 00h,AR1            ; if not, set LSB of test_stat location. ");
362        asm(" STI AR1,@_test_stat      ;");
363
364        asm(" LDI  @_testi2,AR5        ; load register AR5 with 32-bit integer. ");
365        asm(" CMPI @_testi2,AR5        ; does AR5 contain 0x55555555? ");
366        asm(" LDINE 00h,AR1            ; if not, set LSB of test_stat location. ");
367        asm(" STI AR1,@_test_stat      ;");
368
369        asm(" LDI @_temp1,AR5          ; restore contents of AR5. ");
370
371
372
373
374     /* test AR6 */
375        asm(" STI AR6,@_temp1          ; save contents of AR6 at temp1 address. ");
376
377
378
379        asm(" LDI  @_testi1,AR6        ; load register AR6 with 32-bit integer. ");
380        asm(" CMPI @_testi1,AR6        ; does AR6 contain 0xAAAAAAAA? ");
381        asm(" LDINE 00h,AR1            ; if not, set LSB of test_stat location. ");
382        asm(" STI AR1,@_test_stat      ;");
383
384        asm(" LDI  @_testi2,AR6        ; load register AR6 with 32-bit integer. ");
385        asm(" CMPI @_testi2,AR6        ; does AR6 contain 0x55555555? ");
386        asm(" LDINE 00h,AR1            ; if not, set LSB of test_stat location. ");
387        asm(" STI AR1,@_test_stat      ;");
388
389        asm(" LDI @_temp1,AR6          ; restore contents of AR6. ");
390
391
392
393
394     /* test AR7 */
395        asm(" STI AR7,@_temp1          ; save contents of AR7 at temp1 address. ");
396
397
398
399        asm(" LDI  @_testi1,AR7        ; load register AR7 with 32-bit integer. ");
```

Navy Case No. 77,062

```
400        asm(" CMPI @_testi1,AR7        ; does AR7 contain 0xAAAAAAAA? ");
401        asm(" LDINE 00h,AR1            ; if not, set LSB of test_stat location. ");
402        asm(" STI AR1,@_test_stat      ;");
403
404        asm(" LDI  @_testi2,AR7        ; load register AR7 with 32-bit integer. ");
405        asm(" CMPI @_testi2,AR7        ; does AR7 contain 0x55555555? ");
406        asm(" LDINE 00h,AR1            ; if not, set LSB of test_stat location. ");
407        asm(" STI AR1,@_test_stat      ;");
408
409        asm(" LDI @_temp1,AR7          ; restore contents of AR7. ");
410        asm(" LDI @_temp2,AR1          ; restore contents of AR1. ");
411
412     return;
413     }
```

Navy Case No. 77,062

```
1     /* ram_test.c */
2
3     #include "newmtim.h"
4
5     /*extern unsigned int test_stat;*/
6
7     /* test internal RAM0 */
8     void ram_test(void)
9     {
10    register unsigned int temp, test_stat_temp;
11    register unsigned int *ptr = (unsigned int *)RAM0_START;
12
13    test_stat_temp = test_stat;
14
15    while (ptr <= (unsigned int *)RAM0_END){
16       temp = *ptr;
17       *ptr = 0xAAAAAAAA;
18       if (*ptr != 0xAAAAAAAA){
19           test_stat_temp = test_stat_temp & 0x000000FD; /* clear b1 */
20           *ptr = temp;
21           break;
22           }
23       else
24           test_stat_temp = test_stat_temp | 0x00000002; /* set b1 */
25
26       *ptr = 0x55555555;
27       if (*ptr != 0x55555555){
28            test_stat_temp = test_stat_temp & 0x000000FD; /* clear b1 */
29            *ptr = temp;
30            break;
31            }
32       else
33           test_stat_temp = test_stat_temp | 0x00000002; /* set b1 */
34
35       *ptr = temp;
36
37       ptr++;
38    }/* end while(ptr <=...) */
39
40    if (!(test_stat_temp & 0x00000002)){
41      test_stat = test_stat_temp;
42      return;
43      }
44
45    /* test internal RAM1 */
46    ptr = (unsigned int *)RAM1_START;
47    while (ptr <= (unsigned int *)RAM1_END){
48       temp = *ptr;
49       *ptr = 0x55555555;
50       if (*ptr != 0x55555555){
51           test_stat_temp = test_stat_temp & 0x000000FD; /* clear b1 */
52           *ptr = temp;
53           break;
54           }
55       else
56           test_stat_temp = test_stat_temp | 0x00000002; /* set b1 */
57
```

Navy Case No. 77,062

```
58        *ptr = 0xAAAAAAAA;
59        if (*ptr != 0xAAAAAAAA){
60            test_stat_temp = test_stat_temp & 0x000000FD; /* clear b1 */
61            *ptr = temp;
62            break;
63            }
64         else
65            test_stat_temp = test_stat_temp | 0x00000002; /* set b1 */
66
67         *ptr = temp;
68         ptr++;
69     }/* end while(ptr <=...) */
70
71     test_stat = test_stat_temp;
72
73     return;
74     }
75
```

Navy Case No. 77,062

```
1     /* dpramtst.c */
2
3     #include "newmtim.h"
4
5     /*extern unsigned int test_stat;*/
6
7     void dpramtst(void)
8     {
9
10    unsigned int temp, *ptr = (unsigned int *)DPRAM_BANK0_START;
11
12    /* test DPRAM bank 0 */
13    while (ptr <= (unsigned int *)DPRAM_BANK0_END){
14       *ptr = 0xCC;
15       temp = *ptr & 0x000000FF;
16       if (temp != 0xCC){
17           test_stat = test_stat & 0x000000FB; /* clear b2 */
18            break;
19             }
20       else
21           test_stat = test_stat | 0x00000004; /* set b2 */
22       *ptr = 0x33;
23       temp = *ptr & 0x000000FF;
24       if (temp != 0x33){
25            test_stat = test_stat & 0x000000FB; /* clear b2 */
26            break;
27            }
28       else
29           test_stat = test_stat | 0x00000004; /* set b2 */
30       ptr++;
31    }/* end while(ptr <=...) */
32
33    if (!(test_stat & 0x00000004))
34       return;
35
36    /* test DPRAM bank 1 */
37    ptr = (unsigned int *)DPRAM_BANK1_START;
38    while (ptr <= (unsigned int *)DPRAM_BANK1_END){
39       *ptr = 0x33;
40       temp = *ptr & 0x000000FF;
41       if (temp != 0x33){
42            test_stat = test_stat & 0x000000FB; /* clear b2 */
43            break;
44            }
45       else
46           test_stat = (test_stat) | 0x00000004; /* set b2 */
47       *ptr = 0xCC;
48       temp = *ptr & 0x000000FF;
49       if (temp != 0xCC){
50            test_stat = test_stat & 0x000000FB; /* clear b2 */
51            break;
52            }
53     else
54           test_stat = test_stat | 0x00000004; /* set b2 */
55       ptr++;
56    }/* end while(ptr <=...) */
57
```

Navy Case No. 77,062

```
58      return;
59      }
```

Navy Case No. 77,062

```
1     /* lachtest.c */
2
3     #include "newmtim.h"
4
5     unsigned int latchtest_stat = 0;
6
7     void lachtest(void)
8     {
9     unsigned int temp, *ptr = (unsigned int *)MTIM_LED_OUT_ADD;
10    *ptr = 0x2AA;
11    temp = *ptr & 0x000003FF;
12       if (temp != 0x2AA){
13            latchtest_stat = 0x000000F7; /* clear b3 */
14           }
15        else
16           latchtest_stat = 0x00000008; /* set b3 */
17       *ptr = 0x155;
18        temp = *ptr & 0x000003FF;
19        if (temp != 0x155){
20            latchtest_stat = 0x000000F7; /* clear b3 */
21           }
22        else
23           latchtest_stat = 0x00000008; /* set b3 */
24        *ptr = 0x3FF; /* turn off leds */
25
26    ptr = (unsigned int *)PCM_LED_OUT_ADD;
27    *ptr = 0xAA;
28    temp = *ptr & 0x000000FF;
29       if (temp != 0xAA){
30            latchtest_stat = 0x000000F7; /* clear b3 */
31           }
32       else
33           latchtest_stat = 0x00000008; /* set b3 */
34       *ptr = 0x55;
35        temp = *ptr & 0x000000FF;
36        if (temp != 0x55){
37            latchtest_stat = 0x000000F7; /* clear b3 */
38           }
39        else
40           latchtest_stat = 0x00000008; /* set b3 */
41        *ptr = 0xFF; /* turn off leds */
42
43
44    ptr = (unsigned int *)MTIM_CHAN_OUT_ADD;
45    *ptr = 0x2A;
46    temp = *ptr & 0x0000007F;
47       if (temp != 0x2A){
48            latchtest_stat = 0x000000F7; /* clear b3 */
49           }
50       else
51           latchtest_stat = 0x00000008; /* set b3 */
52       *ptr = 0x55;
53        temp = *ptr & 0x0000007F;
54        if (temp != 0x55){
55            latchtest_stat = 0x000000F7; /* clear b3 */
56          }
57        else
```

Navy Case No. 77,062

```
58          latchtest_stat = (latchtest_stat) | 0x00000008; /* set b3 */
59
60
61
62     ptr = (unsigned int *)MTIM_DATA_OUT_ADD;
63     *ptr = 0x2EAA;/*2EAA, not 2AAA, to prevent mtim_data_output.syncst bit from
64                    deasserting*/
65     temp = *ptr & 0x00003FFF;
66        if (temp != 0x2EAA){
67             latchtest_stat = 0x000000F7; /* clear b3 */
68           }
69        else
70           latchtest_stat = 0x00000008; /* set b3 */
71       *ptr = 0x1555;
72         temp = *ptr & 0x00003FFF;
73         if (temp != 0x1555){
74           latchtest_stat = 0x000000F7; /* clear b3 */
75            }
76        else
77           latchtest_stat = 0x00000008; /* set b3 */
78
79
80     /* asm(" OR 040h,IOF    ; clear watchdog timer (rising edge, port XF1, bit 6)"); */
81
82     return;
83     }
```

Navy Case No. 77,062

```
1     /* send_pcm.c */
2
3     #include "newmtim.h"
4
5     void send_pcm(unsigned int data_word, unsigned int chan_word)
6     {
7        mtim_data_output.syncst = 1; /* If this function is called, then the
8                                        system is in PCM sync. */
9
10    /*   mtim_data_output.adc_dr = 0; */
11
12       if (oper_cal)
13          mtim_data_output.data = mtim_1015_or_8;
14       else
15          mtim_data_output.data = data_word;
16
17       *mtim_data_out_ptr = mtim_data_output;
18       *mtim_chan_out_ptr = chan_word;
19
20         if (chan_word == mtim_pushwheels){
21             *mtim_led_out_ptr = ~mtim_data_output.data;
22             }
23
24       mtim_data_output.adc_dr = 1;
25       *mtim_data_out_ptr = mtim_data_output;
26
27       *timer1_global_cntrl_ptr = START_TIMER1;
28       while(*timer1_count_ptr < 7); /* setup time */
29
30
31    /* *timer1_global_cntrl_ptr = START_TIMER1;
32       while(*timer1_count_ptr < 7); /* hold time */
33
34       mtim_data_output.adc_dr = 0;
35       *mtim_data_out_ptr = mtim_data_output;
36
37    /* *timer1_global_cntrl_ptr = STOP_TIMER1;*/
38
39
40       return;
41    }
42
```

Navy Case No. 77,062

```
/* pcf.c */

#include "newmtim.h"

/* ************************************************************ */
/*    This Function will output the Coded Two Bit Binary pcm_word[]    */
/*    (CTBB) depending on how two input analog pcm_word[] compare to two mean */
/*    pcm_word[], one of four possible output choices (80, 320, 576, or 816) */
/* ************************************************************ */
int pcf_1(int ctbb_1,int ctbb_2)
{
     int      pcf_1_count;

     if ((ctbb_1 < 0) && (ctbb_2 < 0))
          pcf_1_count = PCF_1_COUNT_1;
     else if ((ctbb_1 < 0) && (ctbb_2 >= 0))
          pcf_1_count = PCF_1_COUNT_2;
     else if ((ctbb_1 >= 0) && (ctbb_2 < 0))
          pcf_1_count = PCF_1_COUNT_3;
     else
          pcf_1_count = PCF_1_COUNT_4;

     return (pcf_1_count);
}


/* ************************************************************ */
/*    This Function will output the Coded Two Bit Binary pcm_word[]    */
/*      (CTBB) depending on how two input analog pcm_word[] compare to two mean  */
/*      pcm_word[], one of four possible output choices (8, 192, 320, or 480) */
/* ************************************************************ */
int pcf_2(int ctbb_1,int ctbb_2)
{
     int      pcf_2_count;

     if ((ctbb_1 < 0) && (ctbb_2 < 0))
          pcf_2_count = PCF_2_COUNT_1;
     else if ((ctbb_1 < 0) && (ctbb_2 >= 0))
          pcf_2_count = PCF_2_COUNT_2;
     else if ((ctbb_1 >= 0) && (ctbb_2 < 0))
          pcf_2_count = PCF_2_COUNT_3;
     else
          pcf_2_count = PCF_2_COUNT_4;

     return (pcf_2_count);
}
```

Navy Case No. 77,062

```
1     /* c_int11.c */
2
3     /* ******************************************************** */
4     /*      Re-initialize the DMA Source and Transfer Counter    */
5     /*       when the CPU gets a DMA interupt                    */
6     /* ******************************************************** */
7
8     #include "newmtim.h"
9
10    void c_int11(void)
11    {
12         extern unsigned int sim_pcm[PCM_SIZE];
13
14         register unsigned int *regpointer;
15
16         regpointer = (unsigned int *) DMA_Src_Addr_Reg;
17         *regpointer = (unsigned int) &sim_pcm[0];
18
19         regpointer = (unsigned int *) DMA_Tran_Ctr_Reg;
20         *regpointer = 0x19;
21
22         regpointer = (unsigned int *) DMA_Glob_Ctrl_Reg;
23         *regpointer = 0xE13;
24    }
```

Navy Case No. 77,062

```
/* comp.c */

#include "newmtim.h"

/* Array defined for comparison to calculated pcm value  */

int comp[] = {
      ZERO_PERCENT,         /* 0x08  */
      ONE_HUNDRED_PERCENT,  /* 0x3F7 */
      DUMMY_VALUE_1,        /* 0x55  */
      DUMMY_VALUE_2,        /* 0xAA  */
      1878,                 /* 0x756 (appears as 0x356 on LEDs) */
      849,                  /* 0x351 */
      816,                  /* 0x330 */
      480,                  /* 0x1E0 */
      173,                  /* 0x0AD */
      -855,                 /* 0xFA9 */
      0x5F,                 /* start PCM sync pattern */
      0xCF,
      0x04,                 /* end PCM sync pattern */
   FTY_PERCENT,          /* 0x200 */
   320,                  /* 0x140 */
   576,                  /* 0x240 */
   192                   /* 0x0C0 */
};
```

Navy Case No. 77,062

```
1     /* gnuusart.c */
2
3     #include "newmtim.h"
4
5     int gnu_usart_test_count = 0;
6
7     void c_int04(void)
8     {
9      switch(gnu_usart_test_count){
10       case 0:
11         *gnu_usart_rcve_xmit_ptr = 0xAA;
12         break;
13       case 1:
14         *gnu_usart_rcve_xmit_ptr = 0x55;
15         break;
16       case 2:
17         *gnu_usart_rcve_xmit_ptr = 0xFE;
18         break;
19       case 3:
20         *gnu_usart_rcve_xmit_ptr = 0xDC;
21         break;
22       case 4:
23         *gnu_usart_rcve_xmit_ptr = 0xBA;
24         break;
25       case 5:
26         *gnu_usart_rcve_xmit_ptr = 0x98;
27         break;
28       case 6:
29         *gnu_usart_rcve_xmit_ptr = 0x76;
30         break;
31       case 7:
32         *gnu_usart_rcve_xmit_ptr = 0x54;
33         break;
34       case 8:
35         *gnu_usart_rcve_xmit_ptr = 0x32;
36         break;
37       case 9:
38         *gnu_usart_rcve_xmit_ptr = 0x10;
39         break;
40       default:
41         break;
42      }
43
44      gnu_usart_test_count++;
45      if (gnu_usart_test_count == 10)
46        gnu_usart_test_count = 0;
47
48    asm(" AND 07F7h,IF;"); /* clear GNU USART int bit */
49    }
```

Navy Case No. 77,062

```
/* hex2bcd.c */

unsigned int hex2bcd[] = {
                    0x00,
                    0x01,
                    0x02,
                    0x03,
                    0x04,
                    0x05,
                    0x06,
                    0x07,
                    0x08,
                    0x09,
                    0x10,
                    0x11,
                    0x12,
                    0x13,
                    0x14,
                    0x15,
                    0x16,
                    0x17,
                    0x18,
                    0x19,
                    0x20,
                    0x21,
                    0x22,
                    0x23,
                    0x24,
                    0x25,
                    0x26,
                    0x27,
                    0x28,
                    0x29,
                    0x30,
                    0x31,
                    0x32,
                    0x33,
                    0x34,
                    0x35,
                    0x36,
                    0x37,
                    0x38,
                    0x39,
                    0x40,
                    0x41,
                    0x42,
                    0x43,
                    0x44,
                    0x45,
                    0x46,
                    0x47,
                    0x48,
                    0x49,
                    0x50,
                    0x51,
                    0x52,
                    0x53,
```

Navy Case No. 77,062

```
58                  0x54,
59                  0x55,
60                  0x56,
61                  0x57,
62                  0x58,
63                  0x59,
64                  0x60,
65                  0x61,
66                  0x62,
67                  0x63,
68                  0x64
69      };
```

Navy Case No. 77,062

```
1          .length 59                    ; Specify number of rows ...
2          .width 130                    ; and columns in assembled listing
3
4   ******************************************************************************
5   *
6   *
7   *  MTIM_INT.ASM  v1.08
8   *  Paul H. Sailer MAY 4, 1995
9   *
10  *  This is the "mtim_int.asm" source code which contains the "Interupt " Vecs
11  *  for the MTIM (mtim.out).  mtimint.asm is assembled into relocatable object
12  *  file "mtim_int.obj".
13  *
14  ******************************************************************************
15
16         .global  _c_int00, _c_int01, _c_int02, _c_int03
17         .global  _c_int04, _c_int05, _c_int06, _c_int07
18         .global  _c_int08, _c_int09, _c_int10, _c_int11
19
20
21       .sect    "int_vecs"              ;Link map starts vectors at 0h
22  _RESET:  .word    _c_int00                ;RESET
23  _INT0:   .word    _c_int01
24  _INT1:   .word    _c_int02                ;External interrupt 1 Flag
25  _INT2:   .word    _c_int03                ;External interrupt 2 Flag
26  _INT3:   .word    _c_int04                ;External interrupt 3 flag
27  _XINT0:  .word    _c_int05                ;Serial-port 0 Transmit Interrupt Vector
28  _RINT0:  .word    _c_int06                ;Serial-port 0 Receive interrupt vector
29  _XINT1:  .word    _c_int07                ;Serial-port 1 Transmit interrupt vector
30  _RINT1:  .word    _c_int08                ;Serial-port 1 Receive interrupt vector
31  _TINT0:  .word    _c_int09                ;Timer 0 interrupt flag
32  _TINT1:  .word    _c_int10                ;Timer 1 interrupt flag
33  _DINT:   .word    _c_int11                ;DMA channel interrupt flag
34
35
36  .global _scale_2_index, _scale_1_index, _pcf_1_index
37  .global _pcm_51_mask, _pcm_50_mask, _pass_thru_index, _comp_index
38
39  .sect "index_lookups"
40  .word _scale_2_index, _scale_1_index, _pcf_1_index
41  .word _pcm_51_mask, _pcm_50_mask, _pass_thru_index, _comp_index
42
```

Navy Case No. 77,062

```
43    /* simpam.c  */
44
45    unsigned int simpam[] = {
46
47    /* chan_id              scaled  ADC  value  */
48                                     0,  /* dummy placeholder for array index 0. */
49    /* 1 */                            89,
50    /* 2 */                            1015,
51    /* 3 */                            330,
52    /* 4 */                            914,
53    /* 5 */                            109,
54    /* 6 */                            814,
55    /* 7*/                             209,
56    /* 8 */                            713,
57    /* 9 */                            310,
58    /* 10*/                           582,
59    /* 11 */                           612,
60    /* 12*/                            411,
61    /* 13*/                            824,
62    /* 14*/                            512,
63    /* 15*/                            512,
64    /* 16*/                            512,
65    /* 17*/                            411,
66    /* 18*/                            612,
67    /* 19*/                            89,
68    /* 20*/                            310,
69    /* 21*/                            109,
70    /* 22*/                            713,
71    /* 23*/                            209,
72    /* 24*/                            109,
73    /* 25*/                            814,
74    /* 26*/                            8,
75    /* 27*/                            199,
76    /* 28*/                            8,
77    /* 29*/                            914,
78    /* 30 */                           8,
79    /* 31 */                           814,
80    /* 32 */                           8,
81    /* 33 */                           713,
82    /* 34 */                           1015,
83    /* 35 */                           612,
84    /* 36 */                           8,
85    /* 37 */                           109,
86    /* 38 */                           8,
87    /* 39 */                           209,
88    /* 40  */                          1015,
89    /* 41  */                          512,
90    /* 42  */                          1015,
91    /* 43  */                          411,
92    /* 44  */                          1015,
93    /* 45  */                          310,
94    /* 46  */                          8,
95    /* 47  */                          209,
96    /* 48  */                          1015,
97    /* 49  */                          109,
98    /* 50  */                          8,
99    /* 51  */                          109,
```

Navy Case No. 77,062

```
/* 52  */                    1015,
/* 53  */                    109,
/* 54  */                    1015,
/* 55  */                    209,
/* 56  */                    1015,
/* 57  */                    209,
/* 58  */                    310,
/* 59  */                    8,
/* 60  */                    8,
/* 61  */                    1015,
/* 62  */                    1015,
/* 63 */                     1015,
/* 64 */                     512
};
```

Navy Case No. 77,062

Appendix B

MTIM MASTER (8751)/SLAVE (TMS320C30) COMMUNICATION PROTOCOL (Version 1.5)

MESSAGE FORMAT & IMPLEMENTATION:

Each message shall consist of one DATA BYTE followed by one OPCODE being written to the DPRAM addresses specified below. The OPCODE must follow the DATA BYTE because the OPCODE is located at the memory address which generates the interrupt to the receiving processor.

| MASTER ADDRESS | MASTER MESSAGE PART & DIRECTION | DPRAM ADDRESS | SLAVE MESSAGE PART & DIRECTION | SLAVE ADDRESS |
|---|---|---|---|---|
| 7Ch | (1) Write DATA BYTE ⇒ | 3FCh | Read DATA BYTE ⇒ | 0x800AFC |
| 7Dh | ⇐ Read DATA BYTE | 3FDh | ⇐ (1) Write DATA BYTE | 0x800AFD |
| 7Eh | ⇐ Read OPCODE | 3FEh | ⇐ (2) Write OPCODE | 0x800AFE |
| 7Fh | (2) Write OPCODE ⇒ | 3FFh | Read OPCODE ⇒ | 0x800AFF |

MESSAGE CONTENT:

| OPCODE | DIRECTION | DESCRIPTION | DATA BYTE (MSB=b7,b6,b5,b4,b3,b2,b1,b0=LSB) (Unused bits default to 0) |
|---|---|---|---|
| 01h | M⇒S | Test non-TM functions | b0 = 0 if slave is initially to output 0% (i.e. MTIM DATA = 8) for all non-sync data<br>b0 = 1 if slave is initially to output 100% (i.e. MTIM DATA = 1015) for all non-sync data |
| 02h | M⇒S | Send non-TM function status | 00h |
| 03h | M⇐S | Non-TM function status | b0 = 1 if extended precision registers (Rn) and auxiliary registers (ARn) are OK. b0 = 0 if NOT OK.<br>b1 = 1 if RAM0 and RAM1 blocks are OK. b1 = 0 of NOT OK.<br>b2 = 1 if all 255 non-interrupt locations in DPRAM are OK via the right port. b2= 0 if NOT OK.<br>b3 = 1 if all readback latches (U27/U30, U32, U39, and U28/U39) are OK. b3 = 0 if NOT OK.<br>b4 = 1 if 320 kHz TEST CLOCK frequency is within 0.1%. b4 = 0 if frequency is outside this tolerance.<br>b5 = 1 if 25.6 kHz PAM CLOCK frequency is within 0.1%. b5 = 0 if frequency is outside this tolerance. |
| 11h | M⇒S | DAC/ADC Test #1 | 00h - The master's DAC has generated what should be -1.45 Vdc at the PAM filter input. Assuming the filter imposes no DC offset, the slave's corresponding ADC output should approximate C22h. |
| 12h | M⇐S | DAC/ADC Test #1 status | b0 = 1 if slave's ADC output is within 1% of expected value. b0 = 0 if voltage is outside this tolerance. |
| 13h | M⇒S | DAC/ADC Test #2 | 00h - The master's DAC has generated what should be 0.00 Vdc at the PAM filter input. Assuming the filter imposes no DC offset, the slave's corresponding ADC output should approximate 0h. |
| 14h | M⇐S | DAC/ADC Test #2 status | b0 = 1 if slave's ADC output is within 1% of expected value. b0 = 0 if voltage is outside this tolerance. |
| 15h | M⇒S | DAC/ADC Test #3 | 00h - The master's DAC has generated what should be +1.44 Vdc at the PAM filter input. Assuming the filter imposes no DC offset, the slave's corresponding ADC output should approximate 3D7h. |
| 16h | M⇐S | DAC/ADC Test #3 status | b0 = 1 if slave's ADC output is within 1% of expected value. b0 = 0 if voltage is outside this tolerance. |
| 21h | M⇒S | Calibrate PAM | b0 = 0 if slave is initially to output 0% (i.e. MTIM DATA = 8) for all non-sync data<br>b0 = 1 if slave is initially to output 100% (i.e. MTIM DATA = 1015) for all non-sync data |
| 22h | M⇒S | Send PAM Calibration status | 00h |
| 23h | M⇐S | Calibrate PAM test status | b0 = 1 if PAM data - generated by master - compares within 1% of value expected by slave. |

Navy Case No. 77,062

| | | | |
|---|---|---|---|
| | | | b0 = 0 if PAM data - generated by master - is out of tolerance by more than 1% |
| 24h | M⇒S | Calibrate PCM | b0 = 0 if slave is initially to output 0% (i.e. MTIM DATA = 8) for all non-sync data |
| | | | b0 = 1 if slave is initially to output 100% (i.e. MTIM DATA = 1015) for all non-sync data |
| 25h | M⇒S | Send PCM Calibration status | 00h |
| 26h | M⇐S | Calibrate PCM test status | b0 = 1 if PCM data - generated by slave - compares within 1% of value expected by slave. |
| | | | b0 = 0 if PCM data - generated by slave - is out of tolerance by more than 1% |
| 30h | M⇒S | Output 50% | 00h - Self-test failure. MTIM outputs 512 until master tells slave to exit calibrate mode (i.e. enter PAM or PCM mode). |
| 40h | M⇒S | Search for PAM sync | 00h - Master commands slave to search for PAM sync and return 41h if/when found |
| 41h | M⇐S | PAM sync detected | 00h - Slave sends when PAM frame sync has been confirmed |
| 42h | M⇒S | PAM mode | 00h - Master commands slave to begin normal PAM operation |
| 43h | M⇐S | PAM sync lost | 00h - Slave sends when PAM frame sync has been lost |
| 50h | M⇒S | PCM mode | 00h - Master commands slave to begin processing PCM frame in DPRAM Bank 0. |
| 51h | M⇒S | Process DPRAM Bank 0 | 00h - Begin processing PCM frame in DPRAM Bank 0 |
| 52h | M⇒S | Process DPRAM Bank 1 | 00h - Begin processing PCM frame in DPRAM Bank 1 |
| 60h | M⇒S | Begin display test | 00h |
| 61h | M⇒S | Stop display test | 00h |
| 71h | M⇐S | Display data select error | 01h - Sent if selected MTIM output word < > 1-64 (decimal) in PAM mode, or < > 00-7F (hex) in PCM mode. |
| | | | 00h - Sent if selected MTIM output word is no longer invalid |
| 80h | M⇒S | Switch Calibrate Output | 00h - Switch calibrate output to 8 (0%)<br>01h - Switch calibrate output to 1015 (100%) |
| 90h | M⇒S | Prepare to Calibrate | 00h - Sync status = 1, output 8 (0%)<br>01h - " " " ", " 1015 (100%) |

MESSAGE SEQUENCE:

And in the beginning there was... RESET!

Power-on reset, front-panel reset, watchdog timer reset.
Master checks OPER/cal line to see if it's low. If OPER/cal input is high, the master commands the slave to begin its display self test followed by its own display test.

POWER-ON/RESET SELF TEST MODE:

| OPCODE | DATA | DIRECTION | DESCRIPTION |
|---|---|---|---|
| 60h | 00h | M⇒S | Begin display test |

Once the master has completed its display test and sufficient time has elapsed for the slave to complete its display test, the master sends the following command:

| OPCODE | DATA | DIRECTION | DESCRIPTION |
|---|---|---|---|
| 61h | 00h | M⇒S | Stop display test |

Following completion of the POWER-ON/RESET SELF TEST MODE the master shall enter CALIBRATE MODE.

CALIBRATE MODE:
To avoid DPRAM access conflicts with the DPRAM, the master shall begin CALIBRATE MODE by testing all non-interrupt memory locations in DPRAM.

Navy Case No. 77,062

The master will then read the HUND/zero line and send the following command to the Slave via the DPRAM...

| OPCODE | DATA | DIRECTION | DESCRIPTION |
|---|---|---|---|
| 01 | 00 or 01h | M⇒S | Test non-TM functions |

The master will proceed to test its own non-TM functions and then send the following command to be followed by the slave's response:

| OPCODE | DATA | DIRECTION | DESCRIPTION |
|---|---|---|---|
| 02h | 00h | M⇒S | Send non-TM function status |
| 03h | ??h | M⇐S | Non-TM function status |

The master will log the slave's response, stabilize -1.45 Vdc at the SCO filter input (output feeds the slave's ADC), output the following command & await response:

| OPCODE | DATA | DIRECTION | DESCRIPTION |
|---|---|---|---|
| 11h | 00h | M⇒S | DAC/ADC Test #1 |
| 12h | 00 or 01h | M⇐S | DAC/ADC Test #1 status |

The master will log the slave's response, stabilize 0.00 Vdc at the SCO filter input (output feeds the slave's ADC), output the following command & await response:

| OPCODE | DATA | DIRECTION | DESCRIPTION |
|---|---|---|---|
| 13h | 00h | M⇒S | DAC/ADC Test #2 |
| 14h | 00 or 01h | M⇐S | DAC/ADC Test #2 status |

The master will log the slave's response, stabilize +1.45 Vdc at the SCO filter input (output feeds the slave's ADC), output the following command & await response:

| OPCODE | DATA | DIRECTION | DESCRIPTION |
|---|---|---|---|
| 15h | 00h | M⇒S | DAC/ADC Test #3 |
| 16h | 00 or 01h | M⇐S | DAC/ADC Test #3status |

The master will log the slave's response, and then will proceed to generate the test PAM wavetrain. The master will then send the following command:

| OPCODE | DATA | DIRECTION | DESCRIPTION |
|---|---|---|---|
| 21h | 00 or 01h | M⇒S | Calibrate PAM |

Following several PAM frames the master will send the following command prior to receiving the slave's response:

| OPCODE | DATA | DIRECTION | DESCRIPTION |
|---|---|---|---|
| 22h | 00h | M⇒S | Send PAM Calibration status |
| 23h | 00 or 01h | M⇐S | Calibrate PAM test status |

The master will log the slave's response and then command the slave to begin sending test PCM

| OPCODE | DATA | DIRECTION | DESCRIPTION |
|---|---|---|---|
| 24h | 00 or 01h | M⇒S | Calibrate PCM |

Navy Case No. 77,062

Following several PCM frames the master will send the following command prior to receiving the slave's response:

| OPCODE | DATA | DIRECTION | DESCRIPTION |
|---|---|---|---|
| 25h | 00h | M⇒S | Send PCM Calibration status |
| 26h | 00 or 01h | M⇐S | Calibrate PCM test status |

The master will log the slave's response and then, if any of the previous master or slave tests have failed, the master shall send the following command:

| OPCODE | DATA | DIRECTION | DESCRIPTION |
|---|---|---|---|
| 30h | 00h | M⇒S | Output 50% |

If the current calibration was invoked by the MSTS the following command will be sent when OPER/cal = 1. Otherwise, the master shall display results of the calibration for 5 seconds prior to sending the following command:

| OPCODE | DATA | DIRECTION | DESCRIPTION |
|---|---|---|---|
| 40h | 00h | M⇒S | Search for PAM sync |

The slave shall continue to search for a valid PAM wavetrain until it is commanded to enter PCM mode or until it synchronizes with incoming PAM and sends the following message to the master:

| OPCODE | DATA | DIRECTION | DESCRIPTION |
|---|---|---|---|
| 41h | 00h | M⇐S | PAM sync detected |

Upon receipt of the PAM sync detected message, the master shall cease to monitor its PCM USART, and shall acknowledge the slave via the following command:

| OPCODE | DATA | DIRECTION | DESCRIPTION |
|---|---|---|---|
| 42h | 00h | M⇒S | PAM mode |

The master shall continue to operate in PAM mode until the slave sends the following message:

| OPCODE | DATA | DIRECTION | DESCRIPTION |
|---|---|---|---|
| 43h | 00h | M⇐S | PAM sync lost |

Upon receipt of the PAM sync lost message, the master shall send the following command and then resume its search for PCM:

| OPCODE | DATA | DIRECTION | DESCRIPTION |
|---|---|---|---|
| 40h | 00h | M⇒S | Search for PAM sync |

If the master's USART detects PCM synchronization it will parse the first frame into DPRAM Bank 0 and send the following command:

| OPCODE | DATA | DIRECTION | DESCRIPTION |
|---|---|---|---|
| 50h | 00h | M⇒S | PCM mode |

As storage of each subsequent PCM frame into the masters current DPRAM bank, is completed, the master shall inform the slave to begin processing the recently filled bank by alternating the following two commands:

| OPCODE | DATA | DIRECTION | DESCRIPTION |
|---|---|---|---|
| 52h | 00h | M⇒S | Process DPRAM Bank 1 |
| 51h | 00h | M⇒S | Process DPRAM Bank 0 |

When the master detects the loss of PCM synchronization, the master shall send the following command and then resume searching for PCM sync:

| OPCODE | DATA | DIRECTION | DESCRIPTION |
|---|---|---|---|
| 40h | 00h | M⇐S | Search for PAM sync |

NOTE: The slave must be ready at all times to respond to a callibrate command (OPCODE = 21h or 24h) from the master.
The master must be ready at all times to respond to an invalid data selection message (OPCODE = 71h) or to a loss of PAM sync message (OPCODE 43h).

Navy Case No. 77,062

Appendix C

```
MCS-51 MACRO ASSEMBLER    MTIMASTR.ASM                                                    10/13/95

DOS 5.0 (038-N) MCS-51 MACRO ASSEMBLER, V2.2
OBJECT MODULE PLACED IN MTIMASTR.OBJ
ASSEMBLER INVOKED BY:  C:\ICEDIR\ASM51.EXE MTIMASTR.ASM

LOC  OBJ          LINE     SOURCE

                    1      $DEBUG NOPAGING TITLE(MTIMASTR.ASM)
                    2
                    3      ;*****************************************************************************
                    4
                    5      ;  MTIMASTR.ASM, Version 1.58,  October 13, 1995
                    6
                    7      ;  This is assembly code for the MTIM 8751H microcontroller
                    8
                    9      ;*****************************************************************************
                   10
                   11      ;        Assign symbolic references to constants
                   12
 0070              13              DSP_SW_VER_ADDRESS      EQU 70h          ;Address of stored DSP SW ver.
 0080              14              DAC                     EQU 10000000b    ;Write to DAC at this address
 0000              15              DAC_VOLTAGE_NEG_1_45    EQU 00h          ;DAC value yielding -1.45 Vdc
 0080              16              DAC_VOLTAGE_ZERO        EQU 80h          ;DAC value yielding 0.00 Vdc
 00FF              17              DAC_VOLTAGE_POS_1_45    EQU 0FFh         ;DAC value yielding +1.45 Vdc
 007C              18              MS_DATA_BYTE_ADDR       EQU 01111100b    ;Write slave DATA BYTE here (MBANK=1)
 007D              19              SM_DATA_BYTE_ADDR       EQU 01111101b    ;Read slave DATA BYTE here (MBANK=1)
 007E              20              SM_OPCODE_ADDR          EQU 01111110b    ;Read slave OPCODE here (MBANK=1)
 007F              21              MS_OPCODE_ADDR          EQU 01111111b    ;Write slave OPCODE here (MBANK=1)
 00A0              22              USART_RD_HLD_REG        EQU 10100000b    ;Read Receive Holding Register
 00A1              23              USART_RD_STAT_REG       EQU 10100001b    ;  "   Status Register
 00A2              24              USART_RD_MODE_REG       EQU 10100010b    ;  "   Mode Registers (1 then 2)
 00A3              25              USART_RD_CMD_REG        EQU 10100011b    ;  "   Command Register
 00A4              26              USART_WR_HLD_REG        EQU 10100100b    ;Write Transmit Holding Register
 00A5              27              USART_WR_SYNC_REG       EQU 10100101b    ;  "   SYN1/SYN2/DLE Registers
 00A6              28              USART_WR_MODE_REG       EQU 10100110b    ;  "   Mode Registers (1 then 2)
 00A7              29              USART_WR_CMD_REG        EQU 10100111b    ;  "   Command Register
                   30
 00C0              31              DISP0_UDC_ADDR          EQU 11000000b    ;UDC Address Register (UDC=0)
 00C8              32              DISP0_UDC_ROW_0         EQU 11001000b    ;UDC RAM Row 0
 00C9              33              DISP0_UDC_ROW_1         EQU 11001001b    ; "   "   "  1
 00CA              34              DISP0_UDC_ROW_2         EQU 11001010b    ; "   "   "  2
 00CB              35              DISP0_UDC_ROW_3         EQU 11001011b    ; "   "   "  3
 00CC              36              DISP0_UDC_ROW_4         EQU 11001100b    ; "   "   "  4
 00CD              37              DISP0_UDC_ROW_5         EQU 11001101b    ; "   "   "  5
 00CE              38              DISP0_UDC_ROW_6         EQU 11001110b    ; "   "   "  6
 00CF              39              DISP0_UDC_ROW_7         EQU 11001111b    ; "   "   "  7
 00C0              40              DISP0_CTRL              EQU 11000000b    ;Control Word Register
 00C8              41              DISP0_CHAR_0            EQU 11001000b    ;Character RAM #0 (left most)
 00C9              42              DISP0_CHAR_1            EQU 11001001b    ;    "      "  #1
 00CA              43              DISP0_CHAR_2            EQU 11001010b    ;    "      "  #2
 00CB              44              DISP0_CHAR_3            EQU 11001011b    ;    "      "  #3
 00CC              45              DISP0_CHAR_4            EQU 11001100b    ;    "      "  #4
 00CD              46              DISP0_CHAR_5            EQU 11001101b    ;    "      "  #5
 00CE              47              DISP0_CHAR_6            EQU 11001110b    ;    "      "  #6
 00CF              48              DISP0_CHAR_7            EQU 11001111b    ;    "      "  #7 (right most)
                   49
 00E8              50              DISP1_UDC_ROW_0         EQU 11101000b    ;UDC RAM Row 0
 00E9              51              DISP1_UDC_ROW_1         EQU 11101001b    ; "   "   "  1
 00EA              52              DISP1_UDC_ROW_2         EQU 11101010b    ; "   "   "  2
```

Navy Case No. 77,062

```
00EB          DISP1_UDC_ROW_3          EQU 11101011b   ; "   "   "  3
00EC          DISP1_UDC_ROW_4          EQU 11101100b   ; "   "   "  4
00ED          DISP1_UDC_ROW_5          EQU 11101101b   ; "   "   "  5
00EE          DISP1_UDC_ROW_6          EQU 11101110b   ; "   "   "  6
00EF          DISP1_UDC_ROW_7          EQU 11101111b   ; "   "   "  7
00E0          DISP1_CTRL               EQU 11100000b   ;Control Word Register
00E8          DISP1_CHAR_0             EQU 11101000b   ;Character RAM #0 (left most)
00E9          DISP1_CHAR_1             EQU 11101001b   ;    "      "  #1
00EA          DISP1_CHAR_2             EQU 11101010b   ;    "      "  #2
00EB          DISP1_CHAR_3             EQU 11101011b   ;    "      "  #3
00EC          DISP1_CHAR_4             EQU 11101100b   ;    "      "  #4
00ED          DISP1_CHAR_5             EQU 11101101b   ;    "      "  #5
00EE          DISP1_CHAR_6             EQU 11101110b   ;    "      "  #6
00EF          DISP1_CHAR_7             EQU 11101111b   ;    "      "  #7 (right most)

005F          FSYNC_1                  EQU 01011111b   ;AN/DKT-79 Frame Sync 1 (LSB 1st)
00CF          FSYNC_2                  EQU 11001111b   ;    "       "    "  2     "
0004          FSYNC_3                  EQU 00000100b   ;    "       "    "  3     "

0000          DO_NOTHING               EQU 0h          ;TIMERn_ISR_MODE values
0001          SIMULATE_PAM_MD          EQU 1h
0002          STD_TIMER                EQU 2h
00FC          P001_SEC_HI              EQU 0FCh        ;1ms hi byte [(12MHz/12)*0.001 SEC = 1000]
002F          P001_SEC_LO              EQU 2Fh         ;1ms lo byte [2^16 - 1000 = 64,536 = FC18h]
                                                       ;Add 23 to compensate for vector + inst.
00FE          P0004_SEC_HI             EQU 0FEh        ;.4ms hi byte [(12MHz/12)*0.0004 SEC = 400]
0070          P0004_SEC_LO             EQU 70h         ;.4ms lo byte [2^16 - 400 = 65,136 = FE70h]

0032          BOUNCES                  EQU 50          ;HOLD_INDEX key stabilized 50x4uS
001E          FIFTY_MS_PER_MSG         EQU 30          ;# of 50ms intervals per self test message

0000          TEST_MODE                EQU 00H         ;Specifies MASTER_MODE is TEST
0010          PAM_MODE                 EQU 10h         ;Specifies MASTER_MODE is PAM
0020          PCM_MODE                 EQU 20h         ;Specifies MASTER_MODE is PCM
0000          DUMMY_ZERO               EQU 0h          ;"Place holder" value for MS comm DATA BYTE
0001          TEST_NON_TM_FUNCT        EQU 01h         ;Command slave to test RAM, regs, etc.
0002          SEND_NON_TM_STATUS       EQU 02h         ;Command slave to return non-TM test status
0011          DAAD_TEST_1              EQU 11h         ;Command slave to measure SCO filter Vout 1
0012          DAAD_TEST_1_STATUS       EQU 12h         ;Command slave to return DAAD #1 status
0013          DAAD_TEST_2              EQU 13h         ;Command slave to measure SCO filter Vout 2
0014          DAAD_TEST_2_STATUS       EQU 14h         ;Command slave to return DAAD #2 status
0015          DAAD_TEST_3              EQU 15h         ;Command slave to measure SCO filter Vout 3
0016          DAAD_TEST_3_STATUS       EQU 16h         ;Command slave to return DAAD #3 status
0021          CALIBRATE_PAM            EQU 21h         ;Command slave to calibrate test PAM
0022          SEND_CAL_PAM_STATUS      EQU 22h         ;Command slave to return PAM cal status
0023          CAL_PAM_STATUS           EQU 23h         ;Slave returns PAM cal status
0024          CALIBRATE_PCM            EQU 24h         ;Command slave to generate/test PCM
0025          SEND_CAL_PCM_STATUS      EQU 25h         ;Command slave to return PCM cal status
0026          CAL_PCM_STATUS           EQU 26h         ;Slave returns PCM cal status
0030          OUTPUT_50_PERCENT        EQU 30h         ;Command slave to output 50 pct on non-sync
0040          SEARCH_FOR_PAM_SYNC      EQU 40h         ;Command slave to search for PAM sync
0041          PAM_SYNC_DETECTED        EQU 41h         ;Slave sends this message if PAM sync found
0042          ENTER_PAM_MODE           EQU 42h         ;Command slave to process PAM
0043          PAM_SYNC_LOST            EQU 43h         ;Slave sends this message if PAM sync lost
0050          ENTER_PCM_MODE           EQU 50h         ;Command slave to process PCM
0051          PROCESS_DPRAM_BANK_0     EQU 51h         ;Command slave to process PCM in Bank 0
0052          PROCESS_DPRAM_BANK_1     EQU 52h         ;Command slave to process PCM in Bank 1
0060          BEGIN_DISPLAY_TEST       EQU 60h         ;Command slave to begin LED display test
0061          STOP_DISPLAY_TEST        EQU 61h         ;Command slave to stop LED display test
0071          DATA_SELECT_ERROR        EQU 71h         ;Slave sends on (in)valid data selection
0080          SWITCH_CALIBRATE_OUTPUT  EQU 80h         ;Command slave to switch calibrate output t
o 0 or 100 pct
0090          PREP_TO_CALIBRATE        EQU 90h         ;Command slave to raise SYNC_STAT and outpu
t 0 or 100 pct
```

Navy Case No. 77,062

```
0000          TEST_FAILED          EQU 00h        ;Many tests return this value if failed
0001          TEST_PASSED          EQU 01h        ;Many tests return this value if passed

00E5          SYN1_2_DET  BIT ACC.5       ;USART Status reg bit 5 =1 when SYN1&SYN2 det

0090          HUND_zero   BIT P1.0        ;(I) 1/0 for 100/0 pct cal per MS194 open/closed
0091          nSIM_HOLD   BIT P1.1        ;(I) 0 when "HOLD/INDEX" switch depressed
0092          nMSTR_WDI   BIT P1.2        ;(O) Strobed low to lower MAX690 WDI
0093          TM_SEL_0    BIT P1.3        ;(O) TM_SEL_1   TM_SEL_0   TM SOURCE
0094          TM_SEL_1    BIT P1.4        ;(O)    0          0          GND
                                          ;       0          1        EXTERNAL
                                          ;       1          0        SIM PAM
                                          ;       1          1        SIM PCM
0095          nHI_ACK     BIT P1.5        ;(O) 0 to turn on "HOLD/INDEX" switch LED
0096          nPCM_SYNC   BIT P1.6        ;(O) Pulsed low if PCM sync'd, held high if not
0097          HI_IO       BIT P1.7        ;(O) 0 by default (pull high if 8 hi-order addr)

00A0          nFLASH      BIT P2.0        ;(O) 0 to select FLASH memory in DISP0/DISP1
00A1          PT_ct       BIT P2.1        ;(O) 1/0 selects plain/crypto text into USART
00A2          nBS_ERR     BIT P2.2        ;(I) Pulses low if BS gets no data or bad trans
00A3          PAM_pcm     BIT P2.3        ;(O) 1/0 selects FLTR_TM/SIM_PCM to TM buff out
00A4          nUDC        BIT P2.4        ;(O) Lowered if accessing user-defined char
00A5          U_RST       BIT P2.5        ;(O) Raised 3us to reset USART
00A6          TEST_FLAG   BIT P2.6        ;(I/O) Reserved for testing purposes
00A7          OPER_cal    BIT P2.7        ;(I) 1/0 input selects operate/calibrate mode

00B0          MBANK       BIT P3.0        ;(O) 1/0 selects BANK1/0 in left port of DPRAM
00B1          nBUSYL      BIT P3.1        ;(I) 0 when left port of DPRAM is busy
00B2          nRxRDY      BIT P3.2        ;(I) INT0: lowered by USART when TM byte decom'd
00B3          nSM_INT     BIT P3.3        ;(I) INT1: lowered by DPRAM when DSP -> 800AFEh
00B4          CLOCK       BIT P3.4        ;(I) Bit Sync (BS) clock (freq meas. during BIT)
00B5          SIM_PAM_CLK BIT P3.5        ;(I) 25.6 kHz clock for SIM


----          CSEG                        ;Beginning of CODE segment

        ESTABLISH_VECTORS:

0000          ORG     0000h               ;Reset vector
0000 02001E   JMP     INITIALIZE

0003          ORG     0003h               ;INT0 vector
0003 02082C   JMP     USART_ISR

000B          ORG     000Bh               ;TIMER0 vector
000B 020975   JMP     TIMER0_ISR

0013          ORG     0013h               ;INT1 vector
0013 020A57   JMP     GET_MESSAGE_ISR

001B          ORG     001Bh               ;TIMER1 vector
001B 0209E7   JMP     TIMER1_ISR


        INITIALIZE:

001E 75815F   MOV     SP,#5Fh           ;Reserve 32 bytes for stack (#60h - 7Fh)
0021 75D000   MOV     PSW,#00           ;Reset status flags & select register bank 0
0024 759067   MOV     P1,#01100111b     ;Ground TM input source, HOLD/INDEX LED=off
0027 75A0B7   MOV     P2,#10110111b     ;Output filtered TM, PT (vs CT)->USART (reset)
                                        ;   TEST_FLAG=0
002A 75B0FF   MOV     P3,#11111111b     ;Select MBANK=1
002D D218     SETB    MBANK_STAT
002F 797E     MOV     R1,#SM_OPCODE_ADDR   ;Reset any pending int from DPRAM
```

```
0031 E3          179        MOVX    A,@R1                ;... by reading from the sm_opcode_in
0032 758805      180        MOV     TCON,#00000101b ;IT0 = 1 - INT0 (USART) is falling-edge trig
                 181                                ;IE0 = 0 - Reset INT0 interrupt flag
                 182                                ;IT1 = 1 - INT1 (SM_INT) is falling-edge trig
                 183                                ;IE1 = 0 - Reset INT1 interrupt flag
                 184                                ;TR0 = 0 - Disable TIMER0
                 185                                ;TF0 = 0 - Reset pending TIMER0 interrupt flag
                 186                                ;TR1 = 0 - Disable TIMER1
                 187                                ;TF1 = 0 - Reset pending TIMER1 interrupt flag
                 188
0035 75A884      189        MOV     IE,#10000100b   ;EX0 = 0 - Disable RxRDY (INT0) from USART
                 190                                ;ET0 = 0 - Disable TIMER0 int
                 191                                ;EX1 = 1 - Enable Slave->Master int
                 192                                ;ET1 = 0 - Disable TIMER1 int
                 193                                ; ES = 0 - Disable Serial Port int
                 194                                ;n/a = 0 -
                 195                                ;n/a = 0 -
                 196                                ; EA = 1 - Enable all interrupts
                 197
0038 75B801      198        MOV     IP,#00000001b   ;PX0 = 1 - USART RxRDY (INT0) = High priority
                 199                                ;PT0 = 0 - TIMER0 int = Low priority
                 200                                ;PX1 = 0 - Slave->Master int = Low priority
                 201                                ;PT1 = 0 - TIMER1 int = Low priority
                 202                                ; PS = 0 - Serial Port int = Low priority
                 203                                ;n/a = 0 -
                 204                                ;n/a = 0 -
                 205                                ;n/a = 0 -
                 206
003B 753600      207        MOV     TIMER1_ISR_MODE,#DO_NOTHING ;Tell TIMER1 ISR not to do anything
                 208
                 209    INITIALIZE_USART:
003E 12080D      210        CALL    INIT_USART
                 211
                 212    INIT_REG_BANK_3_FOR_PCM:
0041 75D018      213        MOV     PSW,#00011000b  ;Select register bank 3
0044 78A0        214        MOV     R0,#USART_RD_HLD_REG    ;Init USART holding reg read address
0046 7963        215        MOV     R1,#99          ;Init PCM Word Pointer @SYN2
0048 75D000      216        MOV     PSW,#0          ;Select register bank 0
                 217
                 218    BEGIN:
004B C219        219        CLR     PASSED_LAST_CAL ;Notify main program that CALIBRATION hasn't been passed
004D C21A        220        CLR     BEGINNING_PCM   ;Notify USART ISR that 1st PCM frame not acquired
004F C21B        221        CLR     PCM_FRAME_ERROR
0051 C21C        222        CLR     NO_PCM
0053 C21F        223        CLR     CALIBRATING     ;Notify ACQUIRE_PCM_BANK0 to branch on failure to MP
0055 C220        224        CLR     PREVIOUS_ERROR_71_DATA  ;Notify GET_MESSAGE_ISR no sel err detected
0057 753300      225        MOV     SM_OPCODE_IN,#DUMMY_ZERO    ;Clear any previous opcode
005A C223        226        CLR     SEND_80_00      ;Notify USART ISR HUND_zero hasn't changed in CAL
005C C224        227        CLR     SEND_80_01
005E 753010      228        MOV     MASTER_MODE,#PAM_MODE   ;Inform MS/SM message routines mode <> PCM
0061 30A703      229        JNB     OPER_cal,START_CAL  ;Jump if MSTS commanding "calibrate" mode
0064 12020E      230        CALL    SELF_TEST       ;Else, begin self test
                 231    START_CAL:
0067 120391      232        CALL    CALIBRATE
                 233    MAIN_PROCESSING:
006A C2A8        234        CLR     EX0             ;Disable RxRDY (INT0) from USART
006C D293        235        SETB    TM_SEL_0        ;Gate external telemetry to interface circuits
006E C294        236        CLR     TM_SEL_1
0070 C2A3        237        CLR     PAM_pcm         ;Gate unfiltered telemetry to output buffer
0072 D2A1        238        SETB    PT_ct           ;USART data/clock input is direct (KGR-68 bypassed)
0074 D296        239        SETB    nPCM_SYNC       ;Turn off "SYNC" LED
0076 C21D        240        CLR     PCM_VERIFIED    ;Advise main PCM loop that USART ISR has not confirmed PCM
0078 C21A        241        CLR     BEGINNING_PCM   ;Notify USART ISR that 1st PCM frame not acquired
007A 753010      242        MOV     MASTER_MODE,#PAM_MODE   ;Inform MS/SM message routines mode <> PCM
```

```
007D C220          243          CLR     PREVIOUS_ERROR_71_DATA  ;Clear GET_MESSAGE_ISR #71/01 flag
007F D295          244          SETB    nHI_ACK          ;Turn off HOLD_INDEX LED (if on from abort)
0081 753300        245          MOV     SM_OPCODE_IN,#DUMMY_ZERO    ;Clear any previous opcode
0084 753100        246          MOV     MS_DATA_BYTE_OUT,#DUMMY_ZERO    ;Command slave to search for PAM
0087 753440        247          MOV     MS_OPCODE_OUT,#SEARCH_FOR_PAM_SYNC
008A 120757        248          CALL    SEND_MESSAGE
008D 900B62        249          MOV     DPTR,#M_AWAITING_TM ;Display "AWAITING TM"
0090 1207A7        250          CALL    DISPLAY_MSG_AT_MT
0093 78A7          251          MOV     R0,#USART_WR_CMD_REG   ;Disable USART (momentarily)
0095 7410          252          MOV     A,#00010000b    ;       CR0 = 0 - Disable transmitter
                   253                                  ;       CR1 = 0 - Force nDTR high
                   254                                  ;       CR2 = 0 - Disable receiver (momentarily)
                   255                                  ;       CR3 = 0 - Do not send DLE
                   256                                  ;       CR4 = 1 - Reset error flag in status
                   257                                  ;       CR5 = 0 - Force nRTS high
                   258                                  ;  CR7/CR6 = 00 - Do not strip SYN1 & SYN2
0097 F2            259          MOVX    @R0,A
                   260
                   261     REINITIALIZE_USART:          ;Reset USART and force to re-enter "hunt" mode
0098 12080D        262          CALL    INIT_USART
009B C289          263          CLR     IE0              ;Clear any pending USART (INT0) interrupt
                   264
                   265     CHECK_FOR_PT_PCM:
009D D2A1          266          SETB    PT_ct            ;USART data/clock input is direct (KGR-68 bypassed)
009F D21E          267          SETB    CHECKING_FOR_PT_PCM ;Advise main PCM loop we are checking for PT PCM
00A1 120719        268          CALL    DELAY_10MS       ;Allow 4 potential PCM streams to pass
00A4 308949        269          JNB     IE0,CHECK_FOR_CT_PCM    ;Jump if INT0 flag not set by USART
                   270     SETUP_FOR_PCM:
00A7 753020        271          MOV     MASTER_MODE,#PCM_MODE
00AA C2A3          272          CLR     PAM_pcm          ;Gate unfiltered TM to output buffer
00AC 12052B        273          CALL    ACQUIRE_PCM_BANK0
                   274     MAIN_PCM_LOOP:
00AF A218          275          MOV     C,MBANK_STAT     ;Reset watchdog timer as long as the USART is
00B1 9292          276          MOV     nMSTR_WDI,C      ;interrupting uC causing it to switch banks
00B3 E533          277          MOV     A,SM_OPCODE_IN   ;Check for message from slave
00B5 B47111        278          CJNE    A,#DATA_SELECT_ERROR,CHECK_PCM_USART_ISR_FLAGS  ;Jump if no selection err
00B8 753300        279          MOV     SM_OPCODE_IN,#DUMMY_ZERO    ;Else clear message
00BB 7401          280          MOV     A,#01h           ;Find out if selection error has been found or cleared
00BD B53224        281          CJNE    A,SM_DATA_BYTE_IN,PCM_SELECTION_ERROR_CLEARED
00C0 1207D2        282          CALL    SAVE_DISPLAY_CONTENTS
00C3 900C92        283          MOV     DPTR,#M_DATA_SELECT_ERR ;Display "DATA SELECT ERR"
00C6 1207A7        284          CALL    DISPLAY_MSG_AT_MT
                   285     CHECK_PCM_USART_ISR_FLAGS:
00C9 301D11        286          JNB     PCM_VERIFIED,CHECK_PCM_FRAME_ERROR ;Jump if USART ISR has not confirmed PCM
 sync
00CC C21D          287          CLR     PCM_VERIFIED        ;Reset flag so message is only displayed once
00CE 301E06        288          JNB     CHECKING_FOR_PT_PCM,DISP_PROC_STM  ;Else jump if PT not confirmed
                   289     DISP_PROC_PCM:
00D1 900B82        290          MOV     DPTR,#M_PROCESS_PCM ;Display "PROCESSING PCM"
00D4 0200DA        291          JMP     DISPLAY_PCM_OR_STM
                   292     DISP_PROC_STM:
00D7 900B92        293          MOV     DPTR,#M_PROCESS_STM ;Display "PROCESSING STM"
                   294     DISPLAY_PCM_OR_STM:
00DA 1207A7        295          CALL    DISPLAY_MSG_AT_MT
                   296     CHECK_PCM_FRAME_ERROR:
00DD 301B09        297          JNB     PCM_FRAME_ERROR,CHECK_FOR_PCM_DATA_LOSS ;Jump if no USART sync loss
00E0 C21B          298          CLR     PCM_FRAME_ERROR ;Else clear error flag
00E2 8086          299          JMP     MAIN_PROCESSING ;And reinitialize TM search
                   300     PCM_SELECTION_ERROR_CLEARED:
00E4 1207EB        301          CALL    DISPLAY_MSG_AT_DB   ;Restore original display
00E7 80E0          302          JMP     CHECK_PCM_USART_ISR_FLAGS
                   303     CHECK_FOR_PCM_DATA_LOSS:
00E9 301CC3        304          JNB     NO_PCM,MAIN_PCM_LOOP    ;Loop if no loss of data detected
00EC C21C          305          CLR     NO_PCM           ;Else clear error flag
```

```
00EE 016A          306          JMP     MAIN_PROCESSING ;And reinitialize TM search
                   307
                   308    CHECK_FOR_CT_PCM:
00F0 C2A1          309          CLR     PT_ct           ;USART data/clock input is from external KGR-68
00F2 C21E          310          CLR     CHECKING_FOR_PT_PCM  ;Flag display update we're PROCESSING STM
00F4 120719        311          CALL    DELAY_10MS      ;Allow 4 potential PCM streams to pass
00F7 308902        312          JNB     IE0,CHECK_FOR_PAM   ;Jump if INT0 flag not set by USART
00FA 80AB          313          JMP     SETUP_FOR_PCM
                   314
                   315    CHECK_FOR_PAM:
00FC E533          316          MOV     A,SM_OPCODE_IN
00FE B4413E        317          CJNE    A,#PAM_SYNC_DETECTED,CHECK_FOR_HI_KEY   ;Jump if no PAM sync
0101 900B72        318          MOV     DPTR,#M_PROCESS_PAM ;Else display "PROCESSING PAM"
0104 1207A7        319          CALL    DISPLAY_MSG_AT_MT
0107 753100        320          MOV     MS_DATA_BYTE_OUT,#DUMMY_ZERO    ;Command slave to enter PAM mode
010A 753442        321          MOV     MS_OPCODE_OUT,#ENTER_PAM_MODE
010D 120757        322          CALL    SEND_MESSAGE
0110 D2A3          323          SETB    PAM_pcm         ;Gate filtered TM to output buffer
0112 753010        324          MOV     MASTER_MODE,#PAM_MODE   ;Notify SM/MS message routine we are in PAM md
                   325    MAIN_PAM_LOOP:
0115 120739        326          CALL    HOUSEKEEPING
0118 E533          327          MOV     A,SM_OPCODE_IN  ;Get any messages from Slave
011A B44305        328          CJNE    A,#PAM_SYNC_LOST,CHECK_FOR_INVALID_PAM_SELECTION
011D 753300        329          MOV     SM_OPCODE_IN,#DUMMY_ZERO    ;Else clear message
0120 016A          330          JMP     MAIN_PROCESSING ;And reinitialize TM search
                   331    CHECK_FOR_INVALID_PAM_SELECTION:
0122 B471F0        332          CJNE    A,#DATA_SELECT_ERROR,MAIN_PAM_LOOP  ;Loop if no data select error
0125 753300        333          MOV     SM_OPCODE_IN,#DUMMY_ZERO    ;Else clear message
0128 7401          334          MOV     A,#01h          ;Find out if selection error has been found or cleared
012A B5320B        335          CJNE    A,SM_DATA_BYTE_IN,PAM_SELECTION_ERROR_CLEARED
012D 1207D2        336          CALL    SAVE_DISPLAY_CONTENTS
0130 900C92        337          MOV     DPTR,#M_DATA_SELECT_ERR ;Display "DATA SELECT ERR"
0133 1207A7        338          CALL    DISPLAY_MSG_AT_MT
0136 80DD          339          JMP     MAIN_PAM_LOOP
                   340    PAM_SELECTION_ERROR_CLEARED:
0138 1207EB        341          CALL    DISPLAY_MSG_AT_DB   ;Restore original display
013B 80D8          342          JMP     MAIN_PAM_LOOP
                   343
                   344    J_CHECK_FOR_PT_PCM:
013D 019D          345          JMP     CHECK_FOR_PT_PCM
                   346
                   347    CHECK_FOR_HI_KEY:
013F 120739        348          CALL    HOUSEKEEPING
0142 2091F8        349          JB      nSIM_HOLD,J_CHECK_FOR_PT_PCM    ;Jump if BIT results not requested
0145 301911        350          JNB     PASSED_LAST_CAL,LIST_SELF_TEST_ERRORS   ;Jump if last self test failed
0148 900B42        351          MOV     DPTR,#M_PASSED_ST   ;Display "PASSED SELF TEST"
014B 1207A7        352          CALL    DISPLAY_MSG_AT_MT
                   353    RE_DISPLAY_AWAITING_TM:
014E 120733        354          CALL    INTER_MESSAGE_DELAY ;Display self test result for required duration
0151 900B62        355          MOV     DPTR,#M_AWAITING_TM ;Display "AWAITING TM"
0154 1207A7        356          CALL    DISPLAY_MSG_AT_MT
0157 019D          357          JMP     CHECK_FOR_PT_PCM
                   358
                   359    LIST_SELF_TEST_ERRORS:
                   360    REPORT_MASTER_RAM_ERROR?:
0159 201009        361          JB      MASTER_RAM_OK,REPORT_MASTER_DPRAM_ERROR?    ;Jump if master RAM/REGS OK
015C 900BA2        362          MOV     DPTR,#M_MASTER_RAM_ERR  ;Else display "MSTR RAM ERR"
015F 1207A7        363          CALL    DISPLAY_MSG_AT_MT
0162 120733        364          CALL    INTER_MESSAGE_DELAY ;Display self test result for required duration
                   365    REPORT_MASTER_DPRAM_ERROR?:
0165 201109        366          JB      MASTER_DPRAM_OK,REPORT_MASTER_PAM_CLK_ERROR?    ;Jump of master DPRAM OK
0168 900BB2        367          MOV     DPTR,#M_MASTER_DPRAM_ERR    ;Else display "MSTR RAM ERR"
016B 1207A7        368          CALL    DISPLAY_MSG_AT_MT
016E 120733        369          CALL    INTER_MESSAGE_DELAY ;Display self test result for required duration
```

Navy Case No. 77,062

```
                REPORT_MASTER_PAM_CLK_ERROR?:
0171 201209             JB      MASTER_25_6_kHz_OK,REPORT_MASTER_PCM_CLK_ERROR? ;Jump if M P clk OK
0174 900BC2             MOV     DPTR,#M_MASTER_PAM_CLK_ERR  ;Else display "MSTR PAM CK ERR"
0177 1207A7             CALL    DISPLAY_MSG_AT_MT
017A 120733             CALL    INTER_MESSAGE_DELAY ;Display self test result for required duration
                REPORT_MASTER_PCM_CLK_ERROR?:
017D 201309             JB      MASTER_320_kHz_OK,REPORT_SLAVE_Rn_ARn_ERROR?    ;Jump if M PAM clk OK
0180 900BD2             MOV     DPTR,#M_MASTER_PCM_CLK_ERR  ;Else display "MSTR PCM CK ERR"
0183 1207A7             CALL    DISPLAY_MSG_AT_MT
0186 120733             CALL    INTER_MESSAGE_DELAY ;Display self test result for required duration
                REPORT_SLAVE_Rn_ARn_ERROR?:
0189 200009             JB      SLAVE_Rn_ARn_OK,REPORT_SLAVE_RAM_ERROR? ;Jump if slave registers OK
018C 900BE2             MOV     DPTR,#M_SLAVE_REG_ERR   ;Else display "SLAVE REG ERR"
018F 1207A7             CALL    DISPLAY_MSG_AT_MT
0192 120733             CALL    INTER_MESSAGE_DELAY ;Display self test result for required duration
                REPORT_SLAVE_RAM_ERROR?:
0195 200109             JB      SLAVE_RAM_OK,REPORT_SLAVE_DPRAM_ERROR?  ;Jump if slave RAM OK
0198 900BF2             MOV     DPTR,#M_SLAVE_RAM_ERR   ;Else display "SLAVE RAM ERR"
019B 1207A7             CALL    DISPLAY_MSG_AT_MT
019E 120733             CALL    INTER_MESSAGE_DELAY ;Display self test result for required duration
                REPORT_SLAVE_DPRAM_ERROR?:
01A1 200209             JB      SLAVE_DPRAM_OK,REPORT_SLAVE_PORTS_ERROR?    ;Jump if slave DPRAM OK
01A4 900C02             MOV     DPTR,#M_SLAVE_DPRAM_ERR ;Else display "SLAVE DPRAM ERR"
01A7 1207A7             CALL    DISPLAY_MSG_AT_MT
01AA 120733             CALL    INTER_MESSAGE_DELAY ;Display self test result for required duration
                REPORT_SLAVE_PORTS_ERROR?:
01AD 200309             JB      SLAVE_OUT_PORTS_OK,REPORT_SLAVE_PCM_CLK_ERROR?  ;Jump if slave ports OK
01B0 900C12             MOV     DPTR,#M_SLAVE_PORTS_ERR ;Else display "SLAVE PORTS ERR"
01B3 1207A7             CALL    DISPLAY_MSG_AT_MT
01B6 120733             CALL    INTER_MESSAGE_DELAY ;Display self test result for required duration
                REPORT_SLAVE_PCM_CLK_ERROR?:
01B9 200409             JB      SLAVE_320_kHz_OK,REPORT_SLAVE_PAM_CLK_ERROR?    ;Jump if slave PCM CK OK
01BC 900C22             MOV     DPTR,#M_SLAVE_PCM_CLK_ERR       ;Else display "SLAVE PCM CK ERR"
01BF 1207A7             CALL    DISPLAY_MSG_AT_MT
01C2 120733             CALL    INTER_MESSAGE_DELAY ;Display self test result for required duration
                REPORT_SLAVE_PAM_CLK_ERROR?:
01C5 200509             JB      SLAVE_25_6_kHz_OK,REPORT_DAAD_TEST_1_ERROR?
01C8 900C32             MOV     DPTR,#M_SLAVE_PAM_CLK_ERR       ;Else displaly "SLAVE PAM CK ERR"
01CB 1207A7             CALL    DISPLAY_MSG_AT_MT
01CE 120733             CALL    INTER_MESSAGE_DELAY ;Display self test result for required duration
                REPORT_DAAD_TEST_1_ERROR?:
01D1 200809             JB      SLAVE_DAC_ADC_1_OK,REPORT_DAAD_TEST_2_ERROR?    ;Jump if DAAD test #1 OK
01D4 900C42             MOV     DPTR,#M_DAAD_TEST_1_ERR ;Else display "DAAD TEST #1 ERR"
01D7 1207A7             CALL    DISPLAY_MSG_AT_MT
01DA 120733             CALL    INTER_MESSAGE_DELAY ;Display self test result for required duration
                REPORT_DAAD_TEST_2_ERROR?:
01DD 200909             JB      SLAVE_DAC_ADC_2_OK,REPORT_DAAD_TEST_3_ERROR?    ;Jump if DAAD test #2 OK
01E0 900C52             MOV     DPTR,#M_DAAD_TEST_2_ERR ;Else display "DAAD TEST #2 ERR"
01E3 1207A7             CALL    DISPLAY_MSG_AT_MT
01E6 120733             CALL    INTER_MESSAGE_DELAY ;Display self test result for required duration
                REPORT_DAAD_TEST_3_ERROR?:
01E9 200A09             JB      SLAVE_DAC_ADC_3_OK,REPORT_SIM_PAM_TEST_ERROR?   ;Jump if DAAD test #3 OK
01EC 900C62             MOV     DPTR,#M_DAAD_TEST_3_ERR ;Else display "DAAD TEST #3 ERR"
01EF 1207A7             CALL    DISPLAY_MSG_AT_MT
01F2 120733             CALL    INTER_MESSAGE_DELAY ;Display self test result for required duration
                REPORT_SIM_PAM_TEST_ERROR?:
01F5 200B09             JB      SLAVE_PAM_OK,REPORT_SIM_PCM_TEST_ERROR? ;Jump if SIM PAM test OK
01F8 900C72             MOV     DPTR,#M_SIM_PAM_TEST_ERR    ;Else display "SIM PAM TEST ERR"
01FB 1207A7             CALL    DISPLAY_MSG_AT_MT
01FE 120733             CALL    INTER_MESSAGE_DELAY ;Display self test result for required duration
                REPORT_SIM_PCM_TEST_ERROR?:
0201 200C08             JB      SLAVE_PCM_OK,J_RE_DISPLAY_AWAITING_TM   ;Jump if SIM PCM test OK
0204 900C82             MOV     DPTR,#M_SIM_PCM_TEST_ERR    ;Else display "SIM PCM TEST ERR"
0207 1207A7             CALL    DISPLAY_MSG_AT_MT
```

Navy Case No. 77,062

```
020A 214E          JMP     RE_DISPLAY_AWAITING_TM  ;All errors reported.  Resume TM search

J_RE_DISPLAY_AWAITING_TM:
020C 214E          JMP     RE_DISPLAY_AWAITING_TM

;*****************************************************************************
;*****************************************************************************
;

;                                   SUBROUTINES
;*****************************************************************************

SELF_TEST:                          ;Self test is currently limited to the display test
                                    ;and to outputing [holding] simulated PAM & PCM
020E 753100        MOV     MS_DATA_BYTE_OUT,#DUMMY_ZERO    ;Command slave to begin its display test
0211 753460        MOV     MS_OPCODE_OUT,#BEGIN_DISPLAY_TEST
0214 120757        CALL    SEND_MESSAGE
0217 74C0          MOV     A,#11000000b    ;ACC <- code to clear DISP RAM & init self test
0219 79C0          MOV     R1,#DISP0_CTRL
021B F3            MOVX    @R1,A           ;Send code to DISP0 Control Word Register
021C 79E0          MOV     R1,#DISP1_CTRL
021E F3            MOVX    @R1,A           ;Send code to DISP1 Control Word Register
021F 12073C        CALL    SET_TIMER0_FOR_1MS  ;Initiate display self test timer
0222 753A64        MOV     DESIRED_50MS_TICKS,#100 ;Delay 5 seconds for HDSP-2112 self tests
0225 120722        CALL    DELAY_50MS_TICKS    ;Wait 5 seconds
0228 900AE2        MOV     DPTR,#M_DISPTEST    ;Conclude display test with test message
022B 1207A7        CALL    DISPLAY_MSG_AT_MT
022E C295          CLR     nHI_ACK             ;Turn on HOLD/INDEX switch LED
0230 D293          SETB    TM_SEL_0            ;Turn on SIM PCM LED
0232 D294          SETB    TM_SEL_1
0234 753A0A        MOV     DESIRED_50MS_TICKS,#10  ;Delay 0.5 seconds
0237 120722        CALL    DELAY_50MS_TICKS
023A C293          CLR     TM_SEL_0            ;Turn on SIM PAM LED
023C 753A0A        MOV     DESIRED_50MS_TICKS,#10  ;Delay 0.5 seconds
023F 120722        CALL    DELAY_50MS_TICKS
0242 D293          SETB    TM_SEL_0            ;Turn on EXTERNAL LED
0244 C294          CLR     TM_SEL_1
0246 753A0A        MOV     DESIRED_50MS_TICKS,#10  ;Delay 0.5 seconds
0249 120722        CALL    DELAY_50MS_TICKS
024C C293          CLR     TM_SEL_0            ;Turn off EXTERNAL LED
024E C296          CLR     nPCM_SYNC           ;And turn on FRAME SYNC LED
0250 753A0A        MOV     DESIRED_50MS_TICKS,#10  ;Delay 0.5 seconds
0253 120722        CALL    DELAY_50MS_TICKS
0256 D296          SETB    nPCM_SYNC                       ;Turn off FRAME SYNC LED
0258 D295          SETB    nHI_ACK                         ;Turn off HOLD/INDEX switch LED
025A 900AC2        MOV     DPTR,#M_MC_SW_VER   ;Display microcontroller software version
025D 1207A7        CALL    DISPLAY_MSG_AT_MT
0260 753A28        MOV     DESIRED_50MS_TICKS,#40  ;Delay 2 seconds
0263 120722        CALL    DELAY_50MS_TICKS
0266 900AD2        MOV     DPTR,#M_DSP_SW_VER  ;Display DSP software version
0269 1207A7        CALL    DISPLAY_MSG_AT_MT
026C C2B0          CLR     MBANK               ;Prepare to read slave's stored SW ver.
026E 7870          MOV     R0,#DSP_SW_VER_ADDRESS  ;R0 gets address of stored SW ver.
0270 79EC          MOV     R1,#DISP1_CHAR_4    ;R1 points to units char of SW ver field
0272 E2            MOVX    A,@R0               ;ACC gets units of DSP SW version
0273 F3            MOVX    @R1,A               ;Display units
0274 08            INC     R0                  ;R0 points to next digit of DSP SW version
0275 09            INC     R1                  ;Increment R1 to skip decimal point
0276 09            INC     R1                  ;R1 points to tenths char of SW ver field
0277 E2            MOVX    A,@R0               ;ACC gets tenths of DSP SW version
0278 F3            MOVX    @R1,A               ;Display tenths
0279 08            INC     R0                  ;R0 points to next digit of DSP SW version
027A 09            INC     R1                  ;R1 points to hundredths char of SW ver field
027B E2            MOVX    A,@R0               ;ACC gets hundredths of DSP SW version
027C F3            MOVX    @R1,A               ;Display hundredths
```

Navy Case No. 77,062

```
027D D2B0          498          SETB    MBANK                ;Restore default MBANK value
027F 753A28        499          MOV     DESIRED_50MS_TICKS,#40  ;Delay 2 seconds
0282 120722        500          CALL    DELAY_50MS_TICKS
                   501
0285 753100        502          MOV     MS_DATA_BYTE_OUT,#DUMMY_ZERO    ;Command slave to stop its display test
0288 753461        503          MOV     MS_OPCODE_OUT,#STOP_DISPLAY_TEST
028B 120757        504          CALL    SEND_MESSAGE
                   505    OFFER_SIMULATED_PAM:
028E 753010        506          MOV     MASTER_MODE,#PAM_MODE   ;Notify MS/SM message routines of PAM mode
0291 C220          507          CLR     PREVIOUS_ERROR_71_DATA  ;Clear GET_MESSAGE_ISR #71/01 flag
0293 753300        508          MOV     SM_OPCODE_IN,#DUMMY_ZERO    ;Clear any previous opcode
0296 120780        509          CALL    SIMULATE_PAM    ;Generate test PAM at J1
0299 900AF2        510          MOV     DPTR,#M_SIM_PAM ;Notify operator that simulated PAM is on J1
029C 1207A7        511          CALL    DISPLAY_MSG_AT_MT
                   512
029F 753100        513          MOV     MS_DATA_BYTE_OUT,#DUMMY_ZERO    ;New in version 1.30
02A2 753440        514          MOV     MS_OPCODE_OUT,#SEARCH_FOR_PAM_SYNC ;New in version 1.30
02A5 120757        515          CALL    SEND_MESSAGE                    ;New in version 1.30
                   516
02A8 7DC8          517          MOV     R5,#200         ;Prepare to delay 2 seconds
02AA 7837          518          MOV     R0,#EXT_ONE_MS_TICKS    ;R0 points to counter of 10ms intervals
                   519    SELF_TEST_DELAY_1:
02AC 7600          520          MOV     @R0,#0          ;Delay 10ms
02AE B60AFD        521          CJNE    @R0,#10,$       ;Loop for 10ms
02B1 120739        522          CALL    HOUSEKEEPING
02B4 309105        523          JNB     nSIM_HOLD,HOLD_PAM  ;Jump if operator has pressed HOLD/INDEX key
02B7 DDF3          524          DJNZ    R5,SELF_TEST_DELAY_1    ;Else recheck key once every 10ms for 2 seconds
02B9 0202EA        525          JMP     TERMINATE_SIM_PAM ;Jump if HOLD/INDEX key not pressed in 2 seconds
                   526    HOLD_PAM:
02BC C295          527          CLR     nHI_ACK         ;HOLD/INDEX key has been pressed.  Light its LED
02BE 900B12        528          MOV     DPTR,#M_HOLDING_PAM ;Notify operator that SIM PAM is held
02C1 1207A7        529          CALL    DISPLAY_MSG_AT_MT
02C4 120521        530          CALL    DEBOUNCE_HOLD_INDEX_KEY ;Loop until H/I key no longer pressed
                   531    SIM_PAM_LOOP:
02C7 309120        532          JNB     nSIM_HOLD,TERMINATE_SIM_PAM ;Jump if H/I key pressed to exit SIM PAM
02CA 120739        533          CALL    HOUSEKEEPING    ;Else take care of housekeeping chores while waiting
02CD E533          534          MOV     A,SM_OPCODE_IN  ;Get any messages from Slave
02CF B471F5        535          CJNE    A,#DATA_SELECT_ERROR,SIM_PAM_LOOP  ;Loop if no data select error
02D2 753300        536          MOV     SM_OPCODE_IN,#DUMMY_ZERO    ;Else clear message
02D5 7401          537          MOV     A,#01h          ;Find out if selection error has been found or cleared
02D7 B5320B        538          CJNE    A,SM_DATA_BYTE_IN,SPAML_PAM_SELECTION_ERROR_CLEARED
02DA 1207D2        539          CALL    SAVE_DISPLAY_CONTENTS
02DD 900C92        540          MOV     DPTR,#M_DATA_SELECT_ERR ;Display "DATA SELECT ERR"
02E0 1207A7        541          CALL    DISPLAY_MSG_AT_MT
02E3 80E2          542          JMP     SIM_PAM_LOOP
                   543    SPAML_PAM_SELECTION_ERROR_CLEARED:
02E5 1207EB        544          CALL    DISPLAY_MSG_AT_DB   ;Restore original display
02E8 80DD          545          JMP     SIM_PAM_LOOP
                   546    TERMINATE_SIM_PAM:
02EA 120521        547          CALL    DEBOUNCE_HOLD_INDEX_KEY ;Loop until H/I key no longer pressed
02ED C2BB          548          CLR     PT1             ;Restore TIMER1 256 kHz int to lower priority
02EF 753600        549          MOV     TIMER1_ISR_MODE,#DO_NOTHING ;Turn off PAM simulator
02F2 C28E          550          CLR     TR1             ;Disable TIMER1
02F4 C2AB          551          CLR     ET1             ;Disable TIMER1 interrupt
02F6 C28F          552          CLR     TF1             ;Reset TIMER1 interrupt flag
02F8 D295          553          SETB    nHI_ACK         ;HOLD/INDEX key has been pressed.  Turn off its LED
                   554
                   555    OFFER_SIMULATED_PCM:
02FA 753020        556          MOV     MASTER_MODE,#PCM_MODE   ;Notify MS/SM message routines of PCM mode
02FD C220          557          CLR     PREVIOUS_ERROR_71_DATA  ;Clear GET_MESSAGE_ISR #71/01 flag
02FF 753300        558          MOV     SM_OPCODE_IN,#DUMMY_ZERO    ;Clear any previous opcode
0302 751904        559          MOV     PCM_WORD_POINTER,#4     ;Load PCM ptr w/ value OK w/ SEND_MESSAGE
0305 D293          560          SETB    TM_SEL_0        ;Gate simulated PCM to input circuitry
0307 D294          561          SETB    TM_SEL_1
```

```
0309 C2A3        562          CLR     PAM_pcm          ;Gate unfiltered TM to J1 output buffer
                 563      ;   CLR     R_HUND_zero
030B 753100      564          MOV     MS_DATA_BYTE_OUT,#00h   ;Assume slave must output 0 pct during cal mode
030E 309003      565          JNB     HUND_zero,REQUEST_SIMULATED_PCM ;Jump if assumption was correct
0311 753101      566          MOV     MS_DATA_BYTE_OUT,#01h   ;Else slave must output 100 pct during cal mode
                 567      ;   SETB    R_HUND_zero
                 568  REQUEST_SIMULATED_PCM:
0314 753424      569          MOV     MS_OPCODE_OUT,#CALIBRATE_PCM    ;Command slave to generate/test PCM
0317 120757      570          CALL    SEND_MESSAGE
031A 900B02      571          MOV     DPTR,#M_SIM_PCM ;Notify operator that simulated PCM is on J1
031D 1207A7      572          CALL    DISPLAY_MSG_AT_MT
0320 7DC8        573          MOV     R5,#200          ;Prepare to delay 2 seconds
                 574  GET_BANK_0:
0322 12052B      575          CALL    ACQUIRE_PCM_BANK0        ;New in version 1.30
0325 7837        576          MOV     R0,#EXT_ONE_MS_TICKS    ;R0 points to counter of 10ms intervals
                 577  SELF_TEST_DELAY_2:
0327 7600        578          MOV     @R0,#0           ;Delay 10ms
                 579  CHECK_FOR_STD2_FRAME_ERROR:
0329 301B04      580          JNB     PCM_FRAME_ERROR,CHECK_STD2  ;Jump if USART ISR hasn't detected sync err
032C C21B        581          CLR     PCM_FRAME_ERROR      ;Else clear error flag
032E 80F2        582          JMP     GET_BANK_0       ;And jump to re-sync with PCM
                 583  CHECK_STD2:
0330 B60AF6      584          CJNE    @R0,#10,CHECK_FOR_STD2_FRAME_ERROR  ;Loop for 10ms
0333 120739      585          CALL    HOUSEKEEPING
0336 309105      586          JNB     nSIM_HOLD,HOLD_PCM  ;Jump if operator has pressed HOLD/INDEX key
0339 DDEC        587          DJNZ    R5,SELF_TEST_DELAY_2    ;Else recheck key once every 10ms for 2 seconds
033B 020384      588          JMP     TERMINATE_SIM_PCM   ;Jump if HOLD/INDEX key not pressed in 2 seconds
                 589
                 590  HOLD_PCM:
033E C295        591          CLR     nHI_ACK          ;HOLD/INDEX key has been pressed.  Light its LED
0340 900B22      592          MOV     DPTR,#M_HOLDING_PCM ;Notify operator that SIM PCM is held
0343 1207A7      593          CALL    DISPLAY_MSG_AT_MT
                 594
                 595  DEBOUNCE_THE_HOLD_INDEX_KEY:
0346 753C32      596          MOV     DEBOUNCE_COUNT,#BOUNCES ;Initialize number of 4uS debounce counts
                 597  CHECK_FOR_STD3_FRAME_ERROR:
0349 301B05      598          JNB     PCM_FRAME_ERROR,CHECK_STD3  ;Jump if USART ISR hasn't detected sync err
034C C21B        599          CLR     PCM_FRAME_ERROR      ;Else clear error flag
034E 12052B      600          CALL    ACQUIRE_PCM_BANK0        ;New in version 1.30
                 601  CHECK_STD3:
0351 3091F2      602          JNB     nSIM_HOLD,DEBOUNCE_THE_HOLD_INDEX_KEY ;Reinit debounce count if nSIM_HOLD=0
0354 D53CF2      603          DJNZ    DEBOUNCE_COUNT,CHECK_FOR_STD3_FRAME_ERROR  ;Else loop until stabilized
                 604
                 605  SIM_PCM_LOOP:
0357 30912A      606          JNB     nSIM_HOLD,TERMINATE_SIM_PCM ;Jump if H/I key pressed to exit SIM PCM
035A 301B06      607          JNB     PCM_FRAME_ERROR,DO_HOUSEKEEPING  ;Jump if USART ISR hasn't found sync err
035D C21B        608          CLR     PCM_FRAME_ERROR      ;Else clear error flag
035F 12052B      609          CALL    ACQUIRE_PCM_BANK0        ;New in version 1.30
0362 00          610          nop
                 611  DO_HOUSEKEEPING:
0363 120739      612          CALL    HOUSEKEEPING     ;Else take care of housekeeping chores while waiting
0366 E533        613          MOV     A,SM_OPCODE_IN  ;Get any messages from Slave
0368 B471EC      614          CJNE    A,#DATA_SELECT_ERROR,SIM_PCM_LOOP  ;Loop if no data select error
036B 753300      615          MOV     SM_OPCODE_IN,#DUMMY_ZERO    ;Else clear message
036E 7401        616          MOV     A,#01h           ;Find out if selection error has been found or cleared
0370 B5320C      617          CJNE    A,SM_DATA_BYTE_IN,SPCML_PCM_SELECTION_ERROR_CLEARED
0373 1207D2      618          CALL    SAVE_DISPLAY_CONTENTS
0376 900C92      619          MOV     DPTR,#M_DATA_SELECT_ERR ;Display "DATA SELECT ERR"
0379 1207A7      620          CALL    DISPLAY_MSG_AT_MT
037C 00          621          nop
037D 80D8        622          JMP     SIM_PCM_LOOP
                 623
                 624  SPCML_PCM_SELECTION_ERROR_CLEARED:
037F 1207EB      625          CALL    DISPLAY_MSG_AT_DB   ;Restore original display
```

```
0382 80D3          626          JMP     SIM_PCM_LOOP
                   627    TERMINATE_SIM_PCM:
0384 C2A8          628          CLR     EX0              ;Disable USART interrupt
0386 753000        629          MOV     MASTER_MODE,#TEST_MODE  ;Notify MS/SM message routines of test mode
0389 120521        630          CALL    DEBOUNCE_HOLD_INDEX_KEY ;Loop until H/I key no longer pressed
038C D295          631          SETB    nHI_ACK          ;Turn off HOLD/INDEX LED
                   632    RF_SELF_TEST:
038E D296          633          SETB    nPCM_SYNC        ;And make sure master's SYNC LED line is high
0390 22            634          RET                      ;RETURN FROM SELF_TEST
                   635
                   636    ;*****************************************************************************
                   637    CALIBRATE:
0391 D2A6          638          SETB    TEST_FLAG                ;*TEST* Mark beginning of CAL mode
0393 A290          639          MOV     C,HUND_zero      ;Initialize recorded HUND_zero status bit
0395 9221          640          MOV     R_HUND_zero,C
0397 D21F          641          SETB    CALIBRATING              ;Notify ACQUIRE_PCM_BANK0 return here on failure
0399 C220          642          CLR     PREVIOUS_ERROR_71_DATA   ;Clear GET_MESSAGE_ISR #71/01 flag
039B 753300        643          MOV     SM_OPCODE_IN,#DUMMY_ZERO     ;Clear any previous opcode
039E 753000        644          MOV     MASTER_MODE,#TEST_MODE   ;Notify MS/SM message routines of test mode
03A1 12073C        645          CALL    SET_TIMER0_FOR_1MS       ;Initialize TIMER0 for clock tests
03A4 C293          646          CLR     TM_SEL_0                 ;Ground TM IN line for PAM clock test
03A6 C294          647          CLR     TM_SEL_1
03A8 D296          648          SETB    nPCM_SYNC        ;Make sure master's SYNC LED line is high
                   649
                   650      ;    CLR     R_HUND_zero
03AA 753100        651          MOV     MS_DATA_BYTE_OUT,#00h    ;Assume HUND/zero input is low
03AD 309003        652          JNB     HUND_zero,SEND_PREP_CAL_COMMAND     ;Jump if assumption was correct
03B0 753101        653          MOV     MS_DATA_BYTE_OUT,#01h    ;Else slave must output 100 pct during cal mode
                   654      ;    SETB    R_HUND_zero
                   655    SEND_PREP_CAL_COMMAND:
03B3 753490        656          MOV     MS_OPCODE_OUT,#PREP_TO_CALIBRATE
03B6 120757        657          CALL    SEND_MESSAGE
                   658
03B9 900B32        659          MOV     DPTR,#M_CALIBRATING      ;Notify operator of calibrate mode
03BC 1207A7        660          CALL    DISPLAY_MSG_AT_MT
03BF 12057E        661          CALL    TEST_DPRAM_LEFT
                   662      ;    CLR     R_HUND_zero
03C2 753100        663          MOV     MS_DATA_BYTE_OUT,#00h    ;Assume HUND/zero input is low
03C5 309003        664          JNB     HUND_zero,SEND_CALIBRATE_COMMAND     ;Jump if assumption was correct
03C8 753101        665          MOV     MS_DATA_BYTE_OUT,#01h    ;Else slave must output 100 pct during cal mode
                   666      ;    SETB    R_HUND_zero
                   667    SEND_CALIBRATE_COMMAND:
03CB 753401        668          MOV     MS_OPCODE_OUT,#TEST_NON_TM_FUNCT
03CE 120757        669          CALL    SEND_MESSAGE
03D1 1205C7        670          CALL    TEST_MASTER_RAM
03D4 1205E8        671          CALL    TEST_PAM_CLK
03D7 120620        672          CALL    TEST_PCM_CLK
03DA 12073C        673          CALL    SET_TIMER0_FOR_1MS
03DD 753100        674          MOV     MS_DATA_BYTE_OUT,#00h    ;Data byte for this command is 00h
03E0 753402        675          MOV     MS_OPCODE_OUT,#SEND_NON_TM_STATUS
03E3 120757        676          CALL    SEND_MESSAGE
                   677      ;    SETB    TEST_FLAG                ;*TEST* Indicate "02" opcode sent
03E6 7933          678          MOV     R1,#SM_OPCODE_IN     ;R1 points to opcode received from slave
03E8 753700        679          MOV     EXT_ONE_MS_TICKS,#0 ;Clear 1ms TIMER0 counter
                   680    CHK_SLAVE_STAT_1:
03EB B70303        681          CJNE    @R1,#03h,CHK_SLAVE_STAT_1_TIME ;Check timeout if opcode wrong
03EE 020404        682          JMP     SLAVE_N_T_STATUS_RCVD    ;Else jump to read data byte
                   683    CHK_SLAVE_STAT_1_TIME:
03F1 E537          684          MOV     A,EXT_ONE_MS_TICKS  ;ACC gets TIMER0's 1ms count
03F3 B40AF5        685          CJNE    A,#10,CHK_SLAVE_STAT_1  ;Recheck opcode if not timed out
03F6 753100        686          MOV     MS_DATA_BYTE_OUT,#00h    ;Else 10ms elapsed w/o response...
03F9 753402        687          MOV     MS_OPCODE_OUT,#SEND_NON_TM_STATUS
03FC 120757        688          CALL    SEND_MESSAGE         ;... so resend message
                   689      ;    CLR     TEST_FLAG            ;*TEST* Indicate 2nd "02" opcode sent
```

Navy Case No. 77,062

```
03FF 7933          690          MOV     R1,#SM_OPCODE_IN     ;R1 points to opcode received from slave
0401 B703FD        691          CJNE    @R1,#03h,$           ;Now loop until good opcode received or watchdog int
                   692
                   693    SLAVE_N_T_STATUS_RCVD:
0404 853220        694          MOV     SLAVE_NON_TM_STATUS,SM_DATA_BYTE_IN ;Store status from slave
0407 12065E        695          CALL    TEST_DAAD
040A 120780        696          CALL    SIMULATE_PAM
040D 120710        697          CALL    DELAY_1MS
                   698      ;    CLR     R_HUND_zero
0410 753100        699          MOV     MS_DATA_BYTE_OUT,#00h   ;Assume HUND/zero input is low
0413 309003        700          JNB     HUND_zero,SEND_CALIBRATE_PAM_COMMAND    ;Jump if assumption was correct
0416 753101        701          MOV     MS_DATA_BYTE_OUT,#01h   ;Else slave must output 100 pct during cal mode
                   702      ;    SETB    R_HUND_zero
                   703    SEND_CALIBRATE_PAM_COMMAND:
0419 753421        704          MOV     MS_OPCODE_OUT,#CALIBRATE_PAM    ;Command slave to calibrate test PAM
041C 120757        705          CALL    SEND_MESSAGE
041F 753700        706          MOV     EXT_ONE_MS_TICKS,#0 ;Clear 1ms TIMER0 counter
0422 7937          707          MOV     R1,#EXT_ONE_MS_TICKS    ;R1 points to TIMER0 counter
0424 B70AFD        708          CJNE    @R1,#10,$            ;Allow 10 ms for slave to check PAM
0427 753100        709          MOV     MS_DATA_BYTE_OUT,#DUMMY_ZERO
042A 753422        710          MOV     MS_OPCODE_OUT,#SEND_CAL_PAM_STATUS  ;Command slave to send PAM status
042D 120757        711          CALL    SEND_MESSAGE
0430 7933          712          MOV     R1,#SM_OPCODE_IN     ;R1 points to opcode received from slave
0432 753700        713          MOV     EXT_ONE_MS_TICKS,#0 ;Clear 1ms TIMER0 counter
                   714    CHK_SLAVE_STAT_2:
0435 B72303        715          CJNE    @R1,#23h,CHK_SLAVE_STAT_2_TIME ;Check timeout if opcode wrong
0438 02044E        716          JMP     SLAVE_PAM_STATUS_RCVD   ;Else jump to read data byte
                   717    CHK_SLAVE_STAT_2_TIME:
043B E537          718          MOV     A,EXT_ONE_MS_TICKS  ;ACC gets TIMER0's 1ms count
043D B40AF5        719          CJNE    A,#10,CHK_SLAVE_STAT_2  ;Recheck opcode if not timed out
0440 753100        720          MOV     MS_DATA_BYTE_OUT,#DUMMY_ZERO ;Else 10ms elapsed w/o response...
0443 753422        721          MOV     MS_OPCODE_OUT,#SEND_CAL_PAM_STATUS
0446 120757        722          CALL    SEND_MESSAGE         ;... so resend message
0449 7933          723          MOV     R1,#SM_OPCODE_IN     ;R1 points to opcode received from slave
044B B723FD        724          CJNE    @R1,#23h,$           ;Now loop until good opcode received or watchdog int
                   725
                   726    SLAVE_PAM_STATUS_RCVD:
044E D20B          727          SETB    SLAVE_PAM_OK         ;Assume PAM test passes
0450 E532          728          MOV     A,SM_DATA_BYTE_IN    ;Read received data
0452 B40103        729          CJNE    A,#TEST_PASSED,PAM_TEST_FAILED  ;Jump if assumption of pass incorrect
0455 02045A        730          JMP     BEGIN_PCM_TEST  ;Else jump to begin next test
                   731    PAM_TEST_FAILED:
0458 C20B          732          CLR     SLAVE_PAM_OK         ;Flag main program that PAM test failed
                   733    BEGIN_PCM_TEST:
045A 753602        734          MOV     TIMER1_ISR_MODE,#STD_TIMER  ;Turn off PAM simulator
045D C28E          735          CLR     TR1
045F C2AB          736          CLR     ET1
0461 D293          737          SETB    TM_SEL_0             ;Gate simulated PCM to input circuitry
0463 D294          738          SETB    TM_SEL_1
0465 C2A3          739          CLR     PAM_pcm          ;Gate unfiltered TM to J1 output buffer
                   740
                   741      ;    CLR     R_HUND_zero
0467 753100        742          MOV     MS_DATA_BYTE_OUT,#00h   ;Assume HUND/zero input is low
046A 309003        743          JNB     HUND_zero,SEND_CALIBRATE_PCM_COMMAND    ;Jump if assumption was correct
046D 753101        744          MOV     MS_DATA_BYTE_OUT,#01h   ;Else slave must output 100 pct during cal mode
                   745      ;    SETB    R_HUND_zero
                   746    SEND_CALIBRATE_PCM_COMMAND:
0470 C220          747          CLR     PREVIOUS_ERROR_71_DATA  ;Clear GET_MESSAGE_ISR #71/01 flag
0472 753300        748          MOV     SM_OPCODE_IN,#DUMMY_ZERO    ;Clear any previous opcode
0475 753424        749          MOV     MS_OPCODE_OUT,#CALIBRATE_PCM    ;Command slave to generate/test PCM
0478 120757        750          CALL    SEND_MESSAGE
047B 120528        751          CALL    ACQUIRE_PCM_BANK0   ;Sync with and acquire PCM frame in BANK0
047E 753700        752          MOV     EXT_ONE_MS_TICKS,#0 ;Allow slave time to process >= 2 frames
                   753    FORWARD_TWO_PCM_FRAMES:
```

```
0481 E537        754          MOV     A,EXT_ONE_MS_TICKS  ;Give slave 60 ms to test its simulated PCM
0483 B43CFB      755          CJNE    A,#60,FORWARD_TWO_PCM_FRAMES  ;... and for MSTS to test CH IDs
                 756  REQUEST_PCM_CALIBRATION_STATUS:
0486 753100      757          MOV     MS_DATA_BYTE_OUT,#DUMMY_ZERO
0489 753425      758          MOV     MS_OPCODE_OUT,#SEND_CAL_PCM_STATUS
048C 120757      759          CALL    SEND_MESSAGE
048F 7933        760          MOV     R1,#SM_OPCODE_IN    ;R1 points to opcode received from slave
0491 753700      761          MOV     EXT_ONE_MS_TICKS,#0 ;Clear 1ms TIMER0 counter
                 762  CHK_SLAVE_STAT_3:
0494 B72603      763          CJNE    @R1,#26h,CHK_SLAVE_STAT_3_TIME ;Check timeout if opcode wrong
0497 0204AD      764          JMP     SLAVE_PCM_STATUS_RCVD   ;Else jump to read data byte
                 765  CHK_SLAVE_STAT_3_TIME:
049A E537        766          MOV     A,EXT_ONE_MS_TICKS  ;ACC gets TIMER0's 1ms count
049C B40AF5      767          CJNE    A,#10,CHK_SLAVE_STAT_3  ;Recheck opcode if not timed out
049F 753100      768          MOV     MS_DATA_BYTE_OUT,#DUMMY_ZERO  ;Else 10ms elapsed w/o response...
04A2 753425      769          MOV     MS_OPCODE_OUT,#SEND_CAL_PCM_STATUS
04A5 120757      770          CALL    SEND_MESSAGE        ;... so resend message
04A8 7933        771          MOV     R1,#SM_OPCODE_IN    ;R1 points to opcode received from slave
04AA B726FD      772          CJNE    @R1,#26h,$          ;Now loop until good opcode received or watchdog int
                 773
                 774  SLAVE_PCM_STATUS_RCVD:
04AD D20C        775          SETB    SLAVE_PCM_OK        ;Assume PCM test passes
04AF E532        776          MOV     A,SM_DATA_BYTE_IN   ;Read received data
04B1 B40103      777          CJNE    A,#TEST_PASSED,PCM_TEST_FAILED  ;Jump if assumption of pass incorrect
04B4 0204B9      778          JMP     DID_CALIBRATE_PASS?
                 779  PCM_TEST_FAILED:
04B7 C20C        780          CLR     SLAVE_PCM_OK        ;Flag main program that PCM test failed
                 781  DID_CALIBRATE_PASS?:
04B9 C2A6        782          CLR     TEST_FLAG       ;*TEST* Mark end of CAL mode tests
                 783      ;    CLR     MASTER_25_6_kHz_OK  ;*TEST* Clear to indicate failure
04BB E520        784          MOV     A,SLAVE_NON_TM_STATUS   ;ACC gets 1st byte of CALIBRATE status flags
04BD 44C0        785          ORL     A,#11000000b        ;Set unused bits of SLAVE_NON_TM_STATUS
04BF B4FF27      786          CJNE    A,#0FFh,FAILED_CALIBRATION  ;Jump if not all "OK" flags set
04C2 E521        787          MOV     A,SLAVE_ADC_TM_STATUS   ;ACC gets 2nd byte of CALIBRATE status flags
04C4 44E0        788          ORL     A,#11100000b        ;Set unused bits of SLAVE_ADC_TM_STATUS
04C6 B4FF20      789          CJNE    A,#0FFh,FAILED_CALIBRATION  ;Jump if not all "OK" flags set
04C9 E522        790          MOV     A,MASTER_NON_TM_STATUS  ;ACC gets 3rd byte of CALIBRATE status flags
04CB 44F0        791          ORL     A,#11110000b        ;Set unused bits of MASTER_NON_TM_STATUS
04CD B4FF19      792          CJNE    A,#0FFh,FAILED_CALIBRATION  ;Jump if not all "OK" flags set
                 793  PASSED_CALIBRATION:
04D0 D219        794          SETB    PASSED_LAST_CAL ;Notify main program that calibration passed
04D2 900B42      795          MOV     DPTR,#M_PASSED_ST   ;Else display "PASSED SELF TEST" message
04D5 1207A7      796          CALL    DISPLAY_MSG_AT_MT
04D8 30A706      797          JNB     OPER_cal,WAIT_TIL_MSTS_EXITS_CAL_MODE   ;Jump if MSTS invoked CALIBRATE md
04DB 753A3C      798          MOV     DESIRED_50MS_TICKS,#60 ;Else display message for 3 seconds
04DE 120722      799          CALL    DELAY_50MS_TICKS
                 800  WAIT_TIL_MSTS_EXITS_CAL_MODE:
04E1 20A72B      801          JB      OPER_cal,RF_CALIBRATE
04E4 120739      802          CALL    HOUSEKEEPING
04E7 80F8        803          JMP     WAIT_TIL_MSTS_EXITS_CAL_MODE
                 804  FAILED_CALIBRATION:
04E9 C219        805          CLR     PASSED_LAST_CAL ;Notify main program that calibration failed
04EB 753100      806          MOV     MS_DATA_BYTE_OUT,#DUMMY_ZERO
04EE 753430      807          MOV     MS_OPCODE_OUT,#OUTPUT_50_PERCENT    ;Command slave to relay failure to MSTS
04F1 120757      808          CALL    SEND_MESSAGE
04F4 C293        809          CLR     TM_SEL_0            ;Extinguish non-pertinent display LEDs
04F6 C294        810          CLR     TM_SEL_1
04F8 900B52      811          MOV     DPTR,#M_FAILED_ST   ;Else display "FAILED SELF TEST" message
04FB 1207A7      812          CALL    DISPLAY_MSG_AT_MT
                 813
04FE 7410        814          MOV     A,#10h              ;Initiate display flash
0500 78C0        815          MOV     R0,#DISP0_CTRL
0502 F2          816          MOVX    @R0,A
0503 78E0        817          MOV     R0,#DISP1_CTRL
```

```
0505 F2          818          MOVX    @R0,A
                 819
0506 30A7D8      820          JNB     OPER_cal,WAIT_TIL_MSTS_EXITS_CAL_MODE   ;Jump if MSTS invoked CALIBRATE md
0509 753A3C      821          MOV     DESIRED_50MS_TICKS,#60 ;Else display message for 3 seconds
050C 120722      822          CALL    DELAY_50MS_TICKS
                 823     RF_CALIBRATE:
050F C2A8        824          CLR     EX0                     ;Disable USART ISR
0511 753000      825          MOV     MASTER_MODE,#TEST_MODE  ;Notify GET/SEND msg routines OK to change MBANK
0514 D296        826          SETB    nPCM_SYNC               ;Make sure master's PCM SYNC LED is off
0516 7400        827          MOV     A,#0h                   ;Terminate display flash
051B 78C0        828          MOV     R0,#DISP0_CTRL
051A F2          829          MOVX    @R0,A
051B 78E0        830          MOV     R0,#DISP1_CTRL
051D F2          831          MOVX    @R0,A
051E C21F        832          CLR     CALIBRATING     ;Notify ACQUIRE_PCM_BANK0 jump to MP on failure
0520 22          833          RET                     ;Return from calibrate mode
                 834
                 835     ;*****************************************************************************
                 836
                 837     DEBOUNCE_HOLD_INDEX_KEY:
0521 753C32      838          MOV     DEBOUNCE_COUNT,#BOUNCES ;Initialize number of 4uS debounce counts
                 839     STABILIZING:
0524 3091FA      840          JNB     nSIM_HOLD,DEBOUNCE_HOLD_INDEX_KEY   ;Reinit debounce count if nSIM_HOLD = 0
0527 D53CFA      841          DJNZ    DEBOUNCE_COUNT,STABILIZING  ;Else loop until stabilized
052A 22          842          RET
                 843
                 844     ;*****************************************************************************
                 845
                 846     ACQUIRE_PCM_BANK0:
052B C2A8        847          CLR     EX0             ;Disable INT0 (USART RxRDY) interrupt
052D C289        848          CLR     IE0             ;Reset INT0 (USART RxRDY) interrupt flag
052F C2A9        849          CLR     ET0             ;Disable TIMER0 interrupt
                 850     HUNT_FOR_NEXT_PCM_FRAME_SYNC:
0531 12080D      851          CALL    INIT_USART
0534 C21A        852          CLR     BEGINNING_PCM   ;Notify USART ISR not beginning new PCM frame
0536 78A0        853          MOV     R0,#USART_RD_HLD_REG    ;Now R0 must point to USART holding register
0538 900000      854          MOV     DPTR,#0         ;Initialize DPTR for timeout delay
                 855     POLL_FOR_FSYNC_3:
053B 208913      856          JB      IE0,CHECK_FOR_FSYNC_3 ;(2) Jump if USART has received char (FSYNC_3?)
053E A3          857          INC     DPTR            ;(2) Else increment timeout delay
053F E583        858          MOV     A,DPH           ;(1) ACC gets high byte of timer
0541 B402F7      859          CJNE    A,#2,POLL_FOR_FSYNC_3  ;(2) Loop if no timeout (3.6ms)
                 860     ACQUIRE_PCM_BANK0_TIMEOUT:
0544 D2A9        861          SETB    ET0             ;*TEST* Re-enable TIMER0 interrupt
0546 D0E0        862          POP     ACC             ;Pop return address off stack
0548 D0E0        863          POP     ACC
054A 201F02      864          JB      CALIBRATING,J_PCM_TEST_FAILED ;Indicate failure if calibrating
054D 016A        865          JMP     MAIN_PROCESSING ;Else return directly to main program
                 866     J_PCM_TEST_FAILED:
054F 81B7        867          JMP     PCM_TEST_FAILED
                 868
                 869     CHECK_FOR_FSYNC_3:
0551 C289        870          CLR     IE0             ;Reset USART RxRDY interrupt flag
0553 E2          871          MOVX    A,@R0           ;Read data holding register
0554 B404DA      872          CJNE    A,#FSYNC_3,HUNT_FOR_NEXT_PCM_FRAME_SYNC  ;Loop back if FSYNC_3 not detected
                 873     PCM_SYNC_DETECTED:
0557 C2B0        874          CLR     MBANK           ;Select Bank 0 of DPRAM by setting A7 = 0
0559 C218        875          CLR     MBANK_STAT
055B 753020      876          MOV     MASTER_MODE,#PCM_MODE
055E 7900        877          MOV     R1,#0           ;R1 gets address of first DPRAM address
                 878     PREPARE_FOR_NEXT_PCM_WORD:
0560 09          879          INC     R1              ;Increment pointer to access next DPRAM destination
0561 7A1E        880          MOV     R2,#30          ;Init 30uS timeout in case TM ceases
                 881     POLL_FOR_NEXT_PCM_WORD:
```

Navy Case No. 77,062

```
0563 308903        JNB     IE0,CHECK_FOR_USART_FREEZE  ;Loop until USART has received another byte
0566 02056D        JMP     NEXT_PCM_WORD_RECEIVED
                   CHECK_FOR_USART_FREEZE:
0569 DAF8          DJNZ    R2,POLL_FOR_NEXT_PCM_WORD
056B 80D7          JMP     ACQUIRE_PCM_BANK0_TIMEOUT

                   NEXT_PCM_WORD_RECEIVED:
056D E2            MOVX    A,@R0           ;Read USART holding register
056E F3            MOVX    @R1,A           ;Store the received byte in Bank 0 of DPRAM
056F C289          CLR     IE0             ;Reset interrupt flag
0571 B95DEC        CJNE    R1,#93,PREPARE_FOR_NEXT_PCM_WORD    ;Jump until PCM word 93 processed
0574 75195D        MOV     PCM_WORD_POINTER,#93    ;Then hand off processing to USART_ISR
0577 D21A          SETB    BEGINNING_PCM   ;Notify USART ISR to command slave to enter PCM mode
0579 D2A8          SETB    EX0             ;Enable INT0 (USART RxRDY) interrupt
057B D2A9          SETB    ET0             ;*TEST* Re-enable TIMER0 interrupt
057D 22            RET

                   ;*****************************************************************************

                   TEST_DPRAM_LEFT:

057E C211          CLR     MASTER_DPRAM_OK ;Assume DPRAM test fails
0580 C2B0          CLR     MBANK           ;Select lower bank of DPRAM (A7=0)
0582 C218          CLR     MBANK_STAT
0584 7800          MOV     R0,#0           ;Initialize DPRAM ptr at beginning of bank
                   LOW_TEST_MASTER_DPRAM_LOOP:
0586 E2            MOVX    A,@R0           ;ACC gets contents of tested location
0587 F5F0          MOV     B,A             ;Save contents of tested location in B
0589 7496          MOV     A,#96h          ;ACC gets test value #1
058B F2            MOVX    @R0,A           ;Write test value #1 to tested location
058C E2            MOVX    A,@R0           ;Read back the contents of the tested location
058D B49636        CJNE    A,#96h,RF_TEST_DPRAM_LEFT   ;Jump if there is a mismatch
0590 7469          MOV     A,#69h          ;ACC gets test value #2
0592 F2            MOVX    @R0,A           ;Write test value #2 to tested location
0593 E2            MOVX    A,@R0           ;Read back the contents of the tested location
0594 B4692F        CJNE    A,#069h,RF_TEST_DPRAM_LEFT  ;Jump if there is a mismatch
0597 E5F0          MOV     A,B             ;Else restore original contents of tested location
0599 F2            MOVX    @R0,A
059A E2            MOVX    A,@R0           ;Check to make sure contents copied correctly
059B B5F028        CJNE    A,B,RF_TEST_DPRAM_LEFT  ;Jump if copy doesn't match
059E 08            INC     R0              ;Else increment DPRAM ptr
059F B87EE4        CJNE    R0,#126,LOW_TEST_MASTER_DPRAM_LOOP

05A2 D2B0          SETB    MBANK           ;Select higher bank of DPRAM (A7=1)
05A4 D218          SETB    MBANK_STAT
05A6 7800          MOV     R0,#0           ;Initialize DPRAM ptr at beginning of bank
                   HIGH_TEST_MASTER_DPRAM_LOOP:
05A8 E2            MOVX    A,@R0           ;ACC gets contents of tested location
05A9 F5F0          MOV     B,A             ;Save contents of tested location in B
05AB 7496          MOV     A,#96h          ;ACC     gets test value #1
05AD F2            MOVX    @R0,A           ;Write test value #1 to tested location
05AE E2            MOVX    A,@R0           ;Read back the contents of the tested location
05AF B49614        CJNE    A,#96h,RF_TEST_DPRAM_LEFT   ;Jump if there is a mismatch
05B2 7469          MOV     A,#69h         ;ACC     gets test value #2
05B4 F2            MOVX    @R0,A           ;Write test value #2 to tested location
05B5 E2            MOVX    A,@R0           ;Read back the contents of the tested location
05B6 B4690D        CJNE    A,#69h,RF_TEST_DPRAM_LEFT  ;Jump if there is a mismatch
05B9 E5F0          MOV     A,B             ;Else restore original contents of tested location
05BB F2            MOVX    @R0,A
05BC E2            MOVX    A,@R0           ;Check to make sure contents copied correctly
05BD B5F006        CJNE    A,B,RF_TEST_DPRAM_LEFT  ;Jump if copy doesn't match
05C0 08            INC     R0              ;Else increment DPRAM ptr
05C1 B87FE4        CJNE    R0,#127,HIGH_TEST_MASTER_DPRAM_LOOP ;Int location 3FFh not written to
05C4 D211          SETB    MASTER_DPRAM_OK ;If all locations pass test, then set "OK" flag
```

Navy Case No. 77,062

```
                RF_TEST_DPRAM_LEFT:
05C6 22                 RET

                ;*****************************************************************************

                TEST_MASTER_RAM:
05C7 C2A9               CLR     ET0             ;Disable TIMER0 interrupt
05C9 C210               CLR     MASTER_RAM_OK   ;Assume RAM test fails
05CB 7802               MOV     R0,#2           ;Initialize RAM ptr at R2 of reg bank 0
                TEST_MASTER_RAM_LOOP:
05CD 86F0               MOV     B,@R0           ;Save contents of tested location in B
05CF 7655               MOV     @R0,#55h        ;Write test value #1 to tested location
05D1 B65511             CJNE    @R0,#55h,RF_TEST_MASTER_RAM ;Jump if there is a mismatch
05D4 76AA               MOV     @R0,#0AAh       ;Write test value #2 to tested location
05D6 B6AA0C             CJNE    @R0,#0AAh,RF_TEST_MASTER_RAM    ;Jump if there is a mismatch
05D9 A6F0               MOV     @R0,B           ;Restore original contents of tested location
05DB E6                 MOV     A,@R0           ;Check to make sure contents copied correctly
05DC B5F006             CJNE    A,B,RF_TEST_MASTER_RAM  ;Jump if copy doesn't match
05DF 08                 INC     R0              ;Else increment RAM ptr
05E0 B880EA             CJNE    R0,#128,TEST_MASTER_RAM_LOOP    ;Loop until all RAM/registers checked
05E3 D210               SETB    MASTER_RAM_OK   ;If all locations pass test, then set "OK" flag
                RF_TEST_MASTER_RAM:
05E5 D2A9               SETB    ET0             ;Enable TIMER0 interrupt
05E7 22                 RET

                ;*****************************************************************************

                TEST_PAM_CLK:
05E8 758805             MOV     TCON,#00000101b ;IT0 = 1 - INT0 (USART) is falling-edge trig
                                                ;IE0 = 0 - Reset INT0 interrupt flag
                                                ;IT1 = 1 - INT1 (SM_INT) is falling-edge trig
                                                ;IE1 = 0 - Reset INT1 interrupt flag
                                                ;TR0 = 0 - Disable TIMER0
                                                ;TF0 = 0 - Reset pending TIMER0 interrupt flag
                                                ;TR1 = 0 - Disable TIMER1
                                                ;TF1 = 0 - Reset pending TIMER1 interrupt flag
05EB 758951             MOV     TMOD,#01010001b ;M0  = 1 - TIMER0 = 16-bit non-gated timer
                                                ;M1  = 0
                                                ;C/t = 0
                                                ;GT  = 0
                                                ;M0  = 1 - TIMER1 = 16-bit non-gated counter
                                                ;M1  = 0
                                                ;C/t = 1
                                                ;GT  = 0

05EE 758CFC             MOV     TH0,#P001_SEC_HI    ;Initialize TIMER0 at 1ms
05F1 758A2F             MOV     TL0,#P001_SEC_LO
05F4 758D00             MOV     TH1,#0          ;Clear COUNTER1
05F7 758B00             MOV     TL1,#0
05FA 753700             MOV     EXT_ONE_MS_TICKS,#0 ;Reset count of 1ms intervals
05FD 438851             ORL     TCON,#01010001b ;Enable TIMER0 and COUNTER1
0600 7837               MOV     R0,#EXT_ONE_MS_TICKS    ;R0 is pointer to EXT_ONE_MS_TICKS variable
0602 B605FD             CJNE    @R0,#5,$        ;Loop until TIMER0_ISR has counted 5ms
0605 C28E               CLR     TR1             ;Disable COUNTER1
0607 D212               SETB    MASTER_25_6_kHz_OK  ;Assume the PAM clock frequency is OK
0609 E58D               MOV     A,TH1           ;Check to see if high byte of count = 0
060B B4000F             CJNE    A,#0,BAD_PAM_CLK    ;Jump if COUNTER1 > 255
060E 7481               MOV     A,#129          ;ACC gets maximum acceptable count
0610 C2D7               CLR     CY              ;Clear carry flag
0612 958B               SUBB    A,TL1           ;Subtract actual count from maximum count
0614 4007               JC      BAD_PAM_CLK     ;Jump if actual count > maximum count
0616 E58B               MOV     A,TL1           ;Else ACC gets actual count
0618 947F               SUBB    A,#127          ;Subtract minimum count from actual count
061A 4001               JC      BAD_PAM_CLK     ;Jump if actual count < minimum count
```

```
061C 22          1010          RET
                 1011
                 1012    BAD_PAM_CLK:
061D C212        1013          CLR     MASTER_25_6_kHz_OK  ;Indicate failure of PAM clk frequency test
061F 22          1014          RET
                 1015
                 1016    ;*****************************************************************************
                 1017
                 1018    TEST_PCM_CLK:
0620 C293        1019          CLR     TM_SEL_0        ;Make sure TM source is ground
0622 C294        1020          CLR     TM_SEL_1
0624 C2AB        1021          CLR     ET1             ;Disable TIMER1 interrupt
0626 C2A9        1022          CLR     ET0             ;Disable COUNTER0 interrupt
0628 758805      1023          MOV     TCON,#00000101b ;IT0 = 1 - INT0 (USART) is falling-edge trig
                 1024                                  ;IE0 = 0 - Reset INT0 interrupt flag
                 1025                                  ;IT1 = 1 - INT1 (SM_INT) is falling-edge trig
                 1026                                  ;IE1 = 0 - Reset INT1 interrupt flag
                 1027                                  ;TR0 = 0 - Disable TIMER0
                 1028                                  ;TF0 = 0 - Reset pending TIMER0 interrupt flag
                 1029                                  ;TR1 = 0 - Disable TIMER1
                 1030                                  ;TF1 = 0 - Reset pending TIMER1 interrupt flag
062B 758915      1031          MOV     TMOD,#00010101b ;M0  = 1 - TIMER0 = 16-bit non-gated counter
                 1032                                  ;M1  = 0
                 1033                                  ;C/t = 1
                 1034                                  ;GT  = 0
                 1035                                  ;M0  = 1 - TIMER1 = 16-bit non-gated timer
                 1036                                  ;M1  = 0
                 1037                                  ;C/t = 0
                 1038                                  ;GT  = 0
                 1039
062E 758DFE      1040          MOV     TH1,#P0004_SEC_HI   ;Initialize TIMER1 at 0.4ms
0631 758870      1041          MOV     TL1,#P0004_SEC_LO
0634 758C00      1042          MOV     TH0,#0          ;Clear COUNTER0
0637 758A00      1043          MOV     TL0,#0
063A D28E        1044          SETB    TR1             ;Enable TIMER1
063C D28C        1045          SETB    TR0             ;Enable COUNTER0
063E 308FFD      1046          JNB     TF1,$           ;Loop until TIMER1 times out at 0.4ms
0641 C28C        1047          CLR     TR0             ;Disable COUNTER0
0643 C28E        1048          CLR     TR1             ;Disable TIMER1
                 1049
0645 D213        1050          SETB    MASTER_320_kHz_OK   ;Assume the PCM clock frequency is OK
0647 E58C        1051          MOV     A,TH0           ;Check to see if high byte of count = 0
0649 B4000F      1052          CJNE    A,#0,BAD_PCM_CLK    ;Jump if COUNTER1 > 255
064C 7482        1053          MOV     A,#130          ;ACC gets maximum acceptable count
064E C2D7        1054          CLR     CY              ;Clear carry flag
0650 958A        1055          SUBB    A,TL0           ;Subtract actual count from maximum count
0652 4007        1056          JC      BAD_PCM_CLK     ;Jump if actual count > maximum count
0654 E58A        1057          MOV     A,TL0           ;Else ACC gets actual count
0656 9480        1058          SUBB    A,#128          ;Subtract minimum count from actual count
0658 4001        1059          JC      BAD_PCM_CLK     ;Jump if actual count < minimum count
065A 22          1060          RET
                 1061
                 1062    BAD_PCM_CLK:
065B C213        1063          CLR     MASTER_320_kHz_OK   ;Indicate failure of PCM clk frequency test
065D 22          1064          RET
                 1065
                 1066    ;*****************************************************************************
                 1067
                 1068    TEST_DAAD:
065E C293        1069          CLR     TM_SEL_0        ;Gate DAC output to SCO filter input (SIM PAM mode)
0660 D294        1070          SETB    TM_SEL_1
0662 7880        1071          MOV     R0,#DAC         ;R0 gets DAC address
                 1072    DAAD_TEST_ONE:
0664 7400        1073          MOV     A,#DAC_VOLTAGE_NEG_1_45 ;Prepare to output -1.45 Vdc to SCO filter
```

```
0666 F2          1074          MOVX    @R0,A            ;Output test voltage #1
0667 120710      1075          CALL    DELAY_1MS        ;Allow test voltage to stabilize
066A 753100      1076          MOV     MS_DATA_BYTE_OUT,#DUMMY_ZERO    ;Initialize the dummy data byte
066D 753411      1077          MOV     MS_OPCODE_OUT,#DAAD_TEST_1  ;Command slave to measure/compare Vout 1
0670 120757      1078          CALL    SEND_MESSAGE
0673 7933        1079          MOV     R1,#SM_OPCODE_IN    ;R1 points to address where response will be received
                 1080
0675 753700      1081          MOV     EXT_ONE_MS_TICKS,#0 ;Clear 1ms TIMER0 counter
                 1082    CHK_SLAVE_STAT_4:
0678 B71203      1083          CJNE    @R1,#DAAD_TEST_1_STATUS,CHK_SLAVE_STAT_4_TIME ;Chk timeout if opcode wrong
067B 020691      1084          JMP     SLAVE_DAAD_1_STATUS_RCVD   ;Else jump to read data byte
                 1085    CHK_SLAVE_STAT_4_TIME:
067E E537        1086          MOV     A,EXT_ONE_MS_TICKS  ;ACC gets TIMER0's 1ms count
0680 B40AF5      1087          CJNE    A,#10,CHK_SLAVE_STAT_4  ;Recheck opcode if not timed out
0683 753100      1088          MOV     MS_DATA_BYTE_OUT,#DUMMY_ZERO  ;Else 10ms elapsed w/o response...
0686 753411      1089          MOV     MS_OPCODE_OUT,#DAAD_TEST_1
0689 120757      1090          CALL    SEND_MESSAGE        ;... so resend message
068C 7933        1091          MOV     R1,#SM_OPCODE_IN    ;R1 points to opcode received from slave
068E B712FD      1092          CJNE    @R1,#DAAD_TEST_1_STATUS,$   ;Loop until good opcode or watch dog times out
                 1093
                 1094    SLAVE_DAAD_1_STATUS_RCVD:
0691 D208        1095          SETB    SLAVE_DAC_ADC_1_OK  ;Assume DAC/ADC Test #1 passes
0693 E532        1096          MOV     A,SM_DATA_BYTE_IN
0695 B40103      1097          CJNE    A,#TEST_PASSED,DAAD_TEST_1_FAILED   ;Jump if assumption of pass incorrect
0698 02069D      1098          JMP     DAAD_TEST_TWO   ;Else jump to begin next test
                 1099    DAAD_TEST_1_FAILED:
069B C208        1100          CLR     SLAVE_DAC_ADC_1_OK  ;Flag main program that test failed
                 1101
                 1102    DAAD_TEST_TWO:
069D 7480        1103          MOV     A,#DAC_VOLTAGE_ZERO ;Prepare to output 0.00 Vdc to SCO filter
069F F2          1104          MOVX    @R0,A            ;Output test voltage #2
06A0 120710      1105          CALL    DELAY_1MS        ;Allow test voltage to stabilize
06A3 753100      1106          MOV     MS_DATA_BYTE_OUT,#DUMMY_ZERO    ;Initialize the dummy data byte
06A6 753413      1107          MOV     MS_OPCODE_OUT,#DAAD_TEST_2  ;Command slave to measure/compare Vout 2
06A9 120757      1108          CALL    SEND_MESSAGE
06AC 7933        1109          MOV     R1,#SM_OPCODE_IN    ;R1 points to address where response will be received
                 1110
06AE 753700      1111          MOV     EXT_ONE_MS_TICKS,#0 ;Clear 1ms TIMER0 counter
                 1112    CHK_SLAVE_STAT_5:
06B1 B71403      1113          CJNE    @R1,#DAAD_TEST_2_STATUS,CHK_SLAVE_STAT_5_TIME ;Chk timeout if opcode wrong
06B4 0206CA      1114          JMP     SLAVE_DAAD_2_STATUS_RCVD   ;Else jump to read data byte
                 1115    CHK_SLAVE_STAT_5_TIME:
06B7 E537        1116          MOV     A,EXT_ONE_MS_TICKS  ;ACC gets TIMER0's 1ms count
06B9 B40AF5      1117          CJNE    A,#10,CHK_SLAVE_STAT_5  ;Recheck opcode if not timed out
06BC 753100      1118          MOV     MS_DATA_BYTE_OUT,#DUMMY_ZERO  ;Else 10ms elapsed w/o response...
06BF 753413      1119          MOV     MS_OPCODE_OUT,#DAAD_TEST_2
06C2 120757      1120          CALL    SEND_MESSAGE        ;... so resend message
06C5 7933        1121          MOV     R1,#SM_OPCODE_IN    ;R1 points to opcode received from slave
06C7 B714FD      1122          CJNE    @R1,#DAAD_TEST_2_STATUS,$   ;Loop until good opcode or watch dog times out
                 1123
                 1124    SLAVE_DAAD_2_STATUS_RCVD:
06CA D209        1125          SETB    SLAVE_DAC_ADC_2_OK  ;Assume DAC/ADC Test #2 passes
06CC E532        1126          MOV     A,SM_DATA_BYTE_IN
06CE B40103      1127          CJNE    A,#TEST_PASSED,DAAD_TEST_2_FAILED   ;Jump if assumption of pass incorrect
06D1 0206D6      1128          JMP     DAAD_TEST_THREE   ;Else jump to begin next test
                 1129    DAAD_TEST_2_FAILED:
06D4 C209        1130          CLR     SLAVE_DAC_ADC_2_OK  ;Flag main program that test failed
                 1131
                 1132    DAAD_TEST_THREE:
06D6 74FF        1133          MOV     A,#DAC_VOLTAGE_POS_1_45 ;Prepare to output +1.45 Vdc to SCO filter
06D8 F2          1134          MOVX    @R0,A            ;Output test voltage #3
06D9 120710      1135          CALL    DELAY_1MS        ;Allow test voltage to stabilize
06DC 753100      1136          MOV     MS_DATA_BYTE_OUT,#DUMMY_ZERO    ;Initialize the dummy data byte
06DF 753415      1137          MOV     MS_OPCODE_OUT,#DAAD_TEST_3  ;Command slave to measure/compare Vout 3
```

Navy Case No. 77,062

```
06E2 120757   1138          CALL    SEND_MESSAGE
06E5 7933     1139          MOV     R1,#SM_OPCODE_IN    ;R1 points to address where response will be received
              1140
06E7 753700   1141          MOV     EXT_ONE_MS_TICKS,#0 ;Clear 1ms TIMER0 counter
              1142    CHK_SLAVE_STAT_6:
06EA B71603   1143          CJNE    @R1,#DAAD_TEST_3_STATUS,CHK_SLAVE_STAT_6_TIME ;Chk timeout if opcode wrong
06ED 020703   1144          JMP     SLAVE_DAAD_3_STATUS_RCVD   ;Else jump to read data byte
              1145    CHK_SLAVE_STAT_6_TIME:
06F0 E537     1146          MOV     A,EXT_ONE_MS_TICKS  ;ACC gets TIMER0's 1ms count
06F2 B40AF5   1147          CJNE    A,#10,CHK_SLAVE_STAT_6  ;Recheck opcode if not timed out
06F5 753100   1148          MOV     MS_DATA_BYTE_OUT,#DUMMY_ZERO  ;Else 10ms elapsed w/o response...
06F8 753415   1149          MOV     MS_OPCODE_OUT,#DAAD_TEST_3
06FB 120757   1150          CALL    SEND_MESSAGE        ;... so resend message
06FE 7933     1151          MOV     R1,#SM_OPCODE_IN    ;R1 points to opcode received from slave
0700 B716FD   1152          CJNE    @R1,#DAAD_TEST_3_STATUS,$   ;Loop until good opcode or watch dog times out
              1153
              1154    SLAVE_DAAD_3_STATUS_RCVD:
0703 D20A     1155          SETB    SLAVE_DAC_ADC_3_OK  ;Assume DAC/ADC Test #3 passes
0705 E532     1156          MOV     A,SM_DATA_BYTE_IN
0707 B40103   1157          CJNE    A,#TEST_PASSED,DAAD_TEST_3_FAILED   ;Jump if assumption of pass incorrect
070A 02070F   1158          JMP     RF_TEST_DAAD        ;Else jump to begin next test
              1159    DAAD_TEST_3_FAILED:
070D C20A     1160          CLR     SLAVE_DAC_ADC_3_OK  ;Flag main program that test failed
              1161    RF_TEST_DAAD:
070F 22       1162          RET
              1163
              1164    ;*****************************************************************************
              1165
              1166    DELAY_1MS:
0710 753700   1167          MOV     EXT_ONE_MS_TICKS,#0 ;Reset TIMER0 ISR millisecond counter
0713 7937     1168          MOV     R1,#EXT_ONE_MS_TICKS    ;R1 points to TIMER0_ISR millisecond counter
0715 B702FD   1169          CJNE    @R1,#2,$            ;Loop until 1-2ms have passed
0718 22       1170          RET
              1171
              1172    ;*****************************************************************************
              1173
              1174    DELAY_10MS:
0719 753700   1175          MOV     EXT_ONE_MS_TICKS,#0 ;Reset TIMER0 ISR millisecond counter
071C 7937     1176          MOV     R1,#EXT_ONE_MS_TICKS    ;R1 points to TIMER0_ISR millisecond counter
071E B70AFD   1177          CJNE    @R1,#10,$           ;Loop until 9-10ms have passed
0721 22       1178          RET
              1179
              1180    ;*****************************************************************************
              1181
              1182    DELAY_50MS_TICKS:
0722 753900   1183          MOV     FIFTY_MS_TICKS,#0       ;Reset counter of 50ms intervals
              1184    DELAY_50MS_TICKS_LOOP:
0725 E539     1185          MOV     A,FIFTY_MS_TICKS    ;ACC gets current count of 50ms ticks
0727 C2D7     1186          CLR     CY                  ;Clear borrow flag
0729 953A     1187          SUBB    A,DESIRED_50MS_TICKS
072B 5005     1188          JNC     RF_DELAY_50MS_TICKS ;Jump if counted 50ms ticks >= desired 50ms ticks
072D 120739   1189          CALL    HOUSEKEEPING        ;Else, scan through housekeeping tasks
0730 80F3     1190          JMP     DELAY_50MS_TICKS_LOOP ;Then recheck FIFTY_MS_TICKS
              1191    RF_DELAY_50MS_TICKS:
0732 22       1192          RET
              1193
              1194    ;*****************************************************************************
              1195
              1196    INTER_MESSAGE_DELAY:
0733 75391E   1197          MOV     FIFTY_MS_TICKS,#FIFTY_MS_PER_MSG
0736 F122     1198          CALL    DELAY_50MS_TICKS
0738 22       1199          RET
              1200
              1201    ;*****************************************************************************
```

```
                HOUSEKEEPING:
0739 D292               SETB    nMSTR_WDI           ;Output rising edge of nMSTR_WDI
073B 22                 RET

                ;*****************************************************************************

                SET_TIMER0_FOR_1MS:
073C C28C               CLR     TR0                 ;Stop TIMER0
073E 5389F0             ANL     TMOD,#0F0h          ;Leave TIMER1 settings undisturbed
0741 438901             ORL     TMOD,#01h           ;Set TIMER0 for 16-bit non-gated timer
0744 753502             MOV     TIMER0_ISR_MODE,#STD_TIMER  ;Set TIMER0 to standard timer mode
0747 758CFC             MOV     TH0,#P001_SEC_HI    ;Initialize TIMER0 at 1ms
074A 758A2F             MOV     TL0,#P001_SEC_LO
074D 753900             MOV     FIFTY_MS_TICKS,#0   ;Clear count of 50ms intervals
0750 C28D               CLR     TF0                 ;Reset pending TIMER0 interrupt flag
0752 D2A9               SETB    ET0                 ;Enable TIMER0 interrupt
0754 D28C               SETB    TR0                 ;Enable TIMER0
0756 22                 RET

                ;*****************************************************************************

                SEND_MESSAGE:
0757 E530               MOV     A,MASTER_MODE       ;Check to see if in PCM mode
0759 B42013             CJNE    A,#PCM_MODE,SEND_MSG    ;Jump to send the message if not in PCM mode
075C 3018F8             JNB     MBANK_STAT,SEND_MESSAGE ;Else wait until MBANK set by USART_ISR
075F C2D7               CLR     CY                  ;Bank 1 of DPRAM now selected. Clear borrow flag
0761 7403               MOV     A,#3                ;ACC gets lowest acceptable PCM word count for msg
0763 9519               SUBB    A,PCM_WORD_POINTER  ;ACC = 3 - current PCM word pointer
0765 50F0               JNC     SEND_MESSAGE        ;Loop back if PCM word pointer <= 3
0767 C2D7               CLR     CY                  ;Else clear carry bit for next qual test
0769 E519               MOV     A,PCM_WORD_POINTER  ;ACC gets current PCM word pointer
076B 9414               SUBB    A,#20               ;ACC = PCM word pointer - 20 (highest acceptable PCM wd)
076D 50E8               JNC     SEND_MESSAGE        ;Loop back if PCM word pointer >= 20
                SEND_MSG:
076F D2B0               SETB    MBANK               ;Make sure Bank 1 of DPRAM is accessible
0771 797C               MOV     R1,#MS_DATA_BYTE_ADDR   ;R1 gets DPRAM DATA BYTE address
0773 E531               MOV     A,MS_DATA_BYTE_OUT  ;ACC gets actual DATA BYTE
0775 F3                 MOVX    @R1,A               ;Send DATA BYTE
0776 797F               MOV     R1,#MS_OPCODE_ADDR  ;R1 gets DPRAM OPCODE address
0778 E534               MOV     A,MS_OPCODE_OUT     ;ACC gets actual OPCODE
                SEND_MESSAGE_OPCODE:
077A F3                 MOVX    @R1,A               ;Send OPCODE
077B A218               MOV     C,MBANK_STAT        ;Restore original state of MBANK
077D 92B0               MOV     MBANK,C
077F 22                 RET

                ;*****************************************************************************

                SIMULATE_PAM:
0780 C28E               CLR     TR1                 ;Disable TIMER1
0782 C2AB               CLR     ET1                 ;Disable TIMER1 interrupt
0784 C293               CLR     TM_SEL_0            ;Gate simulated PAM to input circuitry
0786 D294               SETB    TM_SEL_1
0788 D2A3               SETB    PAM_pcm             ;Gate filtered TM to J1 output buffer
078A 753601             MOV     TIMER1_ISR_MODE,#SIMULATE_PAM_MD    ;notify TIMER1 ISR of sim PAM md
078D 753B00             MOV     TIMER1_ISR_PTR_OFFSET,#0    ;Initialize TIMER1 ISR wd ptr offset
0790 D2BB               SETB    PT1                 ;Make TIMER1 256 kHz a high priority
0792 E589               MOV     A,TMOD              ;Prepare to mask in control of TIMER1
0794 540F               ANL     A,#0Fh
0796 4460               ORL     A,#60h
0798 F589               MOV     TMOD,A              ;M0  = ?
                                                    ;M1  = ?
                                                    ;C/t = ?
```

Navy Case No. 77,062

```
                                        ;GT  = ?
                                        ;M0  = 0 - Put TIMER1 in "auto-reload" mode...
                                        ;M1  = 1 - So that 25.6 kHz strobes T1 interrupt
                                        ;C/t = 1 - when counter overflows
                                        ;GT  = 0 - Do not gate counter
079A 758BFF          MOV     TL1,#0FFh  ;Prepare TIMER1 to overflow on single count
079D 758DFF          MOV     TH1,#0FFh
07A0 C28F            CLR     TF1        ;Clear any pending TIMER1 interrupt flag
07A2 D2AB            SETB    ET1        ;Enable TIMER1 interrupt
07A4 D28E            SETB    TR1        ;Enable TIMER1
07A6 22              RET


;*****************************************************************************

DISPLAY_MSG_AT_MT:

;   EXPECTS: DPTR contains address of first of 16 characters to be copied to
;            DISP0 then DISP1.

;   RETURNS: R0=0, CY=1, R2=0, DPTR points to first char of next Message Table
;   (MT) message.

07A7 C0E0            PUSH    ACC                ;Save accumulator
07A9 E582            MOV     A,DPL              ;ACC gets low byte of message pointer
07AB B4920A          CJNE    A,#(LOW(M_DATA_SELECT_ERR)),CLEAR_DSE_DISP  ;Jump if not -> DSE
07AE E583            MOV     A,DPH              ;ACC gets high byte of message pointer
07B0 B40C05          CJNE    A,#(HIGH(M_DATA_SELECT_ERR)),CLEAR_DSE_DISP ;Jump if not -> DSE
SET_DSE_DISP:
07B3 D222            SETB    DSE_DISP           ;Else indicate "DATA SELECT ERR" to be displayed
07B5 0207BA          JMP     DISPLAY_MSG        ;And jump to display DSE message
CLEAR_DSE_DISP:
07B8 C222            CLR     DSE_DISP           ;Else indicate message <> "DATA SELECT ERR"
DISPLAY_MSG:
07BA 78C8            MOV     R0,#DISP0_CHAR_0   ;R0 gets address of left-most DISP0 char
07BC 1207C7          CALL    DISPLAY_8_MT       ;Copy first 8 chars from msg table to DISP0
07BF 78E8            MOV     R0,#DISP1_CHAR_0   ;R0 gets address of left-most DISP1 char
07C1 1207C7          CALL    DISPLAY_8_MT       ;Copy last 8 chars from msg table to DISP1
07C4 D0E0            POP     ACC                ;Restore accumulator
07C6 22              RET

;*****************************************************************************

DISPLAY_8_MT:
07C7 7A08            MOV     R2,#8          ;R2 gets count of remaining chars to write
DISPLAY_MT_LOOP:
07C9 7400            MOV     A,#0           ;Else character source is MESSAGE_TABLE
07CB 93              MOVC    A,@A+DPTR      ;ACC gets next char from message table
07CC F2              MOVX    @R0,A          ;Write char to display (HDSP-2112)
07CD 08              INC     R0             ;R0 points to next char position in display
07CE A3              INC     DPTR           ;DPTR points to next char in message table
07CF DAF8            DJNZ    R2,DISPLAY_MT_LOOP  ;Loop until all 8 chars have been written
07D1 22              RET

;*****************************************************************************

SAVE_DISPLAY_CONTENTS:
07D2 20220C          JB      DSE_DISP,RF_SAVE_DISPLAY_CONTENTS  ;Abort if "DATA SELECT ERR" displayed
07D5 793D            MOV     R1,#DISP_BUFF   ;R1 points to first char in display buffer
07D7 78C8            MOV     R0,#DISP0_CHAR_0    ;R0 gets address of left-most DISP0 char
07D9 1207E2          CALL    SAVE_8_DB       ;Read first 8 chars from DISP0 and save in DISP_BUFF
07DC 78E8            MOV     R0,#DISP1_CHAR_0    ;R0 gets address of left-most DISP1 char
07DE 1207E2          CALL    SAVE_8_DB       ;Read last 8 chars from DISP1 and save in DISP_BUFF
RF_SAVE_DISPLAY_CONTENTS:
```

Navy Case No. 77,062

```
07E1 22          1330          RET
                 1331
                 1332   ;*****************************************************************************
                 1333
                 1334   SAVE_8_DB:
07E2 7A08        1335          MOV     R2,#8             ;R2 gets count of remaining chars to save
                 1336   SAVE_DB_LOOP:
07E4 E2          1337          MOVX    A,@R0             ;ACC gets next char from display (HDSP-2112)
07E5 F7          1338          MOV     @R1,A             ;Write char to display buffer
07E6 08          1339          INC     R0                ;R0 points to next char position in display
07E7 09          1340          INC     R1                ;R1 points to next char in DISP_BUFF
07E8 DAFA        1341          DJNZ    R2,SAVE_DB_LOOP ;Loop until all 8 chars have been written
07EA 22          1342          RET
                 1343
                 1344   ;*****************************************************************************
                 1345
                 1346   DISPLAY_MSG_AT_DB:
                 1347
                 1348   ;   EXPECTS: DISP_BUFF contains 16 chars to be displayed
                 1349
                 1350   ;   RETURNS: (In reg bank 1) R0=R2=0, R1 points to DISP_CHAR_15+1
                 1351
07EB C0D0        1352          PUSH    PSW
07ED 75D008      1353          MOV     PSW,#08h          ;Select register bank #1
07F0 30220E      1354          JNB     DSE_DISP,RF_DISPLAY_MSG_AT_DB  ;Jump if "DATA SELECT ERR" not displayed
07F3 793D        1355          MOV     R1,#DISP_BUFF     ;R1 points to first char in display buffer
07F5 78C8        1356          MOV     R0,#DISP0_CHAR_0     ;R0 gets address of left-most DISP0 char
07F7 120804      1357          CALL    DISPLAY_8_DB      ;Write first 8 chars to DISP0
07FA 78E8        1358          MOV     R0,#DISP1_CHAR_0     ;R0 gets address of left-most DISP1 char
07FC 120804      1359          CALL    DISPLAY_8_DB      ;Write last 8 chars to DISP1
07FF C222        1360          CLR     DSE_DISP          ;And indicate "DATA SELECT ERR" not displayed
                 1361   RF_DISPLAY_MSG_AT_DB:
0801 D0D0        1362          POP     PSW
0803 22          1363          RET
                 1364
                 1365   ;*****************************************************************************
                 1366
                 1367   DISPLAY_8_DB:
0804 7A08        1368          MOV     R2,#8             ;R2 gets count of remaining chars to write
                 1369   DISPLAY_DB_LOOP:
0806 E7          1370          MOV     A,@R1             ;ACC gets next char from display buffer
0807 F2          1371          MOVX    @R0,A             ;Write char to display (HDSP-2112)
0808 08          1372          INC     R0                ;R0 points to next char position in display
0809 09          1373          INC     R1                ;R1 points to next char in DISP_BUFF
080A DAFA        1374          DJNZ    R2,DISPLAY_DB_LOOP  ;Loop until all 8 chars have been written
080C 22          1375          RET
                 1376
                 1377   ;*****************************************************************************
                 1378
                 1379   INIT_USART:
080D D2A5        1380          SETB    U_RST             ;Reset USART for 3 microseconds
080F 00          1381          NOP
0810 00          1382          NOP
0811 C2A5        1383          CLR     U_RST
0813 78A6        1384          MOV     R0,#USART_WR_MODE_REG   ;Prepare to initialize mode registers
0815 740C        1385          MOV     A,#00001100b      ;MR11/MR10 = 00 - Synchronous 1X mode
                 1386                                    ;MR13/MR12 = 11 - Character is 8 bits
                 1387                                    ;     MR14 = 0  - Parity disabled
                 1388                                    ;     MR15 = 0  - Parity (unused) odd
                 1389                                    ;     MR16 = 0  - Normal transparency control
                 1390                                    ;     MR17 = 0  - Double SYN
0817 F2          1391          MOVX    @R0,A             ;Initialize Mode Register #1
0818 7400        1392          MOV     A,#00000000b      ;MR23-MR20 = 0000  - 50 Baud (unused)
                 1393                                    ;     MR24 = 0  - External receiver clock
```

```
                                ;     MR25 = 0  -    "        "        "
                                ;MR27-MR26 = 00 - Not used
081A F2         MOVX    @R0,A           ;Initialize Mode Register #2
081B 78A5       MOV     R0,#USART_WR_SYNC_REG   ;Prepare to load PCM frame sync words
081D 745F       MOV     A,#FSYNC_1
081F F2         MOVX    @R0,A           ;Load SYN1
0820 74CF       MOV     A,#FSYNC_2
0822 F2         MOVX    @R0,A           ;Load SYN2
0823 78A7       MOV     R0,#USART_WR_CMD_REG    ;Prepare to initialize cmd register
0825 7414       MOV     A,#00010100b    ;       CR0 = 0 - Disable transmitter
                                        ;       CR1 = 0 - Force nDTR high
                                        ;       CR2 = 1 - Enable receiver
                                        ;       CR3 = 0 - Do not send DLE
                                        ;       CR4 = 1 - Reset error flag in status
                                        ;       CR5 = 0 - Force nRTS high
                                        ;  CR7/CR6 = 00 - Do not strip SYN1 & SYN2
0827 F2         MOVX    @R0,A           ;Initialize Command Register
0828 78A0       MOV     R0,#USART_RD_HLD_REG    ;Make sure rcvr holding reg is clear
082A E2         MOVX    A,@R0
082B 22         RET

;*****************************************************************************
;*****************************************************************************

;IIII
```

Navy Case No. 77,062

```
0858 753480          MOV     MS_OPCODE_OUT,#SWITCH_CALIBRATE_OUTPUT  ;(2) ... and opcode
085B 020864          JMP     POLL_FOR_WORD_96_AND_SWITCH      ;(2) And poll for next word
                 IN_CAL_z_TO_H_CHANGE:
085E 753101          MOV     MS_DATA_BYTE_OUT,#01h  ;(2) Prepare "zero_HUND SWITCH" data byte
0861 753480          MOV     MS_OPCODE_OUT,#SWITCH_CALIBRATE_OUTPUT  ;(2) ... and opcode

                 POLL_FOR_WORD_96_AND_SWITCH:
0864 20892F          JB      IE0,PROCESS_WORD_96_AND_SWITCH ;(2) Jump if word #96 decommed by USART
0867 DAFB            DJNZ    R2,POLL_FOR_WORD_96_AND_SWITCH ;(2) Continue to poll IE0 if no timeout
0869 D21C            SETB    NO_PCM          ;(1) Else notify main program that PCM ceased
086B EC              MOV     A,R4            ;(1) Restore ACC
086C D0D0            POP     PSW             ;(2) Restore PSW (w/ register banks)
086E 32              RETI                    ;(2) And return from USART_ISR

                 POLL_FOR_WORD_96:
086F 208908          JB      IE0,PROCESS_WORD_96 ;(2) Jump if word #96 decommed by USART
0872 DAFB            DJNZ    R2,POLL_FOR_WORD_96 ;(2) Continue to poll IE0 if no timeout
0874 D21C            SETB    NO_PCM          ;(1) Else notify main program that PCM ceased
0876 EC              MOV     A,R4            ;(1) Restore ACC
0877 D0D0            POP     PSW             ;(2) Restore PSW (w/ register banks)
0879 32              RETI                    ;(2) And return from USART_ISR

                 PROCESS_WORD_96:
087A C289            CLR     IE0             ;(1) Prepare to poll for word #97
087C 7A1E            MOV     R2,#30          ;(1) And initialize next "timeout"
087E E2              MOVX    A,@R0           ;(2) ACC gets USART TM word
087F 09              INC     R1              ;(1) Increment the PCM Word Pointer (1-100)
0880 F3              MOVX    @R1,A           ;(2) Write TM word to DPRAM

                 POLL_FOR_WORD_97:
0881 208908          JB      IE0,PROCESS_WORD_97 ;(2) Jump if word #97 decommed by USART
0884 DAFB            DJNZ    R2,POLL_FOR_WORD_97 ;(2) Continue to poll IE0 if no timeout
0886 D21C            SETB    NO_PCM          ;(1) Else notify main program that PCM ceased
0888 EC              MOV     A,R4            ;(1) Restore ACC
0889 D0D0            POP     PSW             ;(2) Restore PSW (w/ register banks)
0888 32              RETI                    ;(2) And return from USART_ISR

                 PROCESS_WORD_97:
088C C289            CLR     IE0             ;(1) Prepare to poll for word #98
088E 7A1E            MOV     R2,#30          ;(1) And initialize next "timeout"
0890 E2              MOVX    A,@R0           ;(2) ACC gets USART TM word
0891 09              INC     R1              ;(1) Increment the PCM Word Pointer (1-100)
0892 F3              MOVX    @R1,A           ;(2) Write TM word to DPRAM
0893 0208CD          JMP     POLL_FOR_WORD_98    ;(2) Now jump to resume normal processing

                 PROCESS_WORD_96_AND_SWITCH:
0896 C289            CLR     IE0             ;(1) Prepare to poll for word #97
0898 7A1E            MOV     R2,#30          ;(1) And initialize next "timeout"
089A E2              MOVX    A,@R0           ;(2) ACC gets USART TM word
089B 09              INC     R1              ;(1) Increment the PCM Word Pointer (1-100)
089C F3              MOVX    @R1,A           ;(2) Write TM word to DPRAM

089D D2B0            SETB    MBANK           ;(1)
089F 89F0            MOV     B,R1            ;(2)
08A1 797C            MOV     R1,#MS_DATA_BYTE_ADDR  ;(1)
08A3 E531            MOV     A,MS_DATA_BYTE_OUT ;(1)
08A5 F3              MOVX    @R1,A           ;(2)
08A6 A9F0            MOV     R1,B            ;(2)
08A8 A218            MOV     C,MBANK_STAT    ;(1)
08AA 92B0            MOV     MBANK,C         ;(2)

                 POLL_FOR_WORD_97_AND_SWITCH:
08AC 208908          JB      IE0,PROCESS_WORD_97_AND_SWITCH ;(2) Jump if word #97 decommed by USART
08AF DAFB            DJNZ    R2,POLL_FOR_WORD_97_AND_SWITCH ;(2) Continue to poll IE0 if no timeout
```

Navy Case No. 77,062

```
08B1 D21C        SETB    NO_PCM          ;(1) Else notify main program that PCM ceased
08B3 EC          MOV     A,R4            ;(1) Restore ACC
08B4 D0D0        POP     PSW             ;(2) Restore PSW (w/ register banks)
08B6 32          RETI                    ;(2) And return from USART_ISR

                 PROCESS_WORD_97_AND_SWITCH:
08B7 C289        CLR     IE0             ;(1) Prepare to poll for word #98
08B9 7A1E        MOV     R2,#30          ;(1) And initialize next "timeout"
08BB E2          MOVX    A,@R0           ;(2) ACC gets USART TM word
08BC 09          INC     R1              ;(1) Increment the PCM Word Pointer (1-100)
08BD F3          MOVX    @R1,A           ;(2) Write TM word to DPRAM

08BE D2B0        SETB    MBANK           ;(1)
08C0 89F0        MOV     B,R1            ;(2)
08C2 797F        MOV     R1,#MS_OPCODE_ADDR  ;(1)
08C4 E534        MOV     A,MS_OPCODE_OUT ;(1)
08C6 F3          MOVX    @R1,A           ;(2)
08C7 A9F0        MOV     R1,B            ;(2)
08C9 A218        MOV     C,MBANK_STAT    ;(1)
08CB 92B0        MOV     MBANK,C         ;(2)

                 POLL_FOR_WORD_98:
08CD 208908      JB      IE0,CHECK_WORD_98   ;Jump if word #98 decommed by USART
08D0 DAFB        DJNZ    R2,POLL_FOR_WORD_98 ;Continue to poll IE0 if no timeout
08D2 D21C        SETB    NO_PCM          ;Else notify main program that PCM ceased
08D4 EC          MOV     A,R4            ;(1) Restore ACC
08D5 D0D0        POP     PSW             ;(2) Restore PSW (w/ register banks)
08D7 32          RETI                    ;(2) And return from USART_ISR

                 CHECK_WORD_98:
08D8 C289        CLR     IE0             ;Prepare to poll for word #99
08DA 7A1E        MOV     R2,#30          ;And initialize next "timeout"
08DC E2          MOVX    A,@R0           ;ACC gets USART TM word
08DD 09          INC     R1              ;Increment the PCM Word Pointer (1-100)
08DE F3          MOVX    @R1,A           ;Write TM word to DPRAM
08DF B45F0B      CJNE    A,#FSYNC_1,J_PCM_FSYNC_ERROR    ;Jump if frame sync word incorrect

                 POLL_FOR_WORD_99:
08E2 20890B      JB      IE0,CHECK_WORD_99   ;Jump if word #99 decommed by USART
08E5 DAFB        DJNZ    R2,POLL_FOR_WORD_99 ;Continue to poll IE0 if no timeout
08E7 D21C        SETB    NO_PCM          ;Else notify main program that PCM ceased
08E9 EC          MOV     A,R4            ;(1) Restore ACC
08EA D0D0        POP     PSW             ;(2) Restore PSW (w/ register banks)
08EC 32          RETI                    ;(2) And return from USART_ISR

                 J_PCM_FSYNC_ERROR:
08ED 020966      JMP     PCM_FSYNC_ERROR

                 CHECK_WORD_99:
08F0 C289        CLR     IE0             ;Prepare to poll for word #99
08F2 7A1E        MOV     R2,#30          ;And initialize next "timeout"
08F4 E2          MOVX    A,@R0           ;ACC gets USART TM word
08F5 09          INC     R1              ;Increment the PCM Word Pointer (1-100)
08F6 F3          MOVX    @R1,A           ;Write TM word to DPRAM
08F7 B4CF6C      CJNE    A,#FSYNC_2,PCM_FSYNC_ERROR  ;Jump if frame sync word incorrect

                 POLL_FOR_WORD_100:
08FA 208908      JB      IE0,CHECK_WORD_100  ;(2) Jump if word #100 decommed by USART
08FD DAFB        DJNZ    R2,POLL_FOR_WORD_100    ;(2) Continue to poll IE0 if no timeout
08FF D21C        SETB    NO_PCM          ;(1) Else notify main program that PCM ceased
0901 EC          MOV     A,R4            ;(1) Restore ACC
0902 D0D0        POP     PSW             ;(2) Restore PSW (w/ register banks)
0904 32          RETI                    ;(2) And return from USART_ISR
                 CHECK_WORD_100:
```

Navy Case No. 77,062

```
0905 C289        1586          CLR     IE0                ;(1) Prepare to poll for word #1
0907 7A1E        1587          MOV     R2,#30             ;(1) And initialize next "timeout"
0909 E2          1588          MOVX    A,@R0              ;(2) ACC gets USART TM word
090A 09          1589          INC     R1                 ;(1) Increment the PCM Word Pointer (1-100)
090B F3          1590          MOVX    @R1,A              ;(2) Write TM word to DPRAM
                 1591    COMPARE_WORD_100_WITH_FSYNC_3:
090C B40457      1592          CJNE    A,#FSYNC_3,PCM_FSYNC_ERROR  ;(2) Jump if frame sync word incorrect
090F D296        1593          SETB    nPCM_SYNC          ;(1) Output indication of good sync
0911 C296        1594          CLR     nPCM_SYNC          ;(1)
0913 7901        1595          MOV     R1,#1              ;(1) Reset PCM Word Pointer
0915 B218        1596          CPL     MBANK_STAT         ;(1) Indicate change of DPRAM bank
0917 A218        1597          MOV     C,MBANK_STAT       ;(1) Copy MBANK_STAT to MBANK
0919 92B0        1598          MOV     MBANK,C            ;(2)
                 1599
                 1600    POLL_FOR_WORD_1:
091B 208908      1601          JB      IE0,PROCESS_WORD_1  ;(2) Jump if word #1 decommed by USART
091E DAFB        1602          DJNZ    R2,POLL_FOR_WORD_1  ;(2) Continue to poll IE0 if no timeout
0920 D21C        1603          SETB    NO_PCM             ;(1) Else notify main program that PCM ceased
0922 EC          1604          MOV     A,R4               ;(1) Restore ACC
0923 D0D0        1605          POP     PSW                ;(2) Restore PSW (w/ register banks)
0925 32          1606          RETI                       ;(2) And return from USART_ISR
                 1607    PROCESS_WORD_1:
0926 C289        1608          CLR     IE0                ;(1) Prepare to poll for word #2
0928 7A1E        1609          MOV     R2,#30             ;(1) And initialize next "timeout"
092A E2          1610          MOVX    A,@R0              ;(2) ACC gets USART TM word
092B F3          1611          MOVX    @R1,A              ;(2) Write TM word to DPRAM
092C 09          1612          INC     R1                 ;(1) Increment the PCM Word Pointer (1-100)
                 1613    CMD_SLAVE_TO_SWITCH_BANKS:
092D 89F0        1614          MOV     B,R1               ;(2) Prepare to command slave to switch banks
092F 797C        1615          MOV     R1,#MS_DATA_BYTE_ADDR   ;(1) B gets PCM Word Pointer,R1 gets slave addr
0931 7400        1616          MOV     A,#DUMMY_ZERO      ;(1) DATA BYTE = 00h for Bank Switch commands
0933 F3          1617          MOVX    @R1,A              ;(2) Send 00h to slave's DATA BYTE
0934 797F        1618          MOV     R1,#MS_OPCODE_ADDR  ;(1) And prepare to send switch command
0936 201A1F      1619          JB      BEGINNING_PCM,COMMAND_PCM_MODE  ;(1) Jump if Bank0 just acquired
0939 201825      1620          JB      MBANK_STAT,SWITCH_SLAVE_TO_BANK_0   ;(1) Else jump if master on bank 1
                 1621    SWITCH_SLAVE_TO_BANK_1:
093C D2B0        1622          SETB    MBANK              ;(1) Temporarily set A7 of DPRAM for message use
093E 7452        1623          MOV     A,#PROCESS_DPRAM_BANK_1 ;(1) ACC gets command to process PCM in Bank 1
                 1624    SEND_BANK_SWITCH_COMMAND:
0940 F3          1625          MOVX    @R1,A              ;(2) Send command
0941 C2B0        1626          CLR     MBANK              ;(1) Restore original state of MBANK
                 1627    RESTORE_PCM_WORD_PTR:
0943 A9F0        1628          MOV     R1,B               ;(2) Restore PCM Word Pointer (1-100)
                 1629    POLL_FOR_WORD_2:
0945 208908      1630          JB      IE0,PROCESS_WORD_2  ;(2) Jump if word #2 decommed by USART
0948 DAFB        1631          DJNZ    R2,POLL_FOR_WORD_2  ;(2) Continue to poll IE0 if no timeout
094A D21C        1632          SETB    NO_PCM             ;(1) Else notify main program that PCM ceased
094C EC          1633          MOV     A,R4               ;(1) Restore ACC
094D D0D0        1634          POP     PSW                ;(2) Restore PSW (w/ register banks)
094F 32          1635          RETI                       ;(2) And return from USART_ISR
                 1636    PROCESS_WORD_2:
0950 C289        1637          CLR     IE0                ;(1) Prepare to accept interrupt for word #3
0952 E2          1638          MOVX    A,@R0              ;(2) ACC gets USART TM word
0953 F3          1639          MOVX    @R1,A              ;(2) Write TM word to DPRAM
                 1640    RF_USART_ISR:
0954 EC          1641          MOV     A,R4               ;(1) Restore ACC
0955 D0D0        1642          POP     PSW                ;(2) Restore PSW (w/ register banks)
0957 32          1643          RETI                       ;(2) And return from USART_ISR
                 1644    COMMAND_PCM_MODE:
0958 D21D        1645          SETB    PCM_VERIFIED       ;(1) Notify main PCM loop that PCM has been confirmed
                 1646      ;     CLR     PREVIOUS_ERROR_71_DATA  ;Clear GET_MESSAGE_ISR #71/01 flag
                 1647      ;     MOV     SM_OPCODE_IN,#DUMMY_ZERO    ;*TEST* Clear any previous opcode
095A C21A        1648          CLR     BEGINNING_PCM      ;(1) Notify subsequent USART ints 1st frame processed
095C 7450        1649          MOV     A,#ENTER_PCM_MODE  ;(1) ACC gets command to enter PCM mode in Bank 0
```

```
095E F3          1650          MOVX    @R1,A            ;(2) Send command
                 1651      ;    CLR     TEST_FLAG        ;*TEST* Indicate msg saying "process bank 0"
095F 80E2        1652          JMP     RESTORE_PCM_WORD_PTR    ;(2) Jump to restore word pointer (Bank 1)
                 1653  SWITCH_SLAVE_TO_BANK_0:
0961 7451        1654          MOV     A,#PROCESS_DPRAM_BANK_0 ;(1) ACC gets command to process PCM in Bank 0
0963 F3          1655          MOVX    @R1,A            ;(2) Send command
0964 80DD        1656          JMP     RESTORE_PCM_WORD_PTR    ;(2) Jump to restore word pointer (Bank 1)
                 1657
                 1658  PCM_FSYNC_ERROR:
0966 C2A8        1659          CLR     EX0              ;*TEST* Disable USART int. Main prog must re-init USART
0968 753000      1660          MOV     MASTER_MODE,#TEST_MODE  ;*TEST* Permit unconditional DPRAM msgs
096B D296        1661          SETB    nPCM_SYNC        ;Output indication of lost sync
096D D21B        1662          SETB    PCM_FRAME_ERROR  ;Notify main program of lost sync
096F 7963        1663          MOV     R1,#99           ;Reinitialize PCM_WORD_PTR @SYN2
0971 EC          1664          MOV     A,R4             ;Restore ACC
0972 D0D0        1665          POP     PSW              ;And return from USART ISR
0974 32          1666          RETI
                 1667
                 1668  ;!!!
```

Navy Case No. 77,062

```
09CA 0209D7          JMP     RF_TIMER0_ISR
                 SWITCH_CAL_NON_PCM:
09CD 753480          MOV     MS_OPCODE_OUT,#SWITCH_CALIBRATE_OUTPUT
09D0 894E            MOV     TEMP_R1,R1                  ;Save R1 (used in SEND_MESSAGE)
09D2 120757          CALL    SEND_MESSAGE
                     ;  CLR   TEST_FLAG                  ;*TEST* Indicate "80" opcode sent
09D5 A94E            MOV     R1,TEMP_R1
                 RF_TIMER0_ISR:
09D7 D0D0            POP     PSW
09D9 D0E0            POP     ACC
09DB 32              RETI

                 REINITIALIZE:
09DC 75815F          MOV     SP,#5Fh                 ;Reinitialize the stack pointer
09DF 90001E          MOV     DPTR,#INITIALIZE        ;DPTR gets address of INITIALIZE address
09E2 C082            PUSH    DPL                     ;Push low byte of desired return address
09E4 C083            PUSH    DPH                     ; "   high "   "     "     "     "
09E6 32              RETI
                 ;IIII
```

```
0A21 66          DB      102          ;PAM CH 18 - 60pct
0A22 EB          DB      235          ;PAM CH 19 - CTBB PCF1 8pct (0 0)
0A23 B3          DB      179          ;PAM CH 20 - 30pct
0A24 E6          DB      230          ;PAM CH 21 - SC1b 10pct
0A25 4D          DB      77           ;PAM CH 22 - 70pct
0A26 CC          DB      204          ;PAM CH 23 - SC2b 20pct
0A27 E6          DB      230          ;PAM CH 24 - 10pct
0A28 33          DB      51           ;PAM CH 25 - 80pct
0A29 FF          DB      255          ;PAM CH 26 - Bit 0 0pct (LSB of EB90h)
0A2A CF          DB      207          ;PAM CH 27 - CTBB PCF2 19pct (0 1)
0A2B FF          DB      255          ;PAM CH 28 - Bit 1 0pct
0A2C 1A          DB      26           ;PAM CH 29 - 90pct
0A2D FF          DB      255          ;PAM CH 30 - Bit 2 0pct
0A2E 33          DB      51           ;PAM CH 31 - 80pct
0A2F FF          DB      255          ;PAM CH 32 - Bit 3 0pct
0A30 4D          DB      77           ;PAM CH 33 - 70pct
0A31 00          DB      0            ;PAM CH 34 - Bit 4 100pct
0A32 66          DB      102          ;PAM CH 35 - 60pct
0A33 FF          DB      255          ;PAM CH 36 - Bit 5 0pct
0A34 E6          DB      230          ;PAM CH 37 - SC1c 10pct
0A35 FF          DB      255          ;PAM CH 38 - Bit 6 0pct
0A36 CC          DB      204          ;PAM CH 39 - SC2c 20pct
0A37 00          DB      0            ;PAM CH 40 - Bit 7 100pct
0A38 80          DB      128          ;PAM CH 41 - 50pct
0A39 00          DB      0            ;PAM CH 42 - Bit 8 100pct
0A3A 99          DB      153          ;PAM CH 43 - 40pct
0A3B 00          DB      0            ;PAM CH 44 - Bit 9 100pct
0A3C B3          DB      179          ;PAM CH 45 - 30pct
0A3D FF          DB      255          ;PAM CH 46 - Bit 10 0pct
0A3E CC          DB      204          ;PAM CH 47 - 20pct
0A3F 00          DB      0            ;PAM CH 48 - Bit 11 100pct
0A40 E6          DB      230          ;PAM CH 49 - 10pct
0A41 FF          DB      255          ;PAM CH 50 - Bit 12 0pct
0A42 E6          DB      230          ;PAM CH 51 - 10pct
0A43 00          DB      0            ;PAM CH 52 - Bit 13 100pct
0A44 E6          DB      230          ;PAM CH 53 - SC1d 10pct
0A45 00          DB      0            ;PAM CH 54 - Bit 14 100pct
0A46 CC          DB      204          ;PAM CH 55 - SC2d 20pct
0A47 00          DB      0            ;PAM CH 56 - Bit 15 100pct (MSB of EB90h)
0A48 CC          DB      204          ;PAM CH 57 - 20pct
0A49 B3          DB      179          ;PAM CH 58 - 30pct
0A4A FF          DB      255          ;PAM CH 59 - Bit 16 0pct
0A4B FF          DB      255          ;PAM CH 60 - 0pct *TEST*
0A4C 00          DB      0            ;PAM CH 61 - 100pct
0A4D 00          DB      0            ;PAM CH 62 - 100pct
0A4E 00          DB      0            ;PAM CH 63 - 100pct
0A4F 80          DB      128          ;PAM CH 64 - 50pct

RF_TIMER1_ISR:
0A50 A84D        MOV     R0,TEMP_R0
0A52 D0D0        POP     PSW          ;Re-select original register bank
0A54 D0E0        POP     ACC          ;Restore used registers
0A56 32          RETI

;IIII
```

```
                IN_PCM_MODE:
0A63 7A0A               MOV     R2,#10                  ;*TEST* Initialize timeout counter
0A65 78A1               MOV     R0,#USART_RD_STAT_REG   ;R0 points to USART status register
                WAIT_FOR_nRxRDY_TO_CHANGE:
0A67 E2                 MOVX    A,@R0                   ;Poll the status register
0A68 20E20A             JB      ACC.2,CHECK_MBANK_STAT  ;Jump if RxRDY has changed
0A6B DAFA               DJNZ    R2,WAIT_FOR_nRxRDY_TO_CHANGE  ;Else loop if no change timeout
0A6D D21B               SETB    PCM_FRAME_ERROR         ;Timeout! Inform main program of error
0A6F 753000             MOV     MASTER_MODE,#TEST_MODE  ;Future msg routines need not wait for USART
0A72 020A8B             JMP     GET_MSG                 ;Take direct control of MBANK

                CHECK_MBANK_STAT:
0A75 3018E6             JNB     MBANK_STAT,GET_MESSAGE  ;Else wait until MBANK set by USART_ISR
0A78 C2D7               CLR     CY                      ;Bank 1 of DPRAM now selected. Clear borrow flag
0A7A 7403               MOV     A,#3                    ;ACC gets lowest acceptable PCM word count for msg
0A7C 9519               SUBB    A,PCM_WORD_POINTER      ;ACC = 3 - current PCM word pointer
0A7E 50DE               JNC     GET_MESSAGE             ;Loop back if PCM word pointer <= 3
0A80 C2D7               CLR     CY                      ;Else clear carry bit for next qual test
0A82 E519               MOV     A,PCM_WORD_POINTER      ;ACC gets current PCM word pointer
0A84 9414               SUBB    A,#20                   ;ACC = PCM word pointer - 20 (highest acceptable PCM wd)
0A86 5006               JNC     GET_MESSAGE             ;Loop back if PCM word pointer >= 20
                GET_MSG:
0A88 D2B0               SETB    MBANK                   ;Make sure Bank 1 of DPRAM is accessible
0A8A 797D               MOV     R1,#SM_DATA_BYTE_ADDR   ;R1 gets DPRAM DATA BYTE address
0A8C E3                 MOVX    A,@R1                   ;ACC gets DATA BYTE from DPRAM
0A8D F532               MOV     SM_DATA_BYTE_IN,A       ;Variable gets copy of DATA BYTE
0A8F 797E               MOV     R1,#SM_OPCODE_ADDR      ;R1 gets DPRAM OPCODE address
0A91 E3                 MOVX    A,@R1                   ;ACC gets OPCODE from DPRAM
0A92 F533               MOV     SM_OPCODE_IN,A          ;Variable gets copy of OPCODE

                GET_MESSAGE_TEST_START:
0A94 B4711C             CJNE    A,#0ATA_SELECT_ERROR,GET_MSG_LOOP
0A97 85334F             MOV     SM_OPCODE_IN_HOLDER,SM_OPCODE_IN        ;*TEST*
0A9A 853250             MOV     SM_DATA_BYTE_IN_HOLDER,SM_DATA_BYTE_IN  ;*TEST*
0A9D E532               MOV     A,SM_DATA_BYTE_IN       ;ACC gets data byte for error opcode #71
0A9F B40009             CJNE    A,#00,POTENTIAL_SELECTION_ERROR_DETECTED
                SELECTION_ERROR_CLEARED:
0AA2 10200E             JBC     PREVIOUS_ERROR_71_DATA,GET_MSG_LOOP  ;Jump if previously 01
                WITHOLD_INVALID_DATA_SEL_ERR:
0AA5 753300             MOV     SM_OPCODE_IN,#DUMMY_ZERO  ;Else withold opcode from main prog
0AA8 020AB3             JMP     GET_MSG_LOOP            ;And exit from GET_MESSAGE_ISR
                POTENTIAL_SELECTION_ERROR_DETECTED:
0AAB B401F7             CJNE    A,#01,WITHOLD_INVALID_DATA_SEL_ERR  ;Jump if bad error #71 data byte rcvd
                SELECTION_ERROR_DETECTED:
0AAE 2020F4             JB      PREVIOUS_ERROR_71_DATA,WITHOLD_INVALID_DATA_SEL_ERR
                RECEIVED_00_THEN_01:
0AB1 D220               SETB    PREVIOUS_ERROR_71_DATA  ;Notify next GET_MESSAGE_ISR

                GET_MSG_LOOP:
0AB3 20B303             JB      nSM_INT,RF_GET_MESSAGE  ;Jump if DPRAM int properly reset
0AB6 E3                 MOVX    A,@R1                   ;Else re-read OPCODE from slave
0AB7 80FA               JMP     GET_MSG_LOOP            ;... until DPRAM int has been deasserted
                RF_GET_MESSAGE:
0AB9 A218               MOV     C,MBANK_STAT            ;Restore original state of MBANK
0ABB 92B0               MOV     MBANK,C
0ABD D0D0               POP     PSW                     ;Restore used registers
0ABF D0E0               POP     ACC
0AC1 32                 RETI

                ;IIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIII
                ;IIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIIII

                ;MMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMMM
```

Navy Case No. 77,062

```
                1906   ;MMMM
```

Navy Case No. 77,062

```
0BAE 52522020
0BB2 20405354    1926    M_MASTER_DPRAM_ERR:     DB  ' MSTR DPRAM ERR '
0BB6 52204450
0BBA 52414D20
0BBE 45525220
0BC2 4D535452    1927    M_MASTER_PAM_CLK_ERR:   DB  'MSTR PAM CK ERR '
0BC6 2050414D
0BCA 20434B20
0BCE 45525220
0BD2 4D535452    1928    M_MASTER_PCM_CLK_ERR:   DB  'MSTR PCM CK ERR '
0BD6 2050434D
0BDA 20434B20
0BDE 45525220
0BE2 20534C41    1929    M_SLAVE_REG_ERR:        DB  ' SLAVE REG ERR  '
0BE6 56452052
0BEA 45472045
0BEE 52522020
0BF2 20534C41    1930    M_SLAVE_RAM_ERR:        DB  ' SLAVE RAM ERR  '
0BF6 56452052
0BFA 414D2045
0BFE 52522020
0C02 534C4156    1931    M_SLAVE_DPRAM_ERR:      DB  'SLAVE DPRAM ERR '
0C06 45204450
0C0A 52414D20
0C0E 45525220
0C12 534C4156    1932    M_SLAVE_PORTS_ERR:      DB  'SLAVE PORTS ERR '
0C16 4520504F
0C1A 52545320
0C1E 45525220
0C22 534C4156    1933    M_SLAVE_PCM_CLK_ERR:    DB  'SLAVE PCM CK ERR'
0C26 45205043
0C2A 4D20434B
0C2E 20455252
0C32 534C4156    1934    M_SLAVE_PAM_CLK_ERR:    DB  'SLAVE PAM CK ERR'
0C36 45205041
0C3A 4D20434B
0C3E 20455252
0C42 44414144    1935    M_DAAD_TEST_1_ERR:      DB  'DAAD TEST #1 ERR'
0C46 20544553
0C4A 54202331
0C4E 20455252
0C52 44414144    1936    M_DAAD_TEST_2_ERR:      DB  'DAAD TEST #2 ERR'
0C56 20544553
0C5A 54202332
0C5E 20455252
0C62 44414144    1937    M_DAAD_TEST_3_ERR:      DB  'DAAD TEST #3 ERR'
0C66 20544553
0C6A 54202333
0C6E 20455252
0C72 53494D20    1938    M_SIM_PAM_TEST_ERR:     DB  'SIM PAM TEST ERR'
0C76 50414D20
0C7A 54455354
0C7E 20455252
0C82 53494D20    1939    M_SIM_PCM_TEST_ERR:     DB  'SIM PCM TEST ERR'
0C86 50434D20
0C8A 54455354
0C8E 20455252
                 1940
0C92 44415441    1941    M_DATA_SELECT_ERR:  DB  'DATA SELECT ERR '
0C96 2053454C
0C9A 45435420
0C9E 45525220
                 1942    ;MMMM
```

```
1944
1945  ;DDDD
```

Navy Case No. 77,062

```
003B    2008    TIMER1_ISR_PTR_OFFSET:  DS  1   ;Word tells TIMER1 ISR where to look up next DAC wd
003C    2009    DEBOUNCE_COUNT:         DS  1
        2010    DISP_BUFF:                      ;Beginning of 16-byte display buffer
003D    2011    DISP_CHAR_0:            DS  1   ;Left-most display buffer char position
003E    2012    DISP_CHAR_1:            DS  1
003F    2013    DISP_CHAR_2:            DS  1
0040    2014    DISP_CHAR_3:            DS  1
0041    2015    DISP_CHAR_4:            DS  1
0042    2016    DISP_CHAR_5:            DS  1
0043    2017    DISP_CHAR_6:            DS  1
0044    2018    DISP_CHAR_7:            DS  1
0045    2019    DISP_CHAR_8:            DS  1
0046    2020    DISP_CHAR_9:            DS  1
0047    2021    DISP_CHAR_10:           DS  1
0048    2022    DISP_CHAR_11:           DS  1
0049    2023    DISP_CHAR_12:           DS  1
004A    2024    DISP_CHAR_13:           DS  1
004B    2025    DISP_CHAR_14:           DS  1
004C    2026    DISP_CHAR_15:           DS  1       ;Right-most display buffer char position
004D    2027    TEMP_R0:                DS  1       ;Temporary TIMER1_ISR storage for R0
004E    2028    TEMP_R1:                DS  1       ;Temporary TIMER0_ISR storage for R1
        2029
004F    2030    SM_OPCODE_IN_HOLDER:    DS  1       ;*TEST*
0050    2031    SM_DATA_BYTE_IN_HOLDER: DS  1       ;*TEST*
        2032
        2033    ;DDDD
```

Navy Case No. 77,062

| | | | |
|---|---|---|---|
| CHECK_FOR_STD3_FRAME_ERROR. . . | C ADDR | 0349H | A |
| CHECK_FOR_USART_FREEZE. . . . . | C ADDR | 0569H | A |
| CHECK_FOR_WORD_94 . . . . . | C ADDR | 0835H | A |
| CHECK_MBANK_STAT. . . . . | C ADDR | 0A75H | A |
| CHECK_PCM_FRAME_ERROR . . . . . | C ADDR | 00DDH | A |
| CHECK_PCM_USART_ISR_FLAGS . . . | C ADDR | 00C9H | A |
| CHECK_STD2. . . . . | C ADDR | 0330H | A |
| CHECK_STD3. . . . . | C ADDR | 0351H | A |
| CHECK_WORD_100. . . . . | C ADDR | 0905H | A |
| CHECK_WORD_98 . . . . . | C ADDR | 08D8H | A |
| CHECK_WORD_99 . . . . . | C ADDR | 08F0H | A |
| CHECKING_FOR_PT_PCM . . . . . | B ADDR | 0023H.6 | A |
| CHK_FOR_CAL_MODE_CHANGE . . . . | C ADDR | 09A7H | A |
| CHK_FOR_CAL_MODE. . . . . | C ADDR | 09A1H | A |
| CHK_SIM_PAM . . . . . | C ADDR | 09F8H | A |
| CHK_SLAVE_STAT_1_TIME . . . . . | C ADDR | 03F1H | A |
| CHK_SLAVE_STAT_1. . . . . | C ADDR | 03EBH | A |
| CHK_SLAVE_STAT_2_TIME . . . . . | C ADDR | 043BH | A |
| CHK_SLAVE_STAT_2. . . . . | C ADDR | 0435H | A |
| CHK_SLAVE_STAT_3_TIME . . . . . | C ADDR | 049AH | A |
| CHK_SLAVE_STAT_3. . . . . | C ADDR | 0494H | A |
| CHK_SLAVE_STAT_4_TIME . . . . . | C ADDR | 067EH | A |
| CHK_SLAVE_STAT_4. . . . . | C ADDR | 0678H | A |
| CHK_SLAVE_STAT_5_TIME . . . . . | C ADDR | 06B7H | A |
| CHK_SLAVE_STAT_5. . . . . | C ADDR | 06B1H | A |
| CHK_SLAVE_STAT_6_TIME . . . . . | C ADDR | 06F0H | A |
| CHK_SLAVE_STAT_6. . . . . | C ADDR | 06EAH | A |
| CHK_T0_DO_NOTHING . . . . . | C ADDR | 097DH | A |
| CHK_T0_IS_TIMER . . . . . | C ADDR | 0983H | A |
| CHK_T1_DO_NOTHING . . . . . | C ADDR | 09F2H | A |
| CLEAR_DSE_DISP. . . . . | C ADDR | 07B8H | A |
| CLOCK . . . . . | B ADDR | 00B0H.4 | A |
| CMD_SLAVE_TO_SWITCH_BANKS . . . | C ADDR | 092DH | A |
| COMMAND_PCM_MODE. . . . . | C ADDR | 0958H | A |
| COMPARE_WORD_100_WITH_FSYNC_3 . | C ADDR | 090CH | A |
| CY. . . . . | B ADDR | 00D0H.7 | A |
| DAAD_TEST_1_FAILED. . . . . | C ADDR | 069BH | A |
| DAAD_TEST_1_STATUS. . . . . | NUMB | 0012H | A |
| DAAD_TEST_1 . . . . . | NUMB | 0011H | A |
| DAAD_TEST_2_FAILED. . . . . | C ADDR | 06D4H | A |
| DAAD_TEST_2_STATUS. . . . . | NUMB | 0014H | A |
| DAAD_TEST_2 . . . . . | NUMB | 0013H | A |
| DAAD_TEST_3_FAILED. . . . . | C ADDR | 070DH | A |
| DAAD_TEST_3_STATUS. . . . . | NUMB | 0016H | A |
| DAAD_TEST_3 . . . . . | NUMB | 0015H | A |
| DAAD_TEST_ONE . . . . . | C ADDR | 0664H | A |
| DAAD_TEST_THREE . . . . . | C ADDR | 06D6H | A |
| DAAD_TEST_TWO . . . . . | C ADDR | 069DH | A |
| DAC_VOLTAGE_NEG_1_45. . . . . | NUMB | 0000H | A |
| DAC_VOLTAGE_POS_1_45. . . . . | NUMB | 00FFH | A |
| DAC_VOLTAGE_ZERO. . . . . | NUMB | 0080H | A |
| DAC . . . . . | NUMB | 0080H | A |
| DATA_SELECT_ERROR . . . . . | NUMB | 0071H | A |
| DEBOUNCE_COUNT. . . . . | D ADDR | 003CH | A |
| DEBOUNCE_HOLD_INDEX_KEY . . . . | C ADDR | 0521H | A |
| DEBOUNCE_THE_HOLD_INDEX_KEY . . | C ADDR | 0346H | A |
| DELAY_10MS. . . . . | C ADDR | 0719H | A |
| DELAY_1MS . . . . . | C ADDR | 0710H | A |
| DELAY_50MS_TICKS_LOOP . . . . . | C ADDR | 0725H | A |
| DELAY_50MS_TICKS. . . . . | C ADDR | 0722H | A |
| DESIRED_50MS_TICKS. . . . . | D ADDR | 003AH | A |
| DID_CALIBRATE_PASS? . . . . . | C ADDR | 04B9H | A |
| DISP_BUFF . . . . . | D ADDR | 003DH | A |
| DISP_CHAR_0 . . . . . | D ADDR | 003DH | A |

Navy Case No. 77,062

| | | | |
|---|---|---|---|
| DISP_CHAR_1 . . . . . | D ADDR | 003EH | A |
| DISP_CHAR_10. . . . . | D ADDR | 0047H | A |
| DISP_CHAR_11. . . . . | D ADDR | 0048H | A |
| DISP_CHAR_12. . . . . | D ADDR | 0049H | A |
| DISP_CHAR_13. . . . . | D ADDR | 004AH | A |
| DISP_CHAR_14. . . . . | D ADDR | 004BH | A |
| DISP_CHAR_15. . . . . | D ADDR | 004CH | A |
| DISP_CHAR_2 . . . . . | D ADDR | 003FH | A |
| DISP_CHAR_3 . . . . . | D ADDR | 0040H | A |
| DISP_CHAR_4 . . . . . | D ADDR | 0041H | A |
| DISP_CHAR_5 . . . . . | D ADDR | 0042H | A |
| DISP_CHAR_6 . . . . . | D ADDR | 0043H | A |
| DISP_CHAR_7 . . . . . | D ADDR | 0044H | A |
| DISP_CHAR_8 . . . . . | D ADDR | 0045H | A |
| DISP_CHAR_9 . . . . . | D ADDR | 0046H | A |
| DISP_PROC_PCM . . . . . | C ADDR | 0001H | A |
| DISP_PROC_STM . . . . . | C ADDR | 0007H | A |
| DISP0_CHAR_0. . . . . | NUMB | 00C8H | A |
| DISP0_CHAR_1. . . . . | NUMB | 00C9H | A |
| DISP0_CHAR_2. . . . . | NUMB | 00CAH | A |
| DISP0_CHAR_3. . . . . | NUMB | 00CBH | A |
| DISP0_CHAR_4. . . . . | NUMB | 00CCH | A |
| DISP0_CHAR_5. . . . . | NUMB | 00CDH | A |
| DISP0_CHAR_6. . . . . | NUMB | 00CEH | A |
| DISP0_CHAR_7. . . . . | NUMB | 00CFH | A |
| DISP0_CTRL. . . . . | NUMB | 00C0H | A |
| DISP0_UDC_ADDR. . . . . | NUMB | 00C0H | A |
| DISP0_UDC_ROW_0 . . . . . | NUMB | 00C8H | A |
| DISP0_UDC_ROW_1 . . . . . | NUMB | 00C9H | A |
| DISP0_UDC_ROW_2 . . . . . | NUMB | 00CAH | A |
| DISP0_UDC_ROW_3 . . . . . | NUMB | 00CBH | A |
| DISP0_UDC_ROW_4 . . . . . | NUMB | 00CCH | A |
| DISP0_UDC_ROW_5 . . . . . | NUMB | 00CDH | A |
| DISP0_UDC_ROW_6 . . . . . | NUMB | 00CEH | A |
| DISP0_UDC_ROW_7 . . . . . | NUMB | 00CFH | A |
| DISP1_CHAR_0. . . . . | NUMB | 00E8H | A |
| DISP1_CHAR_1. . . . . | NUMB | 00E9H | A |
| DISP1_CHAR_2. . . . . | NUMB | 00EAH | A |
| DISP1_CHAR_3. . . . . | NUMB | 00EBH | A |
| DISP1_CHAR_4. . . . . | NUMB | 00ECH | A |
| DISP1_CHAR_5. . . . . | NUMB | 00EDH | A |
| DISP1_CHAR_6. . . . . | NUMB | 00EEH | A |
| DISP1_CHAR_7. . . . . | NUMB | 00EFH | A |
| DISP1_CTRL. . . . . | NUMB | 00E0H | A |
| DISP1_UDC_ROW_0 . . . . . | NUMB | 00E8H | A |
| DISP1_UDC_ROW_1 . . . . . | NUMB | 00E9H | A |
| DISP1_UDC_ROW_2 . . . . . | NUMB | 00EAH | A |
| DISP1_UDC_ROW_3 . . . . . | NUMB | 00EBH | A |
| DISP1_UDC_ROW_4 . . . . . | NUMB | 00ECH | A |
| DISP1_UDC_ROW_5 . . . . . | NUMB | 00EDH | A |
| DISP1_UDC_ROW_6 . . . . . | NUMB | 00EEH | A |
| DISP1_UDC_ROW_7 . . . . . | NUMB | 00EFH | A |
| DISPLAY_8_DB. . . . . | C ADDR | 0804H | A |
| DISPLAY_8_MT. . . . . | C ADDR | 07C7H | A |
| DISPLAY_DB_LOOP . . . . . | C ADDR | 0806H | A |
| DISPLAY_MSG_AT_DB . . . . . | C ADDR | 07EBH | A |
| DISPLAY_MSG_AT_MT . . . . . | C ADDR | 07A7H | A |
| DISPLAY_MSG . . . . . | C ADDR | 078AH | A |
| DISPLAY_MT_LOOP . . . . . | C ADDR | 07C9H | A |
| DISPLAY_PCM_OR_STM. . . . . | C ADDR | 00DAH | A |
| DO_HOUSEKEEPING . . . . . | C ADDR | 0363H | A |
| DO_NOTHING. . . . . | NUMB | 0000H | A |
| DPH . . . . . | D ADDR | 0083H | A |
| DPL . . . . . | D ADDR | 0082H | A |

Navy Case No. 77,062

| | | | | |
|---|---|---|---|---|
| DSE_DISP. . . . . | B | ADDR | 0024H.2 | A |
| DSP_SW_VER_ADDRESS. . . . . | | NUMB | 0070H | A |
| DUMMY_ZERO. . . . . | | NUMB | 0000H | A |
| ENTER_PAM_MODE. . . . . | | NUMB | 0042H | A |
| ENTER_PCM_MODE. . . . . | | NUMB | 0050H | A |
| ESTABLISH_VECTORS . . . . . | C | ADDR | 0000H | A |
| ET0 . . . . . | B | ADDR | 00A8H.1 | A |
| ET1 . . . . . | B | ADDR | 00A8H.3 | A |
| EX0 . . . . . | B | ADDR | 00A8H.0 | A |
| EXT_ONE_MS_TICKS. . . . . | D | ADDR | 0037H | A |
| FAILED_CALIBRATION. . . . . | C | ADDR | 04E9H | A |
| FIFTY_MS_PER_MSG. . . . . | | NUMB | 001EH | A |
| FIFTY_MS_TICKS. . . . . | D | ADDR | 0039H | A |
| FORWARD_TWO_PCM_FRAMES. . . . . | C | ADDR | 0481H | A |
| FSYNC_1 . . . . . | | NUMB | 005FH | A |
| FSYNC_2 . . . . . | | NUMB | 00CFH | A |
| FSYNC_3 . . . . . | | NUMB | 0004H | A |
| GENERAL_FLAGS . . . . . | D | ADDR | 0023H | A |
| GET_BANK_0. . . . . | C | ADDR | 0322H | A |
| GET_MESSAGE_ISR . . . . . | C | ADDR | 0A57H | A |
| GET_MESSAGE_TEST_START. . . . . | C | ADDR | 0A94H | A |
| GET_MESSAGE . . . . . | C | ADDR | 0A5EH | A |
| GET_MSG_LOOP. . . . . | C | ADDR | 0AB3H | A |
| GET_MSG . . . . . | C | ADDR | 0A88H | A |
| HI_IO . . . . . | B | ADDR | 0090H.7 | A |
| HIGH_TEST_MASTER_DPRAM_LOOP . . | C | ADDR | 05A8H | A |
| HOLD_PAM. . . . . | C | ADDR | 02BCH | A |
| HOLD_PCM. . . . . | C | ADDR | 033EH | A |
| HOUSEKEEPING. . . . . | C | ADDR | 0739H | A |
| HUND_ZERO_CHANGED . . . . . | C | ADDR | 09C5H | A |
| HUND_ZERO . . . . . | B | ADDR | 0090H.0 | A |
| HUNT_FOR_NEXT_PCM_FRAME_SYNC. . | C | ADDR | 0531H | A |
| IE. . . . . | D | ADDR | 00A8H | A |
| IE0 . . . . . | B | ADDR | 0088H.1 | A |
| IN_CAL_H_TO_Z_CHANGE. . . . . | C | ADDR | 0855H | A |
| IN_CAL_Z_TO_H_CHANGE. . . . . | C | ADDR | 085EH | A |
| IN_PCM_MODE . . . . . | C | ADDR | 0A63H | A |
| INIT_REG_BANK_3_FOR_PCM . . . . | C | ADDR | 0041H | A |
| INIT_USART. . . . . | C | ADDR | 080DH | A |
| INITIALIZE_USART. . . . . | C | ADDR | 003EH | A |
| INITIALIZE. . . . . | C | ADDR | 001EH | A |
| INT_ONE_MS_TICKS. . . . . | D | ADDR | 0038H | A |
| INTER_MESSAGE_DELAY . . . . . | C | ADDR | 0733H | A |
| IP. . . . . | D | ADDR | 00B8H | A |
| J_CHECK_FOR_PT_PCM. . . . . | C | ADDR | 0130H | A |
| J_PCM_FSYNC_ERROR . . . . . | C | ADDR | 08EDH | A |
| J_PCM_TEST_FAILED . . . . . | C | ADDR | 054FH | A |
| J_RE_DISPLAY_AWAITING_TM. . . . | C | ADDR | 020CH | A |
| LIST_SELF_TEST_ERRORS . . . . . | C | ADDR | 0159H | A |
| LOW_TEST_MASTER_DPRAM_LOOP. . . | C | ADDR | 0586H | A |
| M_AWAITING_TM . . . . . | C | ADDR | 0B62H | A |
| M_CALIBRATING . . . . . | C | ADDR | 0B32H | A |
| M_DAAD_TEST_1_ERR . . . . . | C | ADDR | 0C42H | A |
| M_DAAD_TEST_2_ERR . . . . . | C | ADDR | 0C52H | A |
| M_DAAD_TEST_3_ERR . . . . . | C | ADDR | 0C62H | A |
| M_DATA_SELECT_ERR . . . . . | C | ADDR | 0C92H | A |
| M_DISPTEST. . . . . | C | ADDR | 0AE2H | A |
| M_DSP_SW_VER. . . . . | C | ADDR | 0AD2H | A |
| M_FAILED_ST . . . . . | C | ADDR | 0B52H | A |
| M_HOLDING_PAM . . . . . | C | ADDR | 0B12H | A |
| M_HOLDING_PCM . . . . . | C | ADDR | 0B22H | A |
| M_MASTER_DPRAM_ERR. . . . . | C | ADDR | 0BB2H | A |
| M_MASTER_PAM_CLK_ERR. . . . . | C | ADDR | 0BC2H | A |
| M_MASTER_PCM_CLK_ERR. . . . . | C | ADDR | 0BD2H | A |

Navy Case No. 77,062

| | | | | |
|---|---|---|---|---|
| M_MASTER_RAM_ERR. . . . . | C | ADDR | 0BA2H | A |
| M_MC_SW_VER . . . . . | C | ADDR | 0AC2H | A |
| M_PASSED_ST . . . . . | C | ADDR | 0B42H | A |
| M_PROCESS_PAM . . . . . | C | ADDR | 0B72H | A |
| M_PROCESS_PCM . . . . . | C | ADDR | 0B82H | A |
| M_PROCESS_STM . . . . . | C | ADDR | 0B92H | A |
| M_SIM_PAM_TEST_ERR. . . . . | C | ADDR | 0C72H | A |
| M_SIM_PAM . . . . . | C | ADDR | 0AF2H | A |
| M_SIM_PCM_TEST_ERR. . . . . | C | ADDR | 0C82H | A |
| M_SIM_PCM . . . . . | C | ADDR | 0B02H | A |
| M_SLAVE_DPRAM_ERR . . . . . | C | ADDR | 0C02H | A |
| M_SLAVE_PAM_CLK_ERR . . . . . | C | ADDR | 0C32H | A |
| M_SLAVE_PCM_CLK_ERR . . . . . | C | ADDR | 0C22H | A |
| M_SLAVE_PORTS_ERR . . . . . | C | ADDR | 0C12H | A |
| M_SLAVE_RAM_ERR . . . . . | C | ADDR | 0BF2H | A |
| M_SLAVE_REG_ERR . . . . . | C | ADDR | 0BE2H | A |
| MAIN_PAM_LOOP . . . . . | C | ADDR | 0115H | A |
| MAIN_PCM_LOOP . . . . . | C | ADDR | 00AFH | A |
| MAIN_PROCESSING . . . . . | C | ADDR | 006AH | A |
| MASTER_25_6_KHZ_OK. . . . . | B | ADDR | 0022H.2 | A |
| MASTER_320_KHZ_OK . . . . . | B | ADDR | 0022H.3 | A |
| MASTER_DPRAM_OK . . . . . | B | ADDR | 0022H.1 | A |
| MASTER_MODE . . . . . | D | ADDR | 0030H | A |
| MASTER_NON_TM_STATUS. . . . . | D | ADDR | 0022H | A |
| MASTER_RAM_OK . . . . . | B | ADDR | 0022H.0 | A |
| MATCH_IF_HZ_IS_0. . . . . | C | ADDR | 09AAH | A |
| MATCH_IF_HZ_IS_1. . . . . | C | ADDR | 09B9H | A |
| MBANK_STAT. . . . . | B | ADDR | 0023H.0 | A |
| MBANK . . . . . | B | ADDR | 00B0H.0 | A |
| MS_DATA_BYTE_ADDR . . . . . | | NUMB | 007CH | A |
| MS_DATA_BYTE_OUT. . . . . | D | ADDR | 0031H | A |
| MS_OPCODE_ADDR. . . . . | | NUMB | 007FH | A |
| MS_OPCODE_OUT . . . . . | D | ADDR | 0034H | A |
| NBS_ERR . . . . . | B | ADDR | 00A0H.2 | A |
| NBUSYL. . . . . | B | ADDR | 00B0H.1 | A |
| NEXT_PCM_WORD_RECEIVED. . . . . | C | ADDR | 056DH | A |
| NFLASH. . . . . | B | ADDR | 00A0H.0 | A |
| NHI_ACK . . . . . | B | ADDR | 0090H.5 | A |
| NMSTR_WDI . . . . . | B | ADDR | 0090H.2 | A |
| NO_PCM. . . . . | B | ADDR | 0023H.4 | A |
| NPCM_SYNC . . . . . | B | ADDR | 0090H.6 | A |
| NRXRDY. . . . . | B | ADDR | 00B0H.2 | A |
| NSIM_HOLD . . . . . | B | ADDR | 0090H.1 | A |
| NSM_INT . . . . . | B | ADDR | 00B0H.3 | A |
| NUDC. . . . . | B | ADDR | 00A0H.4 | A |
| OFFER_SIMULATED_PAM . . . . . | C | ADDR | 028EH | A |
| OFFER_SIMULATED_PCM . . . . . | C | ADDR | 02FAH | A |
| OPER_CAL. . . . . | B | ADDR | 00A0H.7 | A |
| OUTPUT_50_PERCENT . . . . . | | NUMB | 0030H | A |
| P0004_SEC_HI. . . . . | | NUMB | 00FEH | A |
| P0004_SEC_LO. . . . . | | NUMB | 0070H | A |
| P001_SEC_HI . . . . . | | NUMB | 00FCH | A |
| P001_SEC_LO . . . . . | | NUMB | 002FH | A |
| P1. . . . . | D | ADDR | 0090H | A |
| P2. . . . . | D | ADDR | 00A0H | A |
| P3. . . . . | D | ADDR | 00B0H | A |
| PAM_MODE. . . . . | | NUMB | 0010H | A |
| PAM_PCM . . . . . | B | ADDR | 00A0H.3 | A |
| PAM_SELECTION_ERROR_CLEARED . . | C | ADDR | 0138H | A |
| PAM_SYNC_DETECTED . . . . . | | NUMB | 0041H | A |
| PAM_SYNC_LOST . . . . . | | NUMB | 0043H | A |
| PAM_TEST_FAILED . . . . . | C | ADDR | 0458H | A |
| PASSED_CALIBRATION. . . . . | C | ADDR | 04D0H | A |
| PASSED_LAST_CAL . . . . . | B | ADDR | 0023H.1 | A |

Navy Case No. 77,062

| | | | | |
|---|---|---|---|---|
| PCM_FRAME_ERROR . . . . . | B | ADDR | 0023H.3 | A |
| PCM_FSYNC_ERROR . . . . . | C | ADDR | 0966H | A |
| PCM_MODE. . . . . | | NUMB | 0020H | A |
| PCM_SELECTION_ERROR_CLEARED . . | C | ADDR | 00E4H | A |
| PCM_SYNC_DETECTED . . . . . | C | ADDR | 0557H | A |
| PCM_TEST_FAILED . . . . . | C | ADDR | 04B7H | A |
| PCM_VERIFIED. . . . . | B | ADDR | 0023H.5 | A |
| PCM_WORD_POINTER. . . . . | D | ADDR | 0019H | A |
| POLL_FOR_FSYNC_3. . . . . | C | ADDR | 053BH | A |
| POLL_FOR_NEXT_PCM_WORD. . . . . | C | ADDR | 0563H | A |
| POLL_FOR_WORD_1 . . . . . | C | ADDR | 091BH | A |
| POLL_FOR_WORD_100 . . . . . | C | ADDR | 08FAH | A |
| POLL_FOR_WORD_2 . . . . . | C | ADDR | 0945H | A |
| POLL_FOR_WORD_95. . . . . | C | ADDR | 083AH | A |
| POLL_FOR_WORD_96_AND_SWITCH . . | C | ADDR | 0864H | A |
| POLL_FOR_WORD_96. . . . . | C | ADDR | 086FH | A |
| POLL_FOR_WORD_97_AND_SWITCH . . | C | ADDR | 08ACH | A |
| POLL_FOR_WORD_97. . . . . | C | ADDR | 0881H | A |
| POLL_FOR_WORD_98. . . . . | C | ADDR | 08CDH | A |
| POLL_FOR_WORD_99. . . . . | C | ADDR | 08E2H | A |
| POTENTIAL_SELECTION_ERROR_DETEC | C | ADDR | 0AABH | A |
| PREP_TO_CALIBRATE . . . . . | | NUMB | 0090H | A |
| PREPARE_FOR_NEXT_PCM_WORD . . . | C | ADDR | 0560H | A |
| PREVIOUS_ERROR_71_DATA. . . . . | B | ADDR | 0024H.0 | A |
| PROCESS_DPRAM_BANK_0. . . . . | | NUMB | 0051H | A |
| PROCESS_DPRAM_BANK_1. . . . . | | NUMB | 0052H | A |
| PROCESS_WORD_1. . . . . | C | ADDR | 0926H | A |
| PROCESS_WORD_2. . . . . | C | ADDR | 0950H | A |
| PROCESS_WORD_95 . . . . . | C | ADDR | 0845H | A |
| PROCESS_WORD_96_AND_SWITCH. . . | C | ADDR | 0896H | A |
| PROCESS_WORD_96 . . . . . | C | ADDR | 087AH | A |
| PROCESS_WORD_97_AND_SWITCH. . . | C | ADDR | 08B7H | A |
| PROCESS_WORD_97 . . . . . | C | ADDR | 088CH | A |
| PSW . . . . . | D | ADDR | 00D0H | A |
| PT_CT . . . . . | B | ADDR | 00A0H.1 | A |
| PT1 . . . . . | B | ADDR | 00B8H.3 | A |
| R_HUND_ZERO . . . . . | B | ADDR | 0024H.1 | A |
| RE_DISPLAY_AWAITING_TM. . . . . | C | ADDR | 014EH | A |
| READ_USART_TM_WORD. . . . . | C | ADDR | 0832H | A |
| RECEIVED_00_THEN_01 . . . . . | C | ADDR | 0AB1H | A |
| REINITIALIZE_USART. . . . . | C | ADDR | 0098H | A |
| REINITIALIZE. . . . . | C | ADDR | 09DCH | A |
| REPORT_DAAD_TEST_1_ERROR? . . . | C | ADDR | 01D1H | A |
| REPORT_DAAD_TEST_2_ERROR? . . . | C | ADDR | 01DDH | A |
| REPORT_DAAD_TEST_3_ERROR? . . . | C | ADDR | 01E9H | A |
| REPORT_MASTER_DPRAM_ERROR?. . . | C | ADDR | 0165H | A |
| REPORT_MASTER_PAM_CLK_ERROR?. . | C | ADDR | 0171H | A |
| REPORT_MASTER_PCM_CLK_ERROR?. . | C | ADDR | 017DH | A |
| REPORT_MASTER_RAM_ERROR?. . . . | C | ADDR | 0159H | A |
| REPORT_SIM_PAM_TEST_ERROR?. . . | C | ADDR | 01F5H | A |
| REPORT_SIM_PCM_TEST_ERROR?. . . | C | ADDR | 0201H | A |
| REPORT_SLAVE_DPRAM_ERROR? . . . | C | ADDR | 01A1H | A |
| REPORT_SLAVE_PAM_CLK_ERROR? . . | C | ADDR | 01C5H | A |
| REPORT_SLAVE_PCM_CLK_ERROR? . . | C | ADDR | 01B9H | A |
| REPORT_SLAVE_PORTS_ERROR? . . . | C | ADDR | 01ADH | A |
| REPORT_SLAVE_RAM_ERROR? . . . . | C | ADDR | 0195H | A |
| REPORT_SLAVE_RN_ARN_ERROR?. . . | C | ADDR | 0189H | A |
| REQUEST_PCM_CALIBRATION_STATUS. | C | ADDR | 0486H | A |
| REQUEST_SIMULATED_PCM . . . . . | C | ADDR | 0314H | A |
| RESTORE_PCM_WORD_PTR. . . . . | C | ADDR | 0943H | A |
| RF_CALIBRATE. . . . . | C | ADDR | 050FH | A |
| RF_DELAY_50MS_TICKS . . . . . | C | ADDR | 0732H | A |
| RF_DISPLAY_MSG_AT_DB. . . . . | C | ADDR | 0801H | A |
| RF_GET_MESSAGE. . . . . | C | ADDR | 0AB9H | A |

Navy Case No. 77,062

| | | | | |
|---|---|---|---|---|
| RF_SAVE_DISPLAY_CONTENTS. . . . | C | ADDR | 07E1H | A |
| RF_SELF_TEST. . . . . | C | ADDR | 038EH | A |
| RF_TEST_DAAD. . . . . | C | ADDR | 070FH | A |
| RF_TEST_DPRAM_LEFT. . . . . | C | ADDR | 05C6H | A |
| RF_TEST_MASTER_RAM. . . . . | C | ADDR | 05E5H | A |
| RF_TIMER0_ISR . . . . . | C | ADDR | 09D7H | A |
| RF_TIMER1_ISR . . . . . | C | ADDR | 0A50H | A |
| RF_USART_ISR_2. . . . . | C | ADDR | 0841H | A |
| RF_USART_ISR. . . . . | C | ADDR | 0954H | A |
| SAVE_8_DB . . . . . | C | ADDR | 07E2H | A |
| SAVE_DB_LOOP. . . . . | C | ADDR | 07E4H | A |
| SAVE_DISPLAY_CONTENTS . . . . . | C | ADDR | 07D2H | A |
| SEARCH_FOR_PAM_SYNC . . . . . | | NUMB | 0040H | A |
| SELECTION_ERROR_CLEARED . . . . | C | ADDR | 0AA2H | A |
| SELECTION_ERROR_DETECTED. . . . | C | ADDR | 0AAEH | A |
| SELF_TEST_DELAY_1 . . . . . | C | ADDR | 02ACH | A |
| SELF_TEST_DELAY_2 . . . . . | C | ADDR | 0327H | A |
| SELF_TEST . . . . . | C | ADDR | 020EH | A |
| SEND_80_00. . . . . | B | ADDR | 0024H.3 | A |
| SEND_80_01. . . . . | B | ADDR | 0024H.4 | A |
| SEND_BANK_SWITCH_COMMAND. . . . | C | ADDR | 0940H | A |
| SEND_CAL_PAM_STATUS . . . . . | | NUMB | 0022H | A |
| SEND_CAL_PCM_STATUS . . . . . | | NUMB | 0025H | A |
| SEND_CALIBRATE_COMMAND. . . . . | C | ADDR | 03CBH | A |
| SEND_CALIBRATE_PAM_COMMAND. . . | C | ADDR | 0419H | A |
| SEND_CALIBRATE_PCM_COMMAND. . . | C | ADDR | 0470H | A |
| SEND_MESSAGE_OPCODE . . . . . | C | ADDR | 077AH | A |
| SEND_MESSAGE. . . . . | C | ADDR | 0757H | A |
| SEND_MSG. . . . . | C | ADDR | 076FH | A |
| SEND_NON_TM_STATUS. . . . . | | NUMB | 0002H | A |
| SEND_PREP_CAL_COMMAND . . . . . | C | ADDR | 03B3H | A |
| SET_DSE_DISP. . . . . | C | ADDR | 07B3H | A |
| SET_TIMER0_FOR_1MS. . . . . | C | ADDR | 073CH | A |
| SETUP_FOR_PCM . . . . . | C | ADDR | 00A7H | A |
| SIM_PAM_CLK . . . . . | B | ADDR | 00B0H.5 | A |
| SIM_PAM_LOOP. . . . . | C | ADDR | 02C7H | A |
| SIM_PAM_TABLE . . . . . | C | ADDR | 0A10H | A |
| SIM_PCM_LOOP. . . . . | C | ADDR | 0357H | A |
| SIMULATE_PAM_MD . . . . . | | NUMB | 0001H | A |
| SIMULATE_PAM. . . . . | C | ADDR | 0780H | A |
| SLAVE_25_6_KHZ_OK . . . . . | B | ADDR | 0020H.5 | A |
| SLAVE_320_KHZ_OK. . . . . | B | ADDR | 0020H.4 | A |
| SLAVE_ADC_TM_STATUS . . . . . | D | ADDR | 0021H | A |
| SLAVE_DAAD_1_STATUS_RCVD. . . . | C | ADDR | 0691H | A |
| SLAVE_DAAD_2_STATUS_RCVD. . . . | C | ADDR | 06CAH | A |
| SLAVE_DAAD_3_STATUS_RCVD. . . . | C | ADDR | 0703H | A |
| SLAVE_DAC_ADC_1_OK. . . . . | B | ADDR | 0021H.0 | A |
| SLAVE_DAC_ADC_2_OK. . . . . | B | ADDR | 0021H.1 | A |
| SLAVE_DAC_ADC_3_OK. . . . . | B | ADDR | 0021H.2 | A |
| SLAVE_DPRAM_OK. . . . . | B | ADDR | 0020H.2 | A |
| SLAVE_N_T_STATUS_RCVD . . . . . | C | ADDR | 0404H | A |
| SLAVE_NON_TM_STATUS . . . . . | D | ADDR | 0020H | A |
| SLAVE_OUT_PORTS_OK. . . . . | B | ADDR | 0020H.3 | A |
| SLAVE_PAM_OK. . . . . | B | ADDR | 0021H.3 | A |
| SLAVE_PAM_STATUS_RCVD . . . . . | C | ADDR | 044EH | A |
| SLAVE_PCM_OK. . . . . | B | ADDR | 0021H.4 | A |
| SLAVE_PCM_STATUS_RCVD . . . . . | C | ADDR | 04ADH | A |
| SLAVE_RAM_OK. . . . . | B | ADDR | 0020H.1 | A |
| SLAVE_RN_ARN_OK . . . . . | B | ADDR | 0020H.0 | A |
| SM_DATA_BYTE_ADDR . . . . . | | NUMB | 007DH | A |
| SM_DATA_BYTE_IN_HOLDER. . . . . | D | ADDR | 0050H | A |
| SM_DATA_BYTE_IN . . . . . | D | ADDR | 0032H | A |
| SM_OPCODE_ADDR. . . . . | | NUMB | 007EH | A |
| SM_OPCODE_IN_HOLDER . . . . . | D | ADDR | 004FH | A |

Navy Case No. 77,062

```
SM_OPCODE_IN. . . . . . . . . . . D ADDR    0033H   A
SP. . . . . . . . . . . . . . . . D ADDR    0081H   A
SPAML_PAM_SELECTION_ERROR_CLEAR  C ADDR    02E5H   A
SPCML_PCM_SELECTION_ERROR_CLEAR  C ADDR    037FH   A
STABILIZING . . . . . . . . . . . C ADDR    0524H   A
START_CAL . . . . . . . . . . . . C ADDR    0067H   A
STD_TIMER . . . . . . . . . . . .   NUMB    0002H   A
STOP_DISPLAY_TEST . . . . . . . .   NUMB    0061H   A
SWITCH_CAL_NON_PCM. . . . . . . . C ADDR    09CDH   A
SWITCH_CALIBRATE_OUTPUT . . . .   NUMB    0080H   A
SWITCH_SLAVE_TO_BANK_0. . . . . . C ADDR    0961H   A
SWITCH_SLAVE_TO_BANK_1. . . . . . C ADDR    093CH   A
SYN1_2_DET. . . . . . . . . . . . B ADDR    00E0H.5 A
TCON. . . . . . . . . . . . . . . D ADDR    0088H   A
TEMP_R0 . . . . . . . . . . . . . D ADDR    004DH   A
TEMP_R1 . . . . . . . . . . . . . D ADDR    004EH   A
TERMINATE_SIM_PAM . . . . . . . . C ADDR    02EAH   A
TERMINATE_SIM_PCM . . . . . . . . C ADDR    0384H   A
TEST_DAAD . . . . . . . . . . . . C ADDR    065EH   A
TEST_DPRAM_LEFT . . . . . . . . . C ADDR    057EH   A
TEST_FAILED . . . . . . . . . . .   NUMB    0000H   A
TEST_FLAG . . . . . . . . . . . . B ADDR    00A0H.6 A
TEST_MASTER_RAM_LOOP. . . . . . . C ADDR    05CDH   A
TEST_MASTER_RAM . . . . . . . . . C ADDR    05C7H   A
TEST_MODE . . . . . . . . . . . .   NUMB    0000H   A
TEST_NON_TM_FUNCT . . . . . . . .   NUMB    0001H   A
TEST_PAM_CLK. . . . . . . . . . . C ADDR    05E8H   A
TEST_PASSED . . . . . . . . . . .   NUMB    0001H   A
TEST_PCM_CLK. . . . . . . . . . . C ADDR    0620H   A
TF0 . . . . . . . . . . . . . . . B ADDR    0088H.5 A
TF1 . . . . . . . . . . . . . . . B ADDR    0088H.7 A
TH0 . . . . . . . . . . . . . . . D ADDR    008CH   A
TH1 . . . . . . . . . . . . . . . D ADDR    008DH   A
TIMER0_ISR_MODE . . . . . . . . . D ADDR    0035H   A
TIMER0_ISR. . . . . . . . . . . . C ADDR    0975H   A
TIMER1_ISR_MODE . . . . . . . . . D ADDR    0036H   A
TIMER1_ISR_PTR_OFFSET . . . . . . D ADDR    003BH   A
TIMER1_ISR. . . . . . . . . . . . C ADDR    09E7H   A
TL0 . . . . . . . . . . . . . . . D ADDR    008AH   A
TL1 . . . . . . . . . . . . . . . D ADDR    008BH   A
TM_SEL_0. . . . . . . . . . . . . B ADDR    0090H.3 A
TM_SEL_1. . . . . . . . . . . . . B ADDR    0090H.4 A
TMOD. . . . . . . . . . . . . . . D ADDR    0089H   A
TR0 . . . . . . . . . . . . . . . B ADDR    0088H.4 A
TR1 . . . . . . . . . . . . . . . B ADDR    0088H.6 A
U_RST . . . . . . . . . . . . . . B ADDR    00A0H.5 A
USART_ISR . . . . . . . . . . . . C ADDR    082CH   A
USART_RD_ADDR . . . . . . . . . . D ADDR    0018H   A
USART_RD_CMD_REG. . . . . . . . .   NUMB    00A3H   A
USART_RD_HLD_REG. . . . . . . . .   NUMB    00A0H   A
USART_RD_MODE_REG . . . . . . . .   NUMB    00A2H   A
USART_RD_STAT_REG . . . . . . . .   NUMB    00A1H   A
USART_WR_CMD_REG. . . . . . . . .   NUMB    00A7H   A
USART_WR_HLD_REG. . . . . . . . .   NUMB    00A4H   A
USART_WR_MODE_REG . . . . . . . .   NUMB    00A6H   A
USART_WR_SYNC_REG . . . . . . . .   NUMB    00A5H   A
WAIT_FOR_NRXRDY_TO_CHANGE . . . . C ADDR    0A67H   A
WAIT_TIL_MSTS_EXITS_CAL_MODE. . . C ADDR    04E1H   A
WITHOLD_INVALID_DATA_SEL_ERR. . . C ADDR    0AA5H   A

REGISTER BANK(S) USED: 0

ASSEMBLY COMPLETE, NO ERRORS FOUND
```

Navy Case No. 77,062

Appendix D

```
SUBDESIGN neg_edge
(
  npam_trans : INPUT;
  256khz     : INPUT;
  _aclr      : INPUT;
  clear_out  : OUTPUT
)

VARIABLE

  s : MACHINE OF BITS (q1,clear_out)
      WITH STATES (s0 = b"00",
                   s1 = b"01",
                   s2 = b"10");

BEGIN

  s.clk = 256khz;
  s.reset = !_aclr;

CASE s IS

 WHEN s0 =>
   IF (npam_trans == VCC) THEN
     s = s0;
   ELSE
     s = s1;
   END IF;

 WHEN s1 =>
   IF (npam_trans == VCC) THEN
     s = s0;
   ELSE
     s = s2;
   END IF;

 WHEN s2 =>
   IF (npam_trans == VCC) THEN
     s = s2;
   ELSE
     s = s2;
   END IF;

END CASE:

END;
```

Navy Case No. 77,062

Appendix E

```
SUBDESIGN g3_2
(
  _aclr                 : INPUT;
  tick,qa,qb,qc,qd      : OUTPUT;
  clock                 : INPUT;
)

VARIABLE

  s : MACHINE OF BITS (qd,qc,qb,qa)
      WITH STATES (s0,s1,s2,s3,s4,s5,s6,s7,s8,s9)

BEGIN

  s.clk = clock;
  s.reset = !_aclr;

CASE s IS

 WHEN s0 => S = S1;
 WHEN s1 => S = S2;
 WHEN s2 => S = S3;
 WHEN s3 => S = S4;
 WHEN s4 => S = S5;
 WHEN s5 => S = S6;
 WHEN s6 => S = S7;
 WHEN s7 => S = S8;
 WHEN s8 => S = S9;
 WHEN s9 => S = S5;

END CASE;

  tick = (s == s4) or (s == s9):

END;
```

Navy Case No. 77,062

Appendix F

```
SUBDESIGN usrtwait
(
  32MHz            : INPUT;
  _gnu_usart_ce    : INPUT;
  _aclr            : INPUT;
  _xrdy            : OUTPUT
)

VARIABLE

  s : MACHINE OF BITS (q3,q2,q1,q0,_xrdy)
      WITH STATES (s0 = b"00001",
                   s1 = b"00011",
                   s2 = b"00101");
                   s3 = b"00111",
                   s4 = b"01001",
                   s5 = b"01011");
                   S6 = b"01101",
                   s7 = b"01111",
                   s8 = b"10001");
                   s9 = b"10011",
                  s10 = b"10101",
                  s11 = b"10110");

BEGIN

  s.clk = 32MHz;
  s.reset = !_aclr;

CASE s IS

 WHEN s0 =>
   IF (_gnu_usart_ce == VCC) THEN
     s = s0;
   ELSE
     s = s1;
   END IF;

 WHEN s1 => S = S2;

 WHEN s2 => S = S3;

 WHEN s3 => S = S4;

 WHEN s4 => S = S5;
```

Navy Case No. 77,062

```
 WHEN s5 => S = S6;

 WHEN s6 => S = S7;

 WHEN s7 => S = S8;

 WHEN s8 => S = S9;

 WHEN s9 => S = S10

 WHEN s10 => S = S11

 WHEN s11 =>
   IF (_gnu_usart_ce == GND) THEN
     s = s11;
   ELSE
     s = s0;
   END IF;

END CASE:

END;
```

Navy Case No. 77,062

Appendix G

MTIM PCM DATA PROCESSING (Rev. B)

| PCM WD | DESIG. | TYPE | PROCESS | NOTE |
|---|---|---|---|---|
| 1 | FRMCT | 8-Bit Data (LS) | Output right-justified to Ch. 5C | PCM frame counter (8 LSBs) |
| 2 | FRMCT | 8-Bit Data | Output right-justified to Ch. 5D | PCM frame counter |
| 3 | FRMCT | 8-Bit Data (MS) | NO PROCESS ASSIGNED | PCM frame counter (8 MSBs) |
| 4 | TMID LOW | 8-Bit Data | Output right-justified to Ch. 5E | Telemeter serial no. bits SN7-SN0 |
| 5 | TMID HIGH | 8-Bit Data | Output right-justified to Ch. 5F | *Note #1 |
| 6 | A1 | CTBB | Output (((2'sC PCM WD)+32)/63)*1007+8 to Ch. 7A<br>Combine as "WORD 1" with PCM WD #7 via<br>PCF 1 for output to Ch. 19. | *Note #2 |
| 7 | A2 | CTBB | Output (((2'sC PCM WD)+32)/63)*1007+8 to Ch. 7B<br>Combine as "WORD 2" with PCM WD #6 via<br>PCF 1 for output to Ch. 19. | *Note #2 |
| 8 | A3 | CTBB | Output (((2'sC PCM WD)+32)/63)*1007+8 to Ch. 7F<br>Combine as "WORD 2" with PCM WD #41 via<br>PCF 1 for output to Ch. 47. | *Note #2 |
| 9 | A4 | CTBB | Output (((2'sC PCM WD)+32)/63)*1007+8 to Ch. 76<br>Combine as "WORD 1" with PCM WD #45 via<br>PCF 1 for output to Ch. 10. | *Note #2 |
| 10 | A5 | CTBB | Output (((2'sC PCM WD)+32)/63)*1007+8 to Ch. 0<br>Combine as "WORD 1" with PCM WD #95 via<br>PCF 1 for output to Ch. 1. | *Note #2 |
| 11 | A6 | CTBB | Output (((2'sC PCM WD)+32)/63)*1007+8 to Ch. 79<br>Combine as "WORD 2" with PCM WD #46 via<br>PCF 1 for output to Ch. 13. | *Note #2 |
| 12 | A7 | CTBB | Output (((2'sC PCM WD)+32)/63)*1007+8 to Ch. 75<br>Combine as "WORD 2" with PCM WD #13 via<br>PCF 1 for output to Ch. 3. | *Note #2 |
| 13 | A8 | CTBB | Output (((2'sC PCM WD)+32)/63)*1007+8 to Ch. 74<br>Combine as "WORD 1" with PCM WD #12 via<br>PCF 1 for output to Ch. 3. | *Note #2 |
| 14 | A9 | Digitized Analog | Output (((2'sC PCM WD)+128)/255)*1007+8 to Ch. 53 | |
| 15 | A10 | Digitized Analog | Output (((2'sC PCM WD)+128)/255)*1007+8 to Ch. 16 | |
| 16 | A11 | Digitized Analog | Output (((2'sC PCM WD)+128)/255)*1007+8 to Ch. 51 | |
| 17 | GNU ID | 8-Bit Data | Output right-justified to Ch. 65 | |
| 18 | GNU DATA | 8-Bit Data | Output right-justified to Ch. 66 | *Note #4 |
| 19 | GNU DATA | 8-Bit Data | Output right-justified to Ch. 67 | *Note #4 |
| 20 | A12 | Digitized Analog | Output (((2'sC PCM WD)+128)/255)*1007+8 to Ch. 12 | |
| 21 | A13 | Digitized Analog | Output (((2'sC PCM WD)+128)/255)*1007+8 to Ch. 58 | |
| 22 | A14 | Digitized Analog | Output (((2'sC PCM WD)+128)/255)*1007+8 to Ch. 43 | |
| 23 | A15 | Digitized Analog | Output (((2'sC PCM WD)+128)/255)*1007+8 to Ch. 41 | |
| 24 | A16 | Digitized Analog | Output (((2'sC PCM WD)+128)/255)*1007+8 to Ch. 1A | |
| 25 | A17 | Digitized Analog | Output (((2'sC PCM WD)+128)/255)*1007+8 to Ch. 39 | |
| 26 | A18 (+5V) | Digitized Analog | Output (((2'sC PCM WD)+128)/255)*1007+8 to Ch. A | |
| 27 | A19 (+15V) | Digitized Analog | Output (((2'sC PCM WD)+128)/255)*1007+8 to Ch. B | |

Navy Case No. 77,062

| | | | | |
|---|---|---|---|---|
| 28 | A20 (-15V) | Digitized Analog | Output {{(2'sC PCM WD)+128)/255)*1007+8 to Ch. C | Table IV of TLM ICD says low output = -129! |
| 29 | A21 | Digitized Analog | Output {{(2'sC PCM WD)+128)/255)*1007+8 to Ch. 1C | |
| 30 | A22 | Digitized Analog | Output {{(2'sC PCM WD)+128)/255)*1007+8 to Ch. 1D | |
| 31 | A23 (+28V) | Digitized Analog | Output {{(2'sC PCM WD)+128)/255)*1007+8 to Ch. D | |
| 32 | A24 | Digitized Analog | Output {{(2'sC PCM WD)+128)/255)*1007+8 to Ch. 37 | |
| 33 | A25 | Digitized Analog | Output {{(2'sC PCM WD)+128)/255)*1007+8 to Ch. 5 | |
| 34 | A26 | Digitized Analog | Output {{(2'sC PCM WD)+128)/255)*1007+8 to Ch. 1E | Table III of TLM ICD says high out = 175! |
| 35 | A27 | Digitized Analog | Output {{(2'sC PCM WD)+128)/255)*1007+8 to Ch. 1F | |
| 36 | A28 | Digitized Analog | Output {{(2'sC PCM WD)+128)/255)*1007+8 to Ch. 45 | |
| 37 | A29 | Digitized Analog | Output {{(2'sC PCM WD)+128)/255)*1007+8 to Ch. 17 | |
| 38 | A30 | Digitized Analog | Output {{(2'sC PCM WD)+128)/255)*1007+8 to Ch. 2 | |
| 39 | A31 | Digitized Analog | Output {{(2'sC PCM WD)+128)/255)*1007+8 to Ch. F | |
| 40 | A32 | Digitized Analog | Output {{(2'sC PCM WD)+128)/255)*1007+8 to Ch. 1B | |
| 41 | A33 | CTBB | Output {{(2'sC PCM WD)+32)/63)*1007+8 to Ch. 7E | *Note #2. Ch 18 = error in ICD. |
| | | | Combine as "WORD 1" with PCM WD #8 via PCF 1 for output to Ch. 47. | |
| 42 | GNU ID | 8-Bit Data | Output right-justified to Ch. 68 | |
| 43 | GNU DATA | 8-Bit Data | Output right-justified to Ch. 69 | *Note #4 |
| 44 | GNU DATA | 8-Bit Data | Output right-justified to Ch. 6A | *Note #4 |
| 45 | A34 | CTBB | Output {{(2'sC PCM WD)+32)/63)*1007+8 to Ch. 77 | *Note #2 |
| | | | Combine as "WORD 2" with PCM WD #9 via PCF 1 for output to Ch. 10. | |
| 46 | A35 | CTBB | Output {{(2'sC PCM WD)+32)/63)*1007+8 to Ch. 78 | *Note #2 |
| | | | Combine as "WORD 1" with PCM WD #11 via PCF 1 for output to Ch. 13. | |
| 47 | A36 | Digitized Analog | Output {{(2'sC PCM WD)+128)/255)*1007+8 to Ch. 2A | |
| 48 | A37 | Digitized Analog | Output {{(2'sC PCM WD)+128)/255)*1007+8 to Ch. 20 | |
| 49 | A38 | Digitized Analog | Output {{(2'sC PCM WD)+128)/255)*1007+8 to Ch. 49 | |
| 50 | MGU LOW | 8-Bit Data | Output right-justified to Ch. 5A | |
| | | BIT 15 (LSB) | Output 8 or 1015 to Ch. 56 if bit 0 = 0 or 1 respectively | |
| | | BIT 14 | Output 8 or 1015 to Ch. 54 if bit 1 = 0 or 1 respectively | |
| | | BIT 13 | Output 8 or 1015 to Ch. 52 if bit 2 = 0 or 1 respectively | |
| | | BIT 12 | Output 8 or 1015 to Ch. 50 if bit 3 = 0 or 1 respectively | |
| | | BIT 11 | Output 8 or 1015 to Ch. 48 if bit 4 = 0 or 1 respectively | |
| | | BIT 10 | Output 8 or 1015 to Ch. 46 if bit 5 = 0 or 1 respectively | |
| | | BIT 9 | Output 8 or 1015 to Ch. 44 if bit 6 = 0 or 1 respectively | |
| | | BIT 8 | Output 8 or 1015 to Ch. 42 if bit 7 = 0 or 1 respectively | |
| 51 | MGU HIGH | 8-Bit Data | Output right-justified to Ch. 5B | |
| | | BIT 7 | Output 8 or 1015 to Ch. 40 if bit 0 = 0 or 1 respectively | |
| | | BIT 6 | Output 8 or 1015 to Ch. 38 if bit 1 = 0 or 1 respectively | |
| | | BIT 5 | Output 8 or 1015 to Ch. 36 if bit 2 = 0 or 1 respectively | |
| | | BIT 4 | Output 8 or 1015 to Ch. 34 if bit 3 = 0 or 1 respectively | |
| | | BIT 3 | Output 8 or 1015 to Ch. 32 if bit 4 = 0 or 1 respectively | |
| | | BIT 2 | Output 8 or 1015 to Ch. 30 if bit 5 = 0 or 1 respectively | |
| | | BIT 1 | Output 8 or 1015 to Ch. 28 if bit 6 = 0 or 1 respectively | |
| | | BIT 0 (MSB) | Output 8 or 1015 to Ch. 26 if bit 7 = 0 or 1 respectively | |
| 52 | A39 | Digitized Analog | Output {{(2'sC PCM WD)+128)/255)*1007+8 to Ch. 24 | |
| 53 | A40 | Digitized Analog | Output {{(2'sC PCM WD)+128)/255)*1007+8 to Ch. 22 | |
| 54 | A41 | Digitized Analog | Output {{(2'sC PCM WD)+128)/255)*1007+8 to Ch. 4 | |
| 55 | A42 | Digitized Analog | Output {{(2'sC PCM WD)+128)/255)*1007+8 to Ch. 6 | |
| 56 | A43 | Digitized Analog | Output {{(2'sC PCM WD)+128)/255)*1007+8 to Ch. 8 | |

Navy Case No. 77,062

| | | | | |
|---|---|---|---|---|
| 57 | A44 | Digitized Analog | Output {{(2'sC PCM WD)+128)/255}*1007+8 to Ch. 9 | Table II of TLM ICD says high output = 128! |
| 58 | A45 | CTBB | Output {{(2'sC PCM WD)+128)/255}*1007+8 to Ch. 7C Combine as "WORD 1" with PCM WD #59 via PCF 2 for output to Ch. 27. | *Note #3 |
| 59 | A46 | CTBB | Output {{(2'sC PCM WD)+128)/255}*1007+8 to Ch. 7D Combine as "WORD 2" with PCM WD #58 via PCF 2 for output to Ch. 27. | *Note #3 |
| 60 | A47 | Digitized Analog | Output {{(2'sC PCM WD)+128)/255}*1007+8 to Ch. 11 | Table II of TLM ICD says high output = 128! |
| 61 | A48 | Digitized Analog | Output {{(2'sC PCM WD)+128)/255}*1007+8 to Ch. 28 | |
| 62 | A49 | Digitized Analog | Output {{(2'sC PCM WD)+128)/255}*1007+8 to Ch. 31 | |
| 63 | A50 | Digitized Analog | Output {{(2'sC PCM WD)+128)/255}*1007+8 to Ch. 57 | |
| 64 | A51 | Digitized Analog | Output {{(2'sC PCM WD)+128)/255}*1007+8 to Ch. 33 | |
| 65 | A52 | Digitized Analog | Output {{(2'sC PCM WD)+128)/255}*1007+8 to Ch. 35 | |
| 66 | A53 | Digitized Analog | Output {{(2'sC PCM WD)+128)/255}*1007+8 to Ch. 55 | |
| 67 | GNU ID | 8-Bit Data | Output right-justified to Ch. 6B | |
| 68 | GNU DATA | 8-Bit Data | Output right-justified to Ch. 6C | *Note #4 |
| 69 | GNU DATA | 8-Bit Data | Output right-justified to Ch. 6D | *Note #4 |
| 70 | A54 | Digitized Analog | Output {{(2'sC PCM WD)+128)/255}*1007+8 to Ch. 23 | |
| 71 | A55 | Digitized Analog | Output {{(2'sC PCM WD)+128)/255}*1007+8 to Ch. 21 | |
| 72 | A56 | Digitized Analog | Output {{(2'sC PCM WD)+128)/255}*1007+8 to Ch. 7 | |
| 73 | A57 | Digitized Analog | Output {{(2'sC PCM WD)+128)/255}*1007+8 to Ch. 18 | Ranges from -128 to +117 |
| 74 | A58 | Digitized Analog | Output {{(2'sC PCM WD)+128)/255}*1007+8 to Ch. E | |
| 75 | A59 | Digitized Analog | Output {{(2'sC PCM WD)+128)/255}*1007+8 to Ch. 2C | |
| 76 | A60 | Digitized Analog | Output {{(2'sC PCM WD)+128)/255}*1007+8 to Ch. 2D | |
| 77 | A61 | Digitized Analog | Output {{(2'sC PCM WD)+128)/255}*1007+8 to Ch. 2E | Table III of TLM ICD says high output = 128! |
| 78 | A62 | Digitized Analog | Output {{(2'sC PCM WD)+128)/255}*1007+8 to Ch. 2F | |
| 79 | A63 | Digitized Analog | Output {{(2'sC PCM WD)+128)/255}*1007+8 to Ch. 3A | |
| 80 | A64 | Digitized Analog | Output {{(2'sC PCM WD)+128)/255}*1007+8 to Ch. 3B | |
| 81 | A65 | Digitized Analog | Output {{(2'sC PCM WD)+128)/255}*1007+8 to Ch. 3C | |
| 82 | A66 | Digitized Analog | Output {{(2'sC PCM WD)+128)/255}*1007+8 to Ch. 3D | |
| 83 | A67 | Digitized Analog | Output {{(2'sC PCM WD)+128)/255}*1007+8 to Ch. 3E | |
| 84 | A68 | Digitized Analog | Output {{(2'sC PCM WD)+128)/255}*1007+8 to Ch. 3F | |
| 85 | A69 | Digitized Analog | Output {{(2'sC PCM WD)+128)/255}*1007+8 to Ch. 4A | |
| 86 | A70 | Digitized Analog | Output {{(2'sC PCM WD)+128)/255}*1007+8 to Ch. 4B | Table III of TLM ICD says high output = 128! |
| 87 | A71 | Digitized Analog | Output {{(2'sC PCM WD)+128)/255}*1007+8 to Ch. 25 | |
| 88 | A72 | Digitized Analog | Output {{(2'sC PCM WD)+128)/255}*1007+8 to Ch. 14 | |
| 89 | A73 | Digitized Analog | Output {{(2'sC PCM WD)+128)/255}*1007+8 to Ch. 15 | |
| 90 | A74 | Digitized Analog | Output {{(2'sC PCM WD)+128)/255}*1007+8 to Ch. 29 | |
| 91 | A75 | Digitized Analog | Output {{(2'sC PCM WD)+128)/255}*1007+8 to Ch. 4C | |
| 92 | GNU ID | 8-Bit Data | Output right-justified to Ch. 6E | |
| 93 | GNU DATA | 8-Bit Data | Output right-justified to Ch. 6F | *Note #4 |
| 94 | GNU DATA | 8-Bit Data | Output right-justified to Ch. 70 | *Note #4 |

Navy Case No. 77,062

| | | | | |
|---|---|---|---|---|
| 95 | A76 | CT88 | Output (((2'sC PCM WD)+32)/63)*1007+8 to Ch. 4D<br>Combine as "WORD 2" with PCM WD #10 via<br>PCF 1 for output to Ch. 1. | *Note #2 |
| 96 | A77 | Digitized Analog | Output (((2'sC PCM WD)+128)/255)*1007+8 to Ch. 4E | |
| 97 | A78 | Digitized Analog | Output (((2'sC PCM WD)+128)/255)*1007+8 to Ch. 4F | |
| 98 | SYNC 1 | 8-Bit Data | Output right-justified to Ch. 71 | *Note #5 |
| 99 | SYNC 2 | 8-Bit Data | Output right-justified to Ch. 72 | |
| 100 | SYNC 3 | 8-Bit Data | Output right-justified to Ch. 73 | |

Navy Case No. 77,062

| | | |
|---|---|---|
| SPECIAL NOTE #1: | Bit 3 of this word is "BIT 16" parameter which is set to a logic one at the beginning of each new MGU frame (400 MGU words per MGU frame). In PCM mode, the MTIM must monitor this bit and output a "1" (i.e. count >= 512 ) or "0" (i.e. count <100) on MTIM output channel #59 accordingly. Bit 2 of this word =0 for "SLAM ER" mode and = 1 for "Harpoon/SLAM" mode. Bits 1 and 0 of this word are the most significant two bits of the telemeter serial number (SN9 & SN8). | |
| *SPECIAL NOTE #2: | PCF 1 | WORD 1 WORD 2 OUTPUT COUNT<br>0 0 80 ( = 50h)<br>0 1 320 ( = 140h)<br>1 0 576 ( = 240h)<br>1 1 816 ( = 330h)<br>WORDn = "0" if input PCM word is < 0.<br>WORDn = "1" if input PCM word is > 0. |
| *SPECIAL NOTE #3: | PCF 2 | WORD 1 WORD 2 OUTPUT COUNT<br>0 0 8 ( = 8h)<br>0 1 192 ( = C0h)<br>1 0 320 ( = 140h)<br>1 1 480 ( = 1E0h)<br>WORDn = "0" if input PCM word is < 0.<br>WORDn = "1" if input PCM word is > 0. |
| *SPECIAL NOTE #4: | When processing SLAM ER data (i.e. when bit B2 of PCM WD#5 =0) the MTIM shall incorporate this word into its RS-422 data stream to the SLAM PC. For the time being, do not address this requirement beyond ensuring we can support it with a minimum of modification to current source code. | |
| *SPECIAL NOTE #5: | Once every PCM frame the MTIM must simulate the PAM frame sync pattern by outputting 0% (8), 100% (1015), 100% (1015), 100% (1015), 50% (512) sequentially to MTIM channels 60, 61, 62, 63, and 64 respectively. | |

What is claimed is:

1. A microprocessor controlled digital interface circuit for processing a pulse amplitude modulated telemetry data stream from a missile's telemetry unit, said pulse amplitude modulated telemetry data stream including a pulse amplitude modulated synchronization signal and a plurality of channels of telemetry data, said microprocessor controlled digital interface circuit comprising:

multiplexing means having a data input for receiving said pulse amplitude modulated telemetry data stream, a control signal input, and an output;

first processing means coupled to the control signal input of said multiplexing means, said first processing means supplying first and second control signals to said multiplexing means;

said multiplexing means being enabled by said first and said second control signals allowing said pulse amplitude modulated telemetry data stream to pass through said multiplexing means;

filtering means coupled to the output of said multiplexing means to receive said pulse amplitude modulated telemetry data stream, said filtering means removing a pair of subcarrier channel oscillator frequencies from said pulse amplitude modulated telemetry data stream;

said filtering means including differentiating means for providing an analog derivative signal of said pulse amplitude modulated telemetry data stream;

window comparison means coupled to said differentiating means to receive said analog derivative signal, said window comparison means generating a pulse signal whenever said analog derivative signal exceeds a predetermined voltage window;

clock signal generating means for generating a first clock signal;

pulse amplitude modulated signal processing means coupled to said window comparison means and said clock signal generating means to receive said pulse signal and said first clock signal, said pulse amplitude modulated signal processing means, responsive to said pulse signal and said first clock signal, generating a pulse amplitude modulated clock signal, said pulse amplitude modulated clock signal being synchronized to each of said plurality of channels of telemetry data;

analog to digital conversion means coupled to said filtering means to receive said pulse amplitude modulated telemetry data stream, said analog to digital conversion means converting said pulse amplitude modulated telemetry data stream from an analog form to a digital form;

second processing means coupled to said first processing means, said analog to digital conversion means and said pulse amplitude modulated signal processing means to receive said pulse amplitude modulated telemetry data stream in said digital form and said pulse amplitude modulated clock signal;

said second processing means being adapted to detect said pulse amplitude modulated synchronization signal, said second processing means upon detecting said pulse amplitude modulated synchronization signal sending a first message to said first processing means, said first message indicating to said first processing means that said second processing means detected said pulse amplitude modulated synchronization signal;

said first processing means, upon receiving said first message from said second processing means, sending a second message to said second processing means, said second message commanding said second processing means to initiate processing of said plurality of channels of telemetry data within said pulse amplitude modulated telemetry data stream;

said second processing means, responsive to said second message and said pulse amplitude modulated clock signal processing and scaling each of said plurality of channels of telemetry data;

said second processing means generating an equivalent digital word for each of said plurality of channels of telemetry data processed and scaled by said second processing means.

2. The microprocessor controlled digital interface circuit of claim 1 wherein said filtering means comprises a six pole low pass bessel filter, said six pole low pass bessel filter having a center frequency of about 38 kHz and an attenuation of −40 dB at a frequency of about 140 kHz.

3. The microprocessor controlled digital interface circuit of claim 1 further comprising a memory coupled to said second processing means, said memory containing a computer software program, said computer software program controlling the handling and processing of each of said plurality of channels of telemetry data by said second processing means.

4. The microprocessor controlled digital interface circuit of claim 3 wherein said memory comprises four programmable read only memories coupled to said second processing means.

5. The microprocessor controlled digital interface circuit of claim 1 further comprising first and second eight bit latches coupled to said second processing means for receiving and latching therein each equivalent digital word generated by said second processing means.

6. The microprocessor controlled digital interface circuit of claim 1 further comprising a third eight bit latch coupled to said second processing means for receiving from said second processing means a digital word channel identification for each of said equivalent digital words generated by said second processing means, said third eight bit latch latching therein said digital word channel identification for each of said equivalent digital words.

7. The microprocessor controlled digital interface circuit of claim 1 wherein said pulse amplitude modulated signal processing means comprises:

a synchronous 4-bit decade counter having first, second, third and fourth data inputs connected to ground, a clock input for receiving said first clock signal, a clear input, a load input and a QC output;

a first inverter having an input connected to the QC output of said synchronous 4-bit decade counter and an output connected the load input of said synchronous 4-bit decade counter;

a first Flip-Flop having a clock input connected to the output of said first inverter, a clear input, a data input and a Q output;

a second inverter having an input connected to the Q output of said first Flip-Flop and an output connected to the data input of said first Flip-Flop;

a third inverter having an input connected to the Q output of said first Flip-Flop and an output;

a second Flip-Flop having a clock input connected to the output of said third inverter, a data input connected to ground, a Q output for providing said pulse amplitude modulated clock signal and a preset input;

a NOR gate having a first input for receiving a pulse amplitude modulated clock interrupt clear signal, a second input for receiving an external reset signal, and an output connected to the preset input of said second Flip-Flop; and a negative edge detect circuit having a clear output for receiving an external inverted reset signal, a clock signal input for receiving said first clock signal, a transition signal input for receiving said pulse signal and a clear output connected to the clear input of said synchronous 4-bit decade counter and the clear input of said first Flip-Flop.

8. A microprocessor controlled digital interface circuit for processing a pulse amplitude modulated telemetry data stream from a missile's telemetry unit, said pulse amplitude modulated telemetry data stream including a pulse amplitude modulated synchronization signal and a plurality of channels of telemetry data, said microprocessor controlled digital interface circuit comprising:

an analog multiplexer having a data input for receiving said pulse amplitude modulated telemetry data stream, a control signal input, and an output;

a master microprocessor coupled to the control signal input of said analog multiplexer, said master microprocessor supplying first and second control signals to said analog multiplexer;

said analog multiplexer being enabled by said first and said second control signals allowing said pulse amplitude modulated telemetry data stream to pass through said analog multiplexer;

a six pole low pass bessel filter coupled to the output of said analog multiplexer to receive said pulse amplitude modulated telemetry data stream, said six pole low pass bessel filter removing a pair of subcarrier channel oscillator frequencies from said pulse amplitude modulated telemetry data stream;

an analog to digital converter coupled to said six pole low pass bessel filter to receive said pulse amplitude modulated telemetry data stream, said analog to digital converter converting said pulse amplitude modulated telemetry data stream from an analog form to a digital form; and a slave microprocessor coupled to said master microprocessor and said analog to digital computer to receive said pulse amplitude modulated telemetry data stream in said digital form, said slave microprocessor being adapted to detect said pulse amplitude modulated synchronization signal, said slave microprocessor upon detecting said pulse amplitude modulated synchronization signal sending a first message to said master microprocessor, said first message indicating to said master microprocessor that said slave microprocessor detected said pulse amplitude modulated synchronization signal;

said master microprocessor, upon receiving said first message from said slave microprocessor, sending a second message to said slave microprocessor, said second message commanding said slave microprocessor to initiate processing of said plurality of channels of telemetry data within said pulse amplitude modulated telemetry data stream;

said slave microprocessor processing each of said plurality of channels of telemetry data using the following equation:

$$\text{Scaled value} = \left( \frac{R_{0\%} - R_{CH}}{R_{0\%} - R_{100\%}} \right) \times 1007 + 8$$

where $R_{0\%}$ is a first voltage reading representing a first digital input voltage for a first channel of said pulse amplitude modulated synchronization signal, $R_{CH}$ is a Pulse Amplitude Modulated data sample voltage reading representing said channel of telemetry data being processed by said slave microprocessor and $R_{100\%}$ is a second voltage reading representing a second digital input voltage for a second channel of said pulse amplitude modulated synchronization signal;

said slave microprocessor generating an equivalent digital word for each of said plurality of channels of telemetry data processed by said slave microprocessor.

9. The microprocessor controlled digital interface circuit of claim 8 further comprising a memory coupled to said slave microprocessor, said memory containing a computer software program, said computer software program controlling the handling and processing of each of said plurality of channels of telemetry data by said slave microprocessor.

10. The microprocessor controlled digital interface circuit of claim 9 wherein said memory comprises four programmable read only memories coupled to said slave microprocessor.

11. The microprocessor controlled digital interface circuit of claim 8 further comprising first and second eight bit latches coupled to said slave microprocessor for receiving and latching therein each equivalent digital word generated by said slave microprocessor.

12. The microprocessor controlled digital interface circuit of claim 8 further comprising a third eight bit latch coupled to said slave microprocessor for receiving from said slave microprocessor a digital word channel identification for each of said equivalent digital words generated by said slave microprocessor, said third eight bit latch latching therein said digital word channel identification for each of said equivalent digital words.

13. A microprocessor controlled digital interface circuit for processing a pulse amplitude modulated telemetry data stream from a missile's telemetry unit, said pulse amplitude modulated telemetry data stream including a pulse amplitude modulated synchronization signal and a plurality of channels of telemetry data, said microprocessor controlled digital interface circuit comprising:

an analog multiplexer having a data input for receiving said pulse amplitude modulated telemetry data stream, a control signal input, and an output;

a master microprocessor coupled to the control signal input of said analog multiplexer, said master microprocessor supplying first and second control signals to said analog multiplexer;

said analog multiplexer being enabled by said first and said second control signals allowing said pulse amplitude modulated telemetry data stream to pass through said analog multiplexer;

a six pole low pass bessel filter coupled to the output of said analog multiplexer to receive said pulse amplitude modulated telemetry data stream, said six pole low pass bessel filter removing a pair of subcarrier channel oscillator frequencies from said pulse amplitude modulated telemetry data stream;

said six pole low pass bessel filter including a differentiating circuit for providing an analog derivative signal of said pulse amplitude modulated telemetry data stream;

a window comparator circuit coupled to said differentiating circuit to receive said analog derivative signal, said window comparator circuit generating a pulse signal whenever said analog derivative signal exceeds a predetermined voltage window;

a clock signal generator for generating a first clock signal;

a pulse amplitude modulated signal processing circuit coupled to said window comparator circuit and said clock signal generator to receive said pulse signal and said first clock signal, said pulse amplitude modulated signal processing circuit, responsive to said pulse signal and said first clock signal, generating a pulse amplitude modulated clock signal, said pulse amplitude modulated clock signal being synchronized to each of said plurality of channels of telemetry data;

an analog to digital converter coupled to said six pole low pass bessel filter to receive said pulse amplitude modulated telemetry data stream, said analog to digital converter converting said pulse amplitude modulated telemetry data stream from an analog form to a digital form;

a slave microprocessor coupled to said master microprocessor, said analog to digital computer and said pulse amplitude modulated signal processing circuit to receive said pulse amplitude modulated telemetry data stream in said digital form and said pulse amplitude modulated clock signal;

said slave microprocessor being adapted to detect said pulse amplitude modulated synchronization signal, said slave microprocessor upon detecting said pulse amplitude modulated synchronization signal sending a first message to said master microprocessor, said first message indicating to said master microprocessor that said slave microprocessor detected said pulse amplitude modulated synchronization signal;

said master microprocessor, upon receiving said first message from said slave microprocessor, sending a second message to said slave microprocessor, said second message commanding said slave microprocessor to initiate processing of said plurality of channels of telemetry data within said pulse amplitude modulated telemetry data stream;

said slave microprocessor, responsive to said second message and said pulse amplitude modulated clock signal, handling and processing each of said plurality of channels of telemetry data using the following equation:

$$\text{Scaled value} = \left( \frac{R_{0\%} - R_{CH}}{R_{0\%} - R_{100\%}} \right) \times 1007 + 8$$

where $R_{0\%}$ is about +1.5 volts, $R_{CH}$ is a Pulse Amplitude Modulated data sample voltage representing said channel of telemetry data being processed by said slave microprocessor and $R_{100\%}$ is about −1.5 volts;

said slave microprocessor generating an equivalent digital word for each of said plurality of channels of telemetry data processed by said slave microprocessor; and a memory coupled to said slave microprocessor, said memory containing a computer software program, said computer software program controlling the handling and processing of each of said plurality of channels of telemetry data by said slave microprocessor.

14. The microprocessor controlled digital interface circuit of claim 13 wherein said memory comprises four programmable read only memories coupled to said slave microprocessor.

15. The microprocessor controlled digital interface circuit of claim 13 further comprising first and second eight bit latches coupled to said slave microprocessor for receiving and latching therein each equivalent digital word generated by said slave microprocessor.

16. The microprocessor controlled digital interface circuit of claim 15 further comprising an analog track-hold amplifier having a track-hold input connected to said second eight bit latch to receive a track-hold signal, said analog track-hold amplifier being connected to said six pole low pass bessel filter to receive said pulse amplitude modulated telemetry data stream from said six pole low pass bessel filter, said track-hold amplifier, responsive to said track-hold signal storing a sample of said pulse amplitude modulated telemetry data stream.

17. The microprocessor controlled digital interface circuit of claim 13 further comprising a second pair of eight bit latches coupled to said slave microprocessor for receiving from said slave microprocessor a digital word channel identification for each of said equivalent digital words generated by said slave microprocessor, said second pair of eight bit latches latching therein said digital word channel identification for each of said equivalent digital words.

18. The microprocessor controlled digital interface circuit of claim 13 wherein said pulse amplitude modulated signal processing circuit comprises:

a synchronous 4-bit decade counter having first, second, third and fourth data inputs connected to ground, a clock input for receiving said first clock signal, a clear input, a load input and a QC output;

a first inverter having an input connected to the QC output of said synchronous 4-bit decade counter and an output connected the load input of said synchronous 4-bit decade counter;

a first Flip-Flop having a clock input connected to the output of said first inverter, a clear input, a data input and a Q output;

a second inverter having an input connected to the Q output of said first Flip-Flop and an output connected to the data input of said first Flip-Flop;

a third inverter having an input connected to the Q output of said first Flip-Flop and an output;

a second Flip-Flop having a clock input connected to the output of said third inverter, a data input connected to ground, a Q output for providing said pulse amplitude modulated clock signal and a preset input;

a NOR gate having a first input for receiving a pulse amplitude modulated clock interrupt clear signal, a second input for receiving an external reset signal, and an output connected to the preset input of said second Flip-Flop; and a negative edge detect circuit having a clear output for receiving an external inverted reset signal, a clock signal input for receiving said first clock signal, a transition signal input for receiving said pulse signal and a clear output connected to the clear input of said synchronous 4-bit decade counter and the clear input of said first Flip-Flop.

19. The microprocessor controlled digital interface circuit of claim 13 further comprising a digital to analog converter coupled to said master microprocessor and a second input of said analog multiplexer to receive a simulated pulse amplitude modulated telemetry data stream from said master microprocessor, said digital to analog converter converting simulated pulse amplitude modulated telemetry data stream from a digital form to an analog form and then supplying said simulated pulse amplitude modulated telemetry data stream to the second input of said analog multiplexer.

20. The microprocessor controlled digital interface circuit of claim 13 further comprising a D-type Flip-Flop having a preset input connected to said slave microprocessor to a slave watch dog interrupt signal, a clear input connected to said master microprocessor to receive a master watch dog interrupt signal and an output; and a master watch dog timer having an input connected to the output of said D-type Flip-Flop and an output for providing a system reset signal.

* * * * *